US010675499B2

(12) United States Patent
Vorozilchak et al.

(10) Patent No.: US 10,675,499 B2
(45) Date of Patent: Jun. 9, 2020

(54) EXERCISE SYSTEMS

(71) Applicant: Maxx Bench, Wilkes Barre, PA (US)

(72) Inventors: David Vorozilchak, Shavertown, PA (US); James J. Lennox, Shickshinny, PA (US); Kenneth Brown, Hamburg, NY (US); Philip Matthew Hunt, Kintnersville, PA (US)

(73) Assignee: MAXX BENCH, Wilkes Barre, PA (US)

( * ) Notice: Subject to any disclaimer, the term of this patent is extended or adjusted under 35 U.S.C. 154(b) by 138 days.

(21) Appl. No.: 15/892,983

(22) Filed: Feb. 9, 2018

(65) Prior Publication Data

US 2018/0296874 A1 Oct. 18, 2018

Related U.S. Application Data

(63) Continuation-in-part of application No. 15/666,919, filed on Aug. 2, 2017, now Pat. No. 10,004,933, and
(Continued)

(51) Int. Cl.
*A63B 21/078* (2006.01)
*A63B 21/072* (2006.01)
(Continued)

(52) U.S. Cl.
CPC ..... *A63B 21/0783* (2015.10); *A63B 21/078* (2013.01); *A63B 21/0724* (2013.01);
(Continued)

(58) Field of Classification Search
CPC ..... A63B 21/0083; A63B 21/0087; A63B 21/0724; A63B 21/078; A63B 21/0783;
(Continued)

(56) References Cited

U.S. PATENT DOCUMENTS 3,874,657 A 4/1975 Niebojewski
3,905,496 A 9/1975 Reeder
(Continued)

FOREIGN PATENT DOCUMENTS

EP 0214328 3/1987

OTHER PUBLICATIONS

Corresponding International Search Report and Written Opinion for PCT/US2016/046806 dated Oct. 24, 2016. WO.
(Continued)

*Primary Examiner* — Joshua Lee
(74) *Attorney, Agent, or Firm* — The Belles Group, P.C.

(57) ABSTRACT

An adjustable weight lifting bench includes a frame, a seat pad, and a back pad. The back pad is pivotably coupled to the frame about a first pivot axis and angularly adjustable between a plurality of user-selectable incline and decline positions. A hydraulic mechanism supports the back pad in the incline and decline positions. A movable operating lever operably coupled to the hydraulic mechanism operates to change the mechanism between an activated condition in which the back pad is movable and a deactivated condition in which the back pad locks into a selected one of the positions. When the mechanism is in activated condition, applying pressure against the back pad the lowers the back pad and removing the pressure raises the back pad. In one embodiment, the mechanism automatically raises the back pad when the pressure is removed and the mechanism is in the deactivated condition.

14 Claims, 125 Drawing Sheets

Related U.S. Application Data a continuation-in-part of application No. PCT/US2016/046806, filed on Aug. 12, 2016, which is a continuation of application No. 15/200,517, filed on Jul. 1, 2016, now Pat. No. 10,071,276, and a continuation-in-part of application No. 15/200,517, filed on Jul. 1, 2016, now Pat. No. 10,071,276.

(60) Provisional application No. 62/369,793, filed on Aug. 2, 2016, provisional application No. 62/254,755, filed on Nov. 13, 2015, provisional application No. 62/240,623, filed on Oct. 13, 2015, provisional application No. 62/203,961, filed on Aug. 12, 2015, provisional application No. 62/195,106, filed on Jul. 12, 2015, provisional application No. 62/187,364, filed on Jul. 1, 2015.

(51) Int. Cl.
*A63B 24/00* (2006.01)
*A63B 21/00* (2006.01)
*A63B 21/008* (2006.01)
*A63B 71/00* (2006.01)

(52) U.S. Cl.
CPC ..... *A63B 21/4029* (2015.10); *A63B 24/0087* (2013.01); *A63B 21/0083* (2013.01); *A63B 21/0087* (2013.01); *A63B 2071/0081* (2013.01); *A63B 2210/50* (2013.01); *A63B 2210/56* (2013.01); *A63B 2220/30* (2013.01); *A63B 2220/34* (2013.01); *A63B 2220/56* (2013.01); *A63B 2225/09* (2013.01); *A63B 2225/093* (2013.01); *F15B 2211/212* (2013.01)

(58) Field of Classification Search
CPC ..... A63B 21/4029; A63B 24/0087; A63B 2071/0081; A63B 2210/50; A63B 2210/56; A63B 2220/30; A63B 2220/34; A63B 2220/56; F15B 2211/212
See application file for complete search history.

(56) References Cited

U.S. PATENT DOCUMENTS 4,355,633 A * 10/1982 Heilbrun ..... A61H 1/0214 482/903
4,848,737 A * 7/1989 Ehrenfield ..... A63B 21/157 482/52
4,902,002 A * 2/1990 Huang ..... A63B 22/0012 482/62
4,995,130 A 2/1991 Hahn et al.
5,125,884 A 6/1992 Weber et al.
5,141,480 A 8/1992 Lennox et al.
5,145,472 A * 9/1992 Johnson, III ..... A63B 23/12 482/119
5,281,193 A 1/1994 Colbo, Jr.
6,605,023 B1 8/2003 Mobley
6,689,027 B1 2/2004 Gardikis, Jr.
6,746,379 B1 6/2004 Brawner
6,926,648 B2 8/2005 Capizzo
7,331,912 B2 2/2008 Keiser et al.
8,066,622 B2 11/2011 Kim
8,834,329 B2 9/2014 Kelly
9,126,069 B2 * 9/2015 Ochi ..... A63B 4/00
2002/0091041 A1 * 7/2002 Mantooth ..... A63B 17/00 482/35
2003/0114277 A1 6/2003 Capizzo
2005/0032614 A1 2/2005 Keiser et al.
2005/0096197 A1 5/2005 Webber et al.
2008/0004165 A1 1/2008 Brawner
2009/0143203 A1 6/2009 Knapp
2009/0156377 A1 * 6/2009 Brown ..... A63B 23/12 482/110
2009/0203505 A1 8/2009 Kroll et al.
2011/0082016 A1 4/2011 Kim
2011/0172066 A1 7/2011 Roppolo
2013/0296143 A1 * 11/2013 Staten ..... A63B 21/0618 482/98
2014/0187391 A1 7/2014 Kelly
2014/0213414 A1 * 7/2014 Balandis ..... A63B 24/0087 482/5
2015/0182773 A1 7/2015 Olson et al.
2018/0021614 A1 * 1/2018 Taft ..... A63B 24/0087 482/5

OTHER PUBLICATIONS

Corresponding International Search Report and Written Opinion for PCT/US2017/045023 dated Oct. 23, 2017. WO.
http://www.platinumrig.ca/en/shop/course-a-abstacles-en/infinit-monkey-bar/?lang=en?la., Infinite Monkey Bars, searched for on Nov. 13, 2017. CA.

* cited by examiner

EXERCISE SYSTEMS

CROSS-REFERENCE TO RELATED APPLICATIONS

The present application is a continuation-in-part of PCT International Application No. PCT/US2016/046806 filed Aug. 12, 2016, which claims priority to U.S. patent application Ser. No. 15/200,517 filed Jul. 1, 2016, U.S. Provisional Application No. 62/254,755 filed Nov. 13, 2015, U.S. Provisional Application No. 62/240,623 filed Oct. 13, 2015, and U.S. Provisional Application No. 62/203,961 filed Aug. 12, 2015.

The present application is also a continuation-in-part of U.S. patent application Ser. No. 15/200,517 filed Jul. 1, 2016, which claims priority to U.S. Provisional Application No. 62/187,364 filed Jul. 1, 2015, and U.S. Provisional Application No. 62/195,106 filed Jul. 21, 2015, and U.S. Provisional Application No. 62/254,755 filed Nov. 13, 2015.

The present application is also a continuation-in-part of U.S. patent application Ser. No. 15/666,919 filed Aug. 2, 2017, which claims priority to U.S. Provisional Application No. 62/369,793 filed Aug. 2, 2016.

The entireties of all of the foregoing listed applications are incorporated herein by reference.

BACKGROUND

The present disclosure relates to exercise equipment, and more particularly to improvements for a self-spotting and hands free adjustable weight bench that allows weight lifters to adjust their positioning while remaining on the weight training equipment, and also remove themselves from heavy weights and a high risk of injury if fatigue prevents continuation of the exercise.

Weight training is performed to develop the strength and size of skeletal muscles. Weight lifters use the gravity force of weight, in the form of barbells and dumbbells, to oppose the force generated by muscle through concentric or eccentric contraction. Weight training uses a variety of specialized equipment for users to target specific muscle groups with different types of movement. While weight lifting, it is common to push oneself to a limit of fatigue that prevents returning the barbell to the rack. At this point in a workout, the weight lifter is at a serious risk for injury. However, even though weight lifters take this into account, it is common for weightlifters to workout alone and without a "spotter" or assistance of a work out companion.

In addition to safety concerns with traditional equipment, adjustability is cumbersome and problematic. It is beneficial for weight training equipment to offer adjustability to accommodate different size users and training with different heights, angles, and strengths. When muscles are forced to contract at different angles, additional muscle fibers are incorporated into the workout, which increases the potential for muscular growth. For a large muscle group, such as the chest, the muscles must be trained from different angles to involve fibers from all parts of the muscle. This type of training builds stronger, fuller muscles. With traditional equipment, weightlifters must put the weight down, get off the equipment, adjust the equipment manually, get back on the equipment, pick the weight back up, and start the exercise again from a different position. The time wasted adjusting the equipment is not only cumbersome, but makes the workout inefficient.

It is further desirable to provide a safe device which is mechanically simple, easy to operate, non-compromising to traditional weight training exercises, and extremely functional for weight training.

A safe and convenient adjustable weight lifting bench is desirable.

The present disclosure also relates to improvements for a self-spotting and adjustable weight bench that allows weight lifters to adjust their positioning while remaining on the weight training equipment, and also remove themselves from heavy weights and a high risk of injury if fatigue prevents continuation of the exercise. Weight training is performed to develop the strength and size of skeletal muscles. Weight lifters use the gravity force of weight, in the form of barbells and dumbbells, to oppose the force generated by muscle through concentric or eccentric contraction. Weight training uses a variety of specialized equipment for users to target specific muscle groups with different types of movement.

While weight lifting, it is common to push oneself to a limit of fatigue that prevents returning the barbell to the rack. At this point in a workout, the weight lifter is at a serious risk for injury or even death. However, even though weight lifters take this into account, it is common for weightlifters to workout alone and without a "spotter" or assistance of a work out companion.

In addition to safety concerns with traditional equipment, adjustability is cumbersome and problematic. It is beneficial for weight training equipment to offer adjustability to accommodate different size users and training with different heights, angles, and strengths. When muscles are forced to contract at different angles, additional muscle fibers are incorporated into the workout, which increases the potential for muscular growth. For a large muscle group, such as the chest, the muscles must be trained from different angles to involve fibers from all parts of the muscle. This type of training builds stronger, fuller muscles. With traditional equipment, weightlifters must put the weight down, get off the equipment, adjust the equipment manually, get back on the equipment, pick the weight back up, and start the exercise again from a different position. The time wasted adjusting the equipment makes the workout inefficient.

It is further desirable to provide a safe device which is mechanically simple, easy to operate, non-compromising to traditional weight training exercises, and extremely functional for weight training.

A safe and convenient weight lifting bench is desirable.

The present disclosure also relates to a rotary exercise system with adjustable rotational resistance to improve training for climbing, pull-ups, CrossFit, general upper body strength, and other forms of fitness.

Traditional means of climbing exercise equipment consume large amounts of space and are potentially dangerous. Elevated monkey bars often seen in CrossFit games, attached to rigs and racks, and included in current multi-functional fitness setups designed for multiple users are designed to elevate users sometimes as high as 12 ft. in the air. Fatigue and muscle failure while climbing these pieces of equipment could prove to be extremely dangerous. Other prior approaches of overhead exercise equipment to simulate continuous climbing or pull-ups include complex designs with many parts, often requiring electricity and motors. Several of the designs utilize a conveyor belt like system with handle bars. Still others may have free spinning handles or bars providing minimal strength training. The foregoing devices further lack versatility for working different muscle groups and performing different exercise routines.

A need exists for an improved and versatile rotary exercise system.

SUMMARY

An adjustable weight lifting bench according to the present disclosure is provided which incorporates various features for safe and convenient operation in addition to a flexible user-changeable configuration adapted for performing a variety of weight-lifting or exercise routines. The bench is configured and operable to allow "hands free" adjustment of the bench position for performing different types of exercises and/or working different parts of muscles without the user getting of the bench. In one embodiment, the back pad of the bench is adjustable between an uppermost incline position, a lowermost decline position, and a continuum of intermediate positions therebetween. In combination with one embodiment of a power rack described herein, the adjustable utility bench and power rack combination may be used for self-spotting scenarios.

The adjustable utility bench in one implementation allows weight lifters to adjust the angle of the back pad while remaining seated on the weight training equipment while exercising, and to lower themselves out from under heavy weight when fatigue failure is reached by the user during exercise. In one embodiment, the angle of the back pad could be adjusted from at or near 90 degrees to the bench frame to negative angles up to −90 degrees measured relative to the pivot axis of the back pad. With the wide variety of adjustability, weight lifters have the ability to perform a full range of exercises from sitting in the straight up position, to sitting at inclined positions, to lying flat, to lying in the decline position. Because the back pad and seat pad in some embodiments are adjustable with respect to the bench frame and its supports which remain, the design is advantageously mechanically simplified resulting in manufacturing savings and improved reliability.

In conjunction with a weight lifting power rack such as the one disclosed herein, the "hands free" adjustable angle utility bench allows weight lifters to remove themselves from heavy weights and a high risk of injury if fatigue prevents continuation of the exercise. By increasing the angle of the bench towards the ground towards a lowermost decline escape position, the user can lower the bench to a point at which the barbell hits the safety rack on the rack and the weight is removed safely from the user's hands and torso.

The adjustable utility bench design provides a new method for performing a variety of exercises back to back, or as a "superset." With the user's ability to change the angle of the back rest or pad, a range of exercises could be performed to work different muscle groups back to back as supersets without the user ever getting off the equipment. Through this embodiment, the user can change the back angle with an operating lever such as a foot pedal, never having to get off the bench to change angle with mechanical pins.

In one implementation, the foot pedal may be double sided or ambidextrous operable with either foot of the user. The double sided foot pedal serves an additional function. When the bench back pad is in the flat or decline position, it could be difficult to get up from the position. The double sided foot pedal could alternately be used by the user to sit-up by locking the feet beneath each side of the foot pedal. As a user positions his/her feet on the underside of the foot pedal, the user can then press his/her legs against the foot pedal to provide force in the opposite direction while sitting up. Alternatively, it is further desirable to perform sit-ups from a flat or decline position for maximum exercise effectiveness in working the stomach muscles. When the angle of the back pad is adjusted to the flat or decline position, users can lock their feet under the foot pedal and perform sit-ups on the adjustable bench.

According to one aspect, an adjustable weight lifting bench includes: a bench frame configured for resting on a surface, the frame defining a horizontal longitudinal axis parallel to the surface and a vertical axis; a seat pad coupled to the frame; a back pad pivotably coupled to the frame about a first pivot axis defined at an orthogonal intersection between the longitudinal axis and the vertical axis, the back pad angularly adjustable relative to the frame between a plurality of user-selectable incline and decline positions; a hydraulic cylinder mechanism operably coupled between the frame and back pad that supports the back pad in the incline and decline positions, the hydraulic cylinder mechanism changeable between an activated condition in which the back pad is movable between the incline and decline positions, and a deactivated condition in which the back pad is locked into a selected one of the incline and decline positions; and an operating lever operably coupled to the hydraulic cylinder mechanism, the operating lever movable to change position of the hydraulic cylinder mechanism between the activated and deactivated conditions.

According to another aspect, a hands free adjustable weight lifting bench includes: a bench frame comprising a longitudinal axis, a bottom configured for resting on a surface, and a top spaced above the bottom; a seat pad coupled to the frame; a back pad pivotably coupled to the frame about a first pivot axis, the back pad angularly movable between an uppermost position, a lowermost position, and a continuum of intermediate positions therebetween; a hydraulic cylinder assembly operable to support and move the back pad; the hydraulic cylinder assembly including a hydraulic cylinder comprising an extendable-retractable cylinder rod pivotably coupled to the back pad and containing a hydraulic fluid, an accumulator pivotably coupled to the frame and containing a compressible liquid, and a flow control valve fluidly connected between the hydraulic cylinder and the accumulator for exchange of hydraulic fluid therebetween; the valve having an open position allowing exchange of hydraulic fluid between the hydraulic cylinder and accumulator and concomitant retraction or extension of the cylinder rod, and a closed position blocking the exchange of hydraulic fluid and retraction or extension of the cylinder rod; a foot-operated lever operably coupled to the valve and movable to change the valve between the open and closed positions; wherein depressing the lever opens the valve and allows movement of the back pad to a selected one of the back pad positions by retracting or extending the cylinder rod, and releasing the lever closes the valve and prevents movement of the back pad.

A method for operating any of the foregoing adjustable weight lifting benches is provided. The method includes: providing the weight lifting bench; a user sitting on the seat pad; depressing the foot-operated lever a first time; applying pressure against the back pad; the back pad moving downward from the uppermost position to a first intermediate position; releasing the foot-operated lever which locks the back pad into the first intermediate position; depressing the foot-operator lever a second time; applying pressure against the back pad; the back pad moving downward from the uppermost position to a second intermediate position lower than the first intermediate position; releasing the foot-operated lever which locks the back pad into the second intermediate position; and depressing the foot-operated lever a third time; removing pressure from the back pad; the back pad automatically moving upward from the second intermediate position to the uppermost position.

According to another aspect, an adjustable weightlifting system includes: any of the foregoing adjustable weight lifting benches and a power rack. The power rack comprises: a base frame configured for resting on a surface; a first pair of upright stanchions extending upwards from a first lateral side of the base frame and longitudinally spaced apart; a second pair of upright stanchions extending upwards from a second lateral side of the base frame and longitudinally spaced apart, the first and second lateral sides being laterally spaced apart; and an elongated safety rack mounted between each of the first and second pairs of stanchions. The bench is positioned between the first and second pairs of stanchions, wherein each safety rack is positioned at a critical height above the back pad when the back pad is in a lowermost decline position, the safety racks when the back pad is in the lowermost decline escape position operable to remove a barbell from the user's torso for allowing the user to escape from the bench.

A weight lifting bench according to the present disclosure is also provided which incorporates various features for safe and convenient operation in addition to a flexible user-changeable configuration adapted for performing a variety of weight-lifting or exercise routines.

According to one aspect, a hydraulic cylinder assembly includes: a hydraulic cylinder containing a hydraulic fluid; an accumulator in fluid communication with the hydraulic cylinder, the accumulator containing a pressurized compressible fluid; and a flow control valve assembly interposed in a flow path between the hydraulic cylinder and the accumulator, the flow control valve configured and operable to control flow of the hydraulic fluid exchanged between the hydraulic cylinder and accumulator; the flow control valve including an axially reciprocating piston defining a flow control orifice and an axially movable plunger having an operating end and an opposing working end, the working end being received in the flow control orifice and positionable between a first axial position and a second axial position relative to the flow control orifice. The working end of the plunger defines a first flow area when the plunger is in the first axial position and a second flow area smaller than the first flow area when the plunger is in the second axial position.

According to another aspect, a hydraulic cylinder assembly includes: a hydraulic cylinder containing a hydraulic fluid; an accumulator in fluid communication with the hydraulic cylinder, the accumulator containing a pressurized compressible fluid; a block manifold disposed between the hydraulic cylinder and accumulator, the block manifold comprising an axial central bore defining a centerline, a hydraulic cylinder port fluidly coupling the central bore to the hydraulic cylinder, and an accumulator port fluidly coupling the central bore to the accumulator, the bore and ports collectively forming a hydraulic fluid flow path between the hydraulic cylinder and the accumulator; a check valve disposed in the central bore and comprising an annular valve seat and a check ball biased into removable engagement with the valve seat by a check spring; a reciprocating piston disposed in the central bore and axially movable between a first proximal position nearest the check valve and a second distal position farthest from the check valve, the piston including a flow control orifice and internal flow control cavity in fluid communication with the flow control orifice; a plunger disposed in the central bore and axially movable between first and second axial positions, the plunger having an operating end and an opposing working end inserted through the flow control orifice and engageable with the check ball. Moving the plunger from a first axial position to a second axial position causes the working end of the plunger to disengage the check ball from the valve seat to open the flow path from the hydraulic cylinder to the accumulator.

A method for operating a hydraulic cylinder assembly is provided. The method includes: providing a hydraulic cylinder assembly including a hydraulic cylinder containing a hydraulic fluid, an accumulator in fluid communication with the hydraulic cylinder and containing a compressible fluid, and a flow control valve assembly interposed in a hydraulic fluid flow path between the hydraulic cylinder and the accumulator, the flow control valve assembly including a reciprocating piston, a plunger, and a check valve collectively forming an open flow path between the hydraulic cylinder and accumulator; engaging a spring-biased check ball with an annular valve seat of the check valve to form a closed flow path; moving the plunger from a first axial position to a second axial position; displacing and disengaging the check ball from the valve seat with the plunger; and opening the flow path via unseating the check ball wherein hydraulic fluid flows from the hydraulic cylinder to the accumulator.

A rotary exercise system with user-adjustable rotational resistance is also described in this application that allows for the same foregoing climbing exercises and motions to be performed in a small space and at a controlled height. The exercise system generally comprises a bi-directionally rotating handle bar assembly rotatably coupled to a support chassis. A resistance mechanism applies a user selectable and adjustable rotational resistance to the handle bar assembly, making it more or less difficult for the user to rotate the handle bars as desired. The handle bar assembly may be mounted at a variety of heights from near the floor and upwards to provide different exercise routines for working various muscle groups including the arms, chest, and legs. None of the prior approaches include a handle bar assembly rotating on a single axis of rotation with adjustable rotational resistance in which the mechanism is directly powered manually by the user.

The rotary exercise system may be used in a variety of mounting positions and heights to permit the user to perform different exercise routines. When the user is suspended freely from the handlebars as in a traditional pull-up exercise, the downward force of gravity of the user's body weight generates a moment about the axis of rotation and thus rotation of the system. When a user is firmly planted on the ground, either sitting or reclining, the force exerted by the user's muscles generates rotation of the rotary apparatus.

The rotating exercise apparatus allows a user to simulate continuous upward climbing while staying in a controlled location, at a controlled height. It creates a unique, space saving climbing experience, a safer environment, an effective work out, and gives users a greater sense of accomplishment and enjoyment compared to standard pull-up bars, inclined monkey bars, rock climbing walls, and free-climbing.

The adjustable rotational resistance control disclosed herein allows the user to regulate the rate of rotation to accommodate users of different body weight and that desired for different exercises. For instance, a larger user with a higher body weight will generate a greater force against the resistance mechanism. By increasing the rotational resistance, the rate of rotation will remain controlled during use.

Greater resistance is also beneficial for explosive exercises such as two handed jump pull-ups from bar to bar. By decreasing the rotational resistance, the apparatus accommodates smaller users with lower body weight and higher speed exercises. With different accessories attached to the bars, the rotating resistance climber can provide varied handholds thus giving a comprehensive forearm and grip workout. These handhold accessories can include but are not limited to: ropes, towels, ball grips, rock-climbing hand holds, wooden dowels of varying thicknesses, etc.

With adjustable height and resistance, the rotating resistance system can provide a superior workout for any fitness level. It is usable for elite athletes who can hold their whole body weight and continually climb. It is also usable with less resistance while users stand on the ground and need to work up to full pull-ups with their whole body weight suspending in air while hanging from the handle bars.

In one aspect, a rotary exercise system includes: a chassis configured for mounting between a pair of stationary elongated support members; an elongated rotational support shaft rotatably supported by the chassis, the support shaft rotatable in opposing directions about an axis of rotation; a plurality of handle bars coupled to the support shaft and rotatable therewith, the handle bars arranged to encircle the support shaft and be graspable by a user; a variable resistance mechanism operably coupled to the support shaft, the resistance mechanism configured and operable to apply a selectable rotational resistance on the support shaft which is adjustable by the user; wherein adjusting the resistance mechanism increases or decreases a physical force required to be exerted manually by a user on the handle bars in order to rotate the support shaft.

In another aspect, a rotary exercise system includes: a pair of spaced apart vertical support members; a chassis comprising first and second mounting rack assemblies, each mounting rack assembly configured for detachable mounting to one of the vertical support members in a plurality of positions; an elongated rotational support shaft rotatably supported by the first and second mounting rack assemblies, the support shaft rotatable in opposing directions about an axis of rotation; a handle bar assembly comprising a plurality of elongated handle bars extending between a pair of side support structures rigidly coupled to the support shaft for rotation therewith, the handle bars arranged for grasping by a user and circumferentially spaced apart around the support shaft; a variable frictional resistance mechanism operably coupled to the support shaft, the resistance mechanism configured and operable to apply a selectable rotational resistance on the support shaft which is adjustable by the user; wherein adjusting the resistance mechanism increases or decreases a physical force required to be exerted manually by a user on the handle bars in order to rotate the support shaft.

In another aspect, a rotary exercise system includes: a pair of spaced apart vertical support members; a chassis comprising first and second mounting rack assemblies, each mounting rack assembly configured for detachable mounting to one of the vertical support members in a plurality of positions; an elongated rotational support shaft rotatably supported by the first and second mounting rack assemblies, the support shaft rotatable in opposing directions about an axis of rotation; a handle bar assembly comprising a plurality of elongated handle bars extending between a pair of side support structures rigidly coupled to the support shaft for rotation therewith, the handle bars arranged for grasping by a user and circumferentially spaced apart around the support shaft; a frictional resistance mechanism supported by one of the first or second mounting rack assemblies and operably coupled to the support shaft, the resistance mechanism configured and operable to apply a selectable rotational resistance on the support shaft which is adjustable by the user; a user-operated control actuator operably coupled to the frictional resistance mechanism, the control actuator having a plurality of user selectable resistance settings; wherein adjusting the control actuator to select one of the resistance settings increases or decreases a physical force required to be exerted manually by the user on the handle bars in order to rotate the support shaft.

BRIEF DESCRIPTION OF THE DRAWINGS

The features of the exemplary embodiments will be described with reference to the following drawings where like elements are labeled similarly, and in which:

FIGS. 49A, 49B, 49C, and 49D are sequential side cross sectional views of the flow control valve assembly taken from FIG. 44 in various stages of operation, in which FIG. 49A shows a first position of the valve assembly, FIG. 49B shows a second position thereof; FIG. 49C shows a third position thereof; and FIG. 49D shows a fourth position thereof;

FIGS. 65A-C show sequential side views of an embodiment of a portable flat bench pad assembly without attached weight rack in the process of the bench descending after actuating the foot pedal, in which FIG. 65A shows a first position of the bench, FIG. 65B shows a second position thereof, and FIG. 65C shows a third position thereof;

FIG. 111B is a side view of the bench of FIGS. 100 and 101 shown in a sixth position;

FIG. 112A is a side view of the bench of FIGS. 100 and 101 shown in a seventh position;

FIG. 112B is a side view of the bench of FIGS. 100 and 101 shown in an eighth position;

FIG. 112C is a side view of the bench of FIGS. 100 and 101 shown in a ninth position;

FIG. 112D is a side view of the bench of FIGS. 100 and 101 shown in a tenth position;

FIGS. 113 and 114 are first and second top perspective views respectively of an alternative hydraulic cylinder assembly according to another embodiment including a hydraulic cylinder, accumulator, and flow control valve assembly;

FIG. 115 is a side cross sectional view thereof;

FIG. 116 is a side cross sectional view of the flow control valve assembly of FIGS. 113 and 114;

FIG. 117 is an exploded perspective view thereof;

FIGS. 118 and 119 are side perspective views thereof;

FIG. 120 is a front view thereof;

Figure 120:
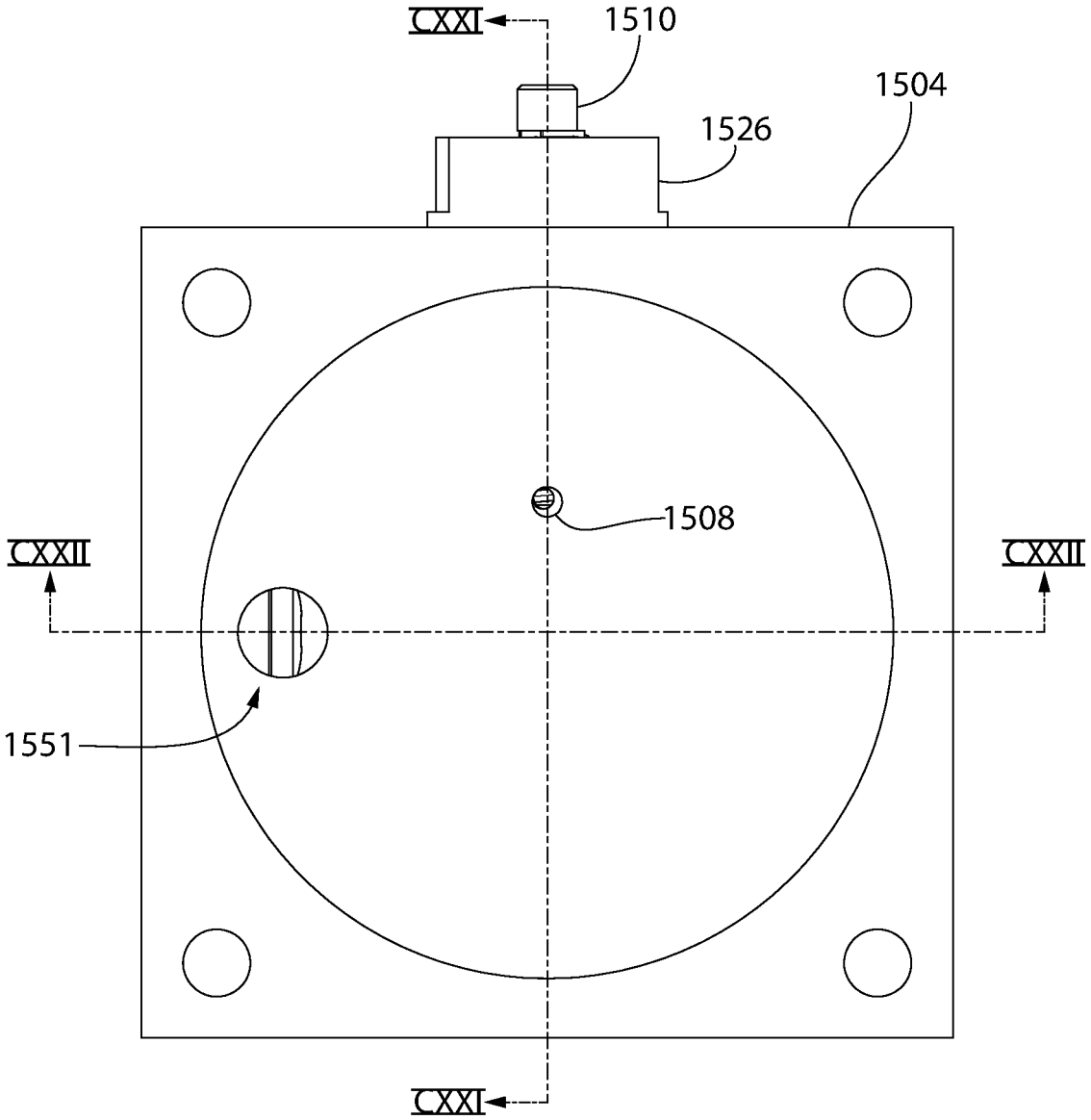
Figure 121A:
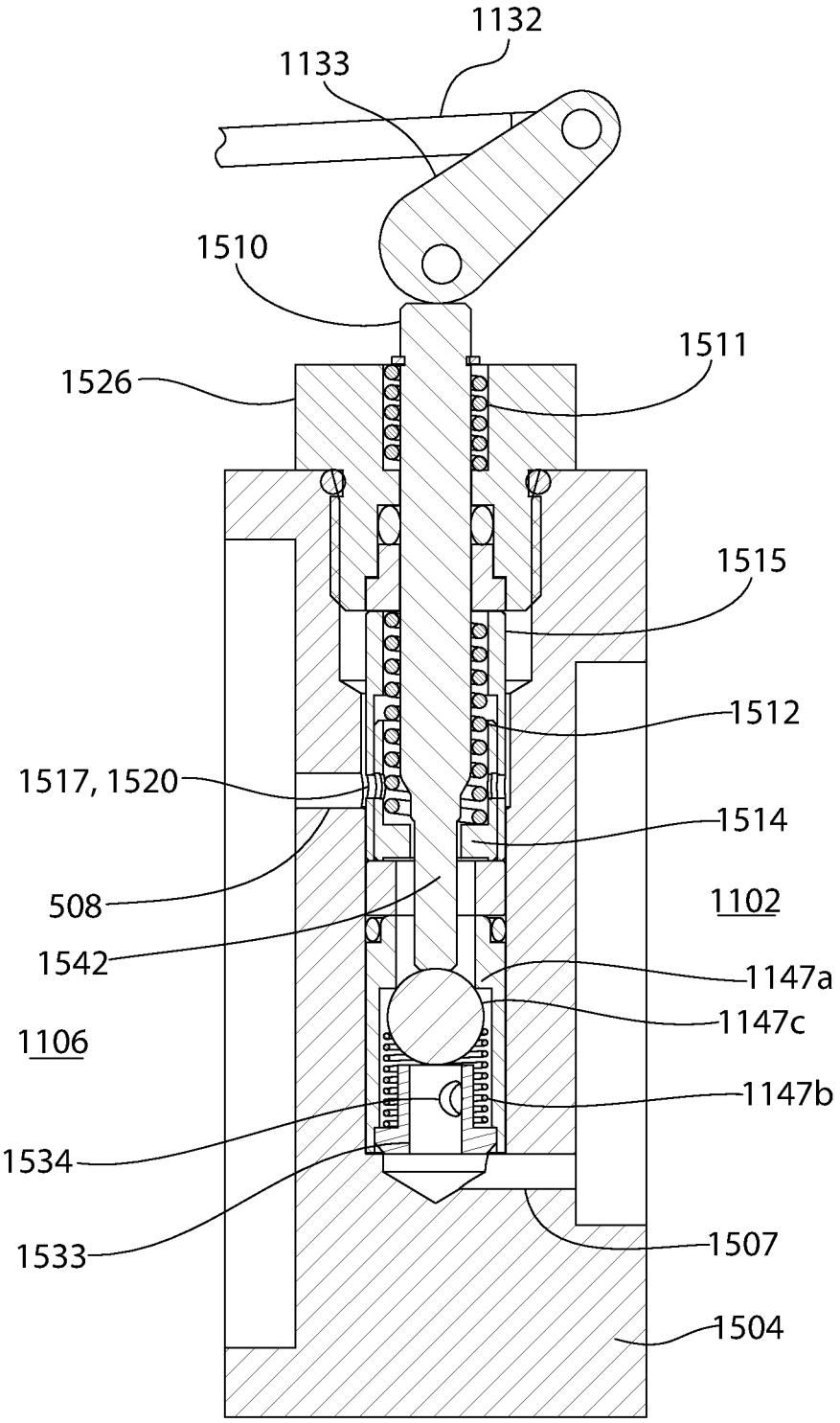
Figure 121B:
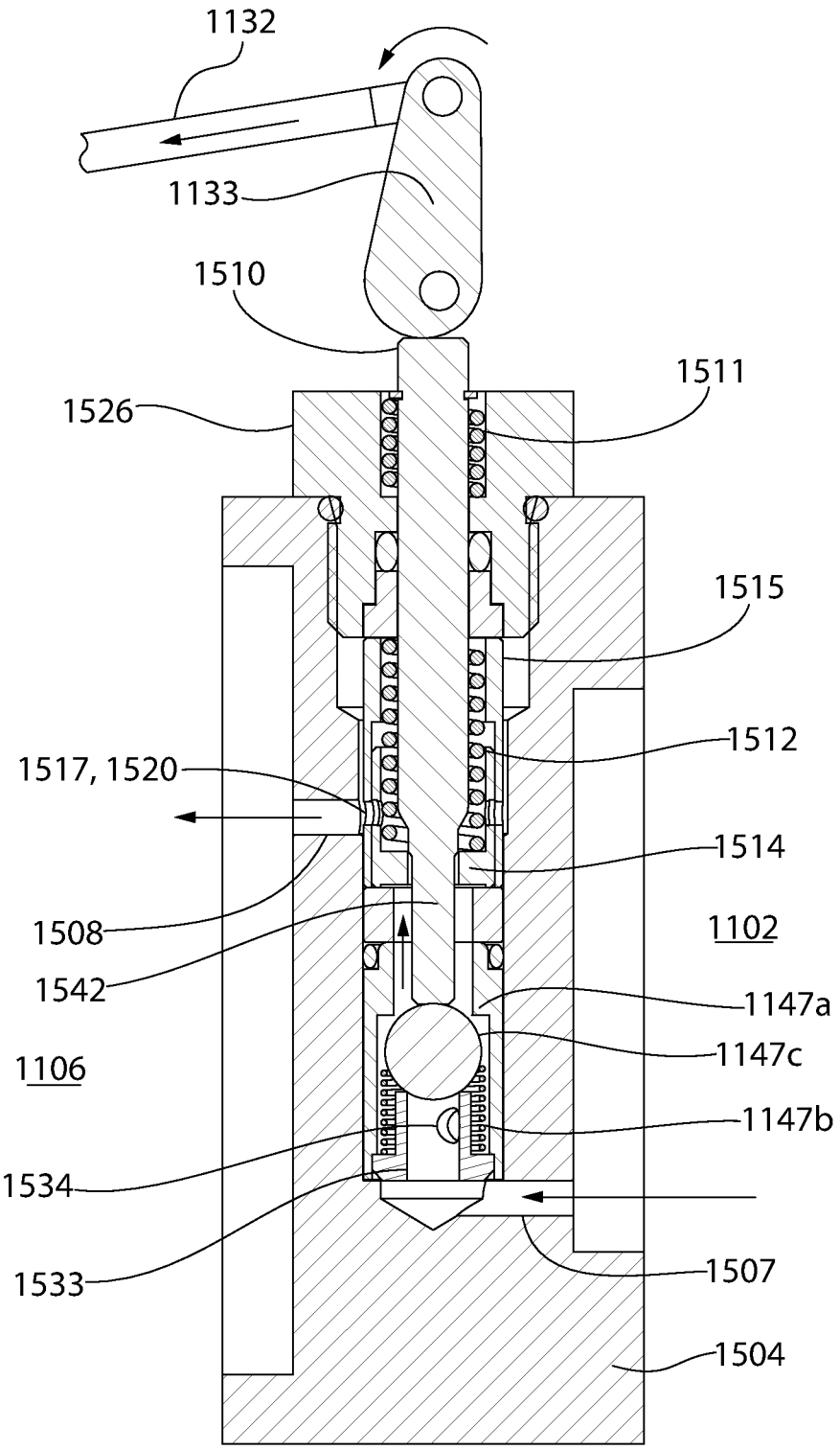
Figure 121C:
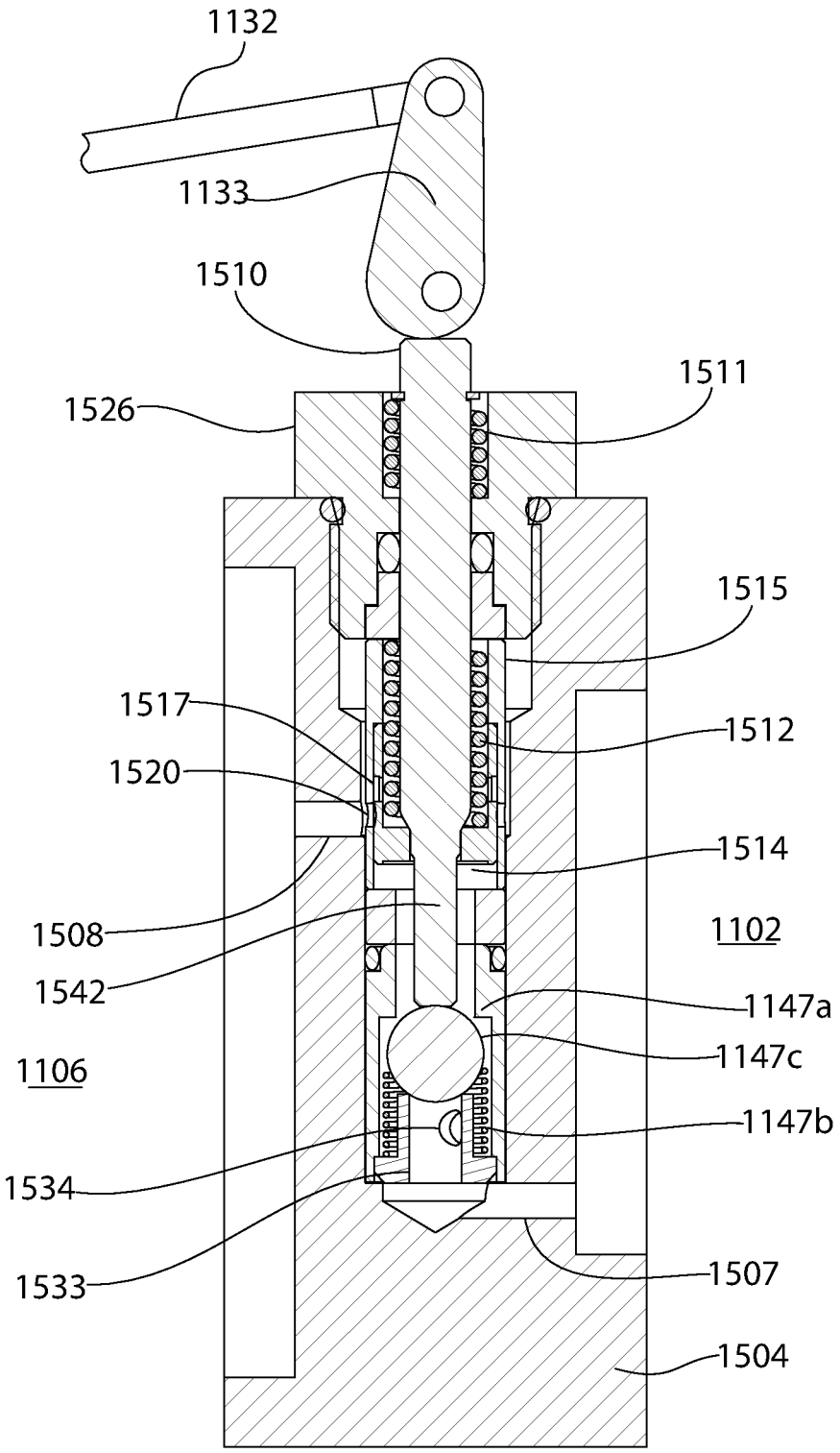
Figure 121D:
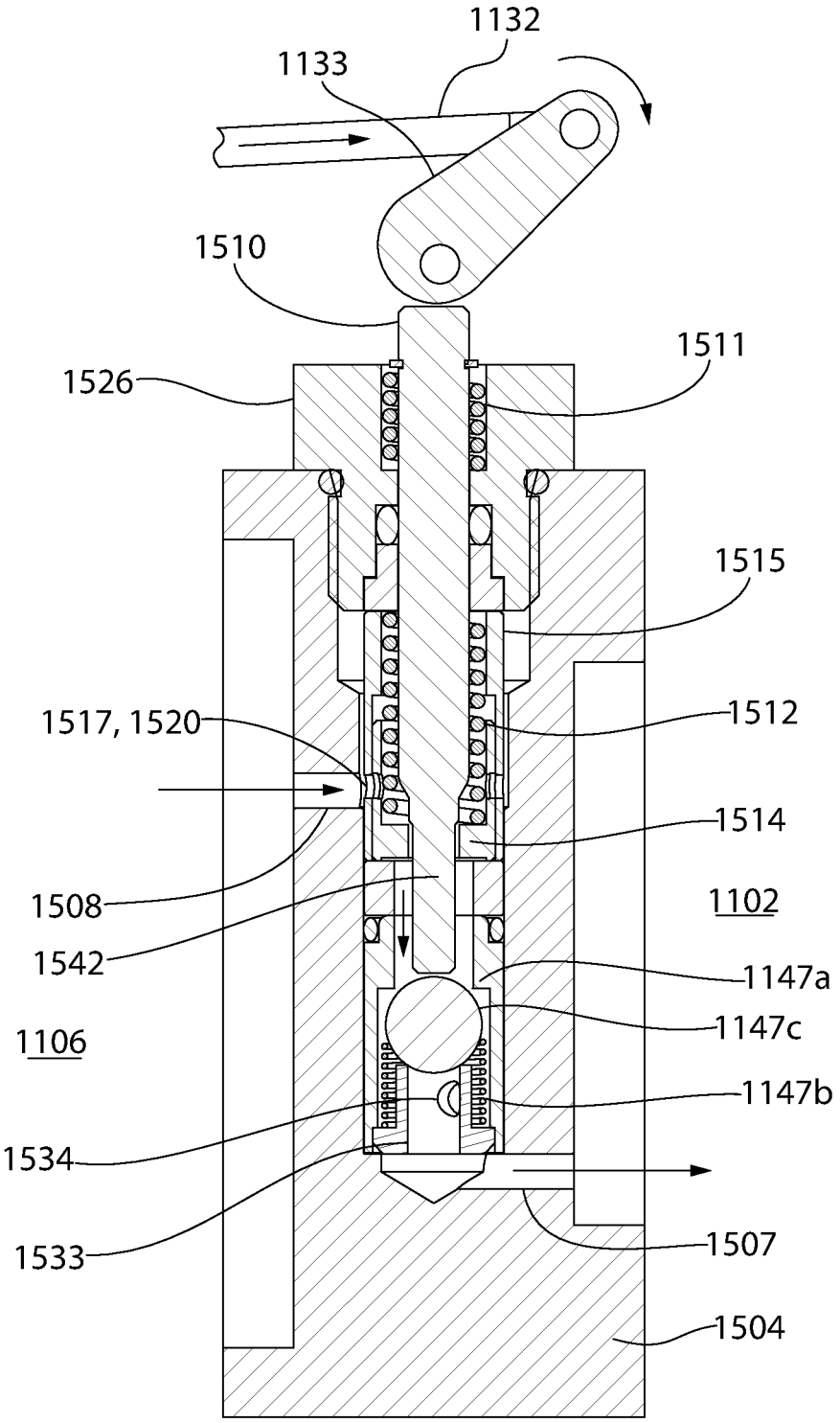
Figure 122:
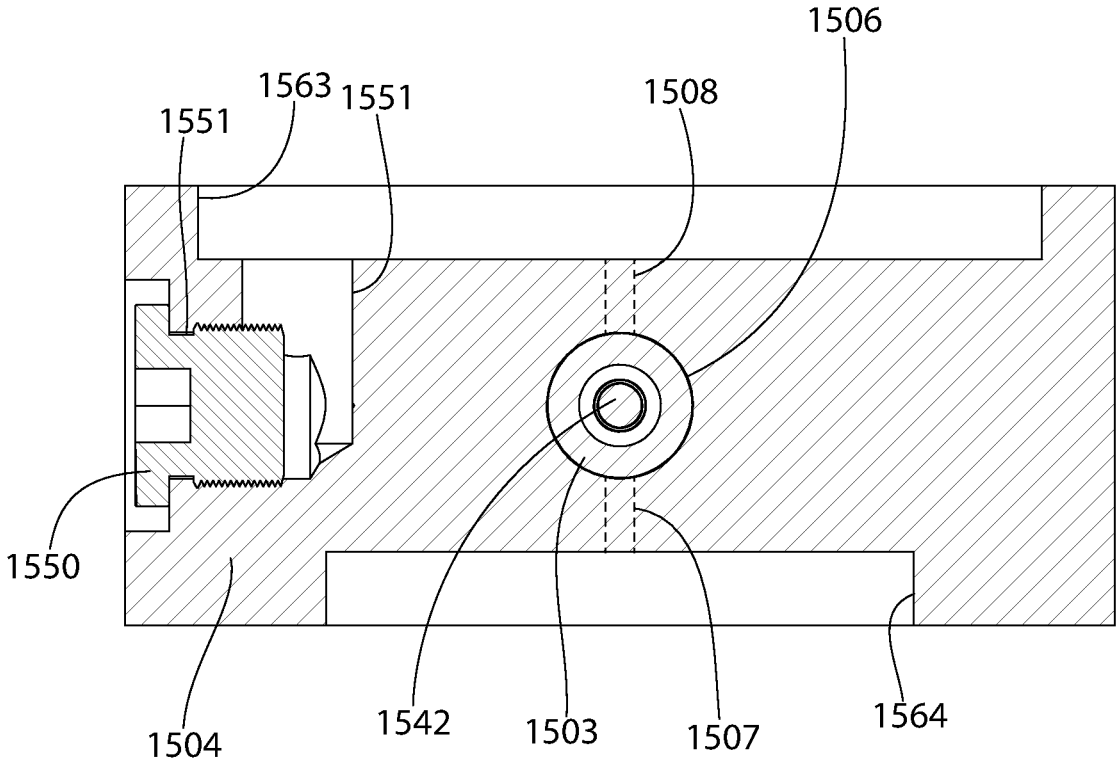
Figure 123A:
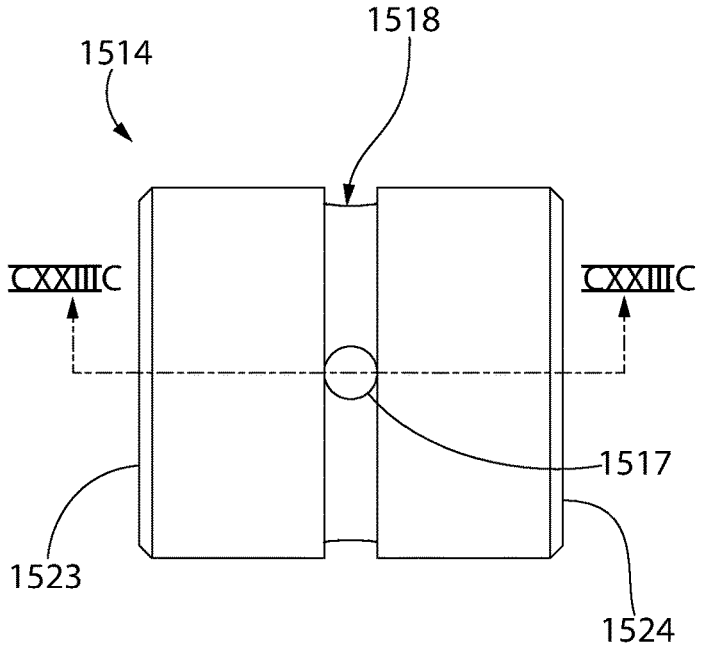
Figure 123B:
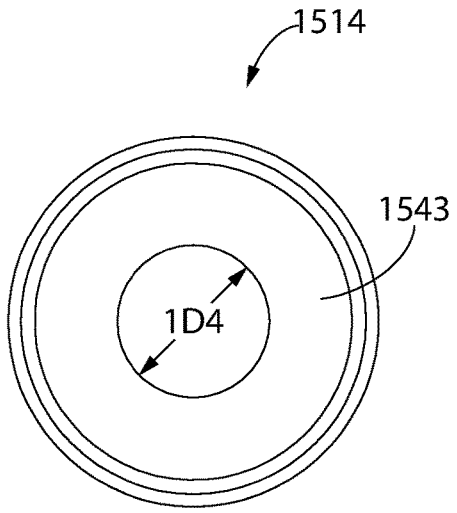
Figure 123C:
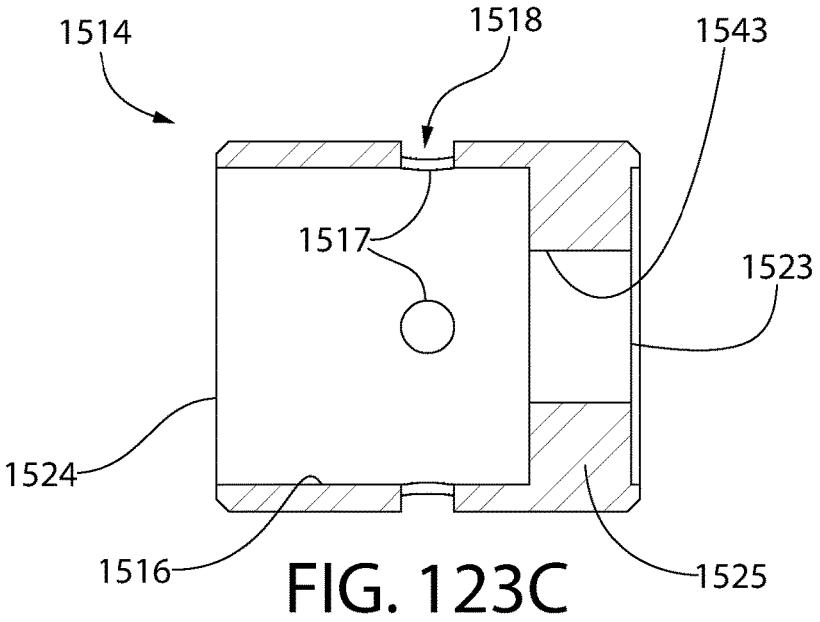
Figure 124A:
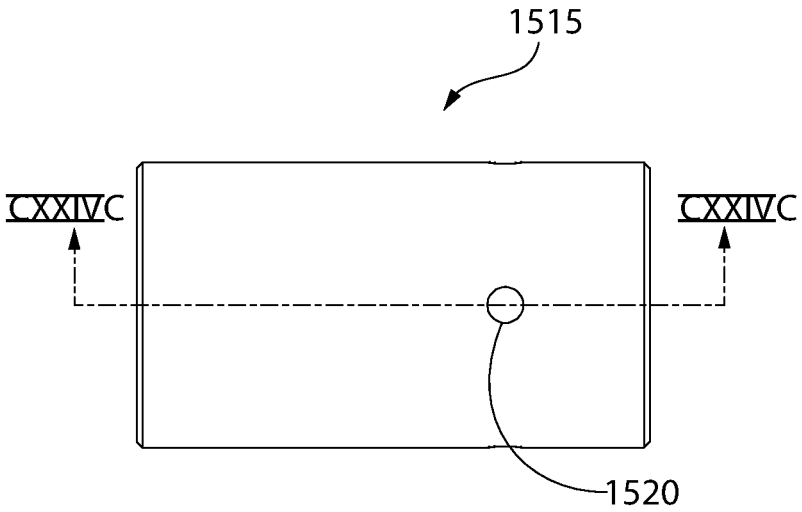
Figure 124B:
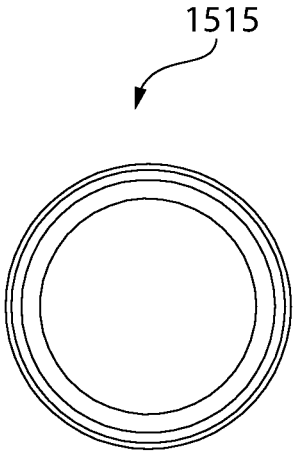
Figure 124C:
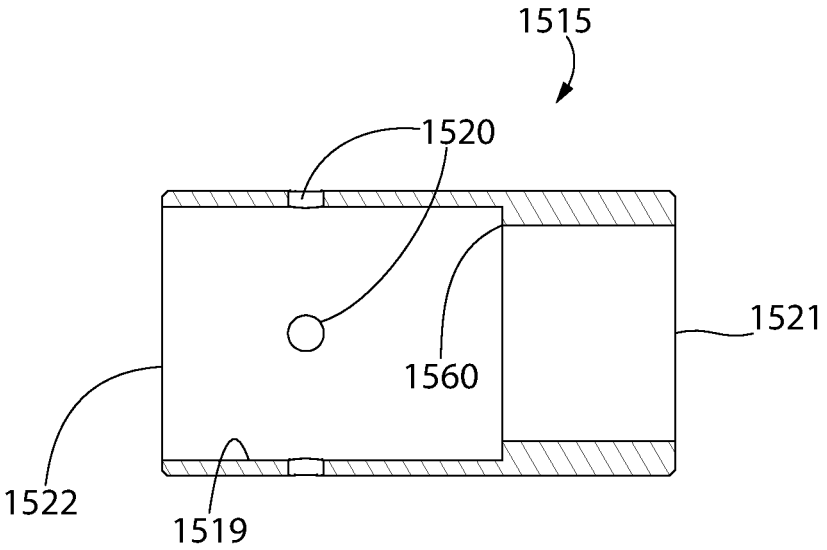
Figure 125A:
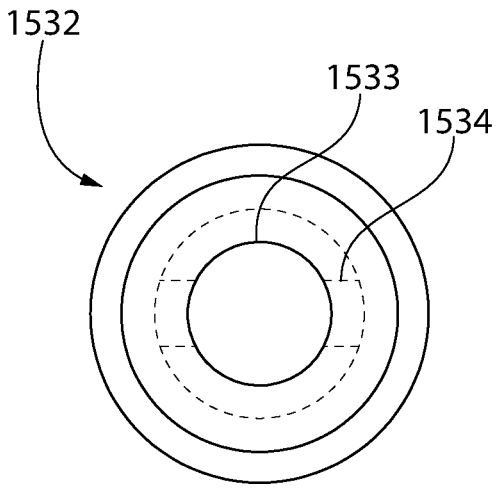
Figure 125B:
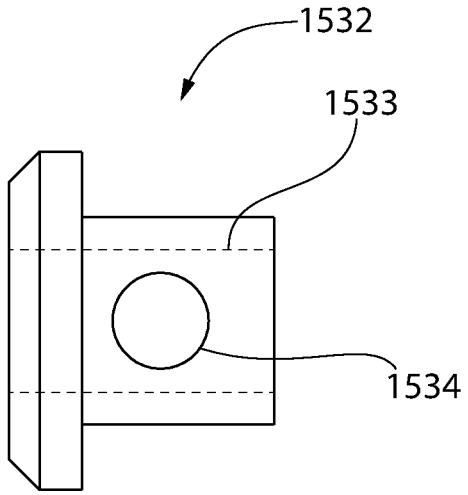
Figure 126:
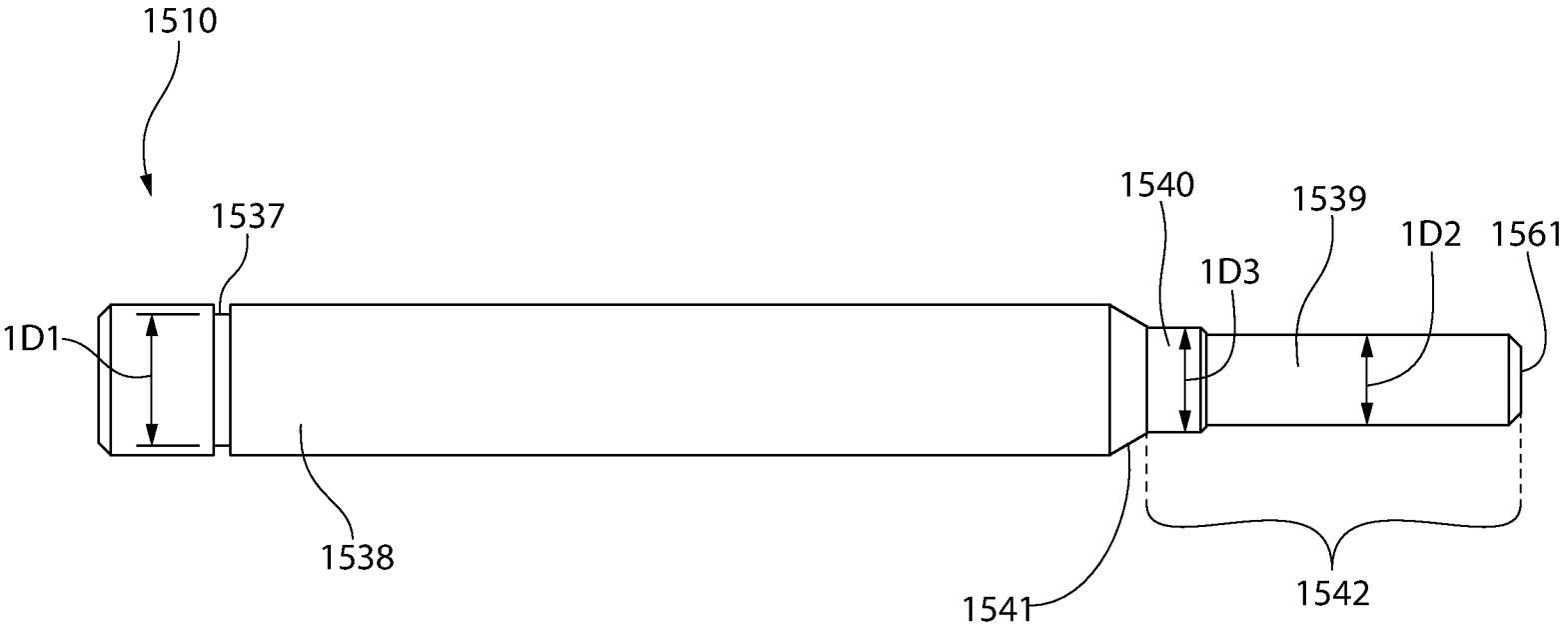

FIGS. 121A-D are sequential side cross sectional views of the flow control valve assembly taken from FIG. 120 in various stages of operation in which FIG. 121A shows a first position of the valve, FIG. 121B shows a second position of the valve, FIG. 121C shows a third position of the valve, and FIG. 121D shows a fourth position of the valve;

FIG. 122 is a top cross sectional view of the flow control valve assembly taken from FIG. 120;

FIGS. 123A-C depict various views of the piston of the flow control valve assembly in which FIG. 123A is a side view, FIG. 123B is an end view, and FIG. 123C is a side cross-sectional view;

FIGS. 124A-C depict various views of the piston sleeve of the flow control valve assembly in which FIG. 124A is a side view, FIG. 124B is an end view, and FIG. 124C is a side cross-sectional view;

FIGS. 125A-B depict various views of the exhaust retainer of the flow control valve assembly in which FIG. 125A is an end view and FIG. 125B is a side view;

FIG. 126 is a side view of the plunger of the flow control valve assembly.

Figure 127:
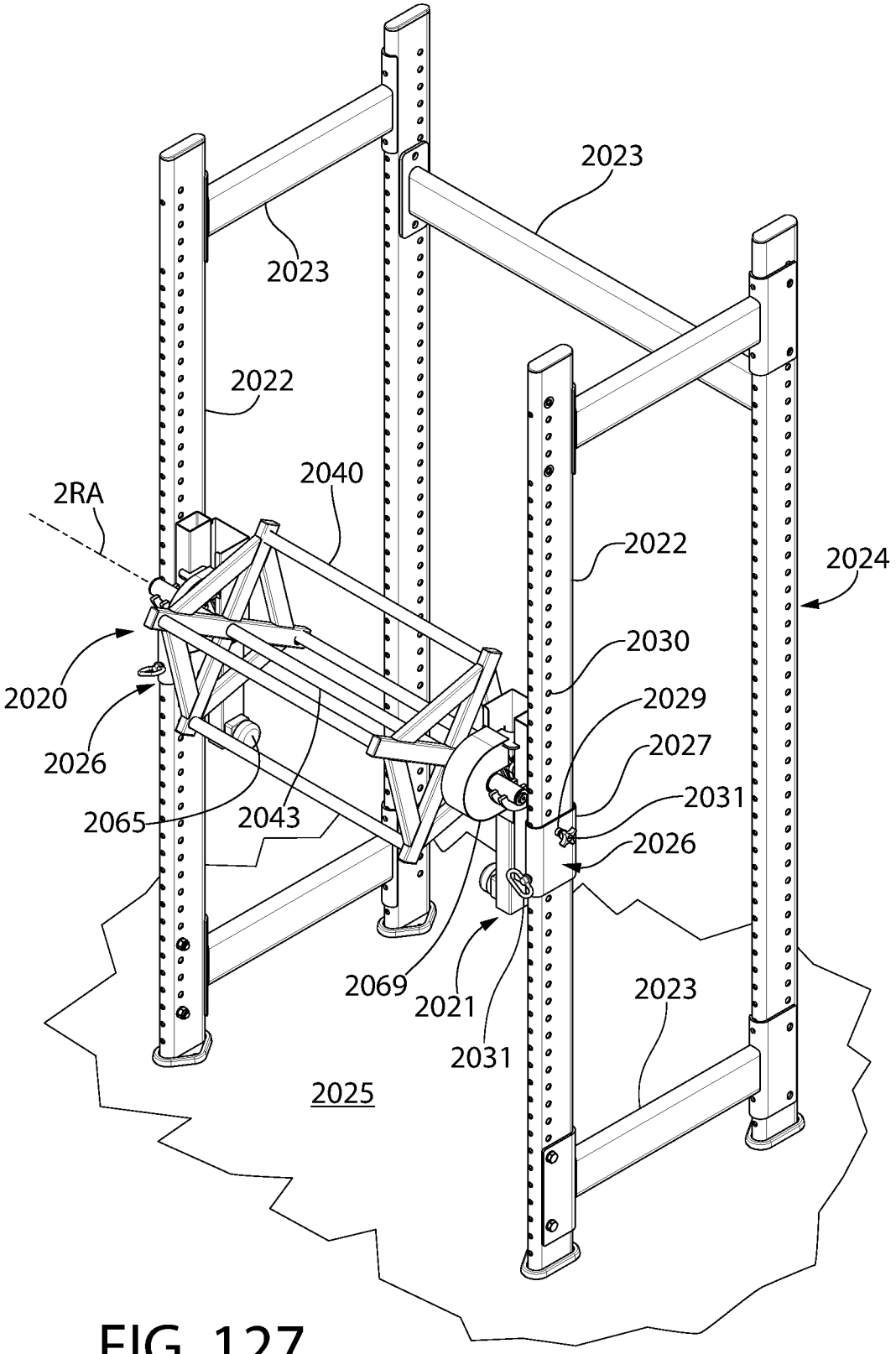
Figure 129:
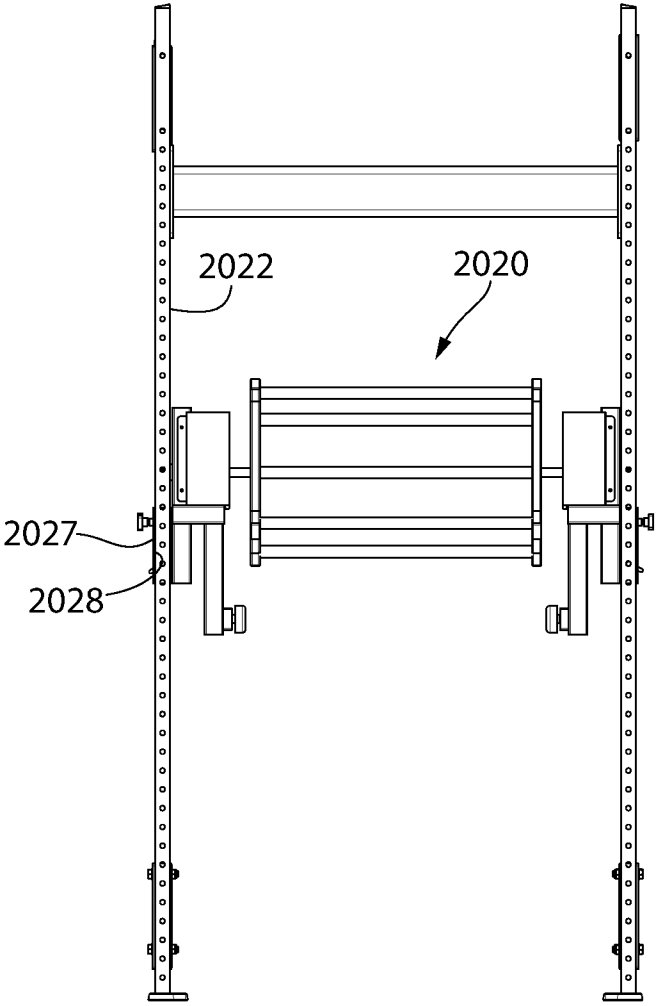
Figure 128:
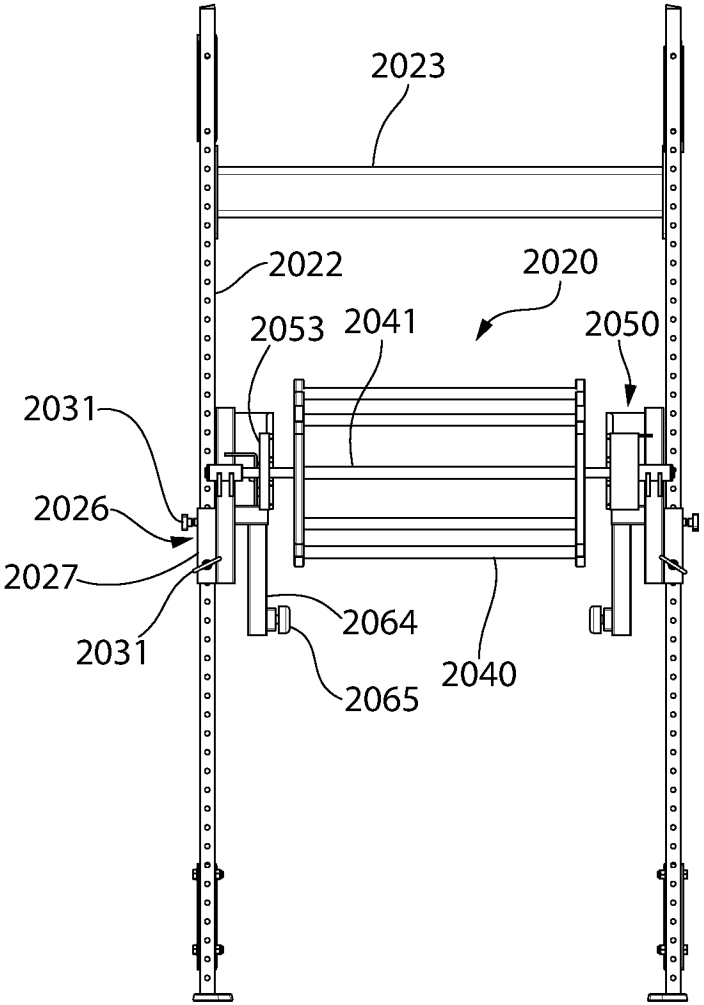
Figure 130:
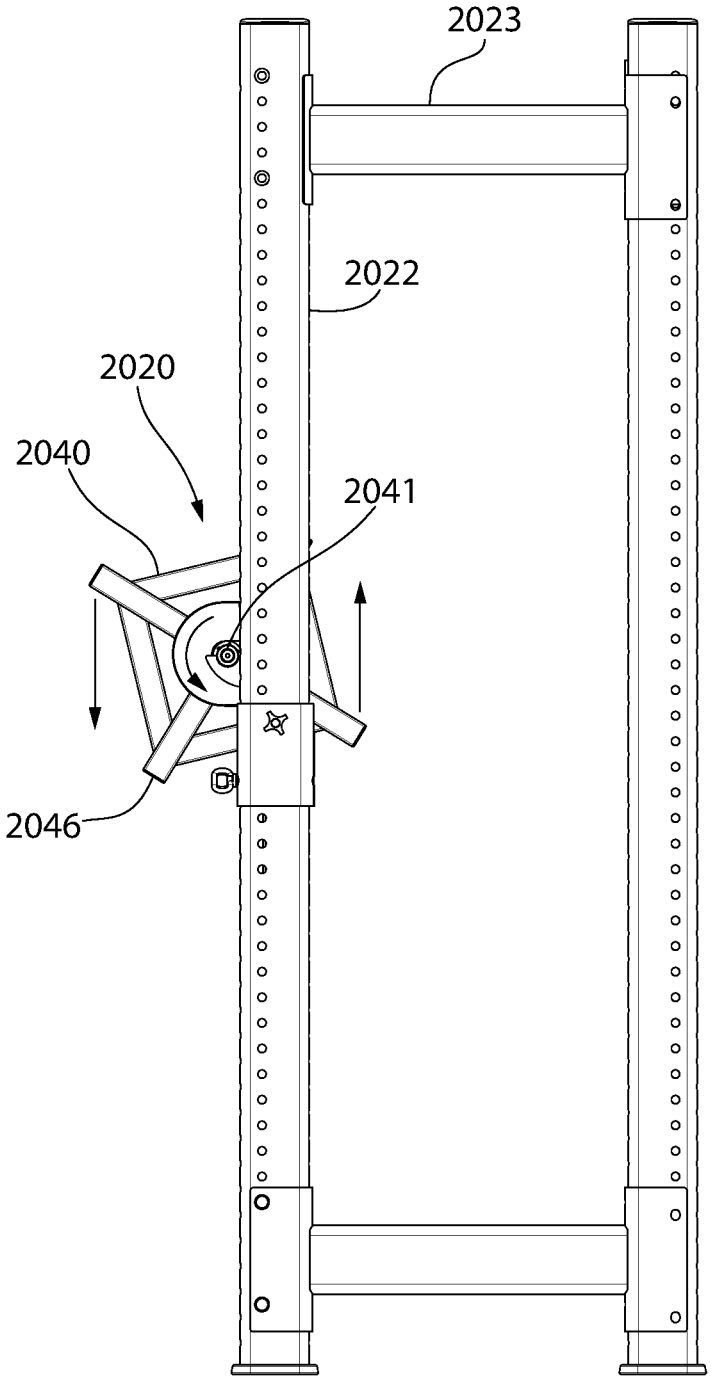
Figure 131:
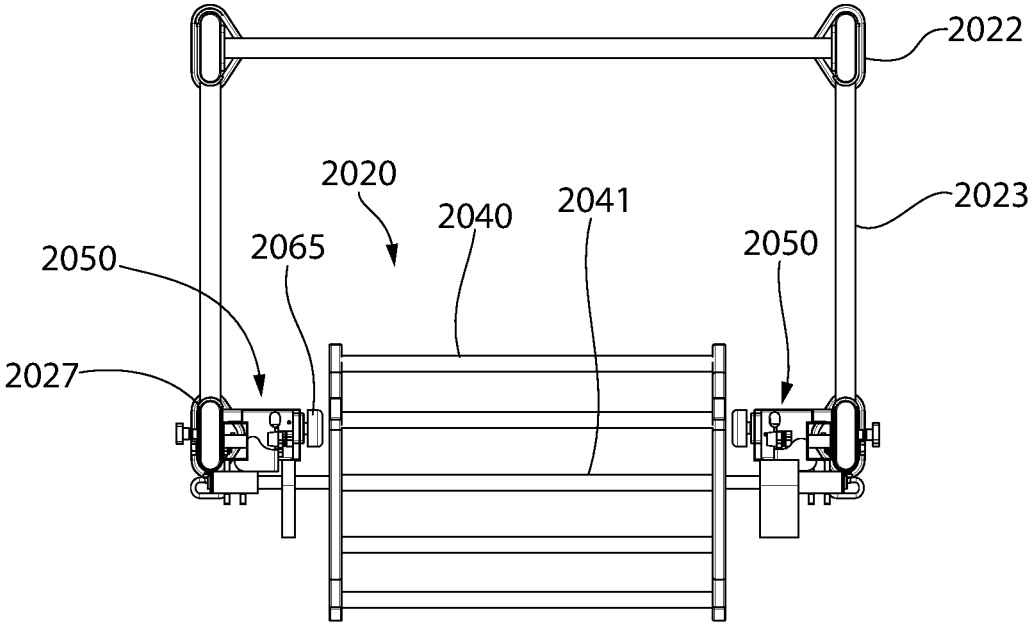
Figure 132:
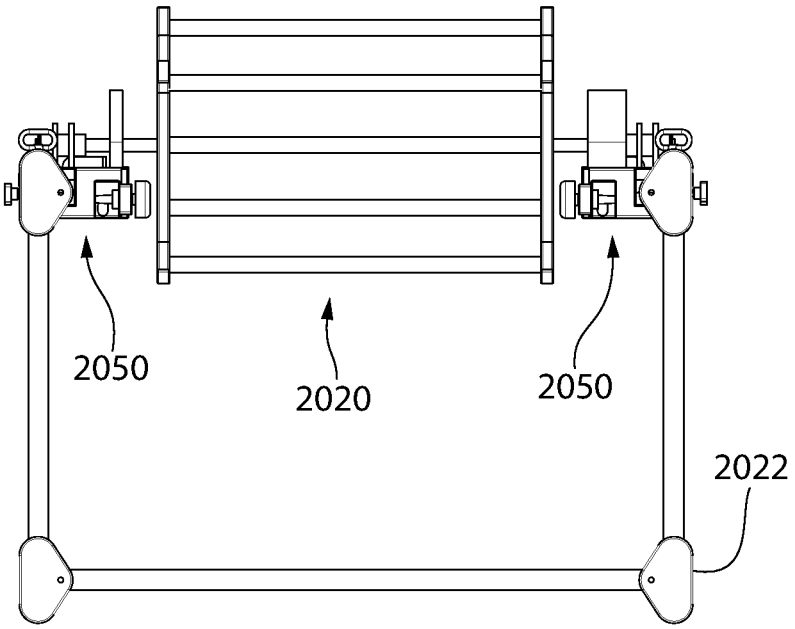
Figure 133:
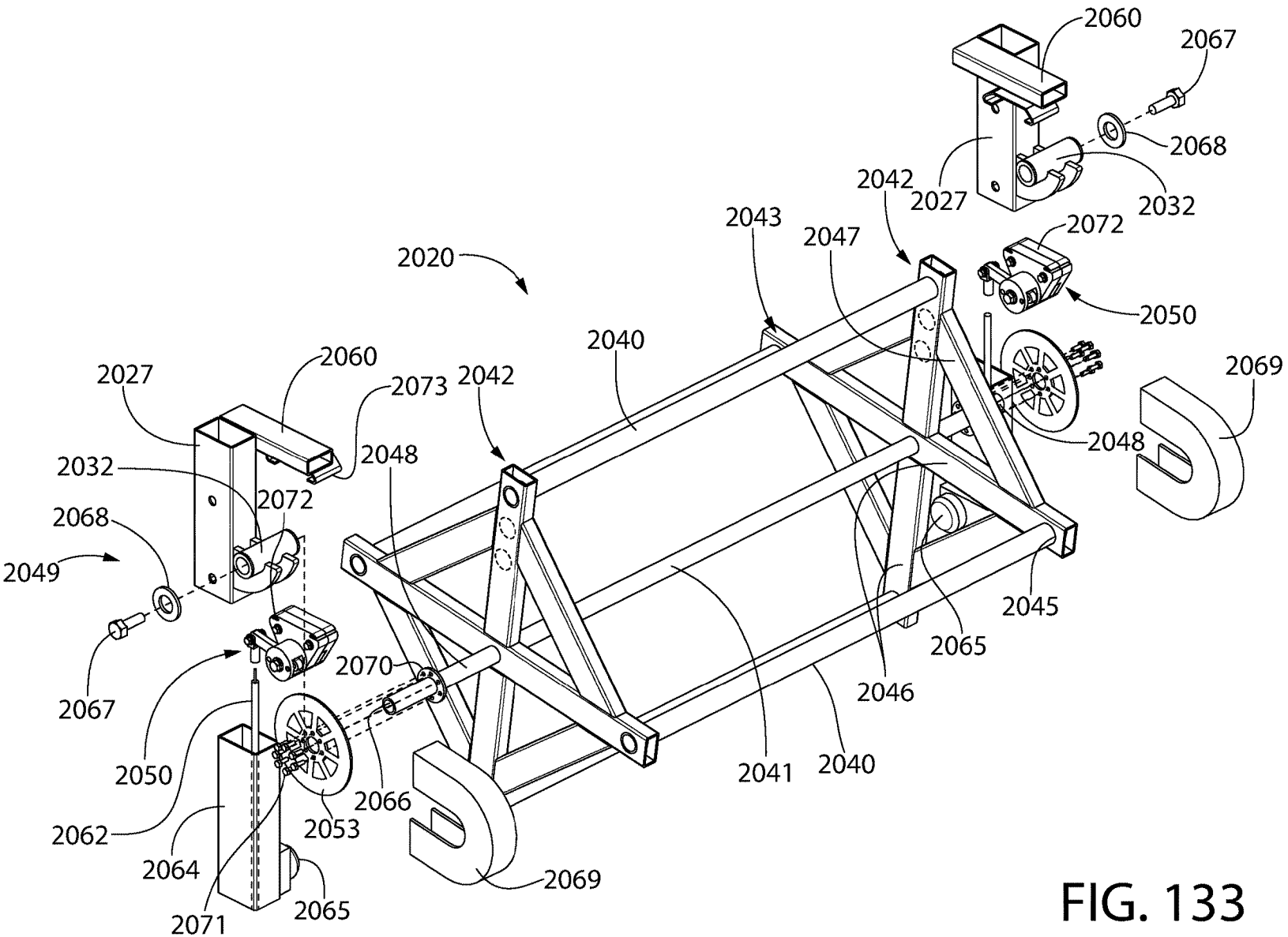
Figure 134:
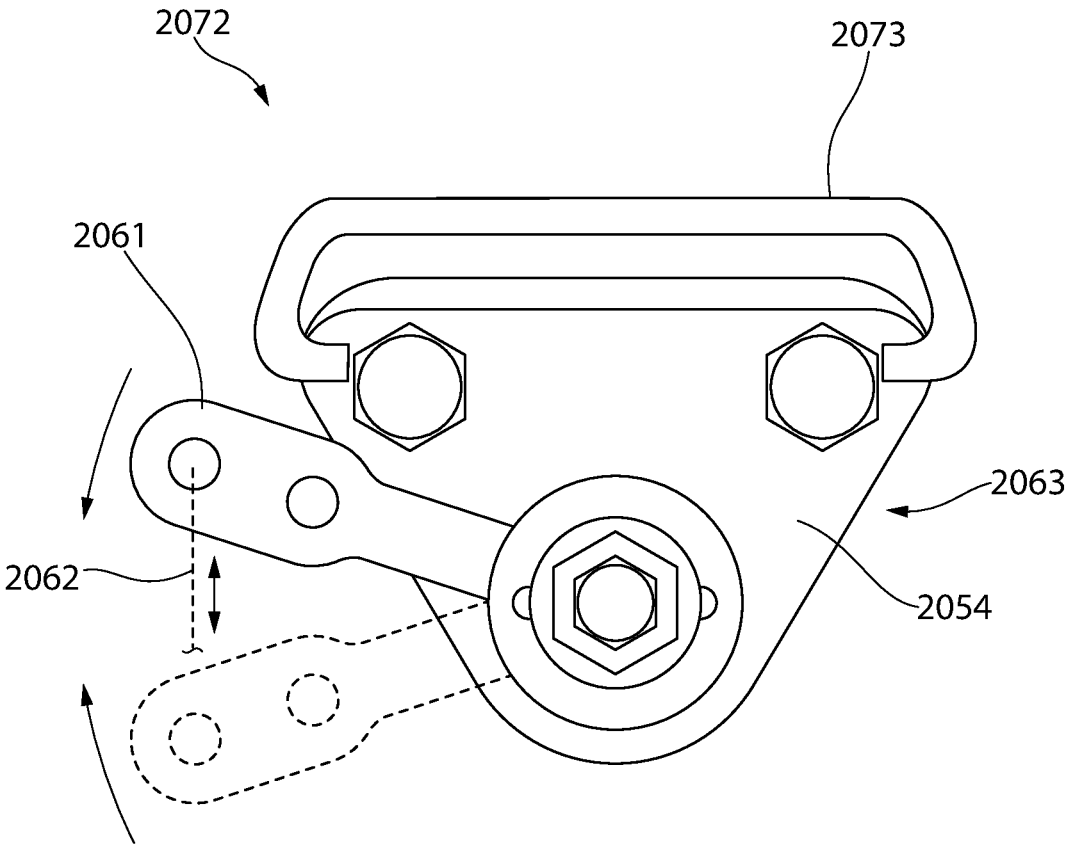
Figure 135:
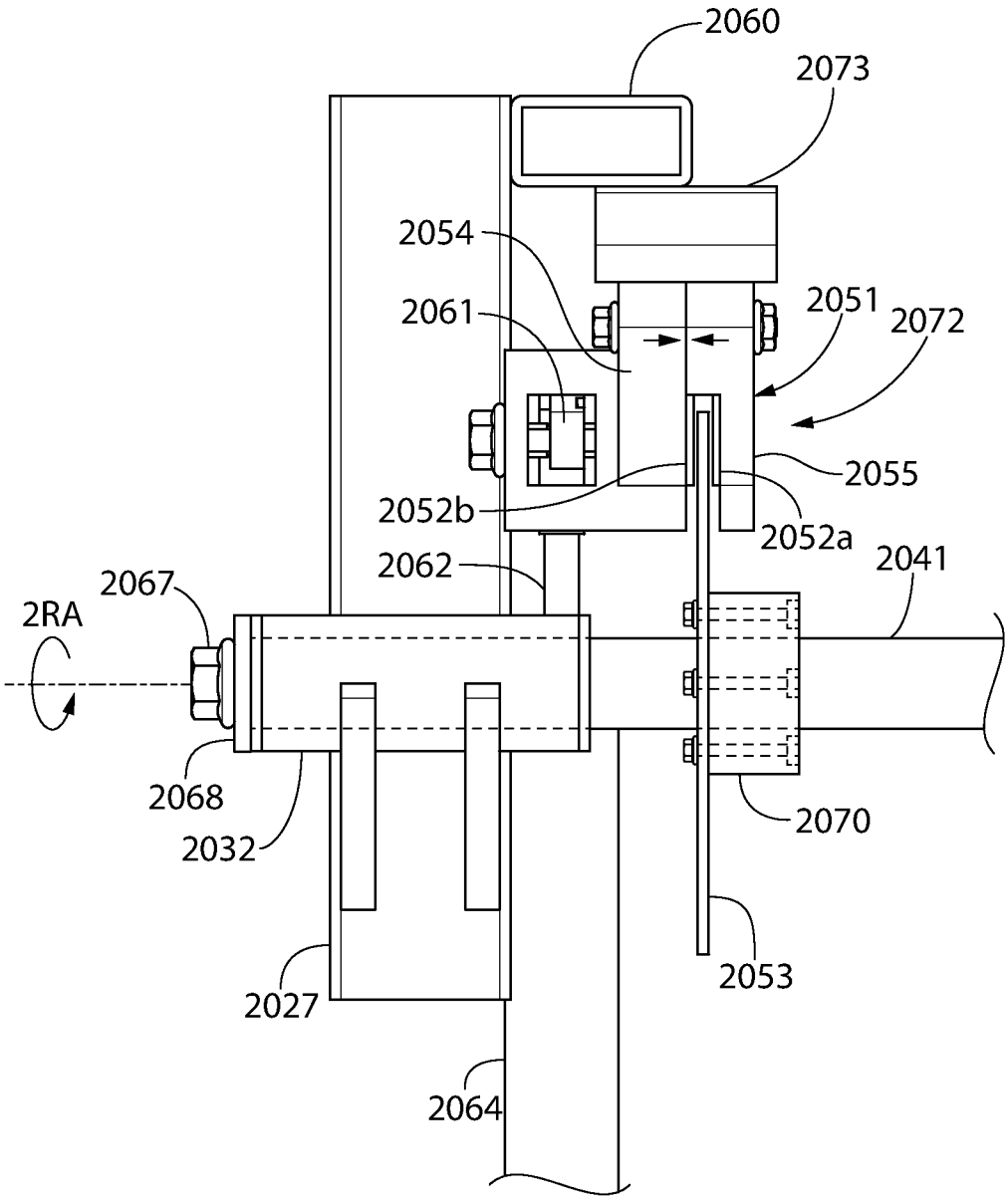
Figure 136:
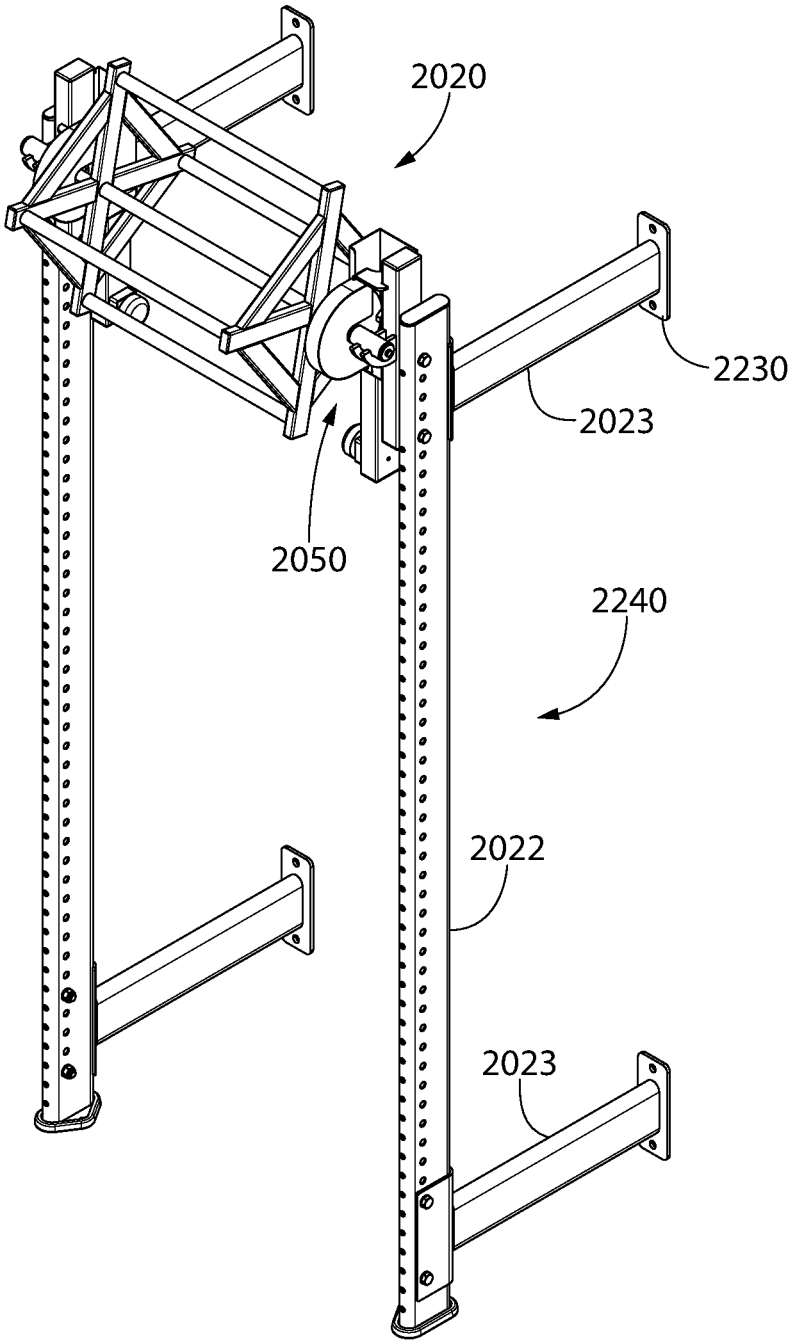
Figure 137:
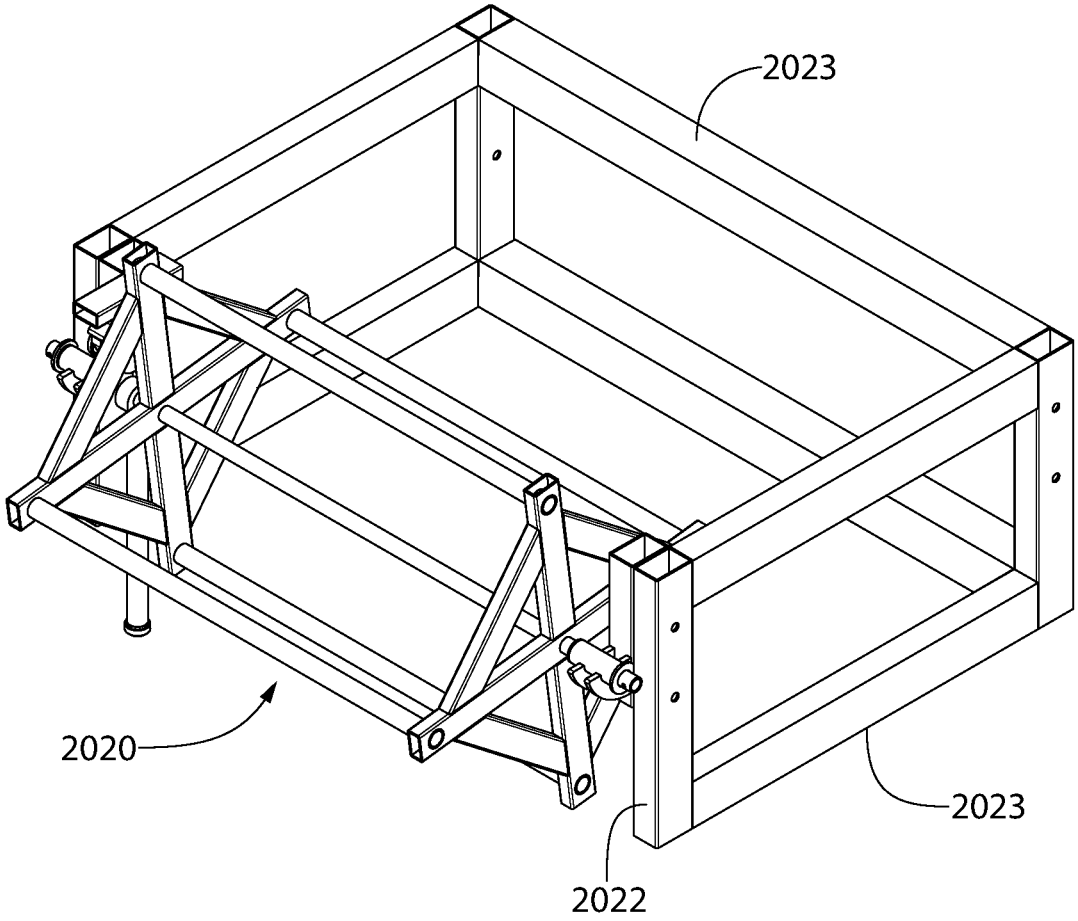
Figure 138:
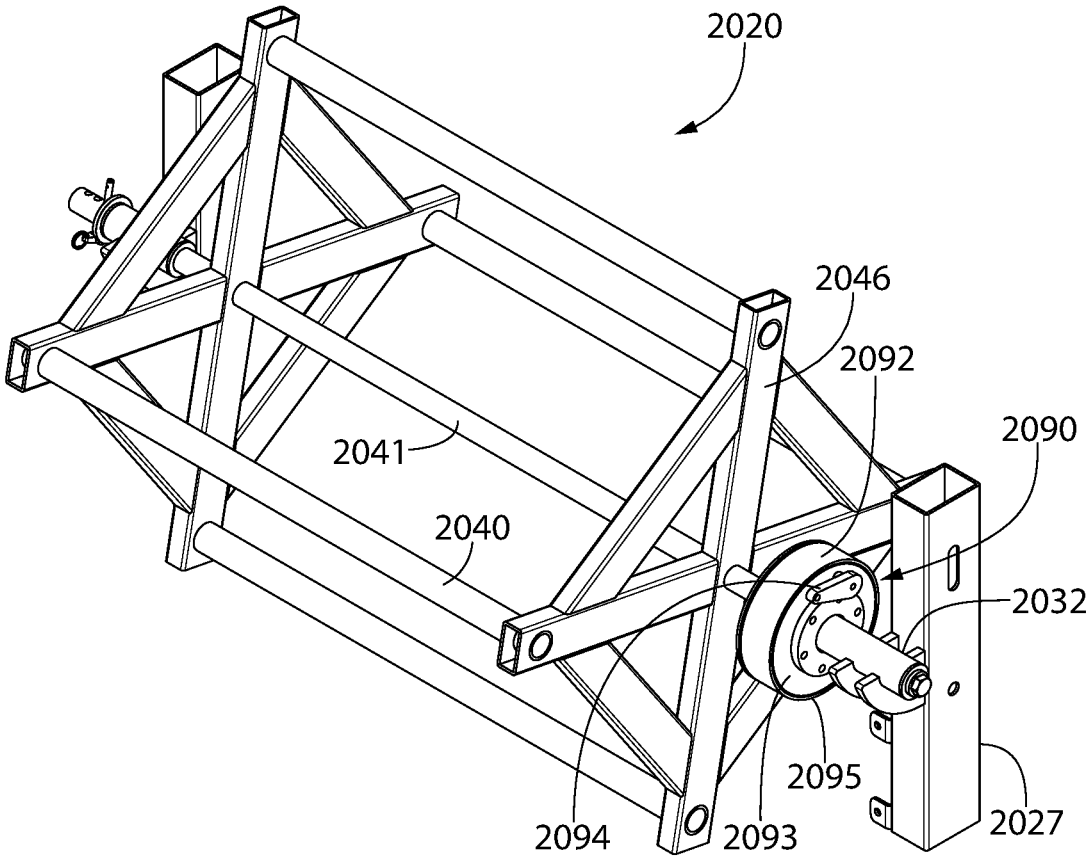
Figure 139:
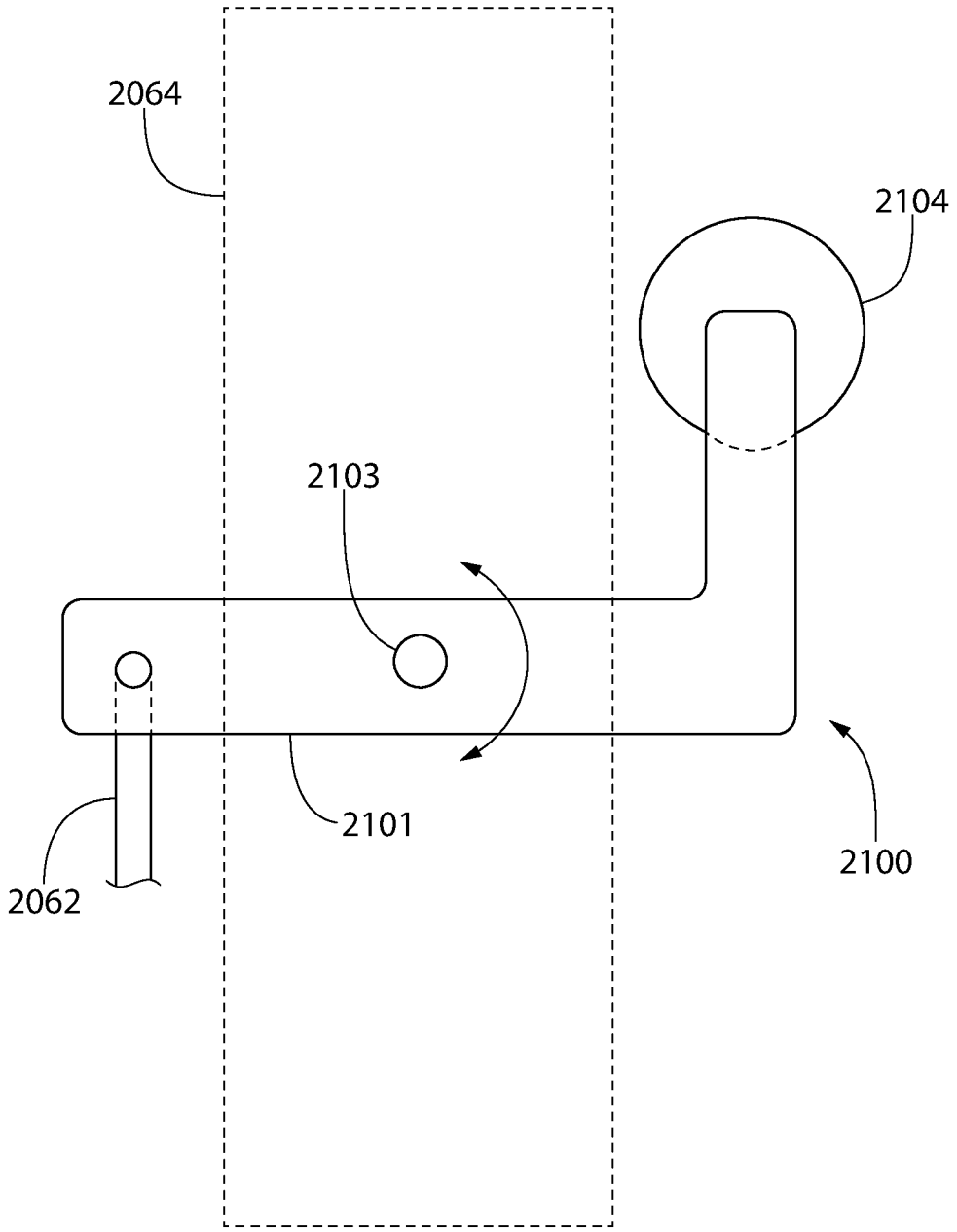
Figure 140:
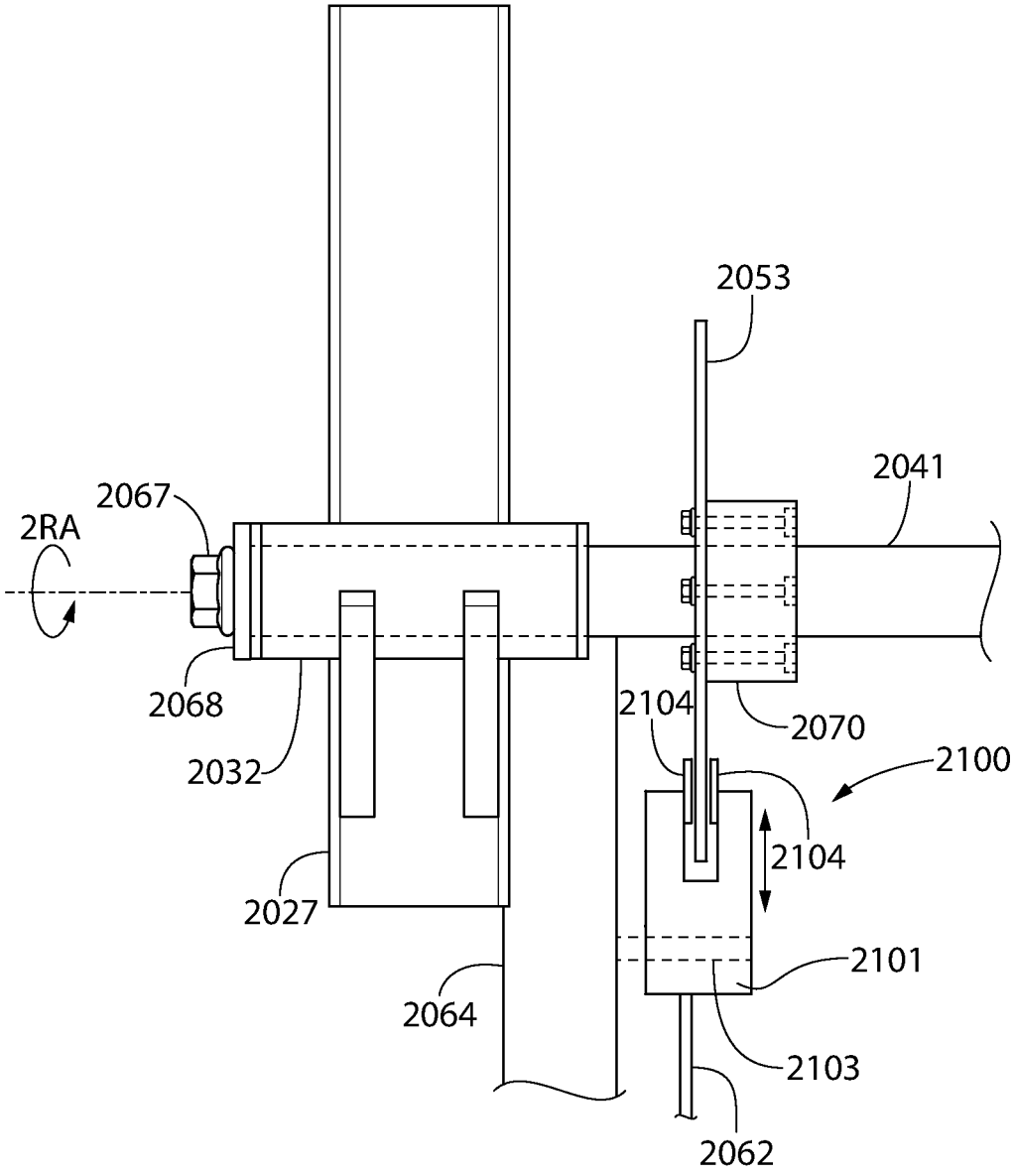

FIG. 127 is a perspective view of a rotary exercise system according to the present disclosure including a rotatable handle bar assembly and floor-supported exercise rack for mounting the handle bar assembly thereon;

FIG. 128 is a front elevation view thereof;

FIG. 129 is a rear elevation view thereof;

FIG. 130 is a side elevation view thereof;

FIG. 131 is a top plan view thereof;

FIG. 132 is a bottom plan view thereof;

FIG. 133 is an exploded view of the handle bar assembly and its rack mounting structure;

FIG. 134 is a side view of a frictional rotational resistance device in the form of a disc brake assembly;

FIG. 135 is a front view thereof mounted on the handle bar rack mounting assembly;

FIG. 136 is a perspective view of an alternative embodiment of a floor and wall-mounted exercise rack with handle bar assembly mounted thereon;

FIG. 137 is a perspective view of another alternative embodiment of a wall-mounted exercise rack with handle bar assembly mounted thereon;

FIG. 138 is a perspective view of the handle bar assembly with an alternative frictional rotational resistance device in the form of a drum brake assembly;

FIG. 139 is a schematic side view of a non-contact magnetic rotational resistance device; and FIG. 140 is a front view thereof mounted on the handle bar rack mounting assembly.

All drawings are schematic and not necessarily to scale. Parts given a reference numerical designation in one figure may be considered to be the same parts where they appear in other figures without a numerical designation for brevity unless specifically labeled with a different part number and/or described herein. Any reference to whole figure numbers (e.g. FIG. 1) which are comprised of multiple sub-parts (e.g. 1A, 1B, etc.) shall be construed as a reference to all sub-parts unless indicated otherwise.

DETAILED DESCRIPTION

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
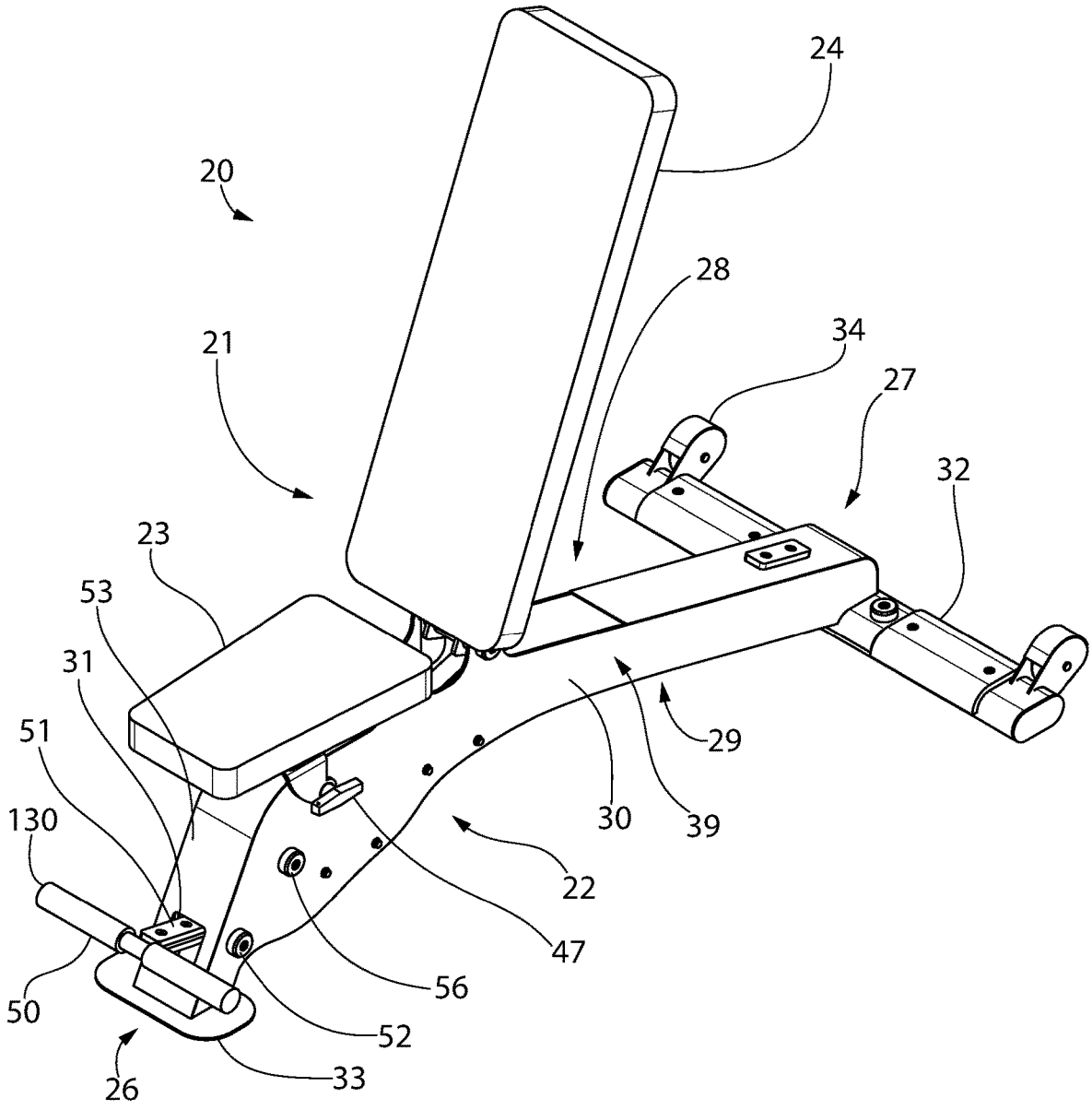
FIG. 1 is a front perspective view of an embodiment of a "hands free" weight lifting bench with automatic back pad return and descent control mechanisms according to the present disclosure.
Figure 2:
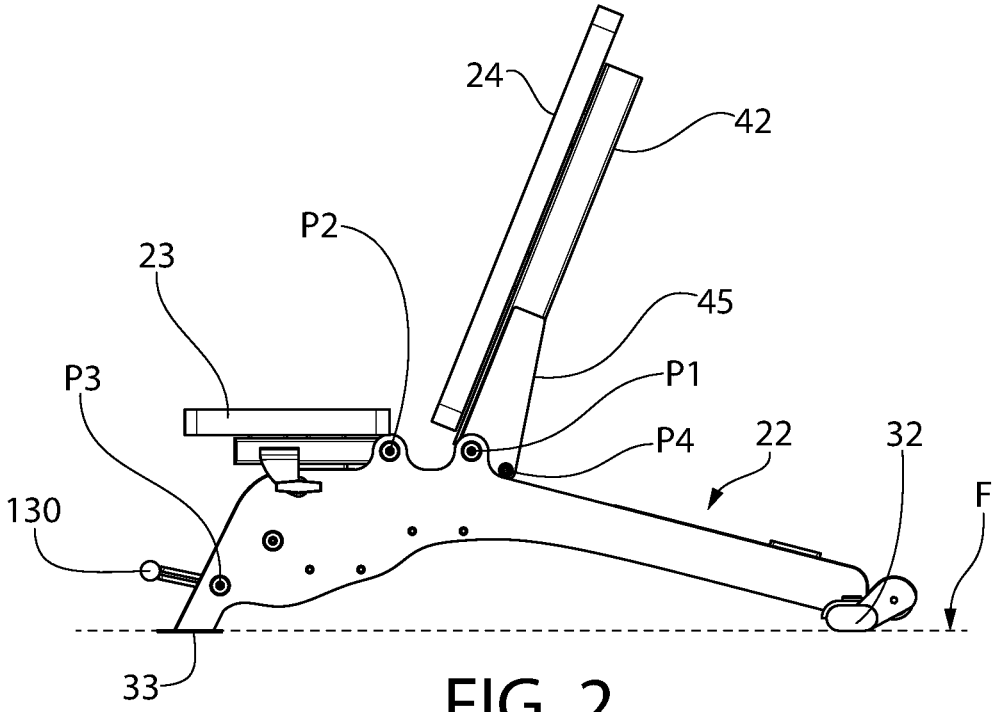
FIG. 2 is a left side view thereof.
Figure 3:
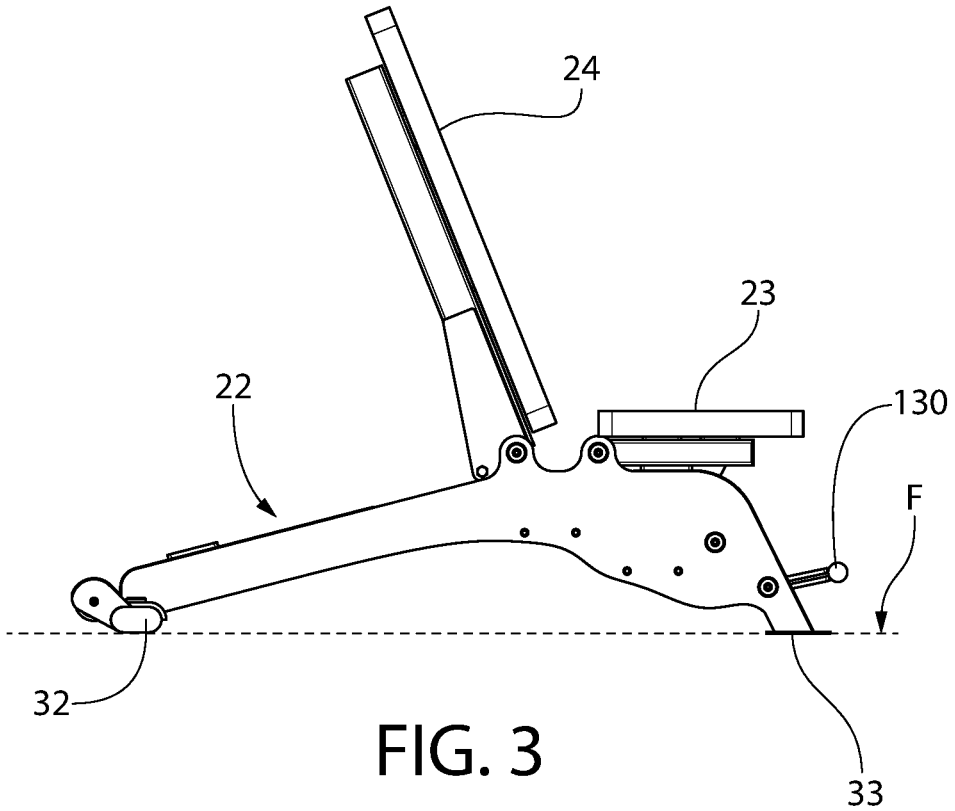
FIG. 3 is a right side view thereof.
Figure 5:
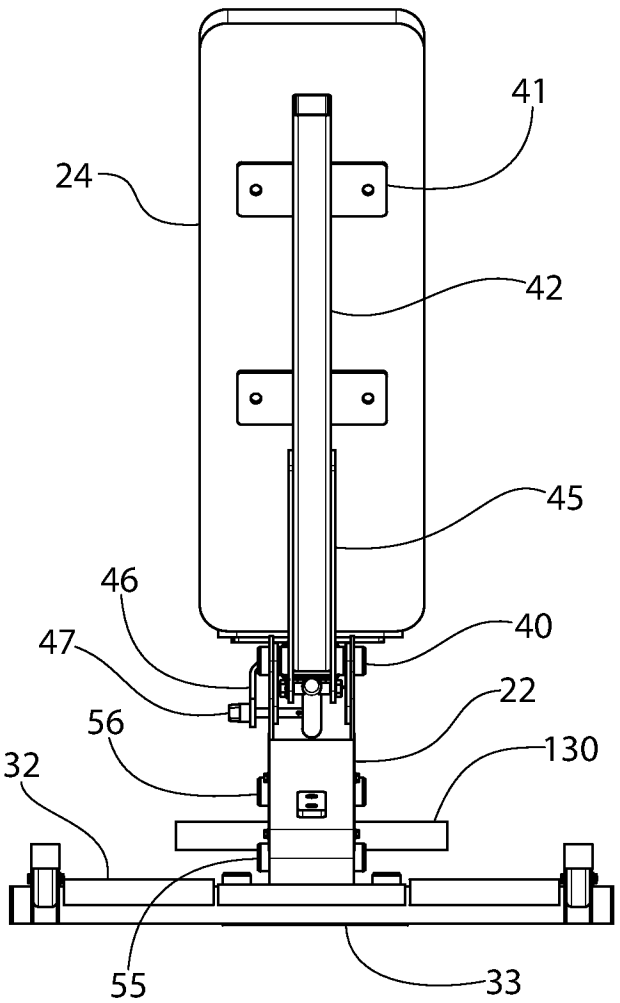
FIG. 5 is a rear view thereof.
Figure 4:
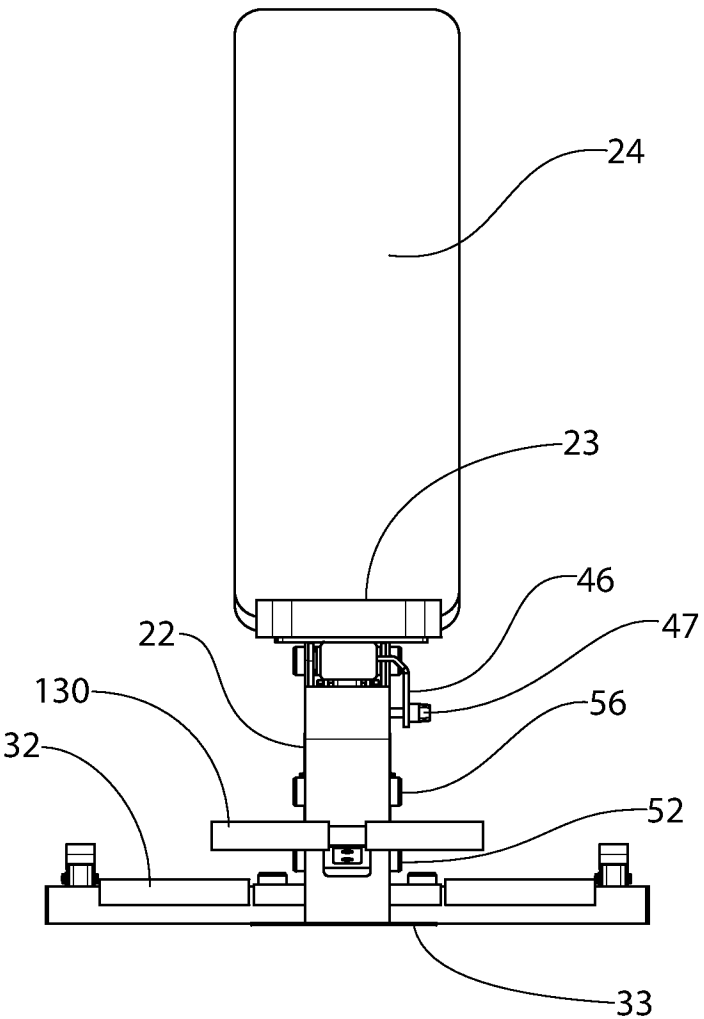
FIG. 4 is a front view thereof.
Figure 6:
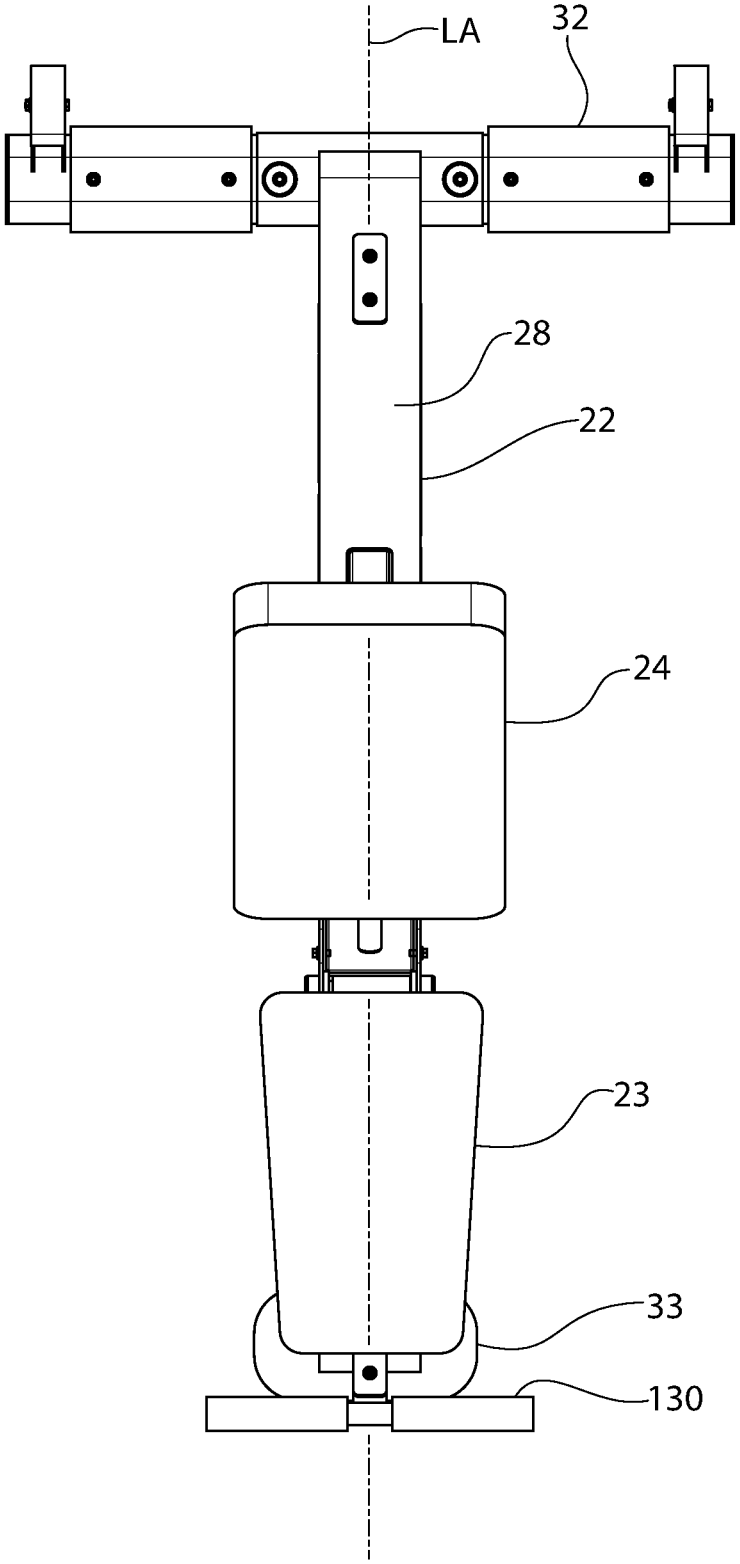
FIG. 6 is a top view thereof.
Figure 7:
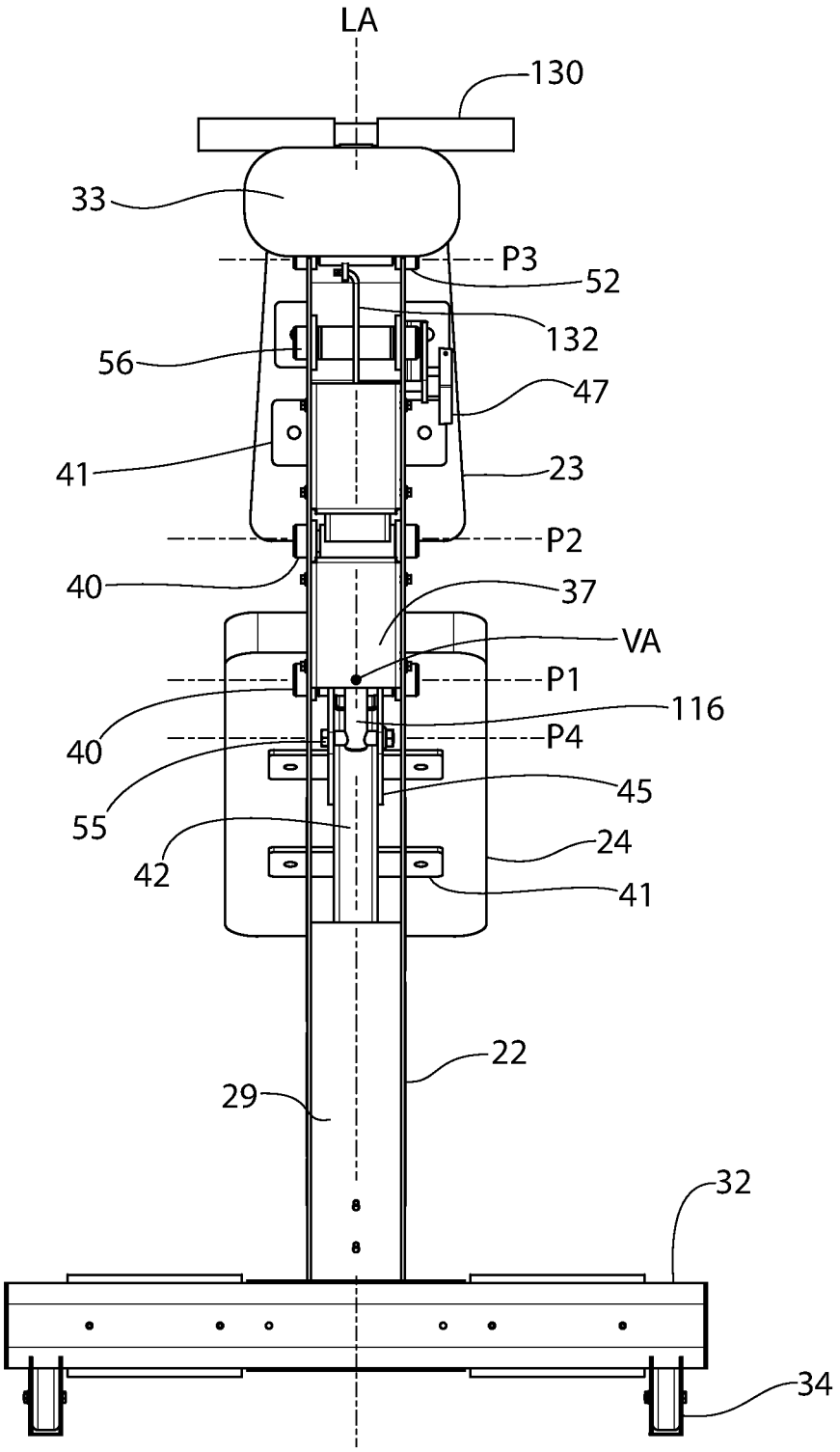
FIG. 7 is bottom view thereof.
Figure 56:
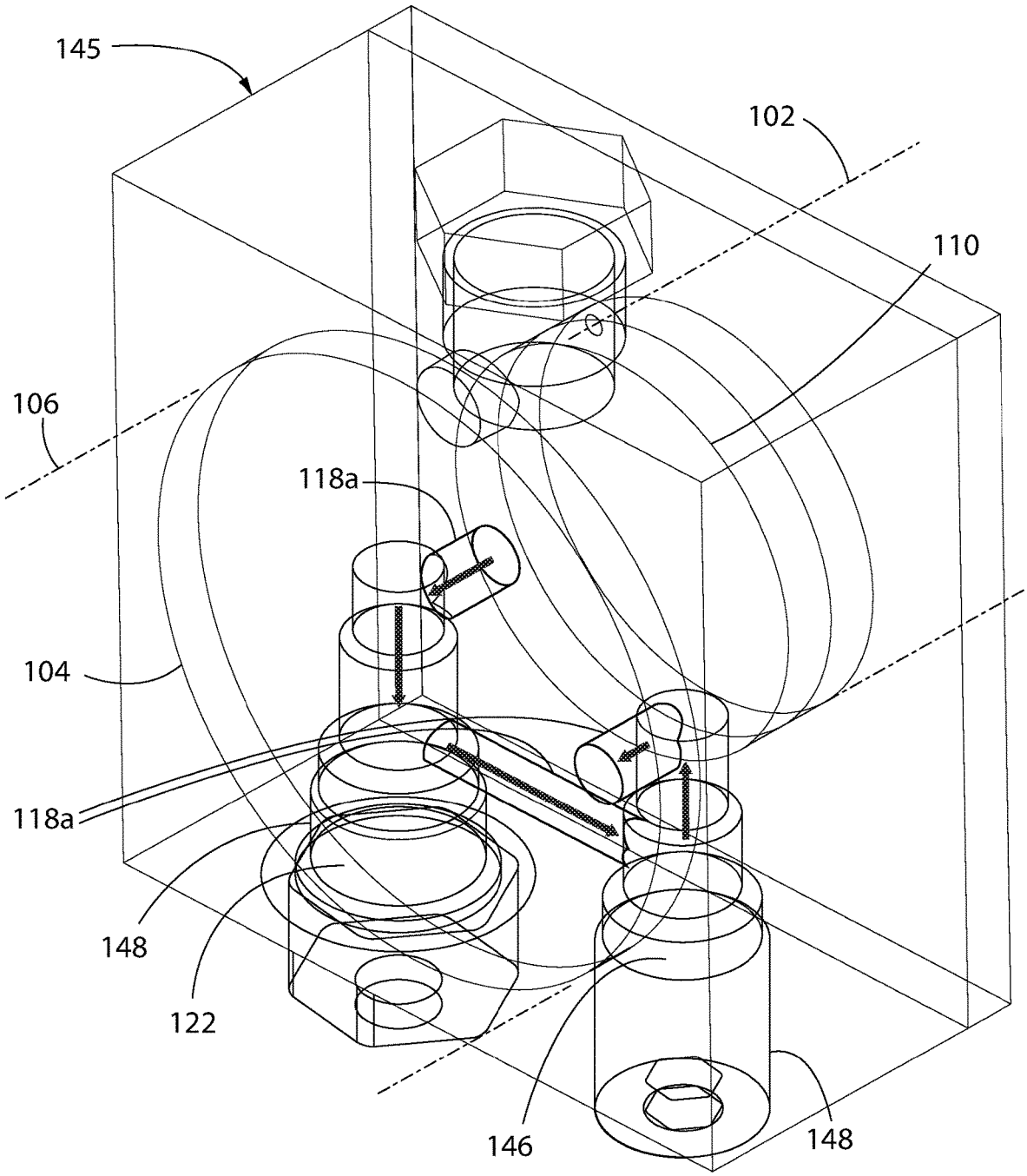
FIG. 56 is a perspective view thereof showing the interior components and flow paths.
Figure 57:
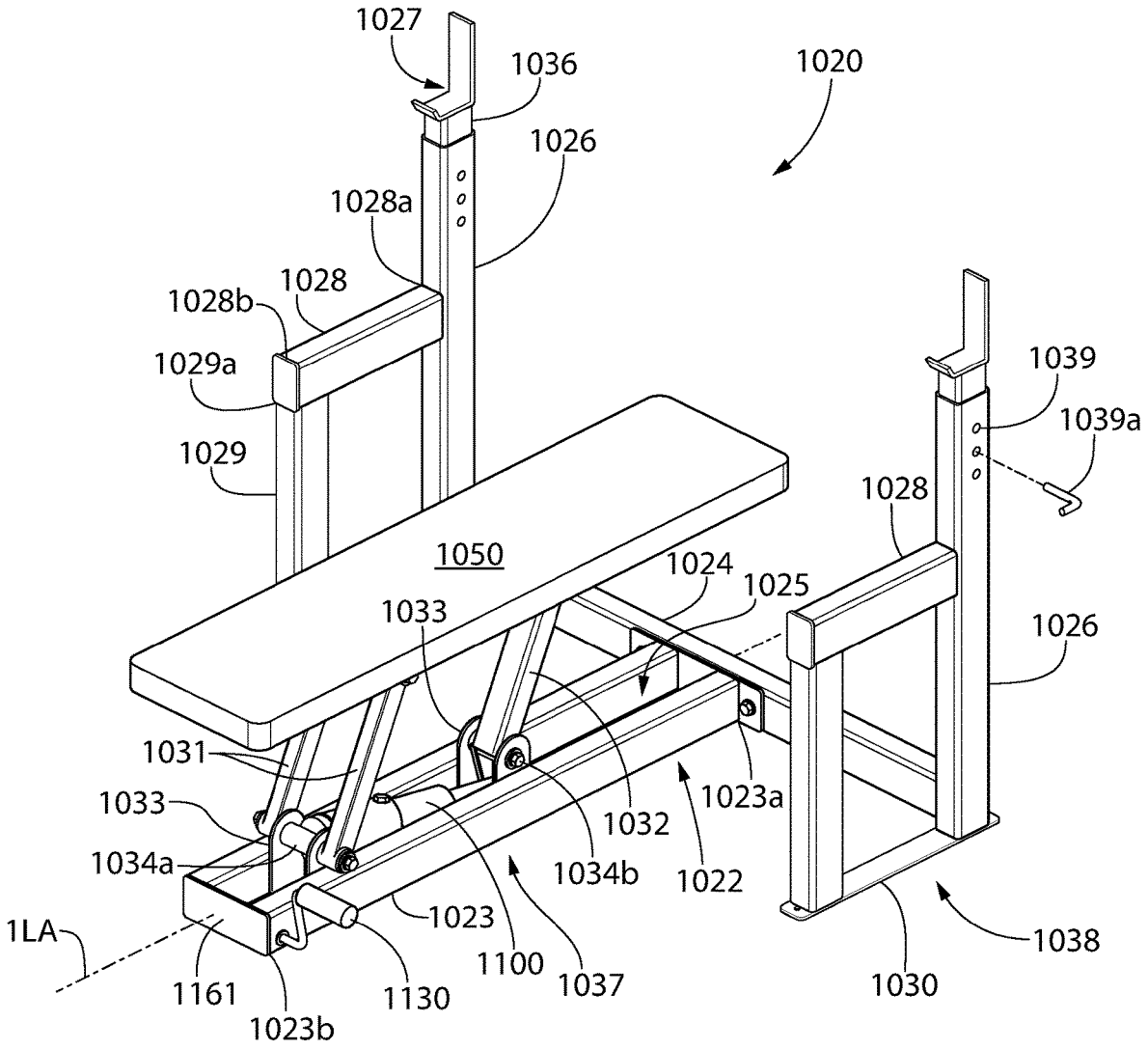
FIG. 57 is a front perspective view of an embodiment of a flat weight lifting bench with automatic bench return and bench descent control mechanisms according to the present disclosure including a bench pad assembly and attached weight rack.
Figure 58:
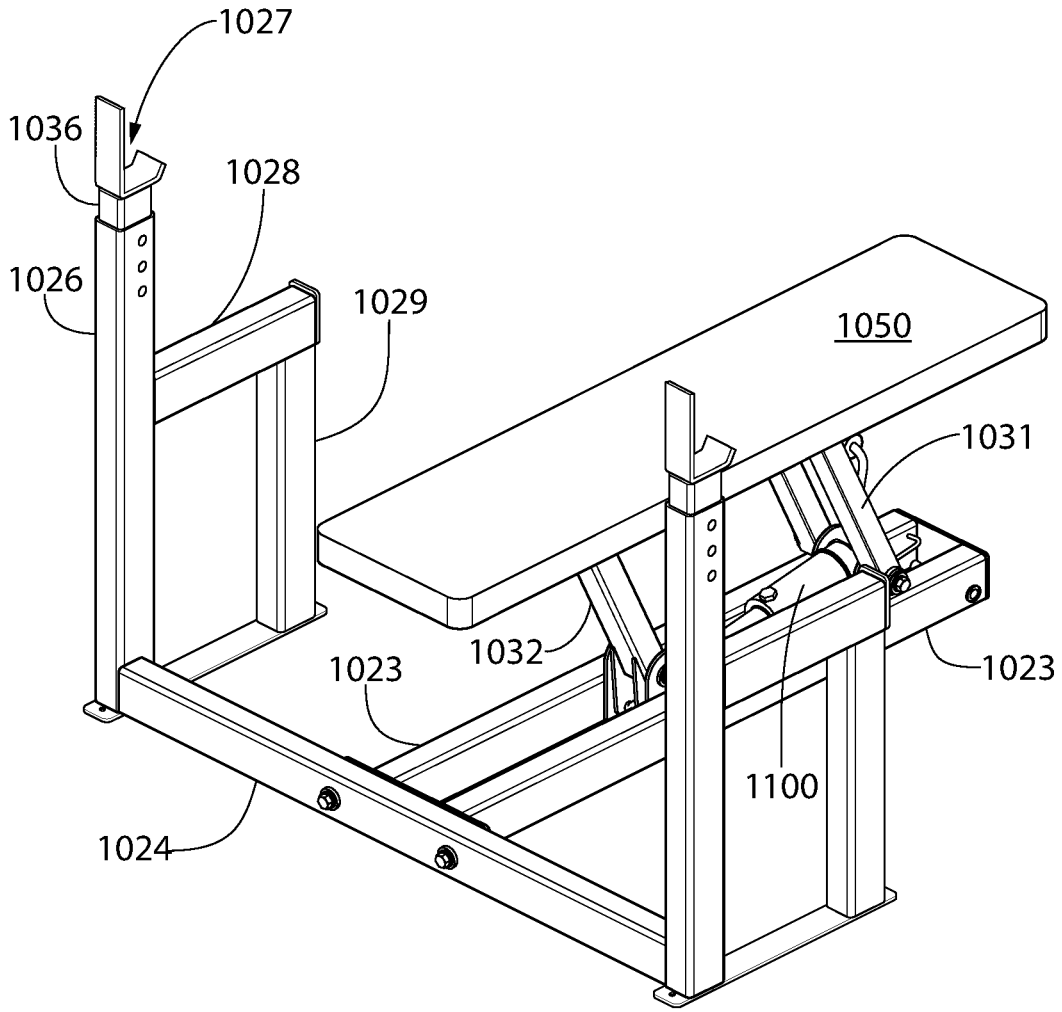
FIG. 58 is a rear perspective view thereof.
Figure 59:
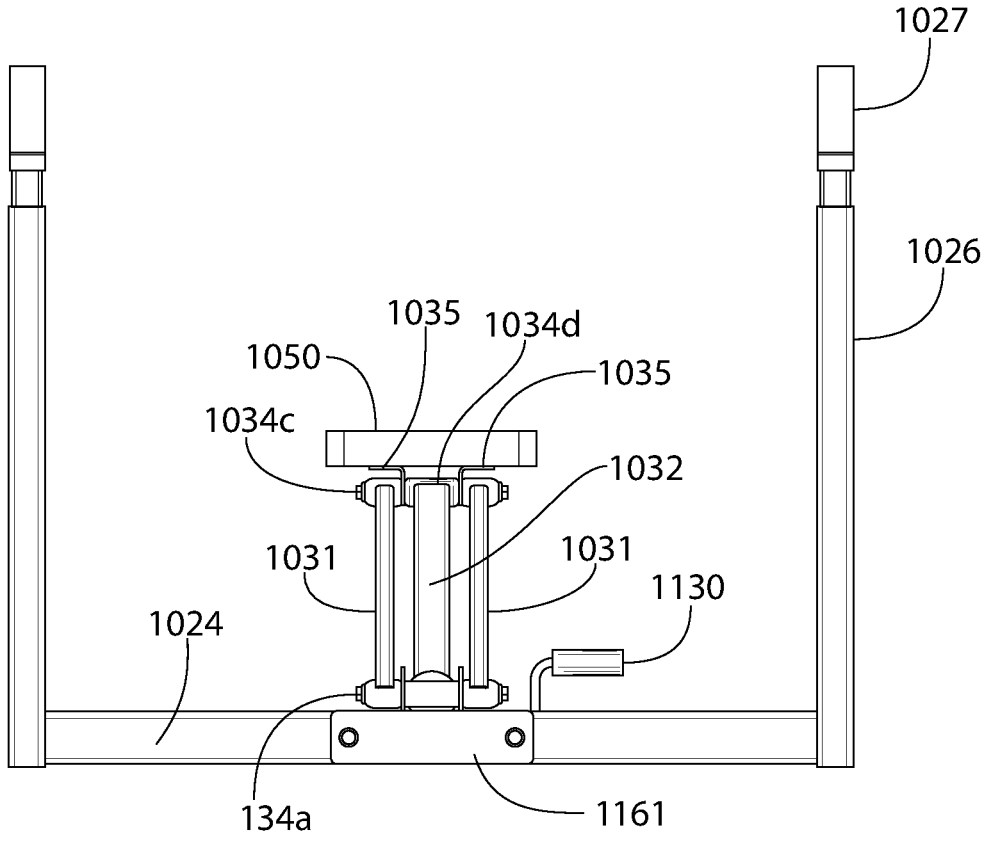
FIG. 59 is a front view thereof.
Figure 60:
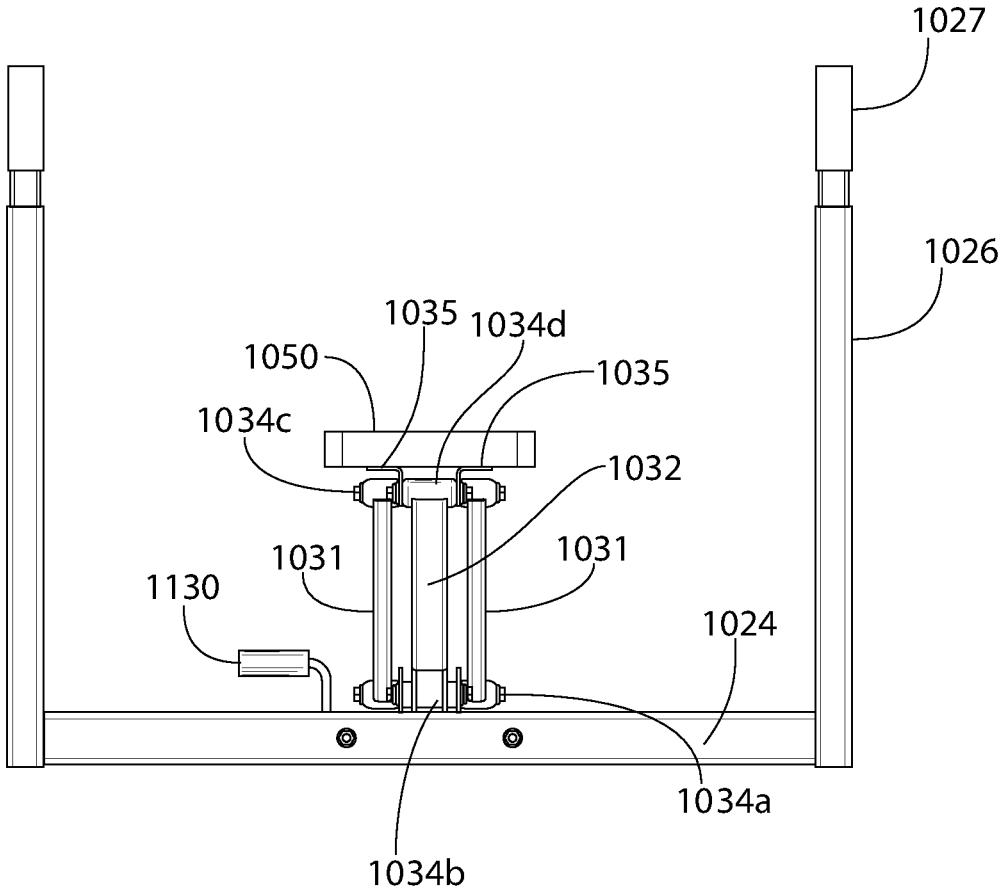
FIG. 60 is a rear view thereof.
Figure 61A:
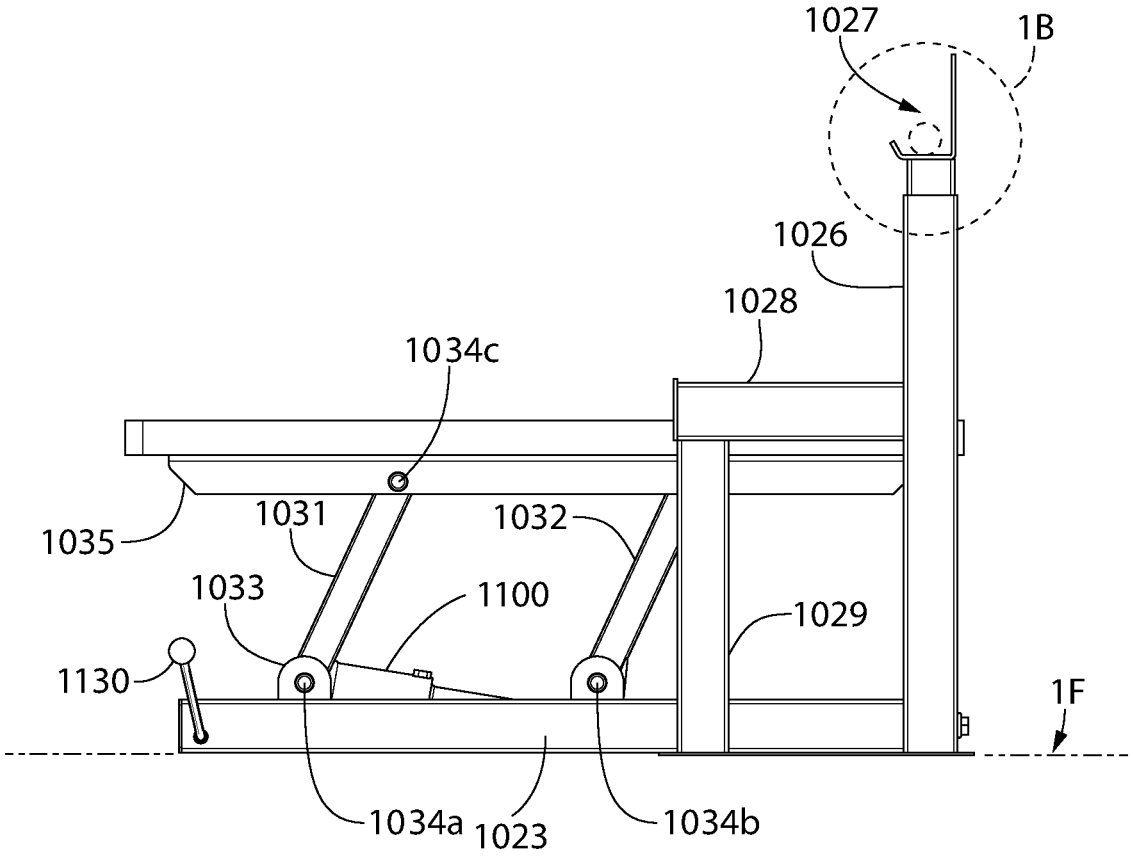
FIG. 61A is a right side view thereof with bench in a first position.
Figure 61B:
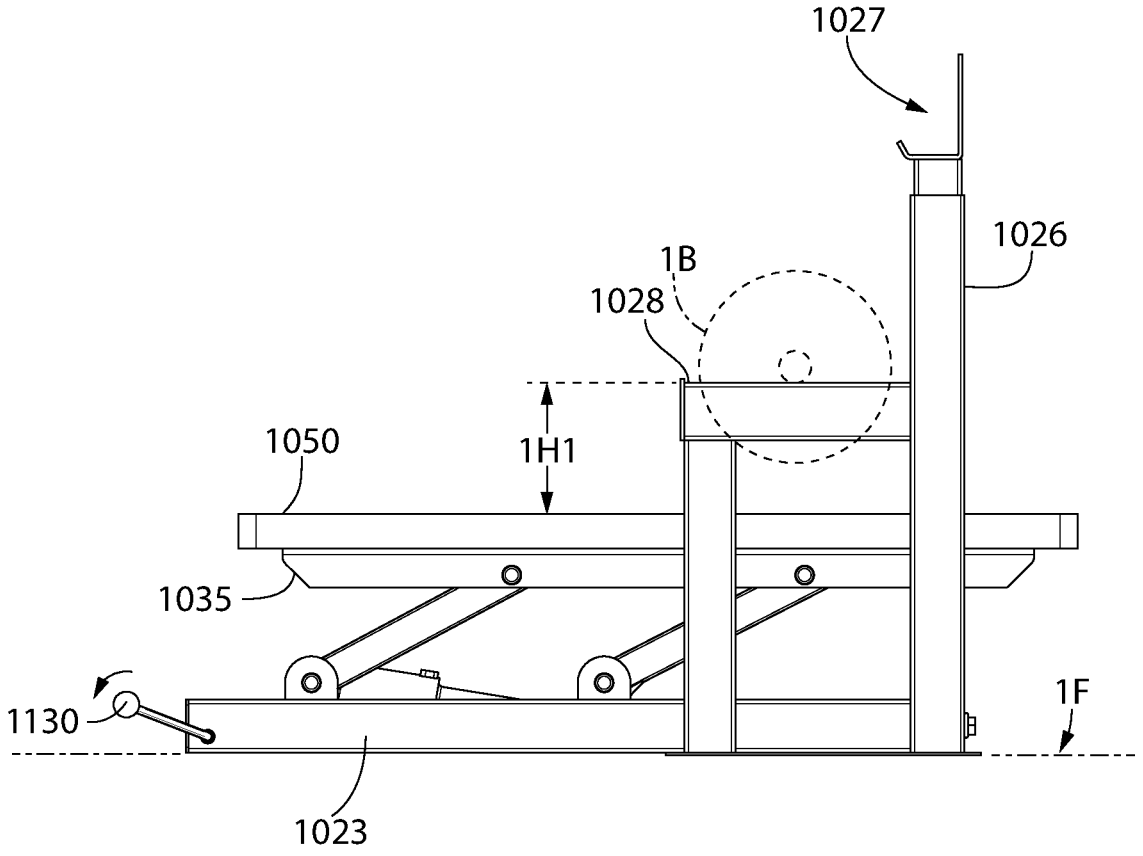
FIG. 61B is a right side view thereof with bench in a second lowered position.
Figure 62:
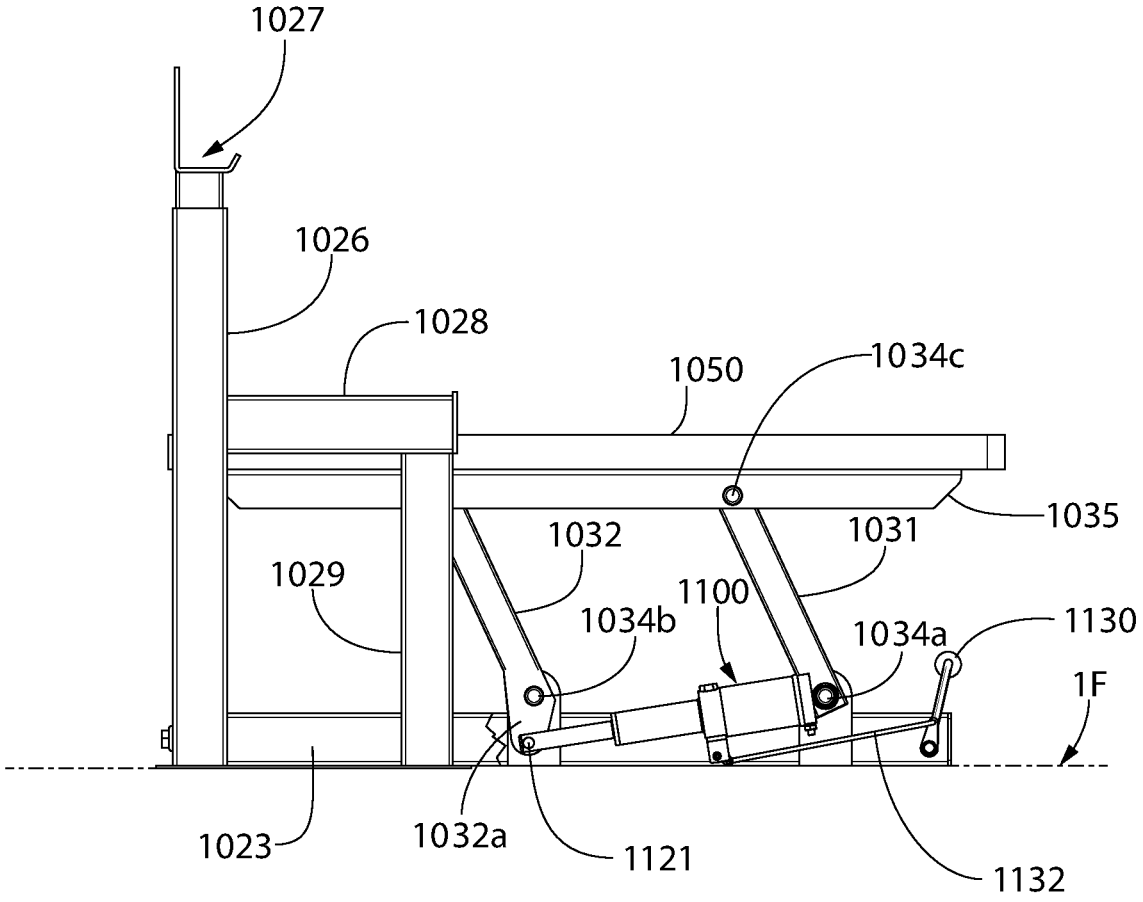
FIG. 62 is a left side view thereof.
Figure 63:
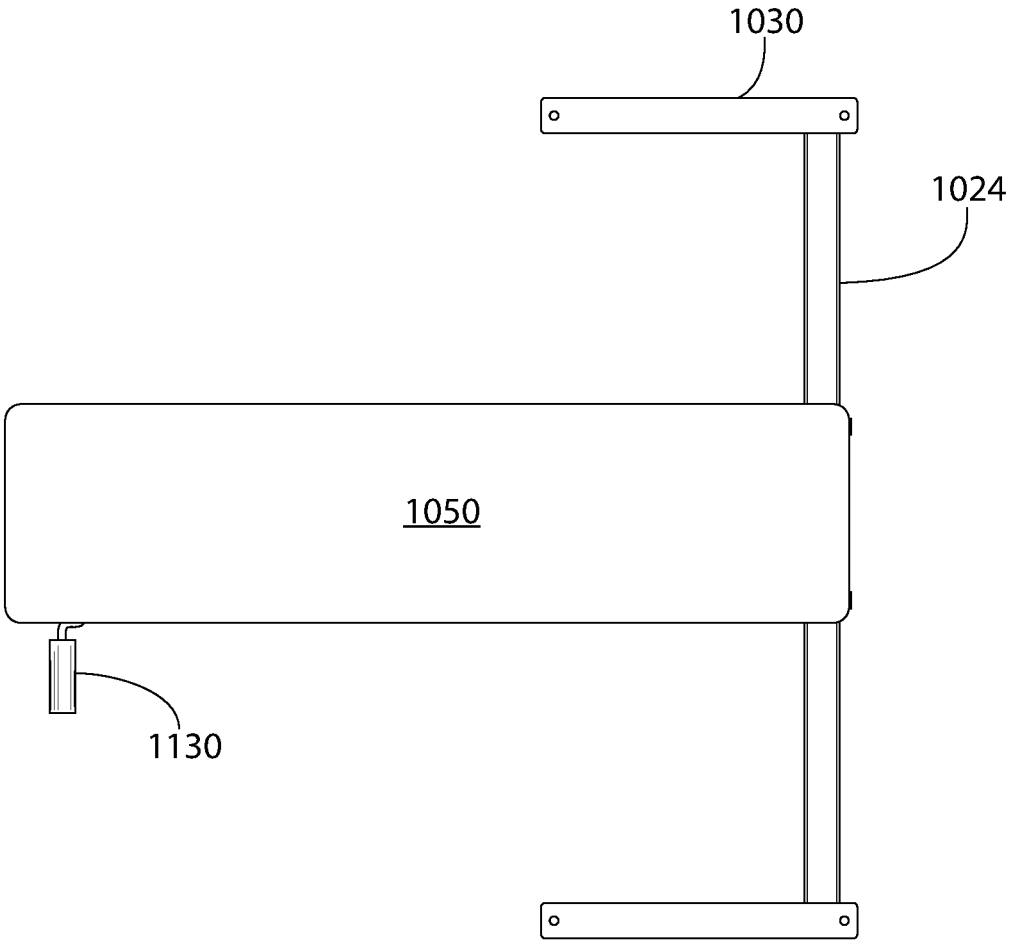
FIG. 63 is a top view thereof.
Figure 64:
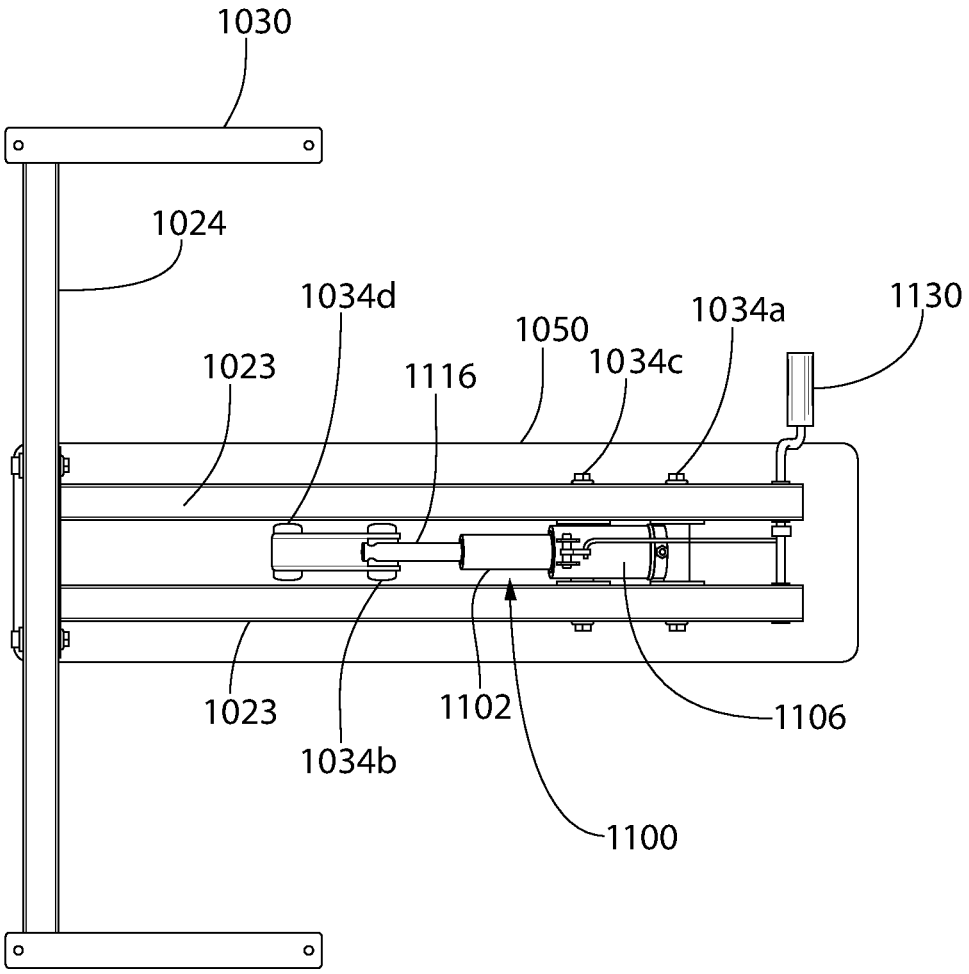
FIG. 64 is a bottom view thereof.
Figure 65A:
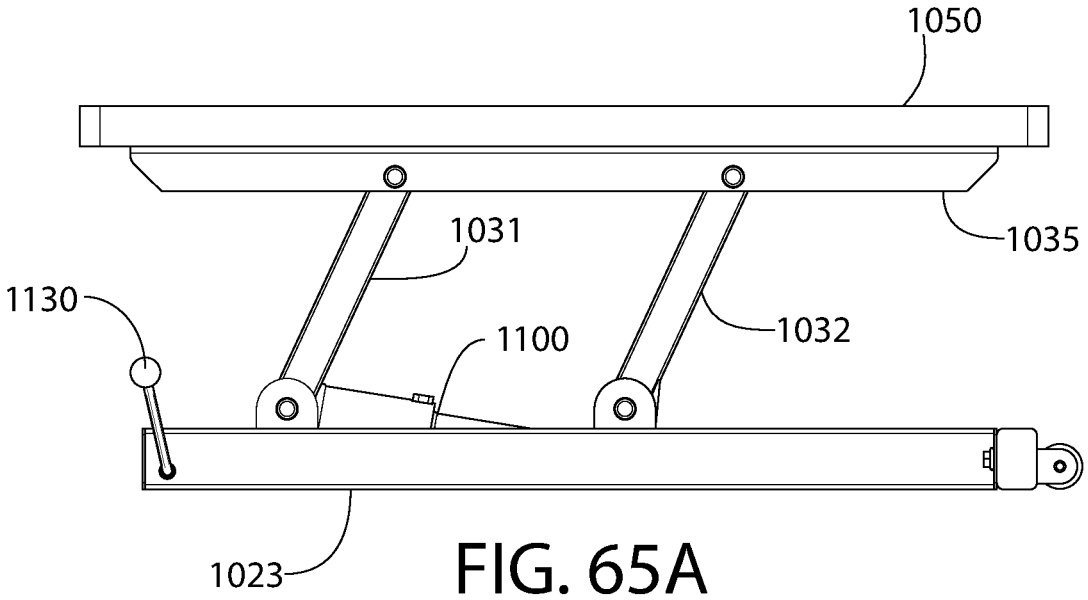
Figure 65B:
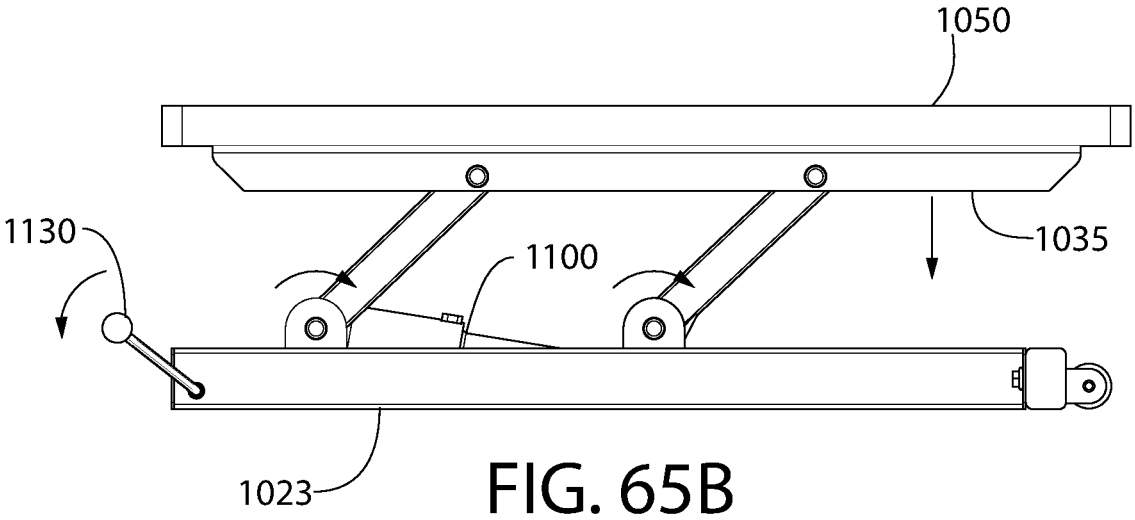
Figure 65C:
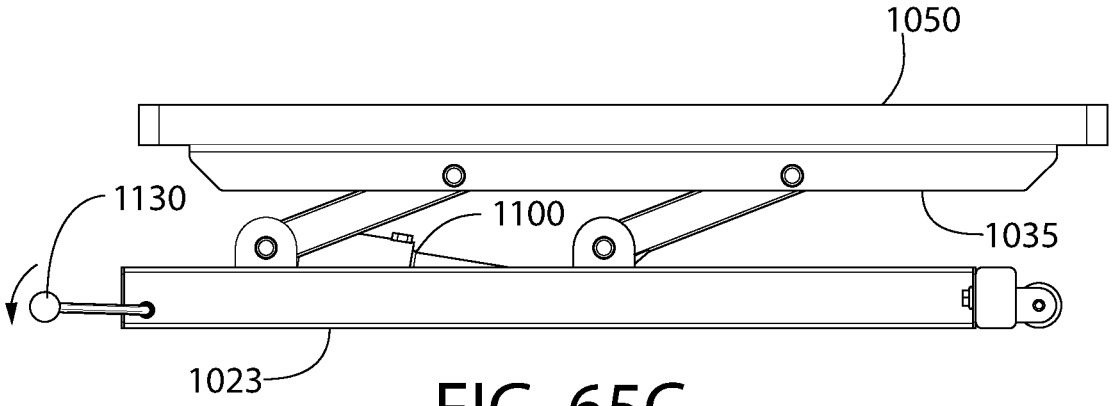
Figure 66:
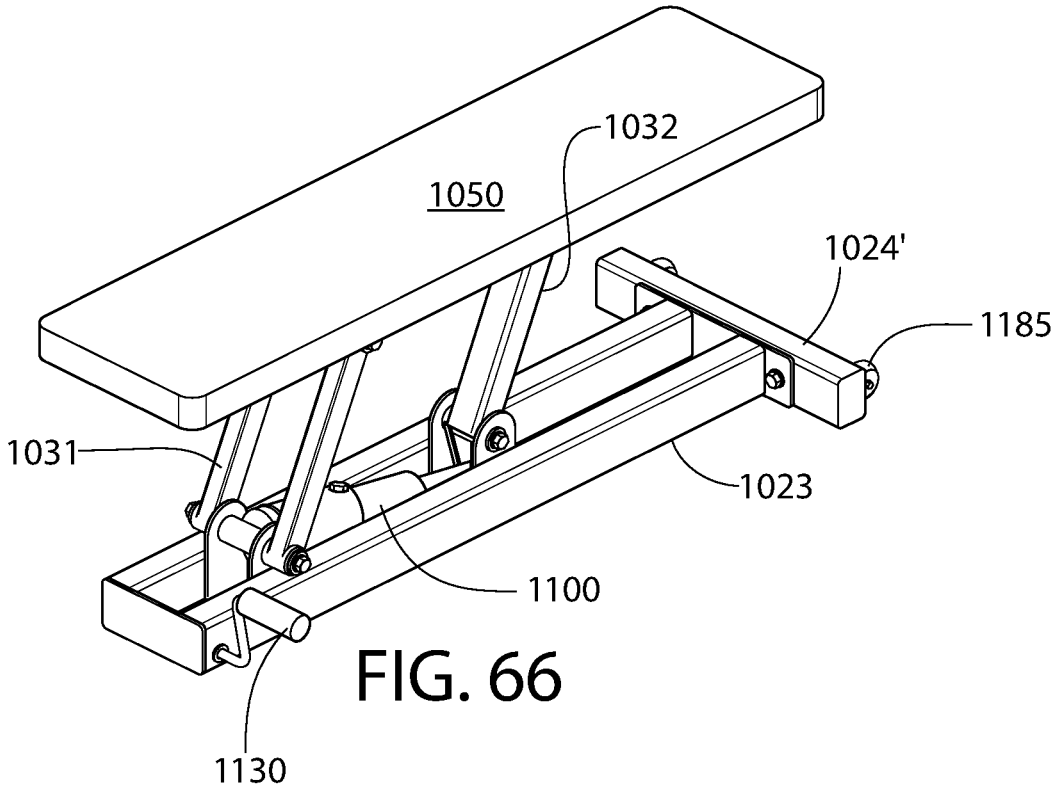
FIG. 66 is a front perspective view of the bench of FIGS. 65A-C.
Figure 67:
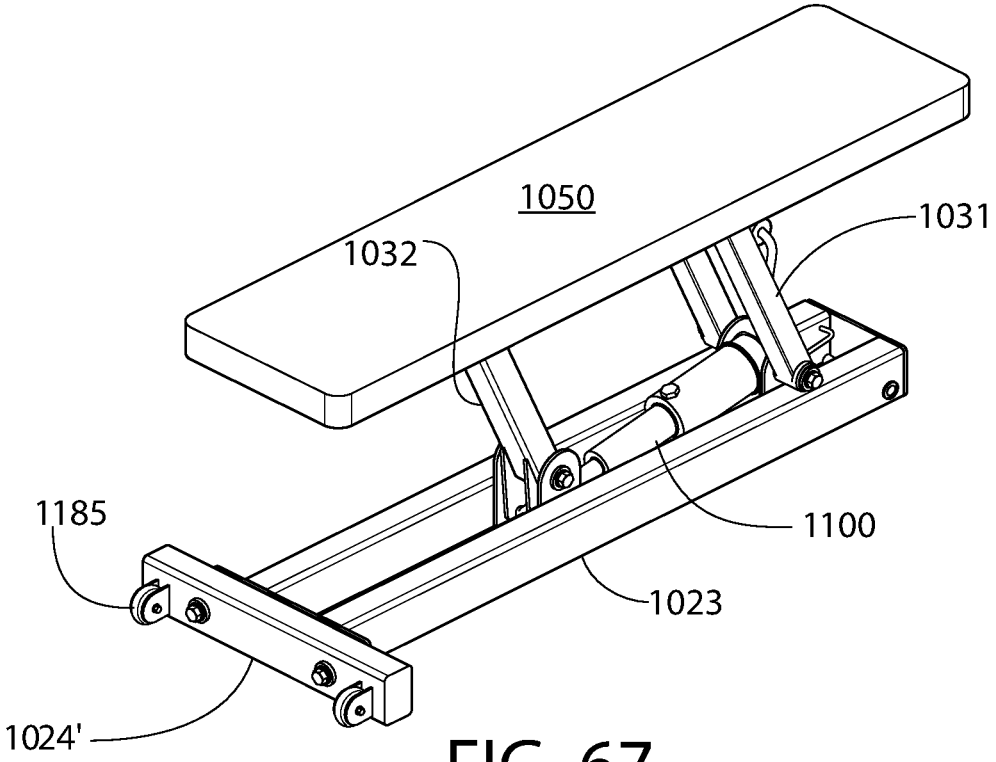
FIG. 67 is a rear perspective view thereof.

Multiple inventive concepts are described herein and are distinguished from one another using headers in the description that follows. Specifically, FIGS. 1-56 are relevant to a First Inventive Concept, FIGS. 57-126 are relevant to a Second Inventive Concept, and FIGS. 127-140 are relevant to a Third Inventive Concept. These Inventive Concepts should be considered in isolation from one another. It is possible that there may be conflicting language or terms used in the description of the First through Third Inventive Concepts. For example, it is possible that in the description of the First Inventive Concept a particular term may be used to have one meaning or definition and that in the description of the Second Inventive Concept the same term may be used to have a different meaning or definition. In the event of such conflicting language, reference should be made to the disclosure of the relevant Inventive Concept being discussed. Similarly, the section of the description describing a particular Inventive Concept being claimed should be used to interpret claim language when necessary.

First Inventive Concept—Adjustable Angle Weight Lifting Bench

FIGS. 1-16 depict a non-limiting embodiment of an angularly adjustable exercise bench in the form of weight lifting bench 20 according to the present disclosure. Bench 20 incorporates features and operability of a flat, incline, and decline benches in a single machine. Advantageously, this provides a multitude of user-adjustable angles for the bench back pad in various configurations to work different portions or groups of muscles. In one preferred embodiment, the bench 20 and it hydraulic control system are configured to provide hands-free adjustment of the angular orientation of the back pad in relation to the bench frame.

Adjustable weight lifting bench 20 may be configured as a free standing "utility" bench which is useable on its own or with multiple different weight rack configurations for performing different types of weight lifting exercise routines. In other embodiments, as another example, the bench 20 may instead be incorporated into the frame of the weight rack Bench 20 generally includes a bench frame 22 and an elongated user bench pad 21 comprising a separate seat pad 23 and back pad 24 each supported independently by the frame, as further described herein. At least the back pad 24 is preferably angularly adjustable in orientation relative to the frame 22 and seat pad 23. The bench 20 further includes an hydraulic support mechanism such as hydraulic cylinder 100 described below which acts as an infinitely adjustable support that maintains the back pad 24 one of a plurality of user selectable angular positions (see, e.g. FIGS. 12-16).

Frame 22 is configured for placement on a horizontal surface such as a floor F. For convenience of reference, the frame 22 may be considered to define a horizontal longitudinal axis LA extending between the front and rear ends 26, 27 and a corresponding axial direction. Frame 22 also defines a vertical axis VA which intersects and is oriented orthogonally to the longitudinal axis. The longitudinal and vertical axes intersect at the pivot axis P1 of the back pad 24 of the bench 20 (formed by cross bolt 40 described below) which serves as a convenient reference location for explaining the angular motions of the back pad as further elaborated herein. A lateral or transverse direction is defined as being orthogonally transverse to the longitudinal axis for convenience of reference also.

The frame 22 includes a front end 26, rear end 27, opposing lateral sides 30, top 28, and bottom 29. In one embodiment, frame 22 has an at least partially enclosed configuration defining an internal cavity 36 which may extend for a majority of the axial length of the frame. Cavity 36 conceals and protects various appurtenances therein which may include portions of the operating lever mechanism and hydraulic support mechanism each further described herein. To provide structural stability, the frame may include one or more internal lateral supports 37 of any suitable configuration which are disposed in internal cavity 36. Supports 37 extend transversely and are fixedly attached to the frame between the lateral sides 30. The lateral supports may be fixedly attached the sides 30 by any suitable method used in the art, such as without limitation fasteners (see, e.g. FIGS. 8 and 9), welding, soldering, etc. Any suitable number of lateral supports 37 may be provided.

To facilitate placement on the floor and for stability when performing an exercise routine or adjusting the bench pad position, frame 22 may include a transversely/laterally extending front base member 33 affixed to front end 26 and a transversely/laterally extending rear base member 32 affixed to rear end 27. The front and rear base members 33, 32 may each have a lateral width (measured in the direction transverse to longitudinal axis LA) which is greater than the lateral width of the frame measured between the opposing lateral sides 30. Accordingly, the front and rear base members 33, 32 may each have right and left portions which extend laterally beyond the lateral sides 30 of the frame. In one embodiment, front base member 33 has a smaller width than rear base member 32 to avoid interfering with user access and the feet of the user when positioned on the bench. The base members 33, 32 may have any suitable configuration and dimension selected for bench stability and aesthetics. In one embodiment, the rear base member 32 may include a pair of wheels 34 to facilitate transport of the bench 20.

In one non-limiting embodiment, the frame 22 may only rest on the horizontal support surface or floor F at the front and rear ends 26, 27 via base members 33 and 32. The intermediate portion 39 of the frame 22 defined between the ends may therefore be spaced apart and does not contact the floor, as shown for example in the illustrated embodiment. In other implementations contemplated, the intermediate portion 39 may engage the floor at various portions. The shape of the intermediate portion 39 and engagement or non-engagement with the floor does not limit the invention.

Frame 22 may be made of any suitable metallic or non-metallic material, or a combination thereof having sufficient structural strength for supporting a user, weight held and lifted by the user (e.g. barbells), and bench pad 21. In one embodiment, the frame may be made of entirely of metal such as steel, aluminum, titanium, or other suitable metals. The material selected does not limit the invention.

In one embodiment, back pad 24 is pivotably coupled to frame 24 for movement into a plurality of user-adjustable and lockable angular positions. The pivot linkage mechanism may include a rear strut 42 pivotably connected at a lower end to frame 22 via transversely oriented cross bolt 40 which forms a pivot. Cross bolt 40 extends laterally through opposite sides of rear strut 42 and defines a pivot axis P1 of the back pad 24. Each end of the cross bolt 40 is received through mating laterally spaced apart mounting holes 43 in the lateral sides 30 of the frame 22. The lower end of the rear strut 42 may include enlarged laterally spaced apart angular gusset plates 45 attached to rear strut 42 to strengthen the back pad support and facilitate creation of the pivot connection. The cross bolt 40 extends through the gusset plates. To structurally reinforce the frame at the pivot mounting locations, reinforcing weldments 44 of a suitable shape may be welded to inside of the frame's lateral sides 30 which also have mounting holes that become concentrically aligned with the frame's mounting holes for receiving the cross bolt 40.

The upper portions of the rear strut 42 above the pivot axis P1 are fixedly attached to the underside of the back pad such as via spaced apart mounting tabs 41 using fasteners or another suitable fixed type mounting arrangement. The rear strut 42 has a sufficient length and width to sufficiently support for the back pad 24 which may be laterally wider than the rear strut as illustrated. It bears noting that the top 28 of the bench frame 22 may be sloped in a downwards direction to the rear of pivot axis P1 to allow the full decline position to be reached (see, e.g. FIG. 16). Portions of the frame 22 forward of pivot axis P1 may have any suitable shape including horizontal or flat as shown. Other shapes and configurations of the frame are possible.

In one embodiment, seat pad 23 may also be pivotably coupled to frame 24 using the same basic construction and features as the back pad 24 pivot connection described above. Seat pad 23 includes an axially elongated seat bracket 35 attached to the underside of the pad such as via mounting tabs 41 using threaded fasteners. Bracket 35 has a front and rear end. The rear end is pivotably mounted to the top 28 of the frame 22 by a second cross bolt 40 that defines a second pivot axis P2 for moving the seat pad into a plurality of user-adjustable angular positions upwards towards the back pad 24. Laterally spaced apart holes 43 in the frame and reinforcing weldments 44 if provided receive the cross bolt.

To adjust and lock the seat pad 23 into a multitude of angular positions with respect to the frame 22, an adjustment bracket 46 has a top end attached to the underside of seat pad 23 and an opposite bottom end positioned adjacent to one of the lateral sides 30 of the bench frame. The bottom end defines a locking hole 49 which may be concentrically aligned with a series of mating locking apertures 48 formed in the lateral side 30 (best shown in FIG. 8). After a selected angular position of the seat pad 23 is selected, a lock pin 47 is inserted through the locking hole 49 and aperture 48 to lock the seat pad in position. In one embodiment, the seat pad may be adjusted from a horizontal position (parallel to longitudinal axis LA) to a selected number of angular positions obliquely angled with respect to the top 28 of the frame 22. Although adjustment bracket 46 may have a generally L-shaped configuration as shown, other suitable configurations of the bracket may be used so long as at least the foregoing functionality is retained.

In the non-limiting illustrated embodiment, both the seat pad and back pad are angularly adjustable. In other possible embodiments, the seat pad 23 may be fixedly attached to the frame in a single angular position or orientation.

Bench 20 may utilize the hydraulic cylinder assembly 100 describe below having either of the valve configurations for a pressure compensating valve assembly 145 or user adjustable flow control plunger valve 150, both of which may incorporate the safety feature of a speed control mechanism to regulate the rate of descent of the back pad 24 in a controlled slow manner. The adjustable bench 20 may further incorporate the auto-return feature which automatically returns the back pad 24 to the uppermost position from any of the positions below the uppermost one simply when the user releases the foot lever or pedal 130.

Using any of the hydraulic control systems described below which provide a support mechanism for the back pad 24, the back pad is adjustable and lockable into a plurality of user-selected angular positions ranging from an uppermost incline position to a lowermost decline position, and a continuum of possible intermediate angular positions therebetween as illustrated in FIGS. 12-16. The lowermost decline position provides an escape position to combat user fatigue when the bench is used with a weight rack having safety bars, as further described herein.

Figure 12:
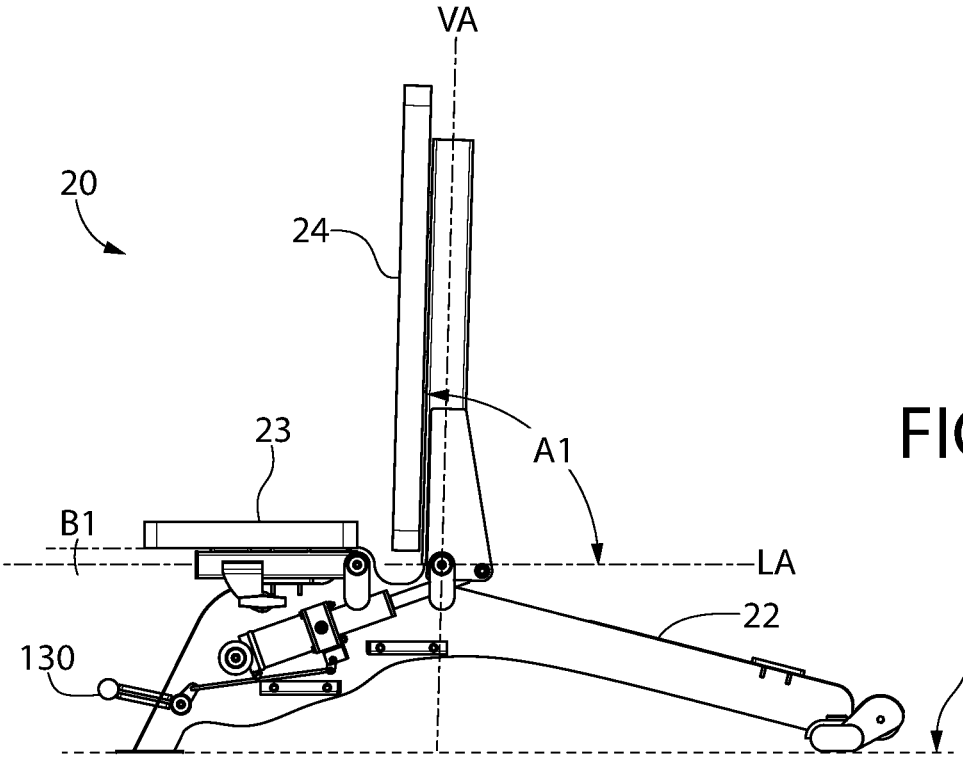
FIG. 12 is a left side view of the bench showing the back pad in an uppermost incline position.

FIG. 12 shows back pad 24 in the uppermost incline position. The back pad is position above the longitudinal axis LA. In one embodiment, the uppermost incline position may be substantially vertical as shown with the back pad being oriented parallel to vertical axis VA and perpendicular to the horizontal longitudinal axis LA at a first angle A1 of 90 degrees. The back pad is locked into position by its hydraulic support mechanism described below. Seat pad 23 is horizontal and disposed parallel to longitudinal axis LA at an angle B1 of 0 degrees.

As the terms are used herein, an incline positions describe the back pad positioned above the longitudinal axis LA and decline positions describe the back pad positioned below the longitudinal axis.

Figure 13:
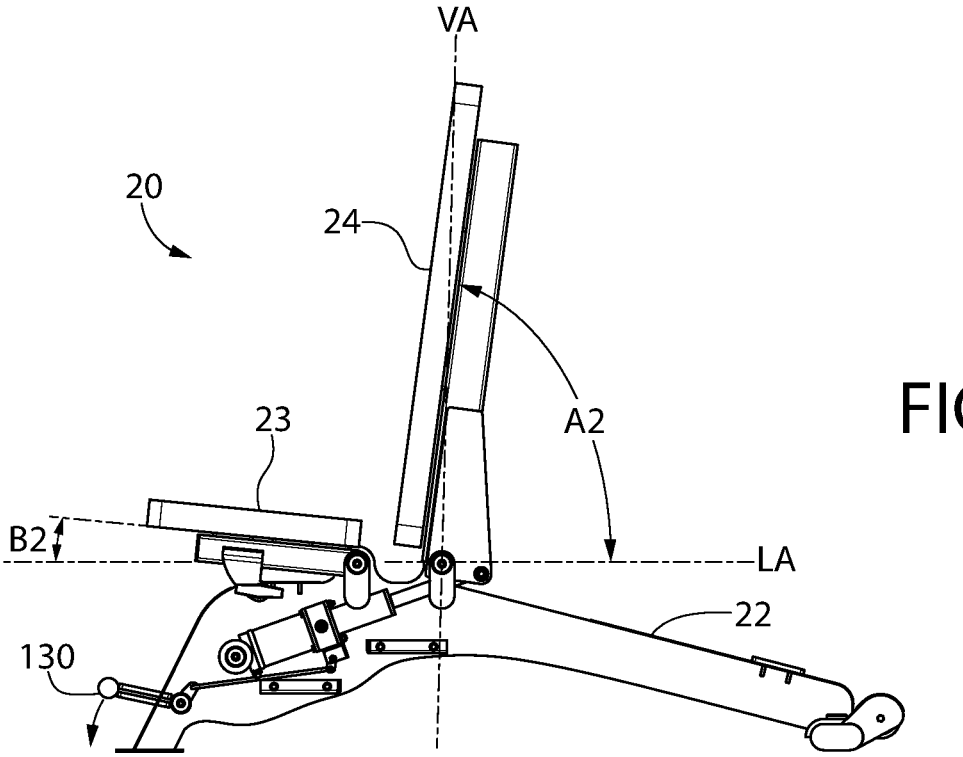
FIG. 13 is a left side view of the bench showing the back pad in a first incline position.

FIG. 13 shows back pad 24 in a possible second incline position relative to the frame 22 and floor F. The back pad 24 is lowered automatically via operation of the hydraulic support mechanism using foot pedal 130 thereby providing "hands free" operation. A second angle A2 is formed which is less than angle A1 shown in FIG. 12. Angle A2 is between 0 and 90 degrees. In this figure, the seat pad 23 is manually raised and angularly positioned at a second angle B2 relative to longitudinal axis LA.

Figure 14:
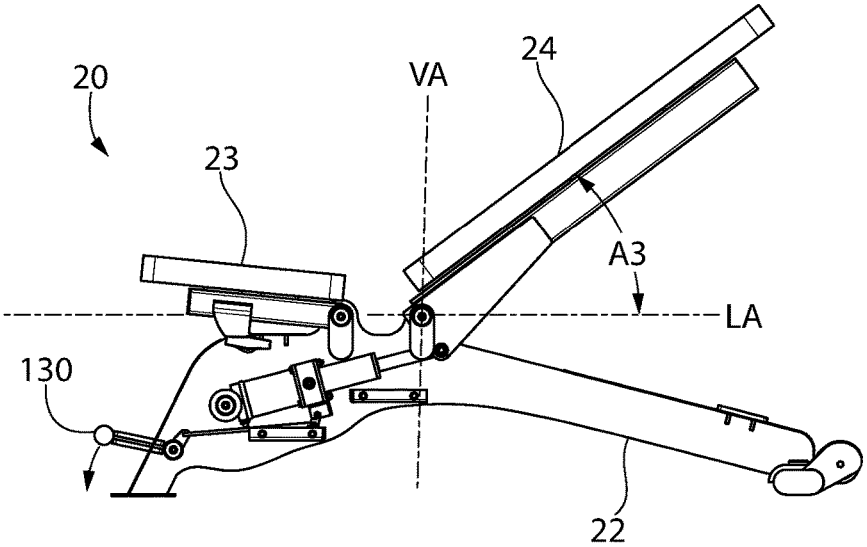
FIG. 14 is a left side view of the bench showing the back pad in a second incline position.

FIG. 14 shows back pad 24 in a possible third incline position relative to the frame 22 and floor F. A third angle A3 is formed which is less than angles A1 or A2. Angle A3 is between 0 and 90 degrees.

Figure 15:
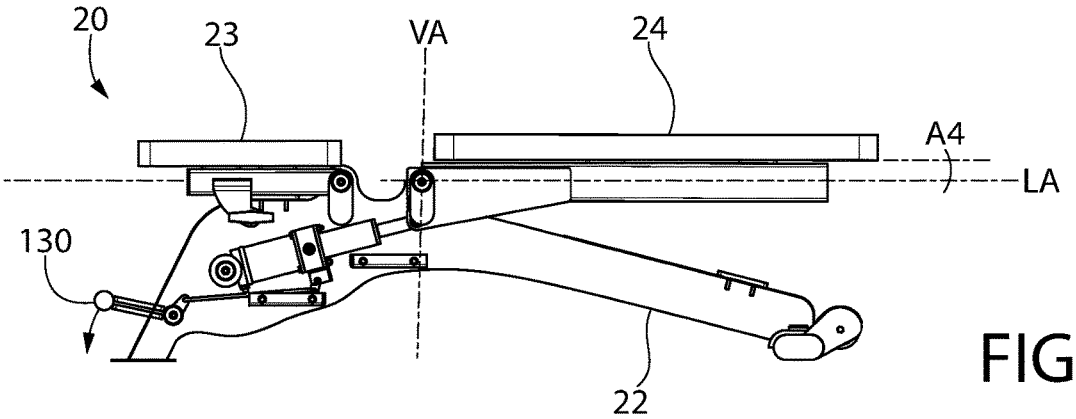
FIG. 15 is a left side view of the bench showing the back pad in a horizontal position.

FIG. 15 shows back pad 24 in a possible fourth horizontal position relative to the frame 22 and floor F. A fourth angle A4 is formed relative to longitudinal axis LA which is 0 degrees. The position allows the user to utilize the bench 20 as a conventional flat bench.

Figure 16:
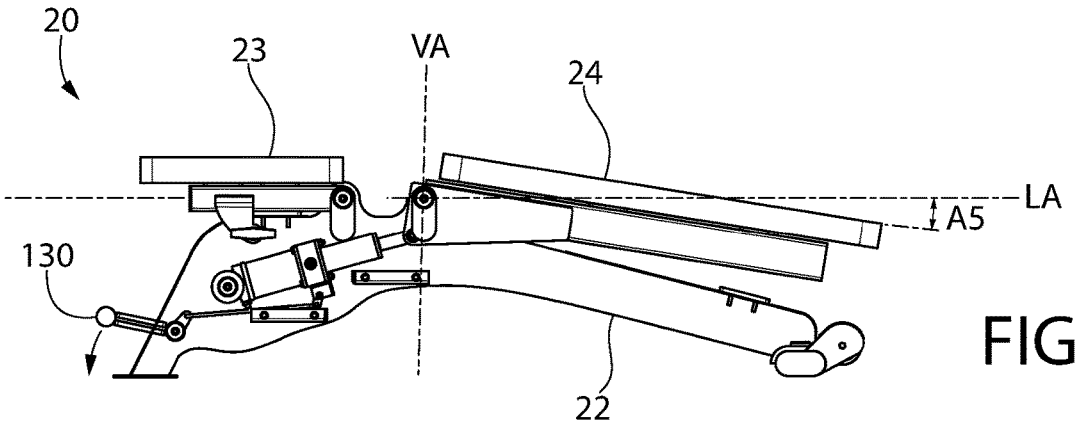
FIG. 16 is a left side view of the bench showing the back pad in a lowermost decline position.
Figure 17:
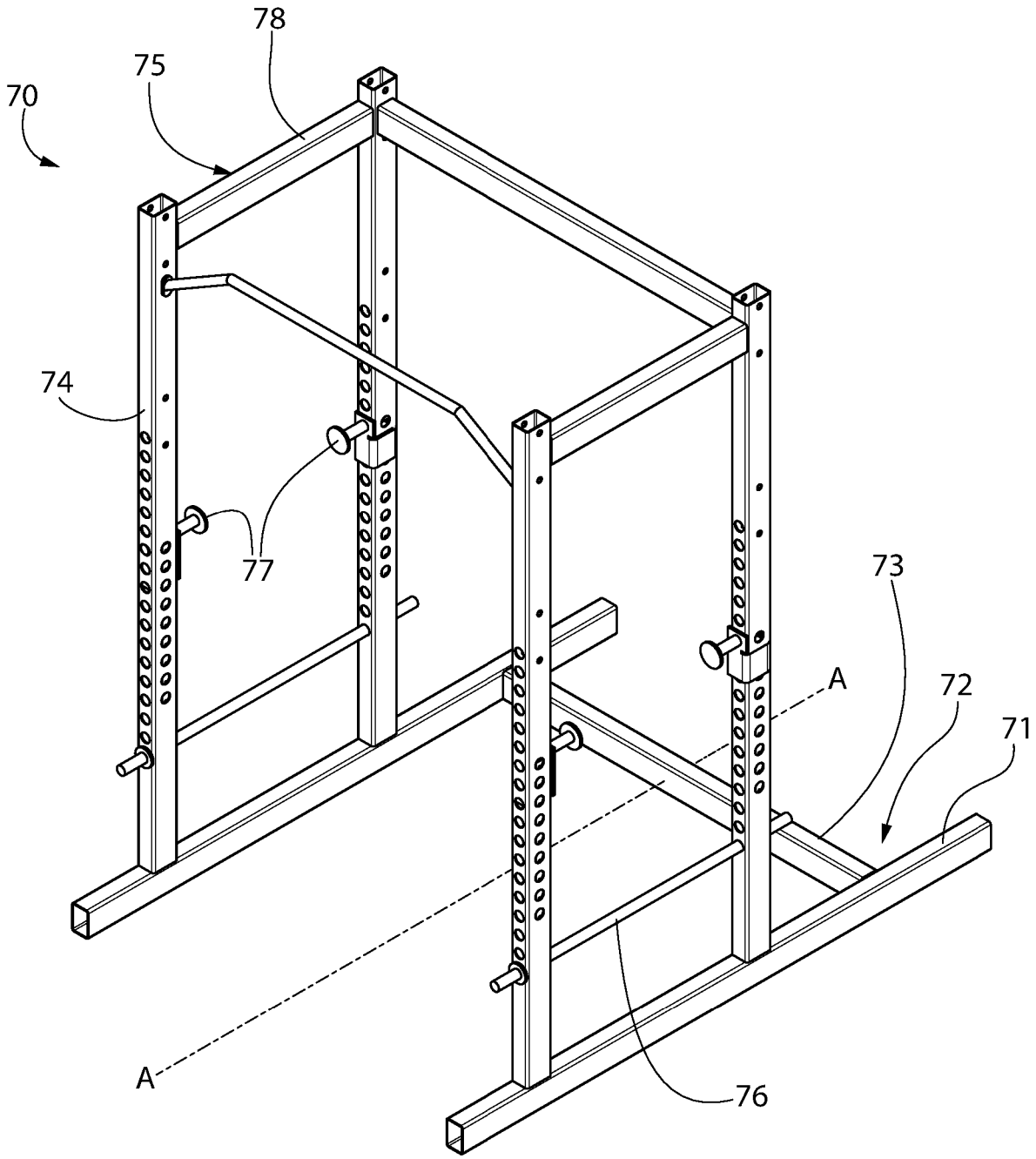
FIG. 17 is a perspective view of a power rack usable with the bench of FIG. 1.
Figure 18:
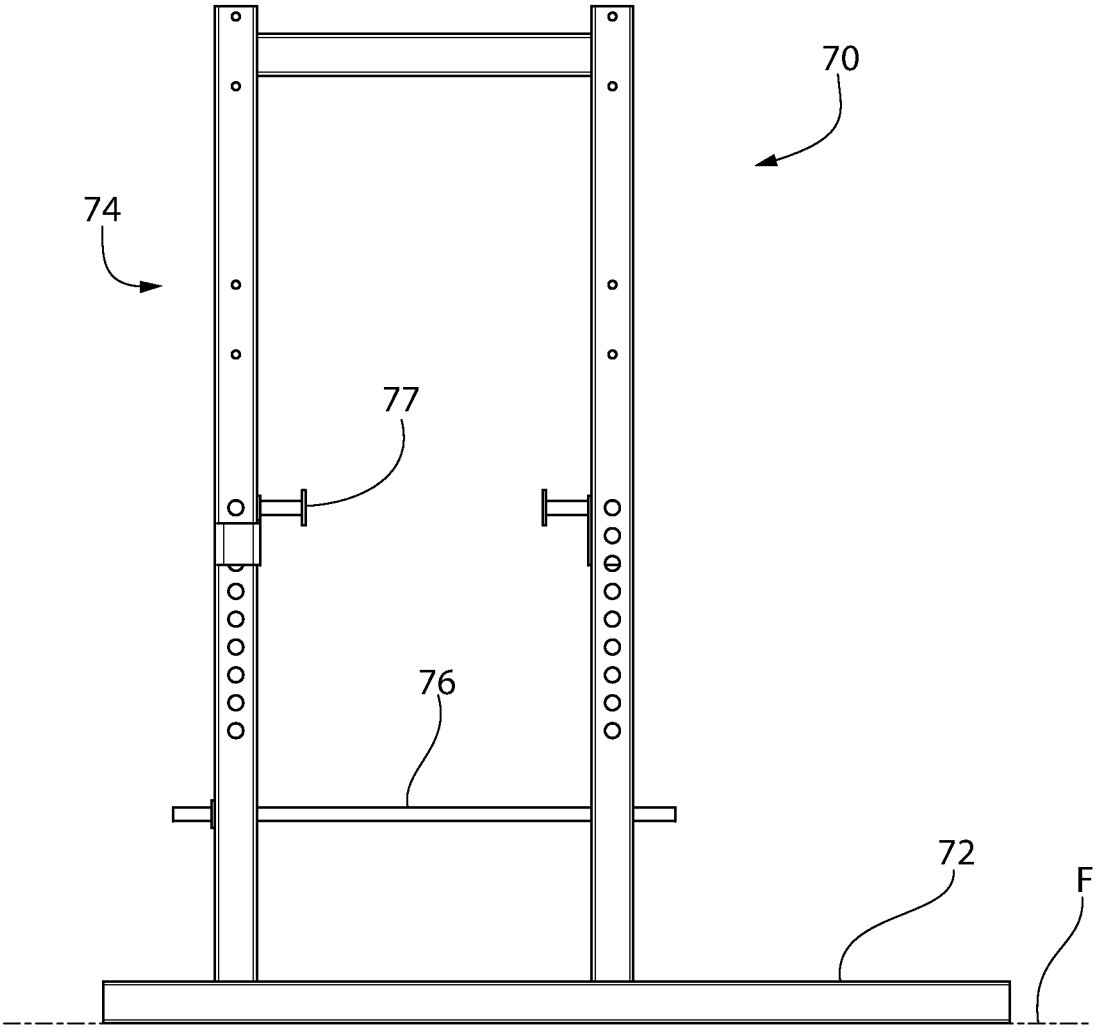
FIG. 18 is a left side view thereof.

FIG. 16 shows back pad 24 in a possible first decline position relative to the frame 22 and floor F. A fifth negative angle A5 is formed relative to longitudinal axis LA. Angle A5 may be between 0 and −90 degrees. In one embodiment, angle A5 may be between 0 and −45 degrees. The back pad position shown may be the lowermost decline position. In this position, when bench 20 is used in conjunction with a weight lifting rack such as power rack 80 described herein, this lowermost decline position may also represent an escape position which the user may use to safely exit the bench when too fatigued to return the barbell to the normal weight rests of the rack.

Hydraulic Control System

A hydraulic control system provides a support mechanism which controls the angular adjustment and motion of the back pad 24, and further operates to both support the back pad and maintain the user selected angular position of the back pad. The hydraulic support is operably coupled between the frame 22 and back pad 24 as shown in FIGS. 10-16. The system controls movement of the back pad 24 between the uppermost incline position and the lowermost decline position, and a plurality or continuum of infinitely adjustable intermediate positions therebetween which includes incline, horizontal, and decline positions. According to one aspect of the invention, the hydraulic support mechanism may be configured to control the back pad descent rate providing a speed control mechanism as further described herein. According to another aspect, the hydraulic support mechanism may also be configured to provide an auto-return mechanism for automatically returning the back pad 24 to its uppermost position as further described herein.

FIGS. 21-31 depict one embodiment of a hydraulic control system and arrangement in greater detail which may be used with bench 20. The system may include a hybrid hydraulic-pneumatic operator which includes a hydraulic cylinder assembly 100 generally comprising a single-acting hydraulic cylinder 102 and an accumulator 106 in fluid communication with the cylinder. In single-acting cylinder designs, the cylinder piston rod extends under hydraulic pressure and retracts under an externally applied force (e.g. gravity weight of equipment, user, etc.) acting against the rod.

The hydraulic cylinder 102 has an axial centerline CL1 and accumulator 106 has an axial centerline CL2. In the illustrated embodiment, the axial centerlines are coaxially aligned forming an end-to-end mounting relationship between the hydraulic cylinder and accumulator. The hydraulic cylinder 102 comprises an elongated tubular body or barrel 108 forming an internal bore 110 which holds hydraulic fluid 101 and an axially movable piston 112 comprising a piston head 114 and cylinder rod 116 having one end rigidly coupled thereto inside the bore. Piston head 114 is sealed at its peripheral edges to the bore 110 by a suitable annular seal 114*a* to keep oil from leaking past the head into the part of the cylinder bore behind the head (space on the left side of the head in FIG. 29). A transversely oriented aperture 120 is formed in an opposite end of the rod 116 which pivotably couples the rod to a transversely oriented cross pin 55 disposed on the lower end of rear strut 42. In one embodiment, cross bolt 55 may be located between and extend through the opposing gusset plates 45 attached to the rear strut 32 at a point below back pad 24 cross bolt 40 and offset from the vertical axial centerline of the rear strut 32 to provide leverage so that the cylinder rod 116 acts to pivot the extension 32*a* about bolt 55 for raising/lowering back pad and holding the pad in stationary position via the hydraulic system. Cross bolt 55 defines a pivot axis for cylinder rod 116 which is parallel to pivot axis P1 of the back pad 26. Pivot axis P4 of the cylinder rod 116 is spaced apart rearward from and below pivot axis P1 to create a lever arm which facilitates rotation of the back pad strut 42 about axis P1.

The accumulator end of the hydraulic cylinder assembly 100 is pivotably coupled to bench frame 22 via transversely oriented tubular sleeve 125. Sleeve 125 receives a transversely mounted cylindrical mounting rod 56 extending between lateral sides 30 of frame 22. Mounting rod 56 defines a pivot axis P5 of the hydraulic cylinder assembly. It bears noting that the hydraulic cylinder assembly 100 may be substantially disposed inside frame 22 within cavity 36 so as to conceal a majority of the assembly from view and protect the linkages associated with the cylinder assembly.

The accumulator 106 in one embodiment comprises an elongated body forming an internal chamber 104 for holding hydraulic fluid 101 and a compressible gas. The internal chamber 104 of the accumulator 106 is fluidly connected to the cylinder bore 110 by one or more flow conduits 118 configured to provide bidirectional exchange and flow of hydraulic fluid between the accumulator 106 and cylinder 102. In one non-limiting embodiment, the accumulator 106 may physically be directly coupled to the cylinder 102 to form a compact cylinder assembly 100. A unique flow control valve assembly 145 may be provided which internally incorporates the flow conduits 118 and is configured to control the flow and exchange of hydraulic fluid between the accumulator 106 and hydraulic cylinder 102 as shown in FIGS. 21-31. Advantageously, this eliminates the need for external tubing to form the flow conduits which may be exposed to damage during shipping or use of the bench.

In one embodiment, the valve assembly 145 may be designed directly as part of the hydraulic cylinder assembly. The valve assembly 145 may be interspersed directly between the accumulator 106 and hydraulic cylinder 102 to provide a compact hydraulic assembly. In this arrangement, one proximal end of hydraulic cylinder barrel 108 is coupled to one side of the valve assembly body and one proximal end of the accumulator 106 is coupled to the other side of the valve assembly body. The accumulator and barrel may be welded to the valve assembly 145 to provide a leak-proof seal in one embodiment; however, other mounting methods may be used such as without limitation bolting or other. The flow conduits 118 extend through the valve assembly 145 which fluidly connects the cylinder bore 110 to the accumulator chamber 104 as describe below.

Referring to FIGS. 27-31, valve assembly 145 includes a shut-off valve such as spring-biased plunger valve 122, check valve 147, and optionally a pressure compensating valve 146. In other embodiments, the shut-off valve may a different type such as a ball or other valve capable of interrupting the flow of hydraulic fluid. Accordingly, the invention is not limited to any particular type of shut-off valve. The pressure compensating valve 146 provides an automatic means for controlling the rate of descent of the back pad 24 when an escape scenario is initiated by a user. One flow conduit circuit 118*a* fluidly connects the plunger valve 122 and pressure compensating valve 146. Flow conduit circuit 118*a* fluidly communicates with and extends through the body of valve assembly 145 in order from: the hydraulic cylinder bore 110 to the plunger valve 122, to the pressure compensating valve 146, and finally to the accumulator chamber 104. This provides a first fluid or flow path for exchange of hydraulic fluid between the hydraulic cylinder 102 and accumulator 106. Plunger valve 122 and pressure compensating valve 146 may be removably disposed in suitably configured bores 148 formed in the body of the valve assembly 145 to facilitate installation and replacement if needed. In one embodiment, the bores 148 may open downwards through the body of the valve assembly 145 for insertion of the valves 122, 146 into their respective bores.

Check valve 147 is disposed in a separate flow conduit circuit 118*b* that extends through the body of the valve assembly 145 and which is fluidly isolated from flow conduit circuit 118*a*. Circuit 118*b* extends from in order hydraulic cylinder bore 110 through the check valve 147 and to the accumulator chamber 104. The check valve 147 is arranged to permit one-way flow from the accumulator 106 into to the hydraulic cylinder 102. Flow in the reverse direction is blocked by the check valve. In one embodiment, check valve 147 may be a ball check type comprising a spring 147*b* and biased ball 147*c* which is seated against a valve seat 147*a*. Valve seat 147*a* may be formed by or include an O-ring in some embodiments.

Plunger valve 122 comprises a spring-biased movable stem or plunger assembly including elongated plunger 124 and compression spring 123 which is manually operated to open and close the valve. Other suitable type springs may be used. The plunger 124 is disposed 90 degrees to the axial centerline hydraulic cylinder 102 in this embodiment. The plunger 124 functions to shut off the flow of hydraulic fluid between the accumulator 106 and hydraulic cylinder 102 by moving the plunger 124 to a closed or blocking position, thereby obstructing flow conduit circuit 118*a*. Conversely, withdrawing the plunger 124 from the flow conduit circuit 118*a* to an open position permits the exchange of hydraulic fluid between the accumulator 106 and hydraulic cylinder 102. The valve 122 and plunger assembly is operated via an operating lever assembly which in one non-limiting preferred embodiment is configured as a foot lever 130. Alternatively, a hand-operated lever may be provided. Foot lever 130 is pivotably mounted to frame 22 for upwards and downwards movement between unactuated and actuated positions.

Figure 8:
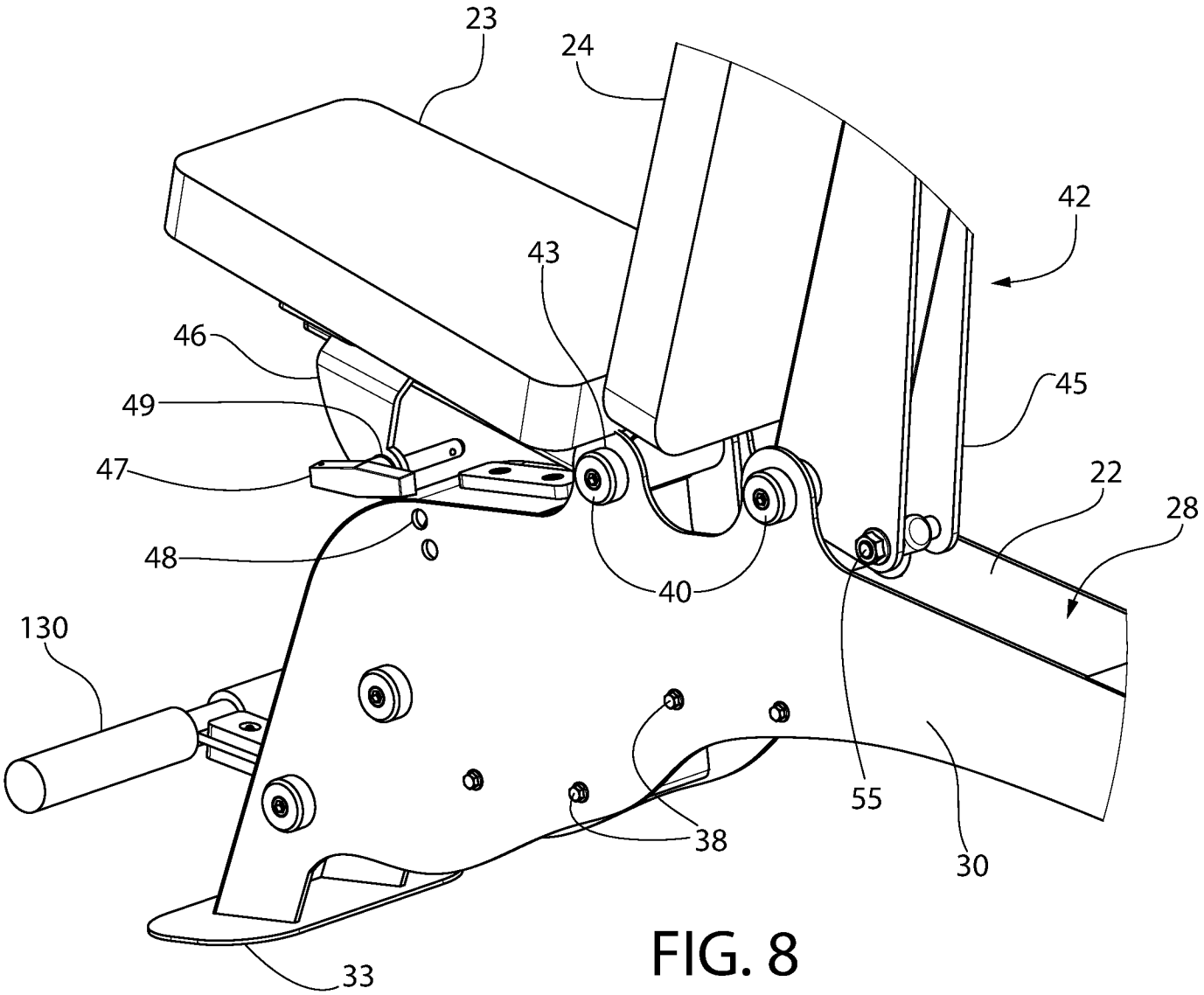
FIG. 8 is a left partial perspective view thereof.
Figure 9:
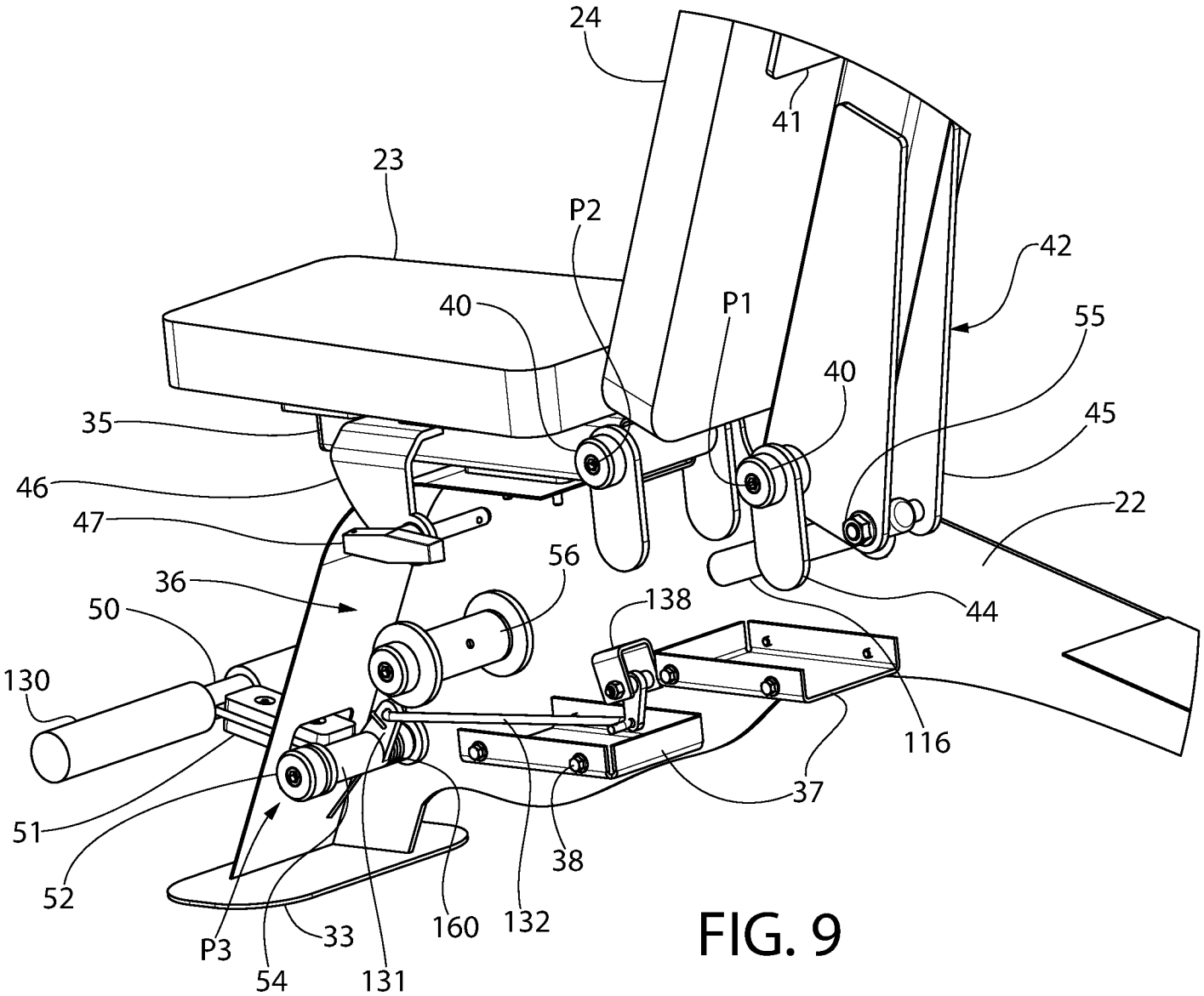
FIG. 9 is a left partial perspective view thereof with a portion of the frame removed without the hydraulic cylinder assembly.

In one embodiment, an ambidextrous operating lever is provided which can be depressed by either foot of a user. Referring briefly to FIGS. 1, 8, and 9, an ambidextrous foot lever 130 has a generally T-shaped configuration comprised of a transversely elongated operating segment 50 connected to an axially oriented mounting segment 51. Each segment may have any suitable polygonal or non-polygonal cross sectional shape, such as circular, square, rectangular, etc. Mounting segment 51 extends through a window 31 in a front wall 53 of the frame 22 into internal cavity 36. The end of mounting segment 51 opposite the end connected to operating segment 50 may be pivotably attached by a tubular collar 54 to a transversely mounted cylindrical cylinder mounting rod 52 extending between lateral sides 30 of frame 22. Mounting rod 52 defines a pivot axis P3 of the foot pedal 130. Depressing the foot pedal 130 in a downward direction in turn rotates the collar 54 relative to the mounting rod 52. In an alternative arrangement, mounting segment 54 may instead be fixedly attached to mounting rod 52 of the frame which instead rotates relative to the frame to provide the same functionality.

In other possible embodiments, the foot pedal 130 may instead be configured for single-sided operation with either the right or left foot of the user. In such an embodiment, the foot lever 130 may be a generally S-shaped lever in the form of a cylindrical rod comprising a horizontal mounting section 130*a* which replaces mounting rod 52 and extends through openings in each of the lateral sides 30 of the frame, a horizontal operating section 130*b* offset but parallel to section 130*a* which is configured for operation preferably by the foot of a user to rotate the foot lever, and an intermediate section 130*c* extending orthogonally therebetween. An enlarged pedal as shown may be provided on operating section 130*b* in some embodiments for easier operation by the user. It bears noting that in this embodiment of a foot lever, mounting section 130*a* is rotatably coupled to the lateral sides 30 of frame 22.

Referring back now to FIGS. 1-16 and the T-shaped foot pedal 130, the foot pedal mounting assembly includes an elongated cantilevered lever arm 131 fixedly connected to and protruding perpendicularly outwards from mounting rod 52 in a radial direction. A mechanical linkage 132 which may be a solid shaft, spring, cable, or other type linkage connects lever arm 131 of the foot lever to a toggle cam 133 pivotably mounted proximate to plunger valve 122 (see, e.g. FIGS. 27-28). In the present embodiment, mechanical linkage 132 is shown as a rod. Toggle cam 133 has a generally flattened plate-like body in the illustrated embodiment defining a cam surface 133*a* at a working end which acts on a cam follower 134 coupled to plunger 124. An opposite operating end of the cam is pivotably connected to mechanical linkage 132, and two opposing lateral sides extends between the working and operating ends. In one embodiment as shown, the cam follower 134 may be defined by a distal cylindrical end portion of the plunger 124 which projects outward and below the valve 122 body. Retracting or projecting the cam follower 134 from valve 122 therefore selectively closes or opens the valve 122, respectively.

The cylindrical cam follower 134 protrudes downwards from and below the body of valve assembly 145 to engage the toggle cam 133. The cam follower 134 formed as an integral part of the valve plunger 124 (or separate part coupled thereto) operates such that pivoting the foot lever 130 in opposite directions open or closes the plunger valve 122 since arcuately curved cam surface 133*a* is asymmetrically offset from pivot 135 which mounts the toggle cam 133 to the body of the valve assembly 145 (see, e.g. FIGS. 27-28). The pivot hole formed in toggle cam 133 which receives pivot 135 is asymmetrically located between the lateral sides of the toggle cam body as shown so that the distance from the pivot to either of the lateral sides is unequal. In one embodiment, pivot 135 may be formed by a transverse pin which is supported by a support bracket such as inverted U-shaped clevis 138 attached to the bottom of the valve assembly 145 body. Other style mounting brackets and arrangements may be used for the pivotable connection.

Figure 28:
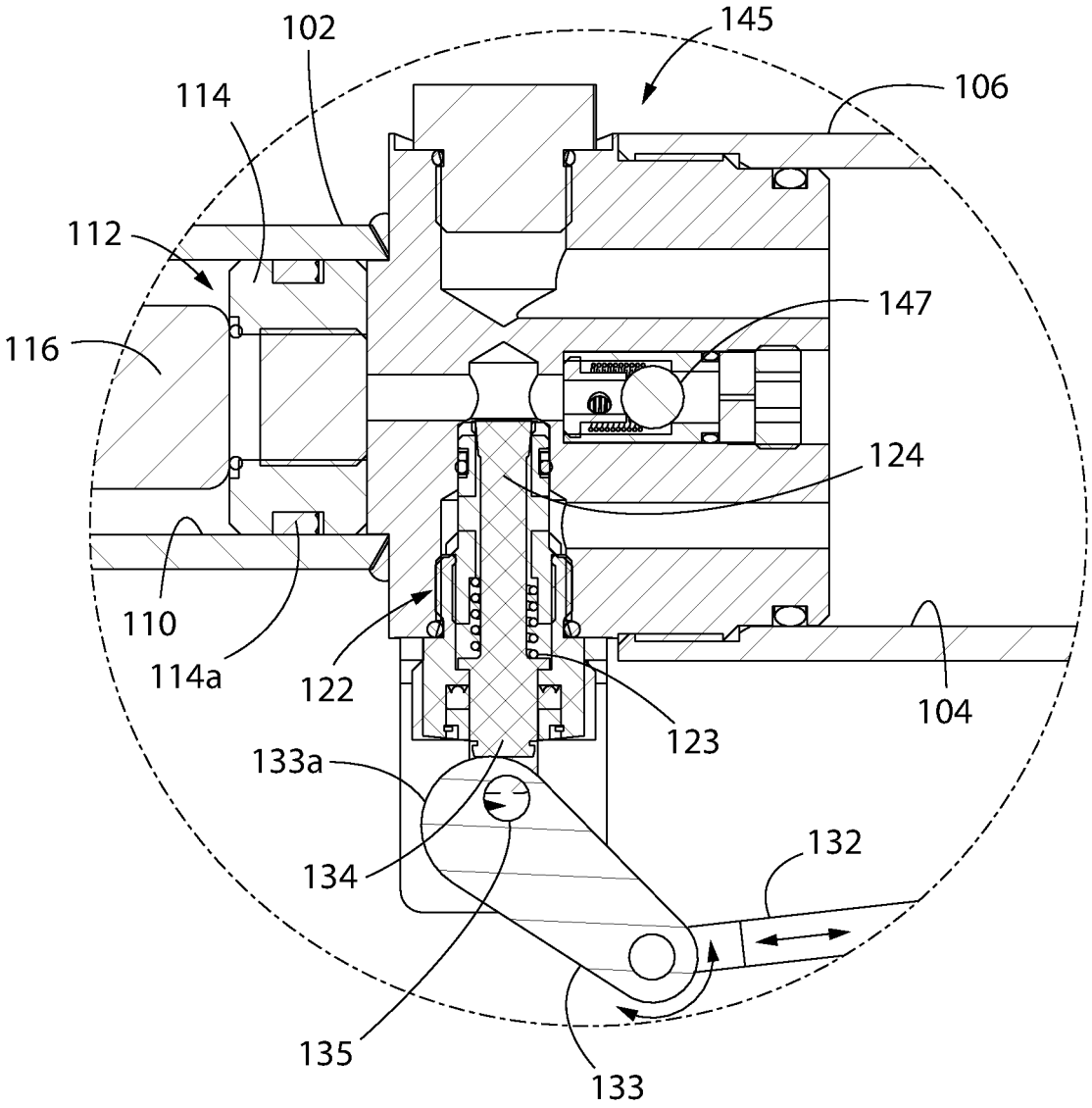
FIG. 28 is a detail view taken from FIG. 27.
Figure 29:
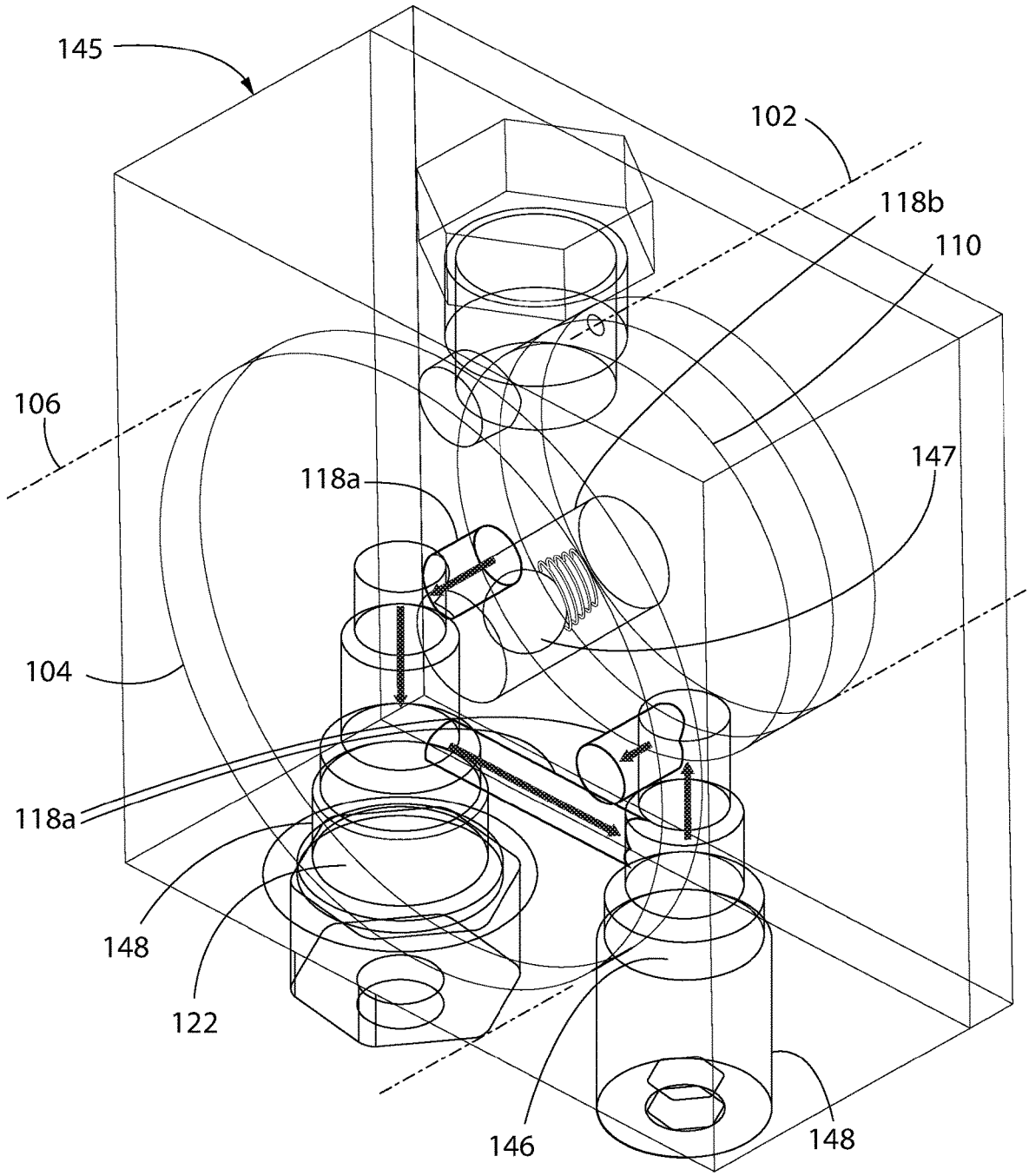
FIG. 29 is a perspective view of the flow control valve assembly of FIG. 21 showing the interior components and flow paths.
Figure 30:
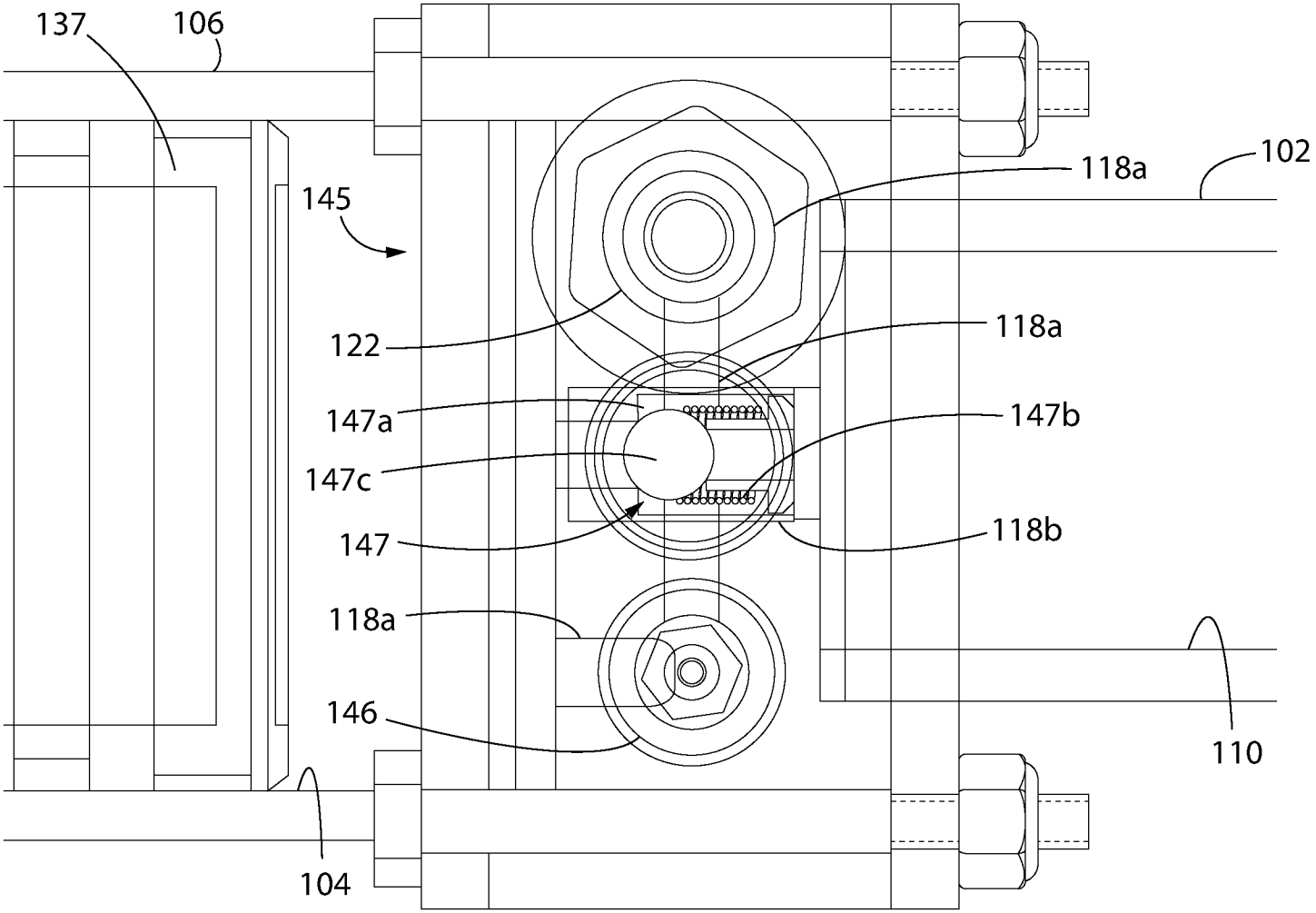
FIG. 30 is a top plan view thereof showing the valve assembly interior components.
Figure 31:
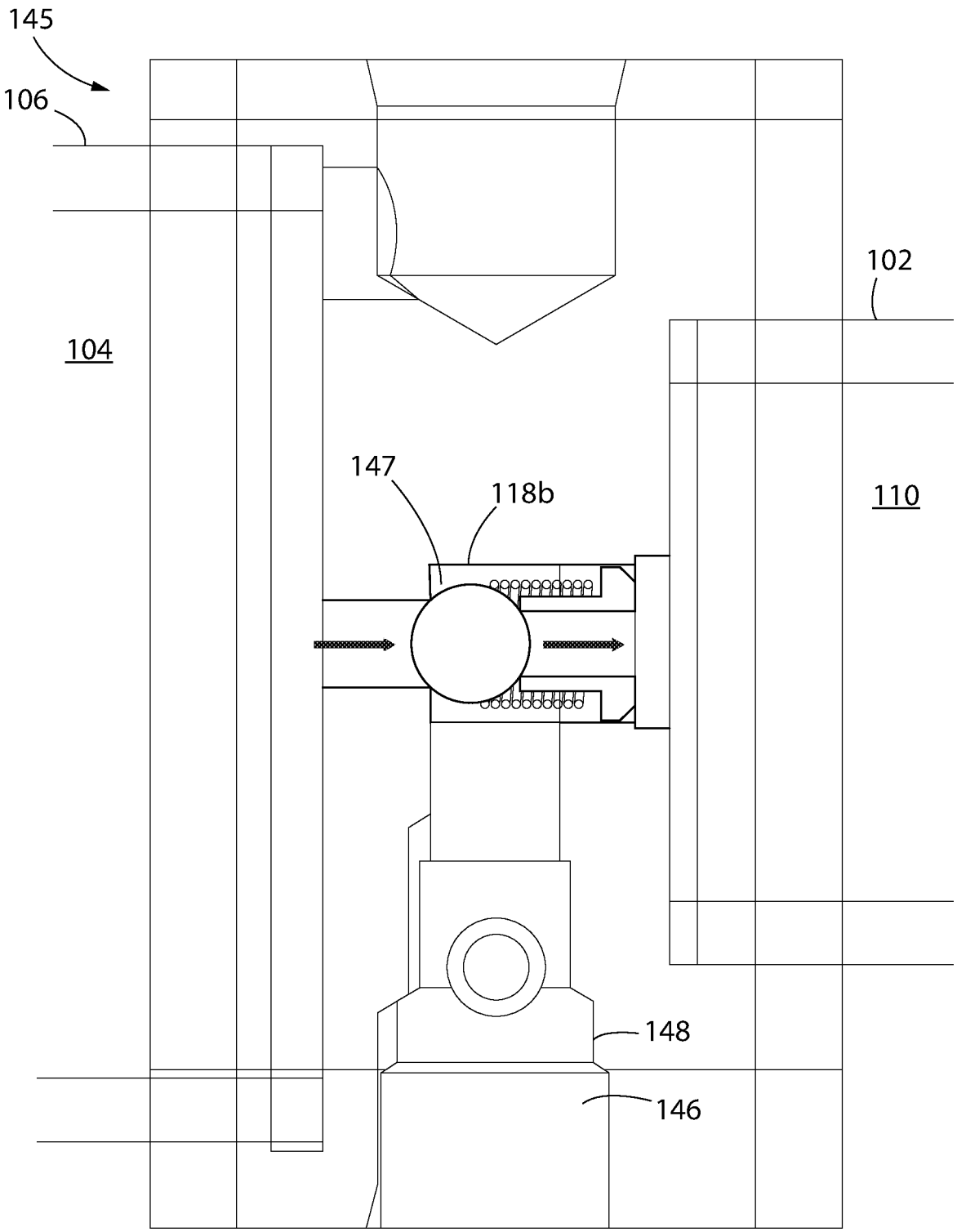
FIG. 31 is a side view thereof showing the valve assembly interior components.
Figure 32:
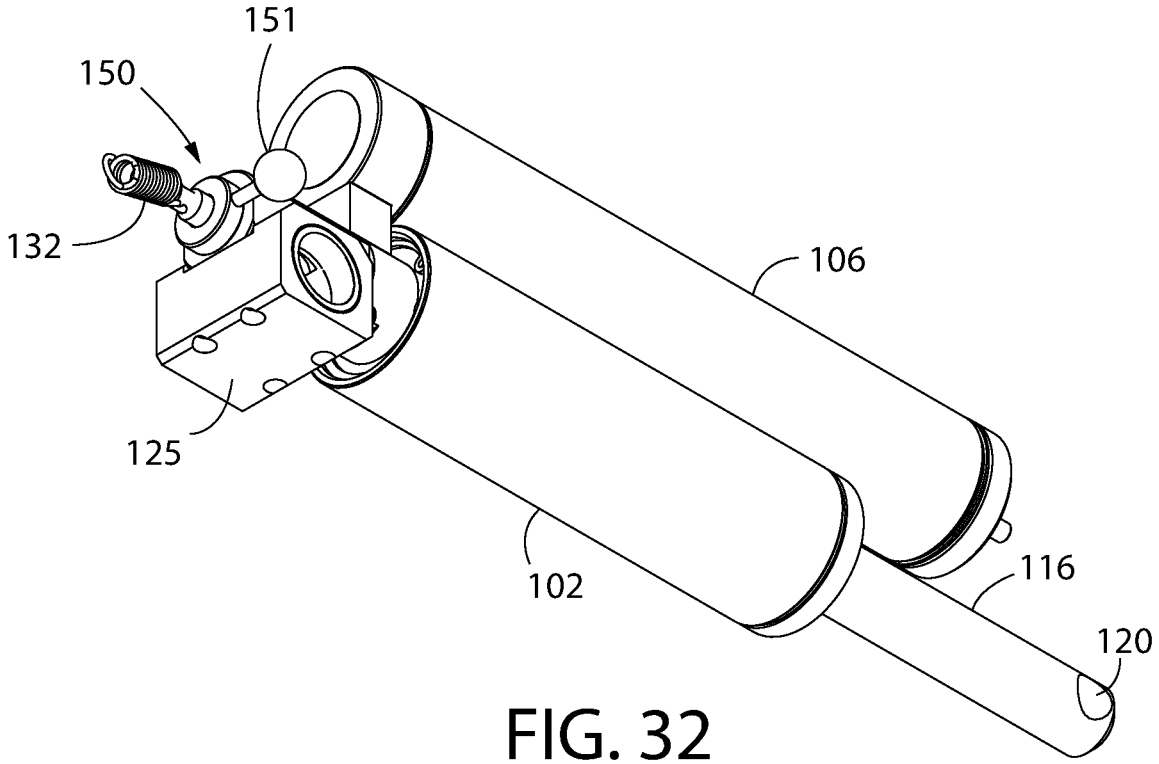
FIG. 32 is a front bottom perspective view of another alternative embodiment of a hybrid hydraulic cylinder system for operating the weight lifting bench of FIG. 1 and back pad assembly that comprises an integrated hydraulic cylinder, accumulator, and operating flow control valve assembly in which the accumulator is arranged parallel to the cylinder.
Figure 33:
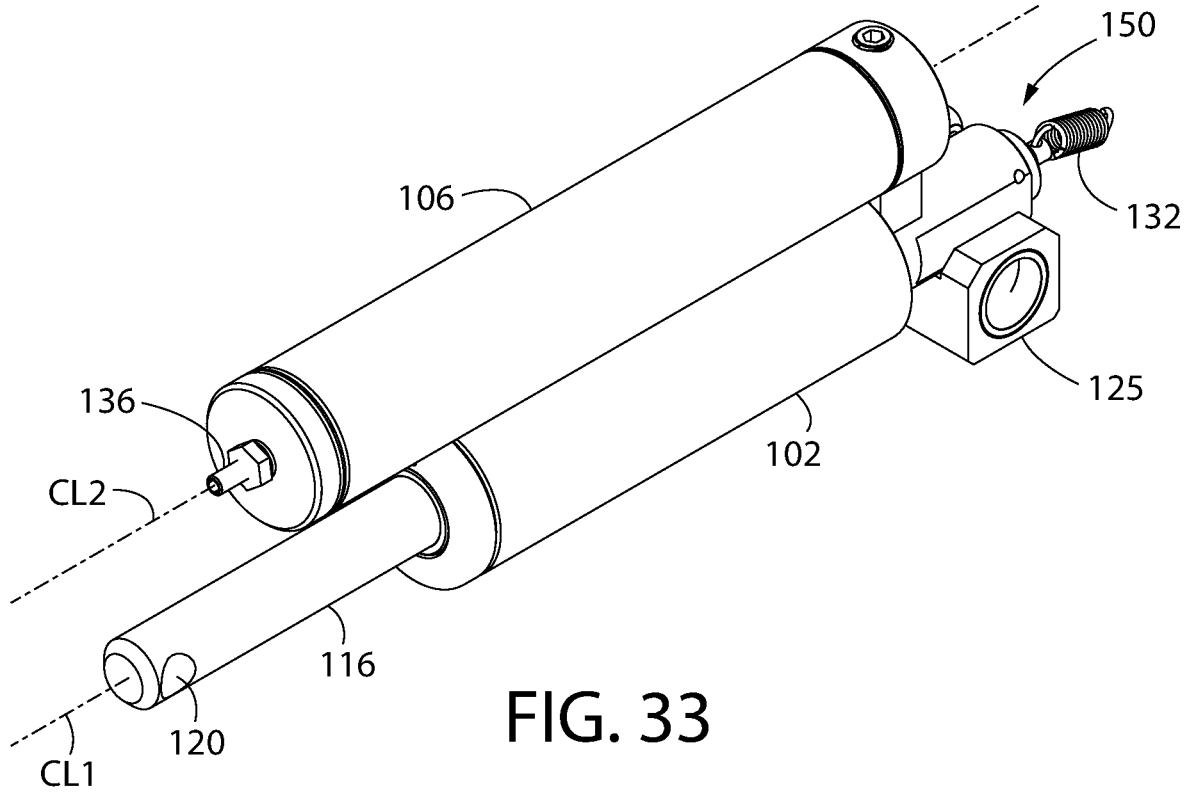
FIG. 33 is a rear perspective view thereof.
Figure 34:
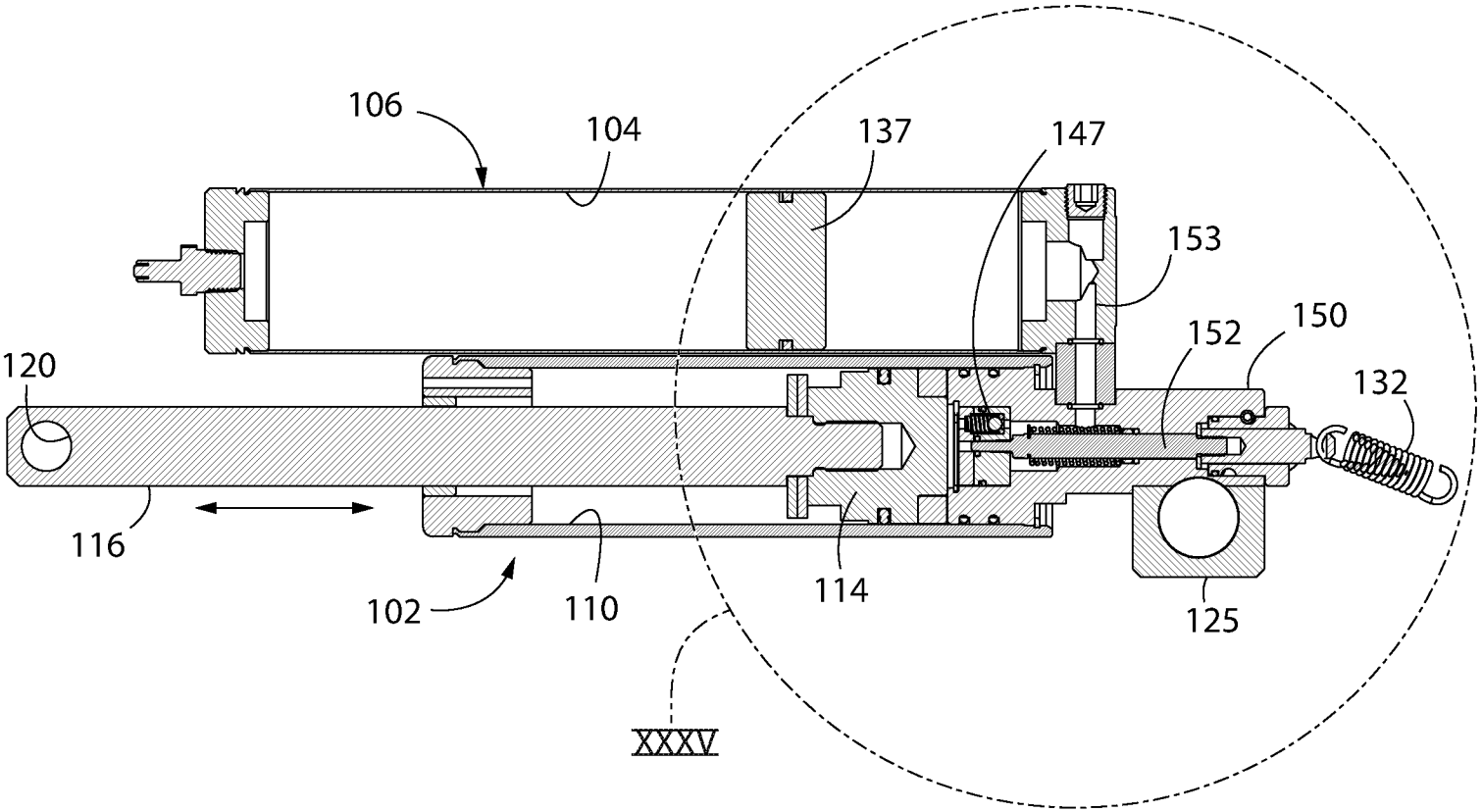
FIG. 34 is a longitudinal cross sectional view thereof.
Figure 35:
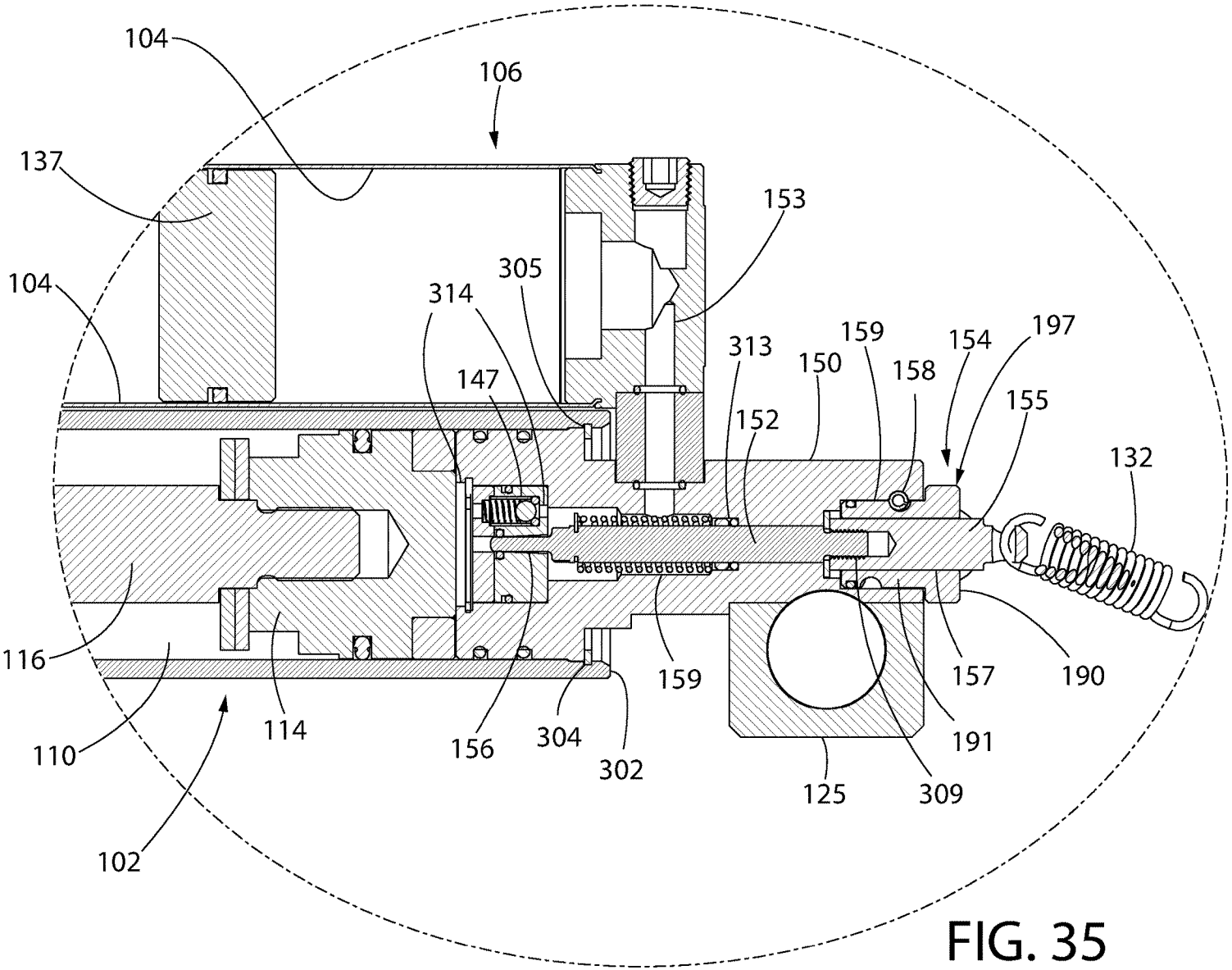
FIG. 35 is a detail view taken from FIG. 34.
Figure 36:
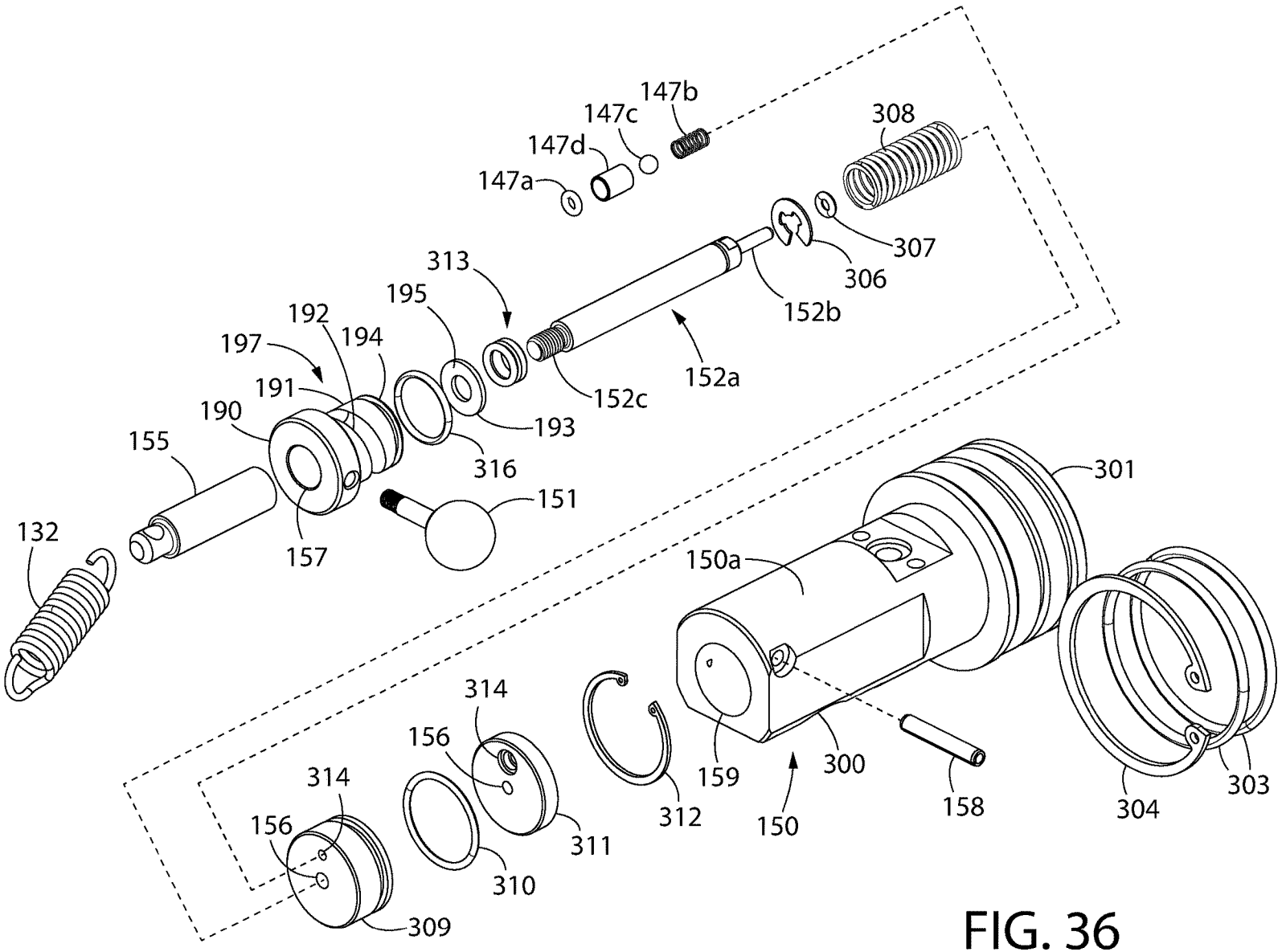
FIG. 36 is an exploded perspective view thereof.
Figure 37:
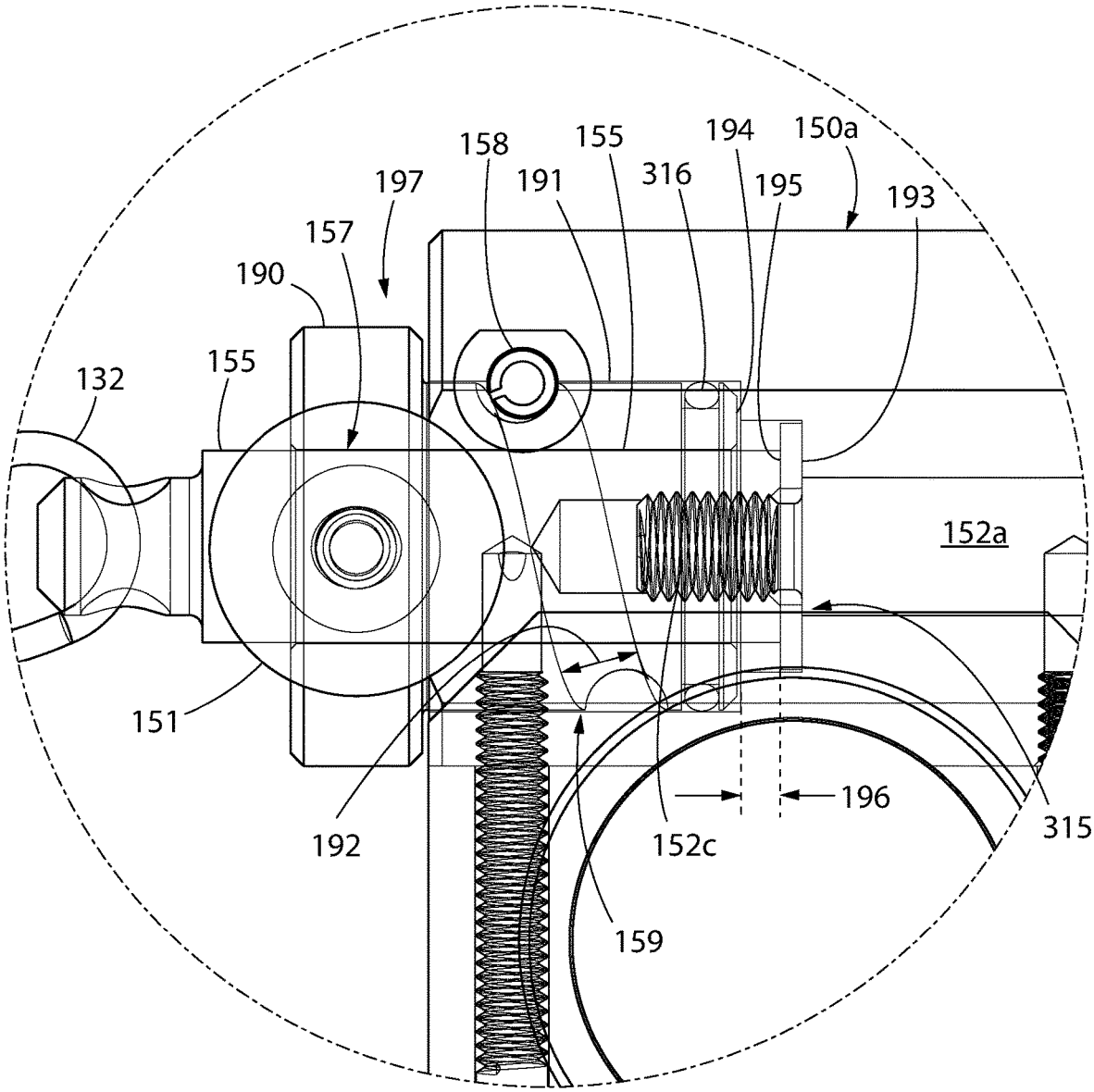
FIG. 37 is a detail side view of the flow control valve showing valve internals.

FIG. 28 shows the toggle cam 133 in a first inactive position with spring-biased cam follower 134 contacting an outer lateral region of cam surface 133*a* closest to pivot 135. The cam follower 134 is biased downward by plunger spring 123 to maintain contact with the cam surface 133*a* on the toggle cam and bias valve 122 into a closed position. Rotating the toggle cam 133 in a clockwise direction (in FIG. 28) via foot lever 130 and mechanical linkage 132 brings the central portion of cam surface 133*a* into engagement with the bottom end of the cam follower 134. This pushes the cam follower 134 and plunger 124 upward into the plunger valve 122 against the biasing force of the plunger spring 123. The plunger 124 is actuated and raised to move plunger valve 122 into a closed position.

Referring to FIG. 21-28, the hydraulic cylinder assembly 100 may utilize a suitable incompressible hydraulic oil used in such cylinders as the working fluid. In one implementation, the accumulator 106 may be a hydro-pneumatic gas-over-oil type in one embodiment incorporating a compressible gas with the hydraulic fluid oil. The gas may be compressed air or other suitable compressible inert gas (e.g. nitrogen, etc.) which is pre-charged (i.e. pre-pressurized) to an appropriate initial pre-charge pressure. The oil 101 occupies the hydraulic cylinder bore 110 and air 103 at least partially fills the accumulator chamber 104 (depending on whether the cylinder rod 116 is retracted or extended). An air-oil interface is formed between the air and oil within the chamber by an axially slidable piston 137 which shifts position in response to movement of the cylinder rod 116 and connected piston head 114 in hydraulic cylinder 102. Piston 137 is sealed at its peripheral edges to the chamber 104 by suitable annular seals to keep air oil from leaking past the piston into the oil. The air 103 may be filled into the chamber 104 at a pre-charge pressure via an air fill or charging valve 136 fluidly connected to the accumulator 106. Valve 136 may be a Schraeder type valve in one embodiment; however, other type valves may be used.

It should be noted that an air/oil accumulator is preferable over other designs due to lower manufacturing costs and added longevity of life. The rubber bladder used in other air or gas-over-oil type accumulators may be problematic for this design and application. Particularly when the hydraulic cylinder used in a substantially horizontal position as illustrated herein, the rubber bladder can rub and wear over time against the interior of the accumulator chamber, thereby ultimately leading to failure and leakage. However, rubber bladder type accumulators may viably be used nonetheless. Still in other embodiments contemplated, weight-loaded piston or spring type accumulators may be used. Accordingly, the choice of accumulator type does not limited the invention.

In operating principle, compressed air 103 at a pressure higher than atmospheric stores useable potential energy which is converted to kinetic energy to displace piston head 114 and automatically return the bench pad 50 to an upright position, as further described herein. The compressed air exerts pressure against a distal side of the piston 137 (farthest from valve 122) in accumulator 106 that separates the air and hydraulic fluid. Piston 137 in turn exerts force against the hydraulic oil 101 on the proximal side of piston 137 (closest to valve assembly 145). The oil acts in a rigid manner (due to the incompressible nature of the hydraulic oil) against the proximal side of the piston head 114 in the cylinder bore 110 when the bore and accumulator chamber 104 are fluidly connected. This pressure force is used to extend the cylinder rod 116 for forming the support pad auto-return feature of the present invention.

The hydraulic cylinder assembly 100 comprising the hydraulic cylinder 102 with cylinder rod 116 is the hydraulic support mechanism between the rear strut 42 of back pad 24 and the frame 22. When the cylinder rod 116 is fully extended, the back pad 24 is in its highest position relative to the floor and the frame. At this point, the hydraulic fluid fills the cylinder bore 110 in the hydraulic cylinder 102 pushing and extending the rod outwards from the cylinder. The transfer of hydraulic fluid between the cylinder bore 110 and the air/oil accumulator chamber 104 controls the cylinder rod and hence back pad position. When the cylinder rod 116 is fully retracted inwards into the cylinder 102, the bench pad 50 is in the lowest position relative to the floor and frame. At this point, the hydraulic fluid fills the accumulator 106 and the rod is completely retracted. To adjust the vertical position of the back pad 24, the user may press the foot lever 130. The foot lever controls the position of flow control valve 122 (e.g. open or closed) which allows or prevents the exchange and flow of hydraulic fluid between the hydraulic cylinder 102 and accumulator 106.

Accordingly, it bears noting that moving the foot lever 130 changes the hydraulic cylinder mechanism between an activated condition in which the back pad is movable between the incline and decline positions when the foot lever is actuated, and a deactivated condition in which the back pad is locked into a selected one of the incline and decline positions when the foot lever is unactuated.

Operation of the hydraulic control system utilizing hydraulic cylinder 100 will now be described for the bench 20 having the fully automatic back pad 24 auto return feature. The auto return is activated merely by the user releasing the foot pedal 130 and removing pressure against the back pad 24, thereby allowing the back pad to automatically return to its uppermost position. In this embodiment, accordingly, valve assembly includes check valve 147 which provides the flow path required for the full auto return feature (i.e. back pad returned to uppermost position without user actuating or depressing the foot pedal 130).

Figure 38A:
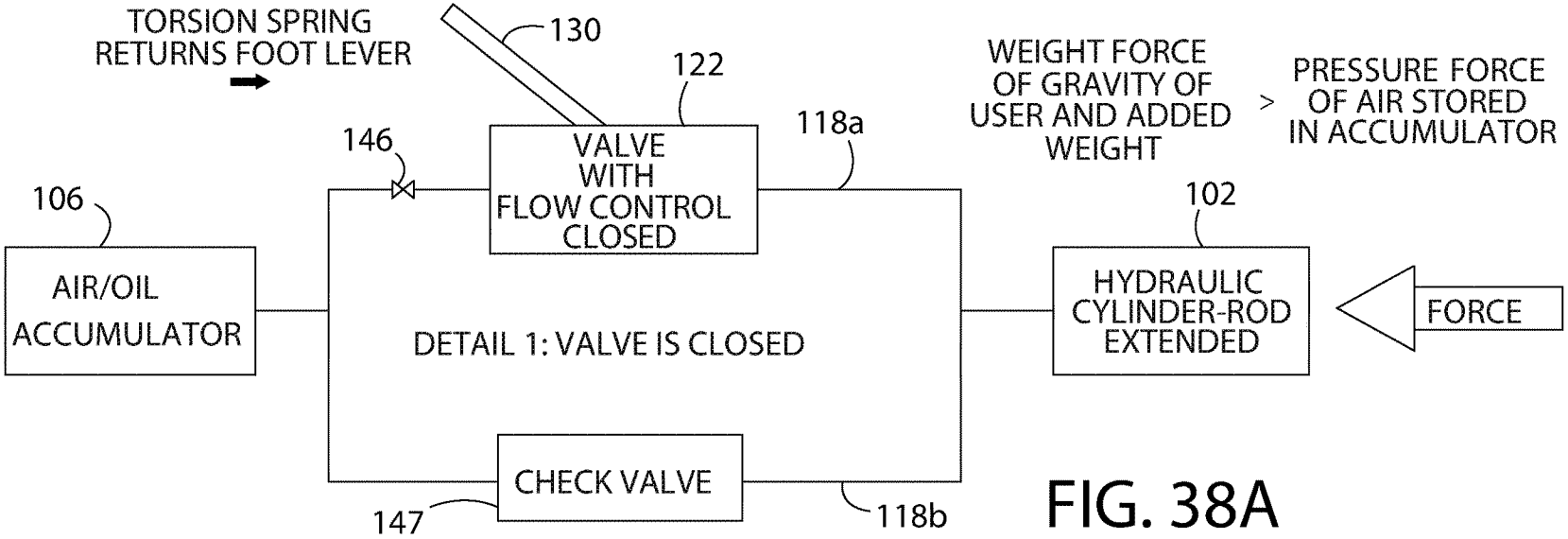
FIG. 38A is a schematic flow diagram of the hydraulic control system in a state when the back pad is in an incline, horizontal, or decline normal exercise position in which the exchange of hydraulic fluid between the hydraulic cylinder and accumulator is stopped by a closed lever actuated plunger valve.

FIG. 38A corresponds to back pad 24 in an uppermost exercise and highest adjustment position (see, e.g. FIG. 12). The back pad may be almost or perfectly vertical in orientation and is fully positioned above the longitudinal axis LA. Plunger valve 122 is closed in which foot lever 130 is in an upward unactuated position and the toggle cam 133 is in a corresponding upward position to close the valve. While the back pad 24 is in an upper incline exercise position with a weight lifter seated on bench 20 and applying a pressing force against the back pad, the gravity force from the weight of the user and the added weights of the barbell act as force against the hydraulic cylinder 102 in a direction towards retracting the rod 116 therein when the user leans against the back pad thereby applying a pressure force thereto. With the foot lever 130 in the upward unactuated position shown in the hydraulic flow diagram of FIG. 38A, however, the plunger valve 122 remains closed and does not permit hydraulic fluid to flow or exchange between the cylinder 102 and accumulator 106, thereby preventing the bench pad from dropping as the trapped hydraulic fluid acts as a solid support for the back pad 24. Accordingly, the hydraulic cylinder 102 is not in fluid communication with the accumulator 106 at this time. In this position, the weight training equipment is ready and operational for exercise. Due to the fact that hydraulic fluid is non-compressible, the hydraulic cylinder set-up provides the same rock solid feel as a rigidly welded component or piece of equipment.

Figure 38B:
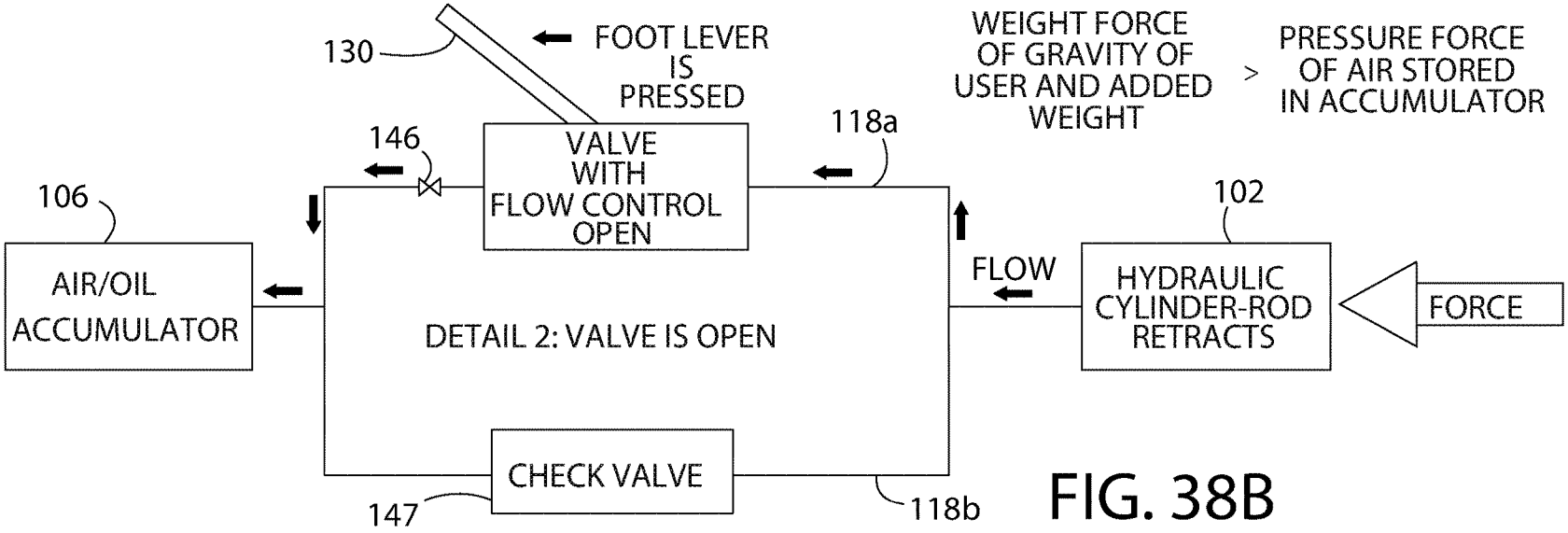
FIG. 38B is a schematic flow diagram of the hydraulic control system in a state when the back pad is in the process of descending towards a lower exercise or lowermost escape position in which hydraulic fluid flows from the hydraulic cylinder into the accumulator via an open plunger valve.

When the foot lever 130 is pressed downward and rotated towards the floor or ground to a downward actuated position, the plunger valve 122 opens as shown in flow diagram of FIG. 38B to implement either adjustment of the incline or decline positions, or the full decline position which equates to an escape scenario for the bench in the event of user fatigue. The downward motion of the foot lever 130 pulls the mechanical linkage 132 towards the front 26 (foot-end) of the bench to open the valve 122. The toggle cam 133 coupled to the valve rotates laterally and upward causing the valve plunger 124 to be urged downwards by spring 123 to open the valve 122. The gravity force of weight from the user against the back pad 24 (i.e. pressing force) and added weight of the barbell on the equipment forces the cylinder rod 116 to retract inwards into hydraulic cylinder 102 and the hydraulic fluid 101 to now flow from the cylinder 102 to the accumulator 106. As the rod 116 retracts into the cylinder 102, the downward gravity force against the back pad 24 causes it to pivot about pivot axis P1 at cross bolt 40, thereby causing the back pad to descend towards the floor F/frame 22 and change its angular position.

If the user intends to simply partially lower the back pad 24 to another incline or a decline position for an exercise routine, releasing the foot lever 130 at any point during the descending motion of the back pad will close the plunger valve 122 and lock/hold the back pad in the respective position selected. With the auto-return feature of the back pad 24 in the present valve embodiment provided by check valve 145, it bears noting that the user must maintain some pressure against the back pad with his/her back to prevent the back pad from automatically returning to the full uppermost incline position as described below. However, it will be appreciated that the user may use this first back pad operating mode with auto return to advantage when exercising. For example, the back pad 24 may be moved in a downwards direction (see, e.g. from full incline position of FIG. 12 towards full decline position of FIG. 16) by depressing the foot pedal 130, and then releasing the pedal which will lock the back pad in position and prevent further descending motion. If the user determines that the angle of the back pad 24 is too low, the user need not actuate the foot pedal to raise the back pad in position slightly. By merely leaning forward, the back pad will remain against the user's back and follow the user upwards to a new incline position. As long as the user does not sit up and break contact with the back pad, the back pad will automatically lock into the new incline position via the valve assembly 145 operation described above.

Figure 55:
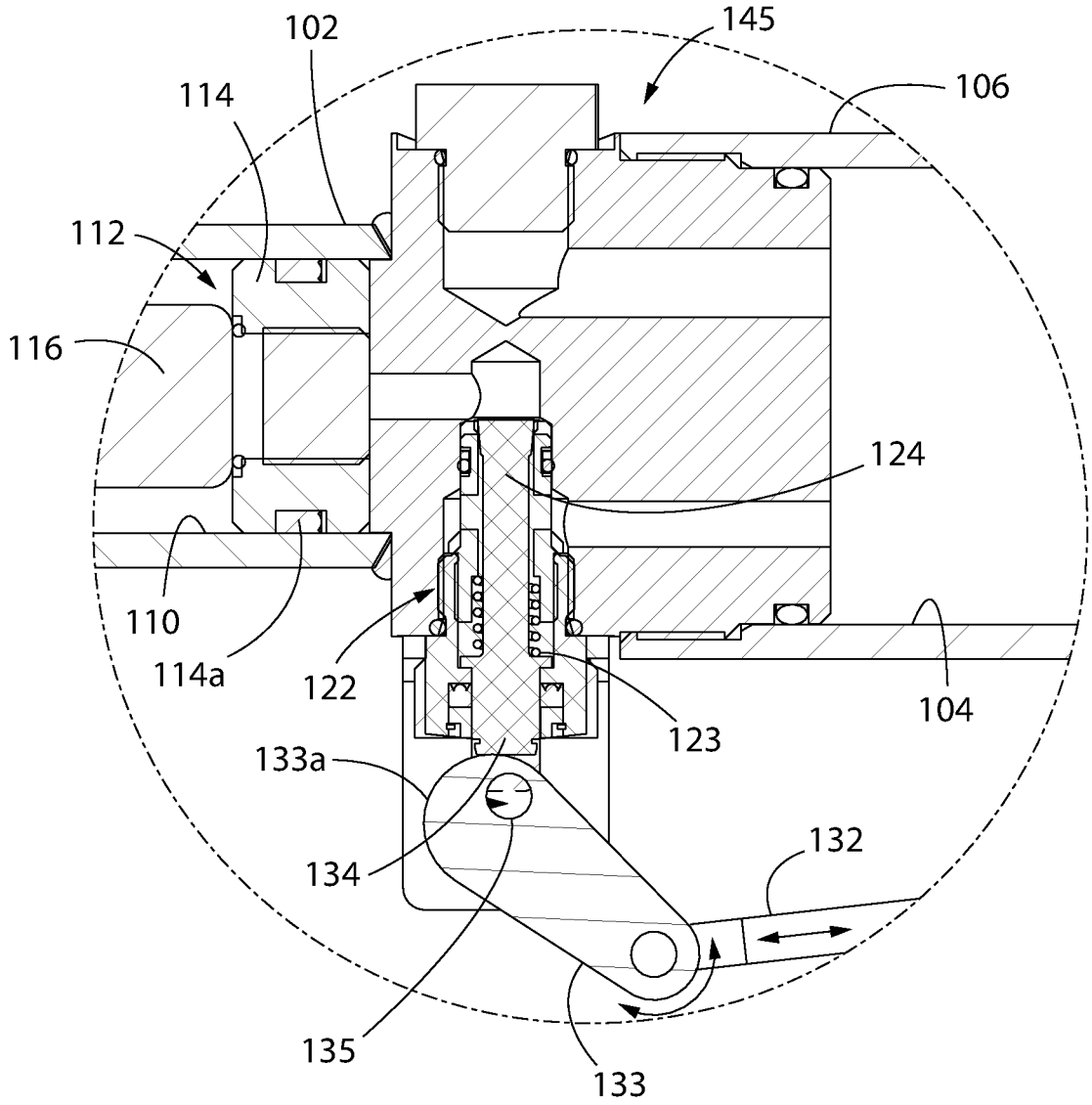
FIG. 55 is an alternative embodiment of a modified flow control valve assembly of FIG. 28 without a check valve and back pad automatic return feature.

A second back pad operating mode is created by a modified embodiment of the valve assembly 145 which eliminates the auto-return feature. Referring to FIGS. 55 and 56, the check valve 147 and its associated flow port 118*b* are removed. This eliminates any flow path directly between the accumulator 106 and cylinder 102 for return flow hydraulic fluid which was controlled by the check valve 147 in the original embodiment of FIGS. 27-31 described above. Hydraulic fluid exchange between the accumulator and cylinder is now always controlled by and must flow through the plunger valve 122 and pressure compensating valve 146 (if provided) without bypass. This second operating mode allows the user to adjust the back pad angle and lock the pad into a user-selected position the same as previously described. However, without the check valve 147, the back pad 24 will retain its angular selected position without the user having to maintain a pressure force against the pad. To return the back pad 24 upwards, the foot pedal 130 must be depressed to open the plunger valve 122 and permit flow of hydraulic fluid from the accumulator 106 back to the hydraulic cylinder 102.

Figure 10:
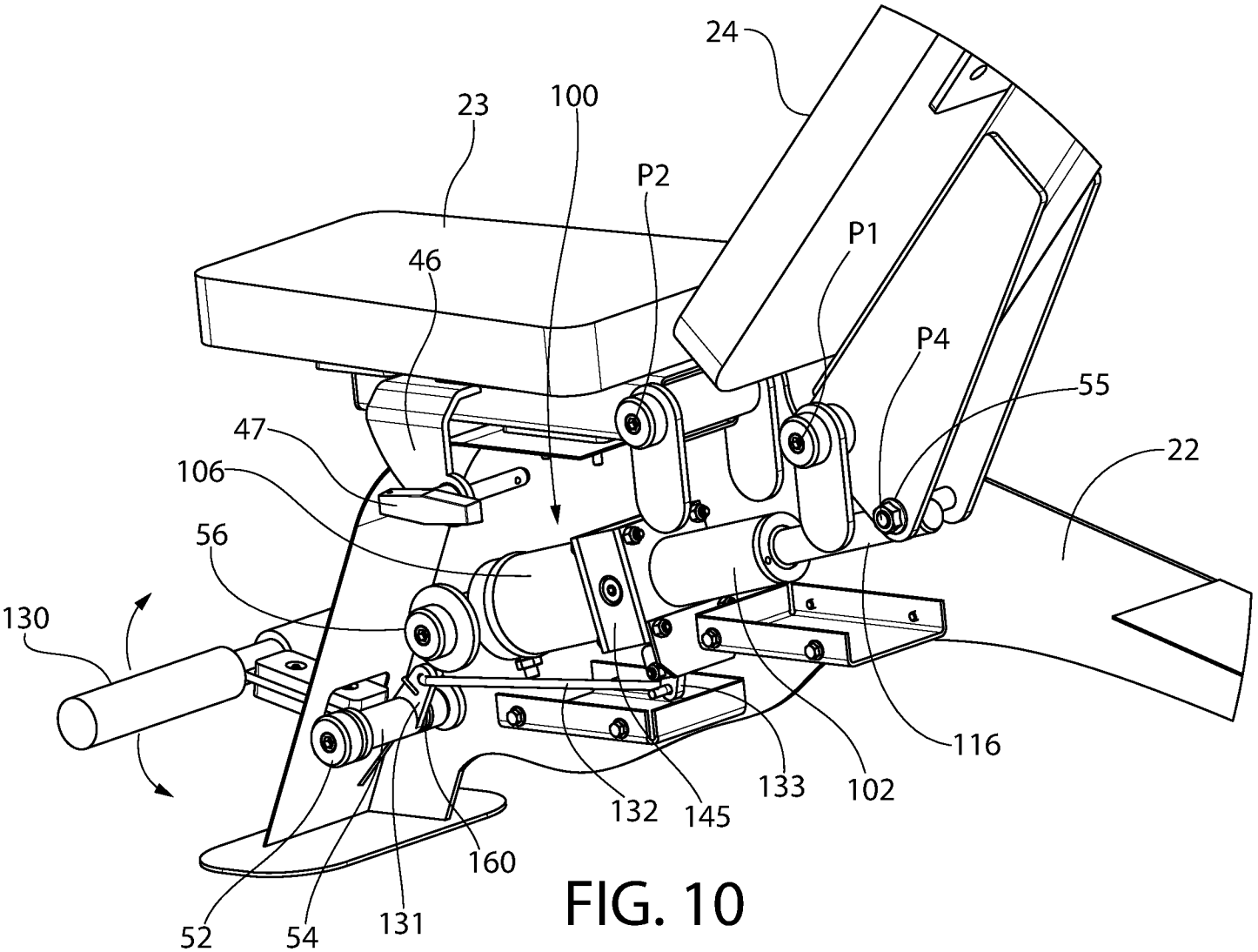
FIG. 10 is a left partial perspective view thereof with a portion of the frame removed and showing the hydraulic cylinder assembly mounted in the bench.
Figure 11:
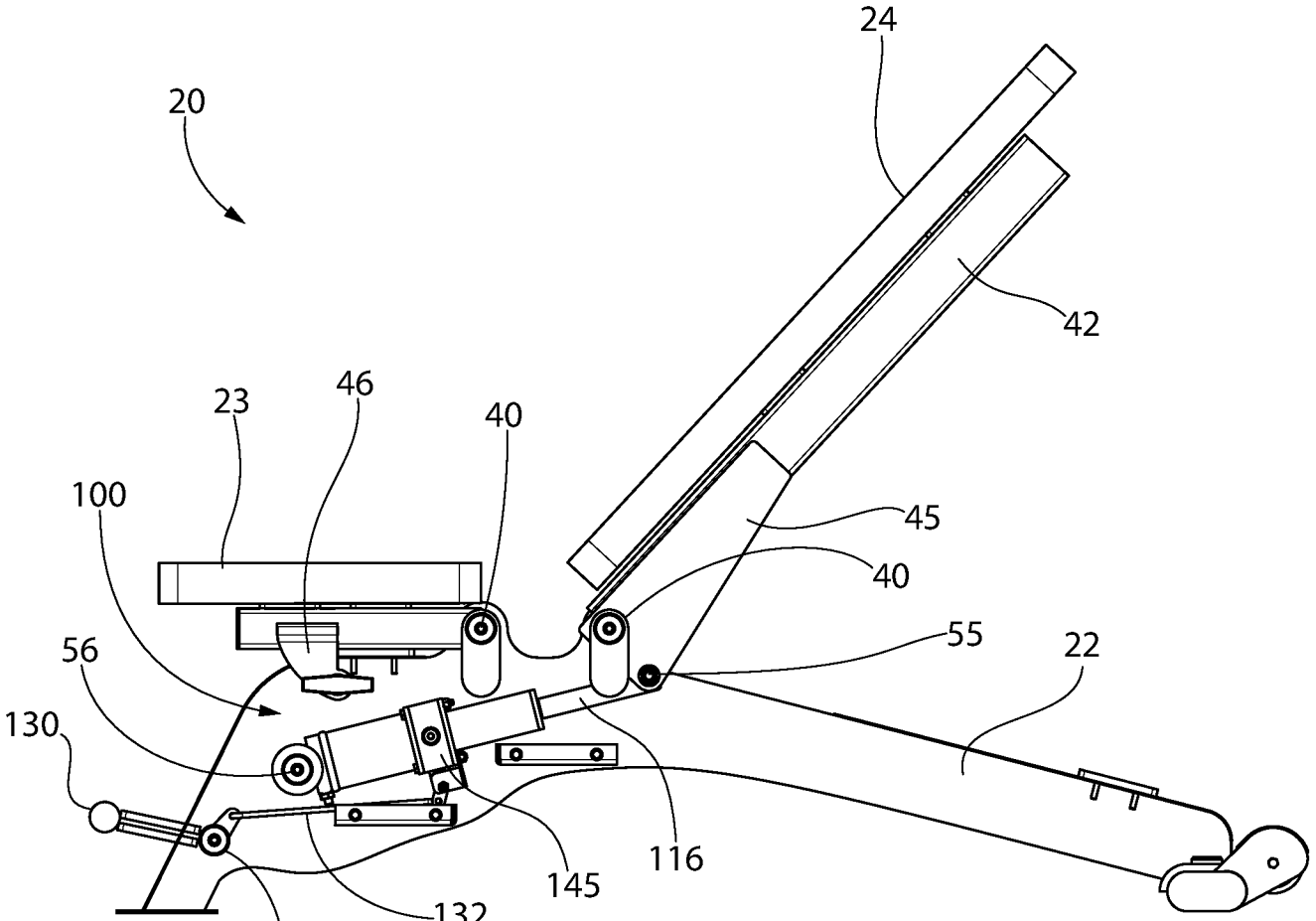
FIG. 11 is a left side view thereof with a portion of the frame removed.
Figure 21:
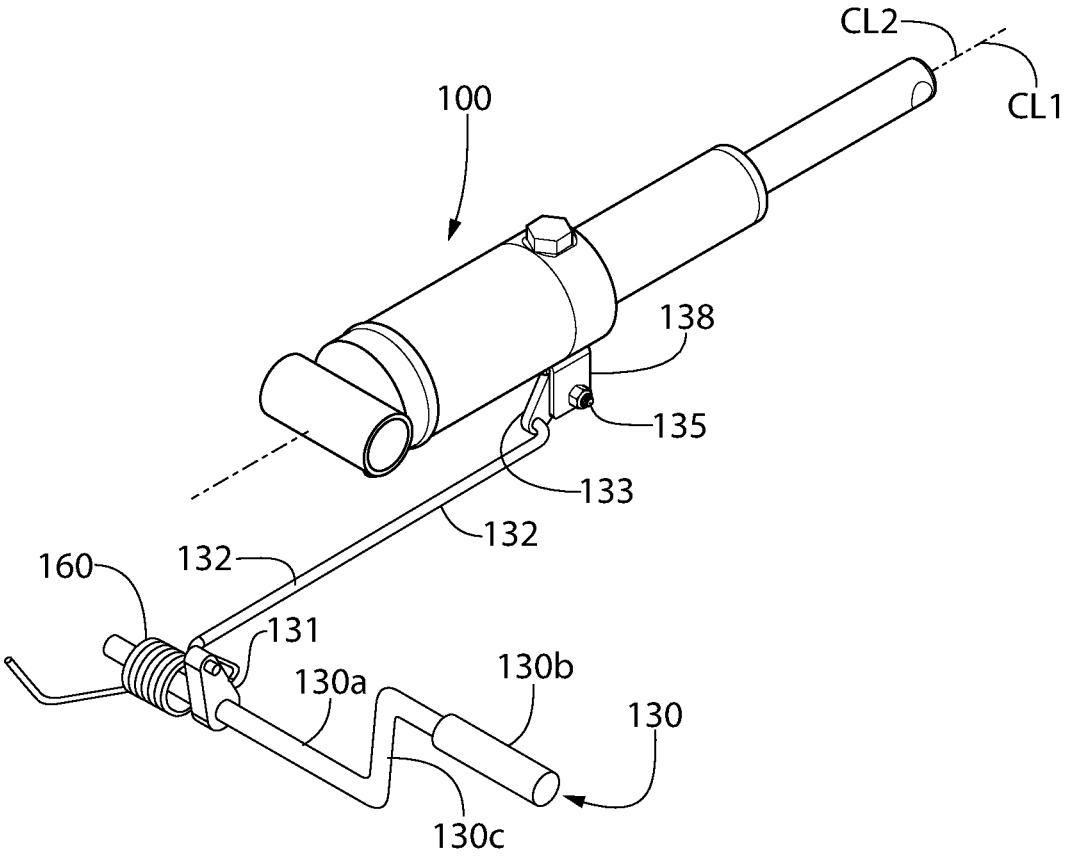
FIG. 21 is a front perspective view of one embodiment of a hybrid hydraulic cylinder system for operating the weight lifting bench of FIG. 1 and back pad assembly that comprises an integrated hydraulic cylinder, accumulator, and operating flow control valve assembly all in axial alignment.
Figure 22:
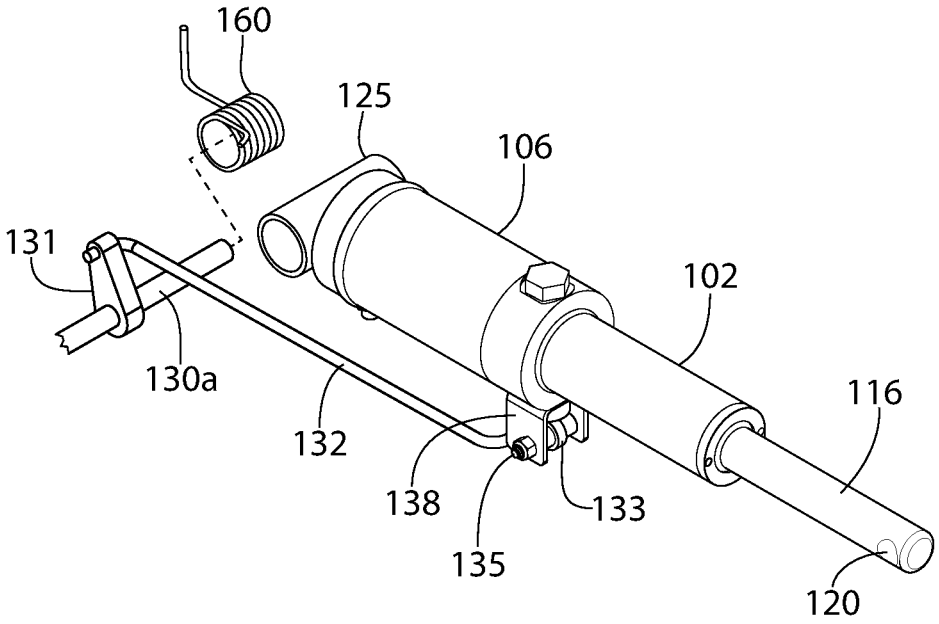
FIG. 22 is a rear perspective view thereof.
Figure 23:
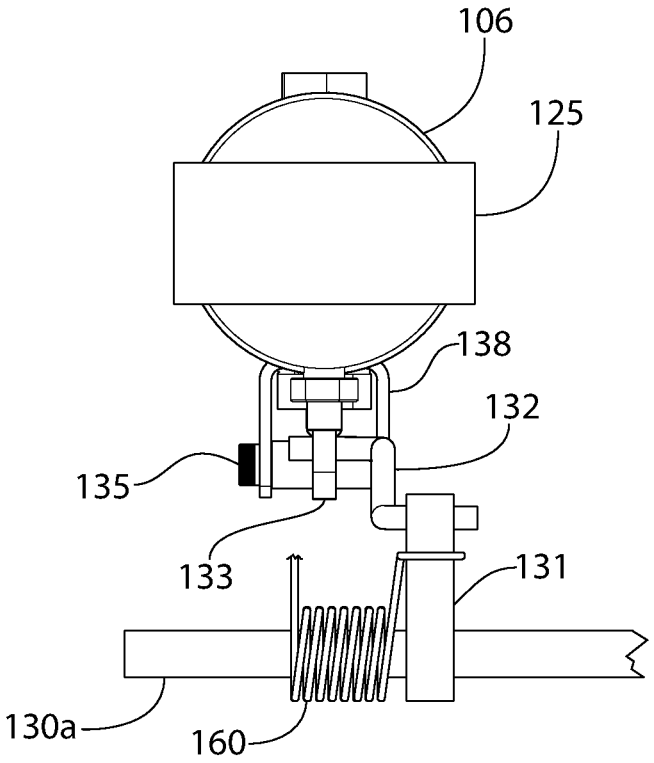
FIG. 23 is a front view thereof.
Figure 24:
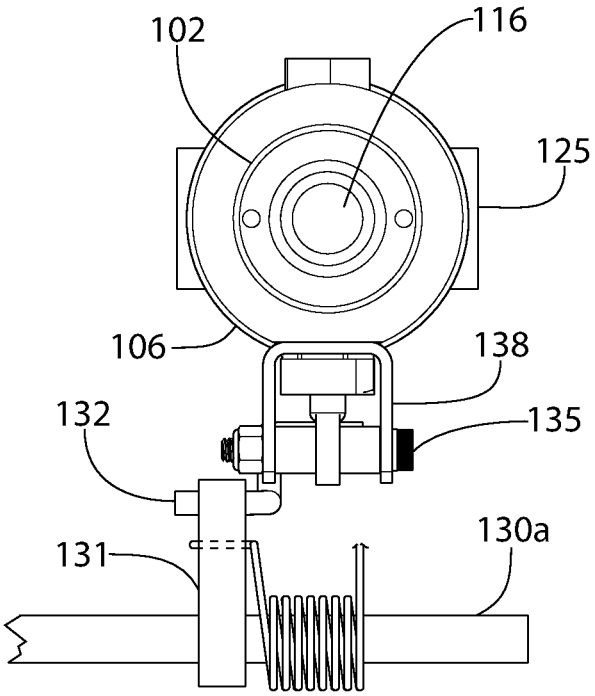
FIG. 24 is a rear view thereof.
Figure 25:
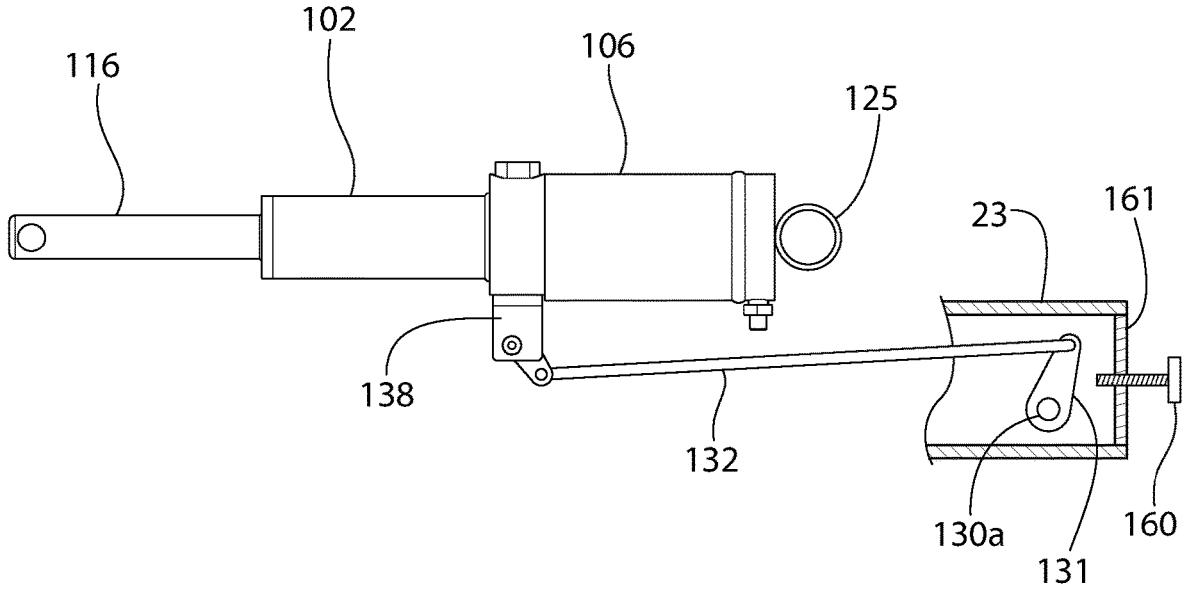
FIG. 25 is a side view thereof.
Figure 26:
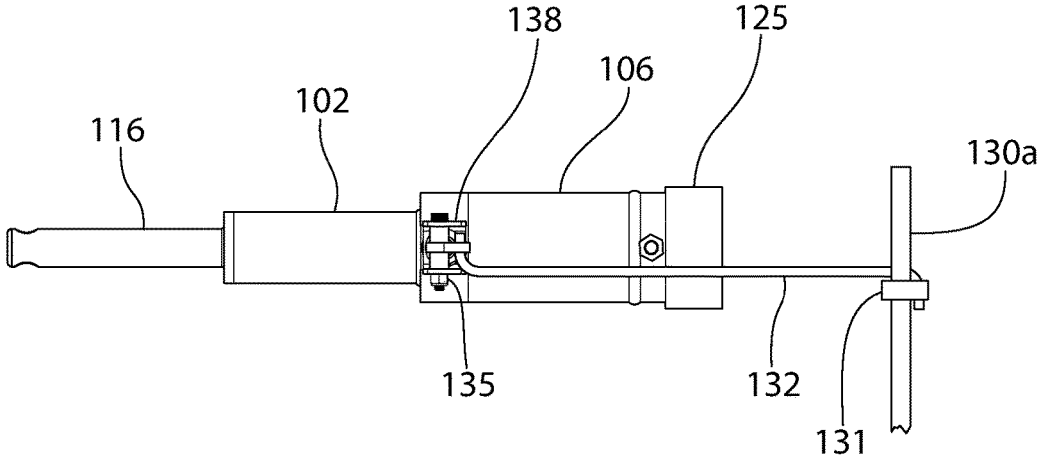
FIG. 26 is a top plan view thereof.
Figure 27:
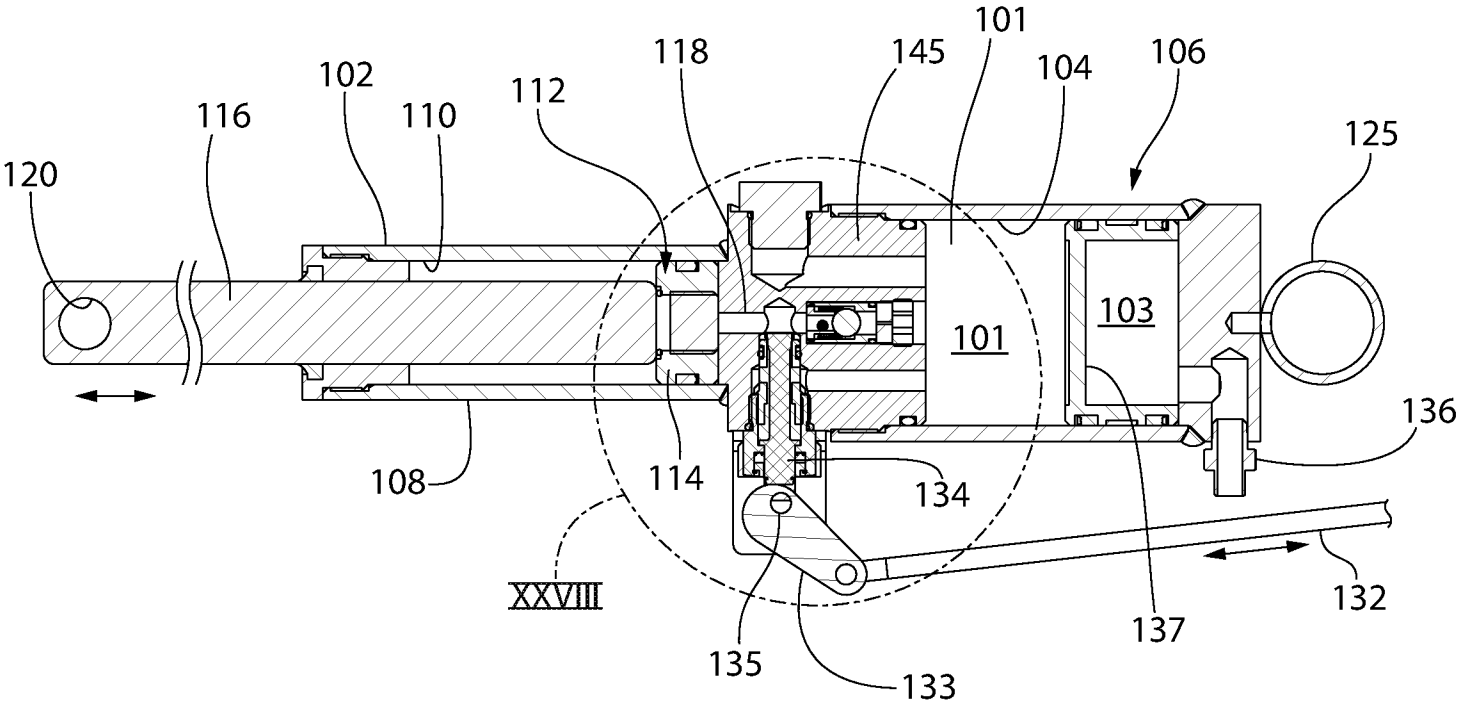
FIG. 27 is a longitudinal cross sectional view thereof.

Interaction of the foot lever or pedal 130 is briefly described. When the foot lever 130 is then released by the user, the lever automatically rotates back into the upward unactuated position under the biasing action of return spring 160, thereby moving the mechanical linkage 132 in an opposite direction back towards the rear head end 27 of the bench. FIGS. 10 and 21-22 show the return spring arrangement. In one embodiment, the return spring 160 may be torsion spring 160 arranged around cylinder mounting rod 52 of the T-shaped lever or the mounting section 130*a* of the S-shaped foot lever rod. One leg of the spring engages the frame 22 and the opposing leg engages the lever arm 131 of the foot lever assembly. This biases the lever arm 131 towards the rear end 27 (head end) of bench 20 (clockwise in FIG. 10), which in turn biases the foot lever 130 into the upwards unactuated position associated with full closure of the plunger valve 122. Without the return spring 160, the user would have to not only press the foot lever to open the valve, but then manually pull it back to close the valve. The automatic return of the foot lever is not only easier for the user to operate, but it is less problematic for the equipment to function as designed. In other possible arrangements, the torsion return spring 160 may alternatively be mounted to the valve assembly 145 around the pivot pin 135 supported by the support bracket or clevis 138 attached to the hydraulic cylinder assembly 100 such as the valve assembly 145. One leg of the spring may engage the toggle cam 133 and the opposing leg engages the clevis 138 or other part of the hydraulic cylinder assembly 100. The foot pedal 130 biasing action remains the same in this embodiment as described above, but the spring is mounted on the other end of the mechanical linkage 132 closest to the hydraulic cylinder instead of the foot pedal. It will be appreciated that other types of springs including helical compression springs, extension springs, etc. may alternatively be used to bias the foot lever into its upward unactuated position.

In order for the plunger valve 122 to stay open, the user must maintain pressure on the foot lever 130. If pressure is removed from the foot lever, the valve will close and the bench pad 50 will remain in a fixed position. This feature allows for "hands free" adjustable positioning of the back pad 24 without ever having to get off the equipment. When the weight lifter experiences maximum fatigue, he/she has the option to press the foot lever and lower the back pad 24 to a decline escape position closer to the ground until the weight (i.e. barbell) is removed safely by safety racks on the weight lifting rack, as further described herein.

By operation of the foot lever 130, the plunger valve 122 configured to function as an on, off, or throttling valve, is operable to create full flow when in a fully opened position, no flow in a fully closed position, and partial flow in a throttled position therebetween. The rate of descent at which the back pad 24 drops during an escape scenario or normal to reach a normal exercise position initiated by a user is determined by the amount that the valve 122 is open and gravity force generally of the weights of both the user and barbell held by user. In various embodiments, the rate of decent may be controlled automatically by the hydraulic cylinder flow control valve assembly 145 to achieve a safe controlled drop of the back pad 24 defining a bench descent speed control safety mechanism described below.

Bench Descent Speed Control Safety Mechanism

Prior weight lifting benches known having mechanisms for lowering the bench upon activation of a release mechanism did not provide a means for controlling the drop rate of the bench in an exercise escape scenario, thereby overlooking this important safety issue. The bench descent speed or rate control safety system according to the present disclosure however prevents the back pad 24 from slamming down when the foot lever 130 is depressed to initiate an escape scenario which may otherwise jolt the user creating a potential for injury. An automatic means for controlling the rate of descent for bench pad 50 to achieve a safe motion is provided in one embodiment by the pressure compensating valve 146 (which in the present embodiment is part of the valve assembly 145 described above). Valve 146 is preferably designed and set to maintain a preset pressure differential across the valve and hence flow rate through the valve regardless of pressure variations in the inlet hydraulic fluid stream that may be caused by users of different physical weights or handling barbell loads which may vary. Accordingly, the rate at which the bench pad 50 will drop when foot lever 130 is depressed downwards will always remain constant thereby reflecting a factory preset pressure differential regardless of whether a heavy or light user is seated on and using the bench, which affects the upstream pressure acting against the valve from the hydraulic cylinder 102 side of the valve. The preset pressure which coincides with the maximum predetermined speed or descent rate for bench pad 50 may preferably be set at the factory as a safeguard and is not adjustable by the user; however, the user may be provided with some ability to adjust the descent rate up to the maximum descent speed. The predetermined maximum descent rate of the bench is therefore independent of the weight load applied to the bench pad. Pressure compensating valves have a cartridge acted on by a spring that regulates the degree that the valve is open. The valve preset pressure differential/flow rate is preferably selected to provide flow of hydraulic fluid through the valve which provides a reasonable rate of descent for the bench pad 50 thereby avoiding a rapid uncontrolled drop jarring the user. Pressure compensating valves are available from numerous commercial sources such as Parker Hannifin Corporation and others.

Hybrid Hydraulic Cylinder Valve Assembly

FIGS. 41-54 depict the hydraulic cylinder assembly 100 of FIGS. 21-31 described in detail above with an alternative embodiment of a unique hybrid and pressure compensating flow control valve assembly 500 having a compact design. Functionally, the compact valve assembly 500 operates under the same principles as, but replaces pressure compensating flow control valve assembly 145 shown in FIGS. 21-31 with differences in the valve internals. In the compact valve assembly 500 design, the pressure compensating valve 502 interacts directly with and is engageable with the ball check valve 147 to control the position of the check valve. Advantageously, the separate plunger valve 122 is eliminated allowing for a more compact and mechanically simpler hydraulic cylinder design that achieves the same functionality with fewer parts due to the unique arrangement of valve elements.

Referring to FIGS. 41-54, pressure compensating flow control valve assembly 500 includes a valve body which defines a flow manifold block 504 comprising a vertically elongated axial central bore 506 for housing the pressure compensating valve 502 and check valve 147 components. Axial bore 506 defines a vertical centerline CL3 of the valve assembly. A plurality of internal fluid conduits defined by hydraulic cylinder and accumulator ports 507, 508 is formed by additional bores in the manifold block 504. Flow ports 507 and 508 may be oriented perpendicular to axial central bore 506 and centerline CL3 in one embodiment as illustrated; however, other orientations are possible. Flow port 508 creates a flow path between accumulator 106 and axial central bore 506. Flow port 507 creates a flow path between hydraulic cylinder 102 and the axial bore 506. Collectively, the axial central bore 506 and flow ports 507, 508 establish a fluid flow path between hydraulic cylinder 102 and accumulator 106 which is controlled by the pressure compensating valve 502 and check valve 147, as further described herein.

In one implementation, manifold block 504 further includes a first side recess 563 which receives an end of the cylindrical tube of the accumulator 106 and an opposing second side recess 564 which receives an end of the cylindrical tube of the hydraulic cylinder 102. The accumulator and hydraulic cylinder tubes may be inserted into the recess and sealed to the manifold block 504 to prevent leakage of hydraulic fluid by any suitable means. Forms of providing a leak-proof seal include without limitation bolted radial flanges and gaskets/seals, circumferential seal welds, shrink fitting, etc. The hydraulic cylinder 102 and accumulator 106 are cantilevered from the manifold block 504 in opposing directions in which the hydraulic cylinder and accumulator are coaxially aligned as illustrated. Other arrangements are possible.

Check valve 147 includes essentially the same cylindrical check body 503 that defines annular valve seat 147*a*, ball 147*c*, and spring 147*b* already described herein with respect to control valve assembly 145 shown in FIGS. 21-31. The valve seat 147*a* is defined by an internal annular shoulder formed inside the central passage 529 of the check body 503 which defines a flow orifice 562 therethrough which is alternatingly closed by the check ball 147*c* to prevent flow in one operating position, and opens in another operating position to permit flow through the check valve. In one embodiment, the check valve 147 may be disposed proximate to the lower of the manifold block 504 and in direct flow communication with flow port 507 which may similarly be disposed near the lower end of the valve body. Check valve 147 is oriented in a vertical position with the seat 147*a* being at the top and the ball and spring immediately below. Spring 147*b* biases the ball 147*c* upwards against the seat to close off the central flow passage 503 of and flow through the check body 503.

Figure 44:
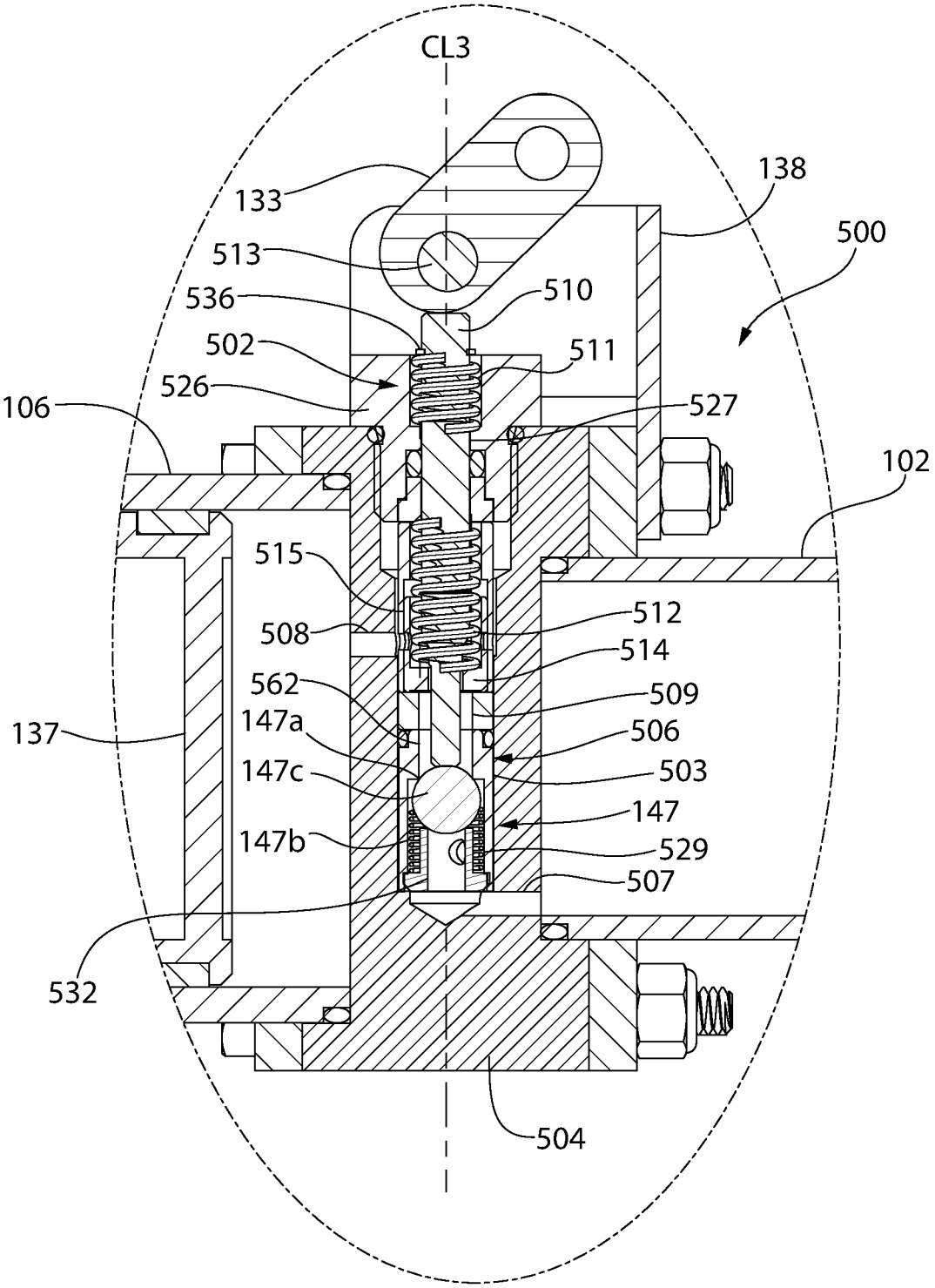
FIG. 44 is a detail side cross sectional view taken from FIG. 43 of the flow control valve assembly.
Figure 45:
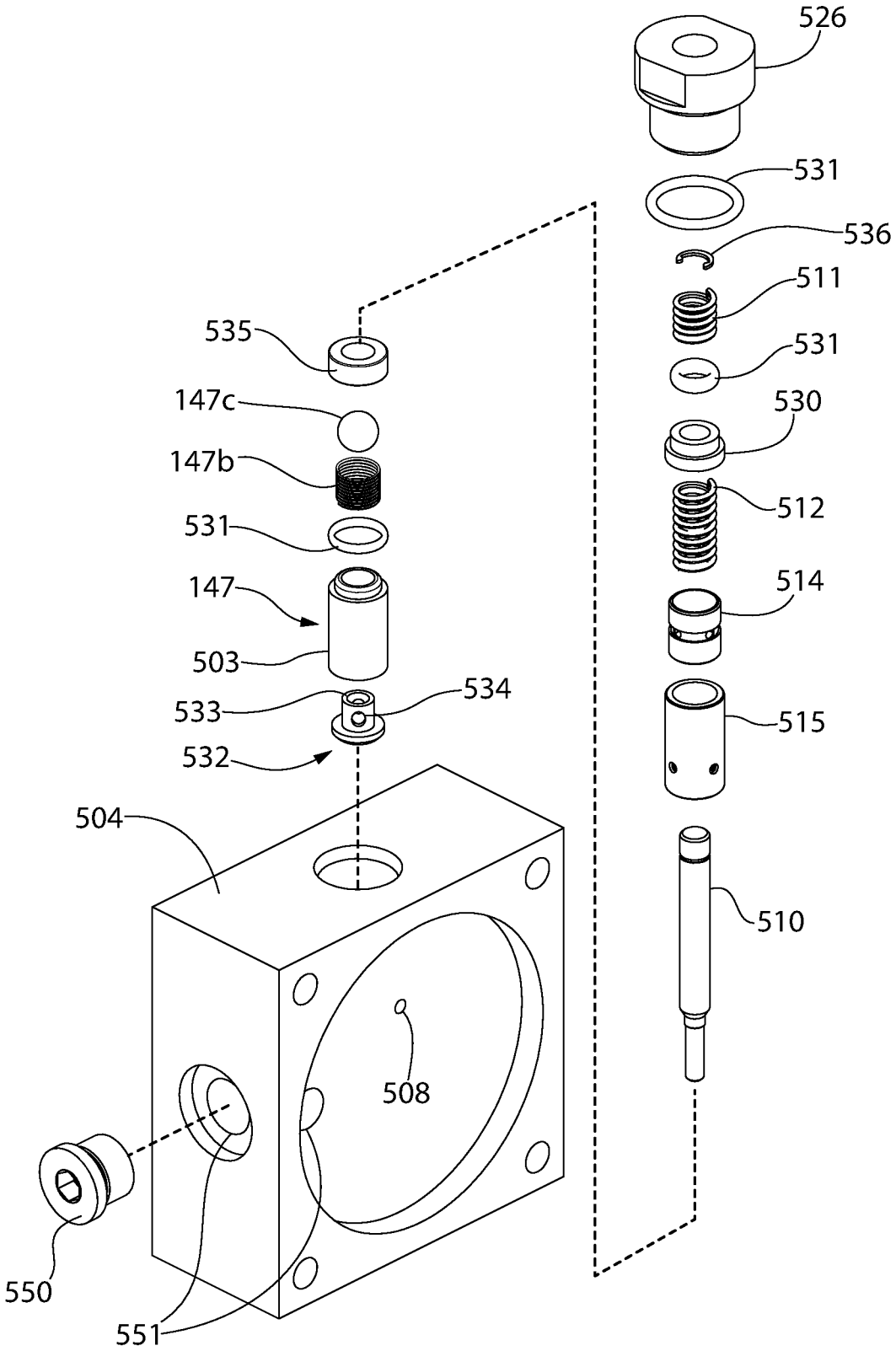
FIG. 45 is an exploded perspective view thereof.
Figure 46:
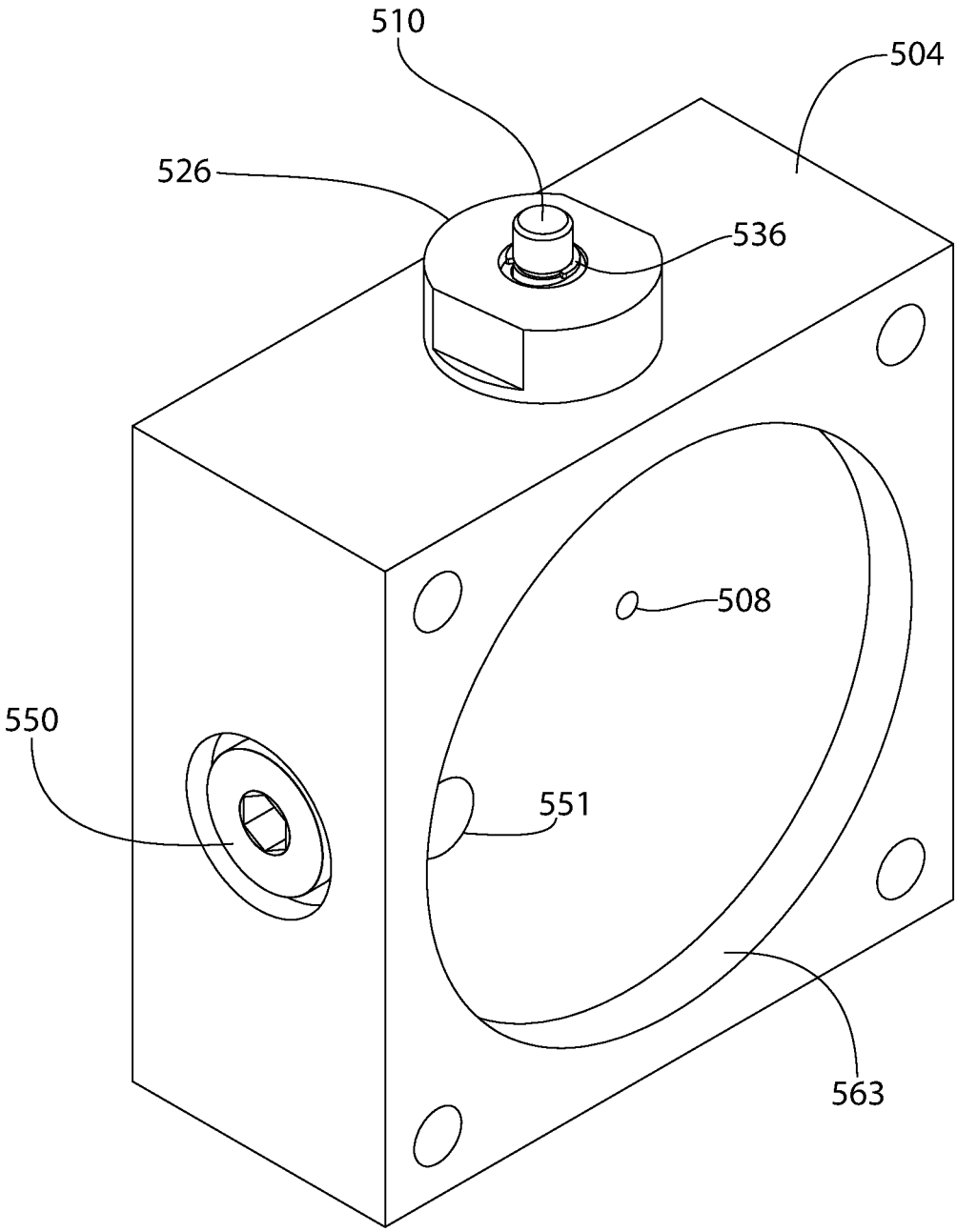
FIG. 46 is a first side perspective view thereof.
Figure 47:
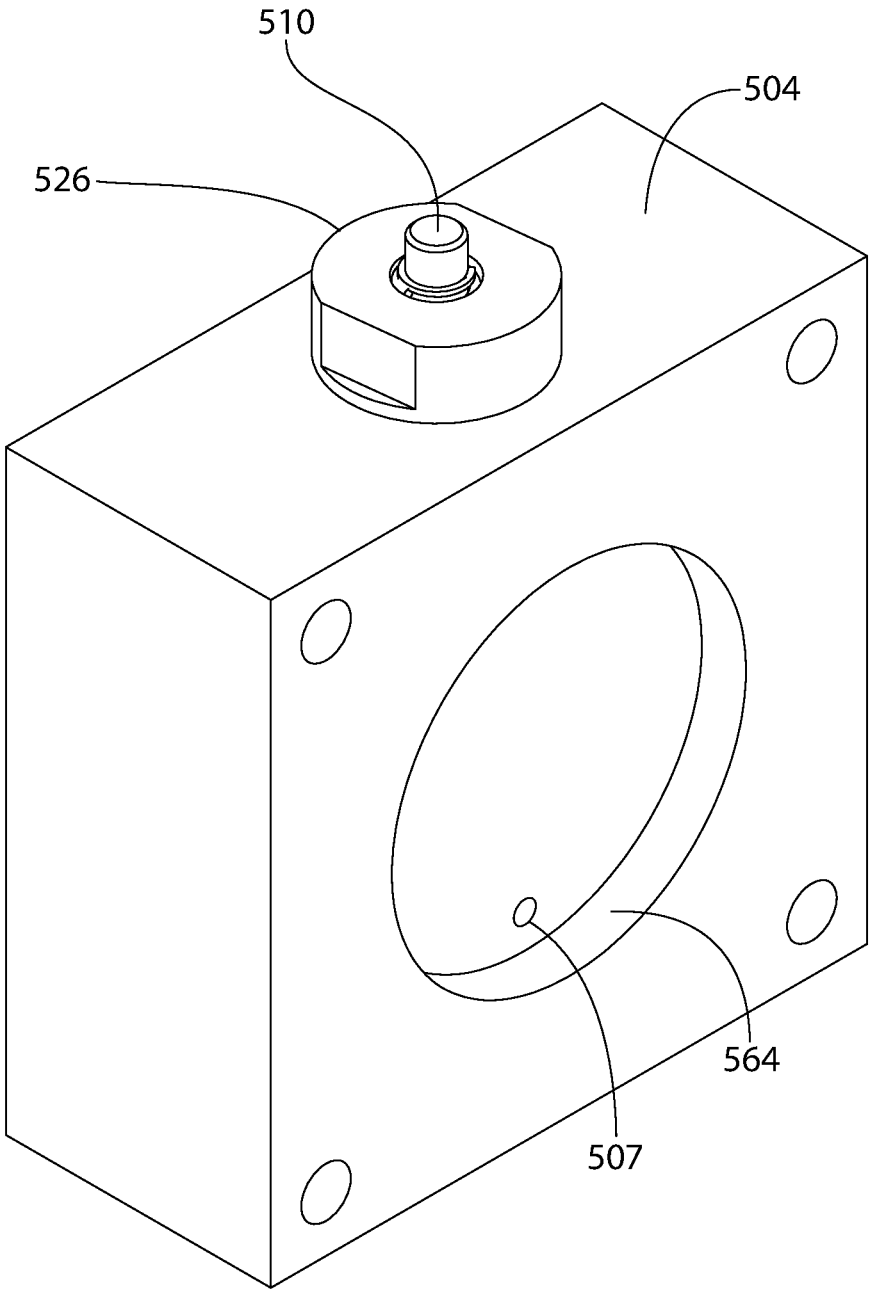
FIG. 47 is a second side perspective view thereof.
Figure 48:
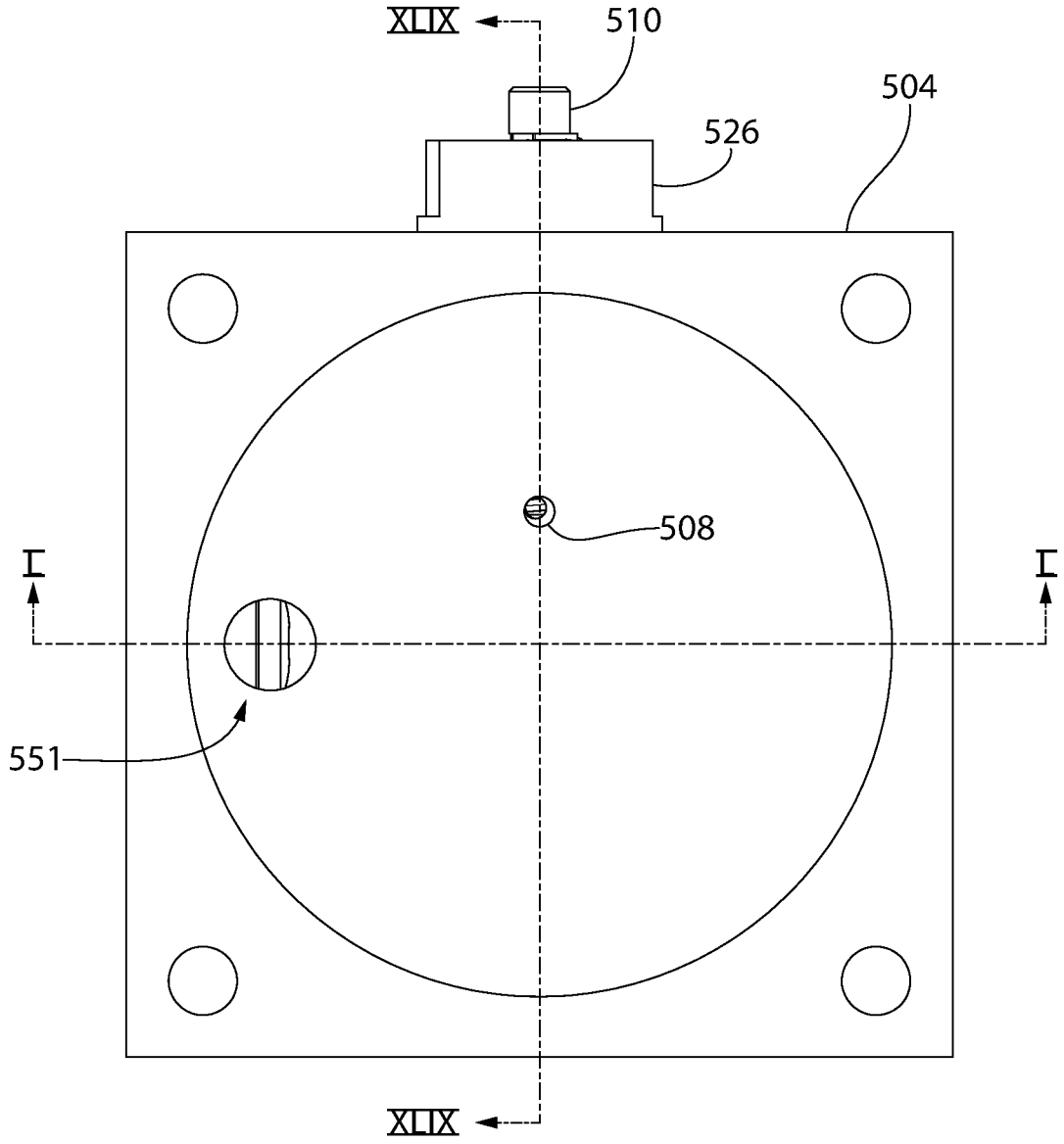
FIG. 48 is a front view thereof.

A generally cylindrical exhaust retainer 532 (see, e.g. FIGS. 45 and 53A-B) is positioned in the bottom of the axial central bore 506 of the manifold block 504. Retainer 532 has an axial through passage 533 and plurality of lateral flow openings 534 which communicate with the through passage 533. The exhaust retainer 532 nests inside the check body 503 as best shown in FIG. 44. The retainer 532 may have a diametrically enlarged head at the bottom end that may include chamfered sides to conform to the shape of the central axial passage 503 closed bottom end.

The pressure compensating valve 502 includes elongated cylindrical plunger 510 movable disposed in manifold block 504 for axial upward and downward movement between extended and retracted positions relative to the manifold block 504. Plunger 510 is biased in an upwards outward direction towards the extended position by return spring 511 toward toggle cam 133 pivotably mounted via pivot 513 to the manifold block 504 above the plunger. In this embodiment, the toggle cam 133 defines a valve operator whose position is changed by mechanism linkage 132 as previously described herein. The bottom end of spring 511 engages a socket disposed in the top of cap housing 526 and top end of the spring may be retained by a retainer clip 536 which engages an annular groove 537 in the plunger 510 (see, e.g. FIG. 54). The top end of the plunger 510 is acted on by the toggle cam 133 (i.e. cam surface 133*a*) and bottom end of the plunger acts on and engages check ball 147*c* as illustrated. Plunger 510 is alternatingly movable between (1) a lower unblocking position (see, e.g. FIG. 49B) to unseat the check ball 147*c* from its seat 147*c* to permit flow through the check valve, and (2) an upper blocking position (see, e.g. FIG. 49B) in which the ball 147*c* is seated to prevent or block flow through the check valve. Accordingly, plunger 510 is coaxially aligned with check valve 147 (and ball 147*c*) in one embodiment.

Figure 54:
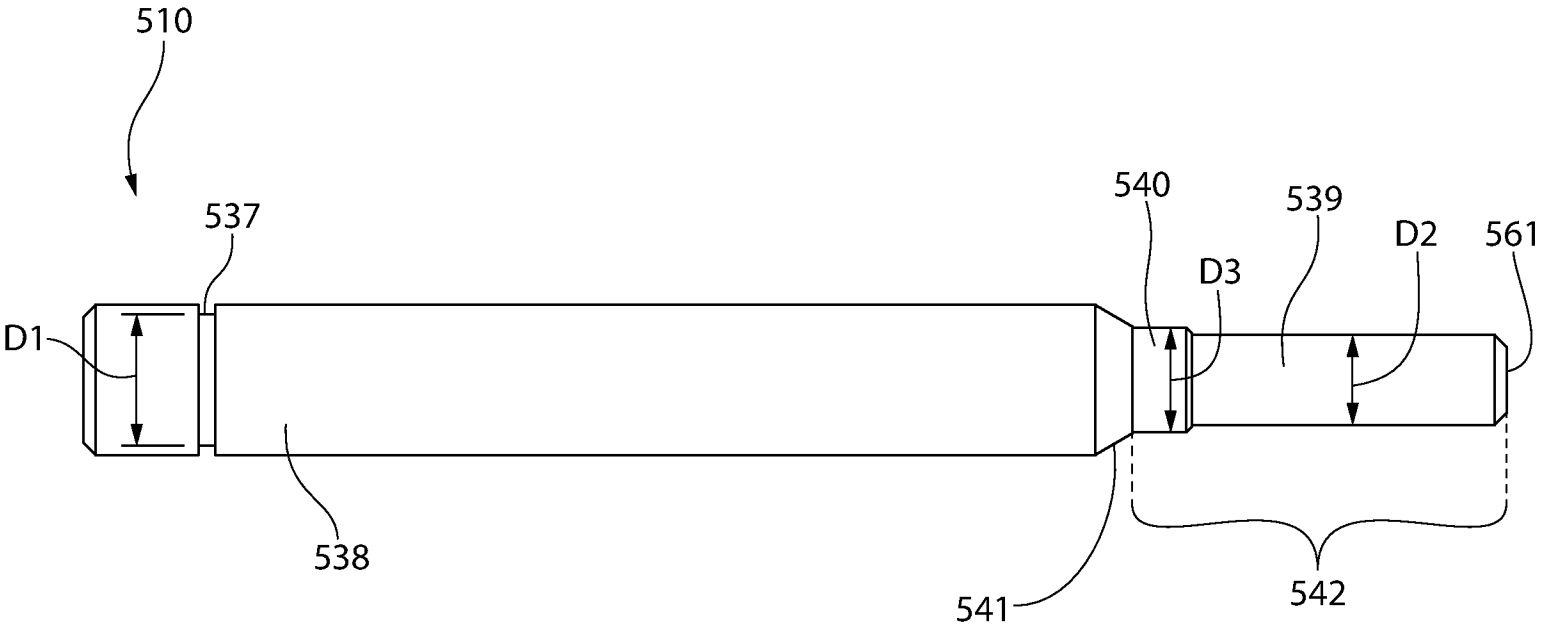
FIG. 54 is a side view of the plunger of the flow control valve assembly.

In one embodiment with reference to FIG. 54, plunger 510 includes an upper operating end 538 having a diameter D1 and a diametrically narrowed and stepped lower working end 542 of various diameters. The working end includes a terminal end segment 539 distal-most to the operating end and having a diameter D2, and an intermediate segment 540 spaced apart from the working end tip 561 of the plunger and adjoining the end segment 539. The terminal end segment 539 defines tip 561. The intermediate segment 540 has a diameter D3 which is larger than D2. Both D2 and D3 are smaller than D1. A frustoconical-shaped shoulder 541 forms a transition between the operating end 538 and working end 542 of plunger 510.

The working end 542 of plunger 510 interfaces with and is alternatingly projectable and retractable in a flow control orifice 543 defined by the head 525 of piston 514 (further described below and shown in FIG. 51A-C) to control the flow of the hydraulic fluid through pressure compensating flow control valve assembly 500 between hydraulic cylinder 102 and accumulator 106. The plunger 510 thereby provides a variable flow control orifice 543 in which the flow rate of hydraulic fluid depends on the position of the plunger in the orifice. Orifice 543 has a diameter D4 slightly larger than both diameters D2 and D3 to allow the working end 542 of plunger 510 to be received through the orifice. In one illustrative example, without limitation, orifice diameter D4 may be 0.180 inches, and the plunger working end diameters D2 and D3 may be 0.150 inches and 0.175 inches. In each instance, the flow area through flow control orifice 543 is defined by the diameter D4 minus diameters D2 or D3, as further described herein.

Pressure compensating valve 502 further includes flow control spring 512, a flow modulation device such as flow control piston 514, and flow control outer sleeve 515. The piston 514 is axially movable in a reciprocating quickly cycling fashion to alternatingly open and close the flow path between the hydraulic cylinder 102 and accumulator 106 when the flow control valve is in the open position with check ball 147 unseated. As best shown in FIGS. 51A-C and 52A-C, flow control piston 514 and sleeve 515 may each generally have a cylindrical tubular shape. Piston 514 has cylindrical sidewalls which define an internal flow control cavity 516 extending from and through bottom end 523 to top end 524 of the piston. The diameter of the flow control cavity 516 is smaller at bottom end 523 than the top end 524 and defines the flow control orifice 543 formed by a hole through piston head 525 at the bottom end, as illustrated. Similarly, flow control sleeve 515 has an open interior defining central passage 519 extending from bottom end 522 to top end 521. The diameter of the central passage 519 is smaller at bottom end 522 than the top end 521 forming an internal annular shoulder 560 of the sleeve. When the valve is assembled, the piston 514 nests inside sleeve 515 (i.e. passage 519) and is slideably movable therein with respect to the sleeve.

Flow control spring 512 is positioned inside axial central bore 506 of the pressure compensating flow control valve assembly 500 and acts on the piston 514. This biases the piston downwards inside the sleeve 515 in a direction towards the bottom of the valve axial central bore 506 (see, e.g. FIG. 49A). Spring 512 extends through both the piston and sleeve. The spring 512 is retained in the manifold block 504 by cap housing 526 removably mounted to the top end of the body in axial central bore 506. Cap housing 526 may include an upwardly/downwardly open central bore 527 through which the plunger 510 extends and is movable upwards/downwards therethrough. Return spring 511 is seated in the bore 527 around the upper portion of the plunger 510.

Plunger 510, piston 514, and ball check valve 147 are coaxially aligned and mounted in axial central bore 506 as shown for example in FIG. 44. Hydraulic fluid flows axially through these components and within the central passage parallel to the valve assembly centerline CL3 and both enters and leaves the central passage in a transverse direction to the centerline, as further described herein.

In one embodiment, flow control piston 514 includes circumferentially spaced apart lateral flow orifices 517 extending completely through the sidewalls of the piston from central passage 516. Similarly, flow control sleeve 515 includes circumferentially spaced apart lateral flow orifices 520 extending completely through the sidewalls of the piston from central passage 519. The outer surface of the piston sidewalls may include an annular slot 518 recessed into the sidewalls which is in fluid communication with the lateral flow orifices 517. Slot 518 extends only partially through the piston sidewalls.

The pressure compensating flow control valve assembly 500 further includes other valve appurtenances such as multiple seals 531 such as O-rings, an O-ring retainer 530 inserted into the cap housing 526 as shown, and check O-ring retainer 535. A bleed port 551 extending through the manifold block 504 and fluidly coupling the accumulator 106 to the ambient environment is provided for initially bleeding air from the hydraulic cylinder assembly. In one embodiment, the bleed port may be L-shaped; however, other shapes and orientations of a bleed portion may be used. A plug 550 which may be threaded into the manifold block 504 is provided which seals the bleed port 551 off during normal operation of the hydraulic cylinder assembly.

Operation of the hybrid pressure compensating flow control valve assembly 500 will now be briefly described. The bench auto-return and controlled descent features previously described herein function in the same general manner as before; the primary difference being in the hydraulic and air fluids flow control and path provided by the hybrid valve assembly. Accordingly, the flow schematic diagrams of FIGS. 38-40 remain applicable except plunger valve 122 shown therein is replaced by the present pressure compensating flow control valve assembly 500.

Figure 49A:
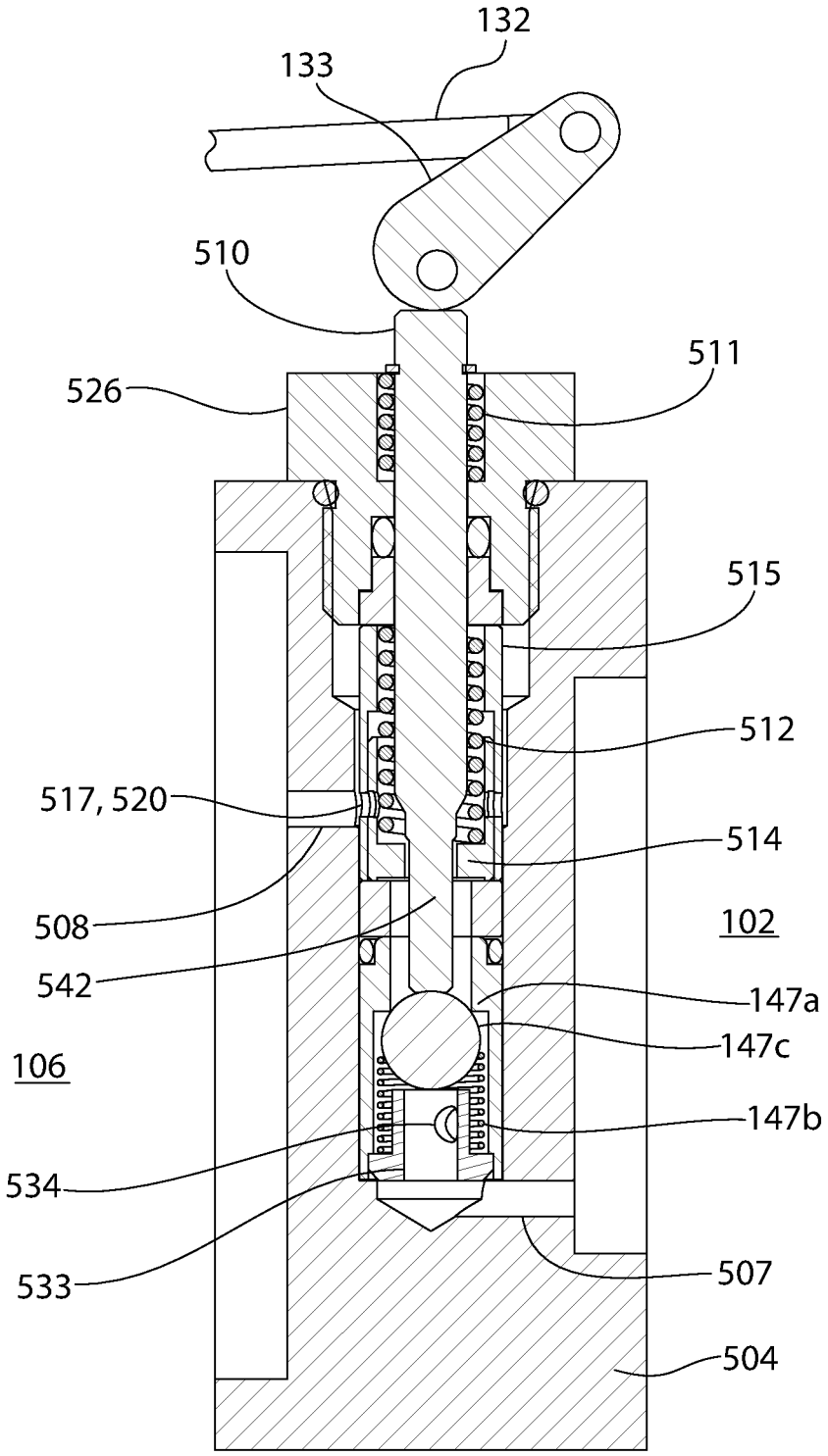
Figure 49B:
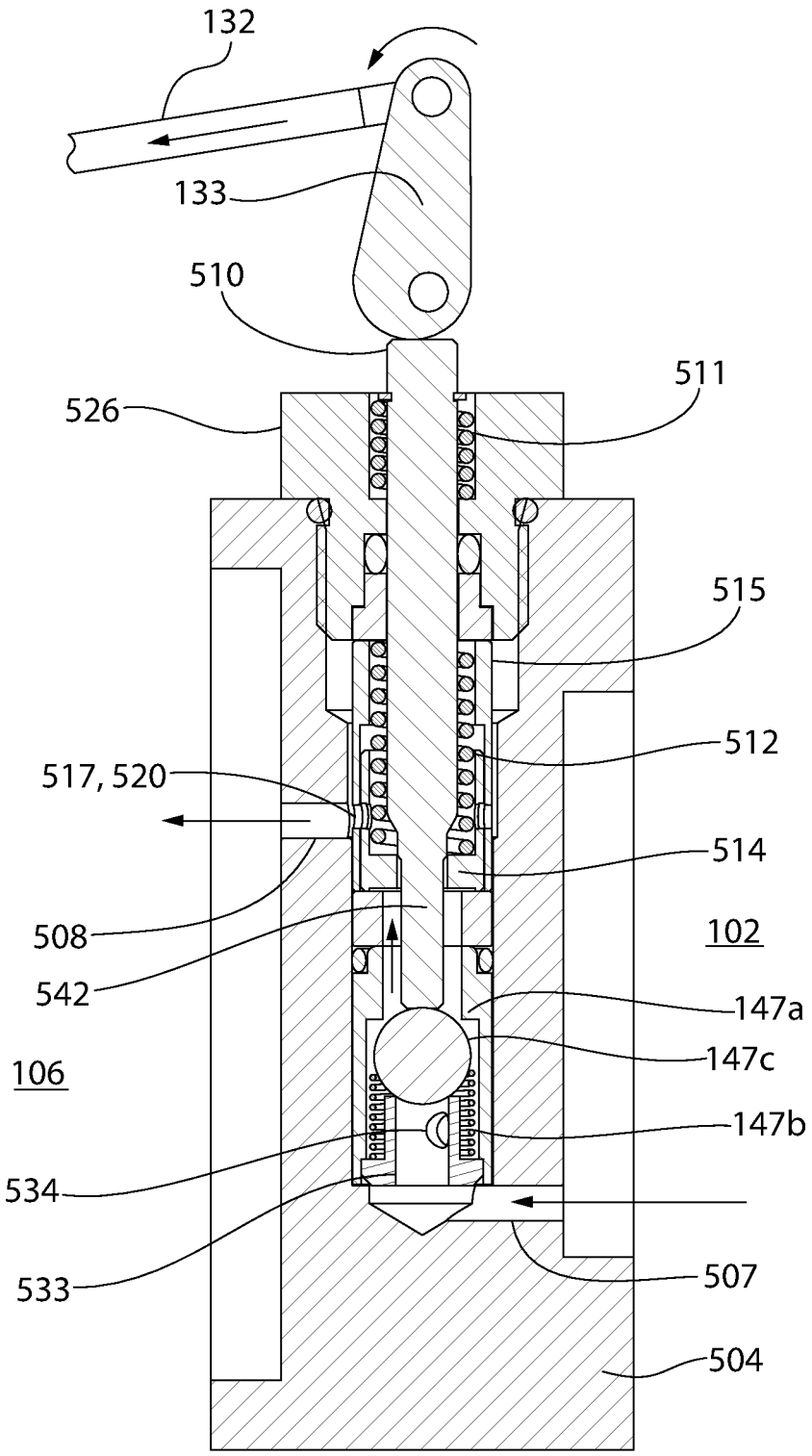

FIGS. 49A-D show sequential cross sectional images of the pressure compensating flow control valve assembly 500 during operation. FIG. 49A shows the valve assembly 500 in its initial position prior to a user seated on the bench initiating an escape scenario via actuation of the foot pedal 130. The hydraulic control system is in the state shown in FIG. 38A. Bench pad 50 is in the fully extended normal upper exercise position in which the exchange of hydraulic fluid 101 between the hydraulic cylinder 102 and accumulator 106 is stopped by a closed pressure compensating valve 502 and check valve 147. In this static state, plunger 510 is in the normally "valve closed" extended position and the cylinder rod 116 is fully extended and locked (bench in the full upright position). The flow control piston 514 is in it lower proximal position with piston head 525 abuttingly engaging the top of the check O-ring retainer 535. The lateral flow orifice 517 and annular groove/slot 518 of the flow control piston 514 are horizontally aligned with the lateral flow orifices 520 of flow control sleeve 515. It bears noting that the annular slot 518 eliminates the need for the lateral flow orifices 517 and 520 of the piston and sleeve respectively to be concentrically aligned to enable flow therethrough. Similarly, an annular gap is formed by clearance between the sleeve 515 and inside of the central axial cavity 506 of the flow manifold block 504 eliminating the need for the sleeve's lateral flow orifices 520 to be concentrically aligned with the accumulator port 508.

At this point in the bench descent operating process, the working end 542 of the plunger 510 is positioned in flow control orifice 543 of the piston 514. The working end tip 561 of the plunger is positioned proximate to (i.e. contacting or slightly spaced apart from) the check ball 147*c*. Check valve 147 is closed and its ball is fully biased upwards and seated on valve seat 147*a* via spring 147*b*, thereby blocking the flow path of and preventing hydraulic fluid from flowing from the hydraulic cylinder 102 to the accumulator 106 through valve 502. The hydraulic fluid 101 is pressurized by the weight of the user, added equipment weight of the bench pad assembly, and any free weights being held by the user at the time.

When the user then initiates an escape scenario as already described herein by pressing down on the foot pedal 130, the bench pad 50 and user will begin to descend at a regulated controlled rate as a result of the pressure compensating flow control valve assembly 500. The flow diagram of FIG. 38B is applicable to this stage in the benches' operation. The plunger 510 is pushed downwards via rotation of the toggle cam 133 to the "valve open" retracted position shown in FIG. 49B (noting that the operated end of the plunger need not be even flush with the outer surface of the manifold block 504 or recessed therein in the retracted position). The bottom tip of the plunger 510 if not previously contacting the check valve ball 147*c* engages and displaces the ball downwards pushing it off of its annular valve seat 147*a*. This opens flow control orifice 543 allowing hydraulic fluid flow in the path shown in FIG. 38B from the hydraulic cylinder 102, through the open check valve, into the pressure compensating valve 502, and finally then into the accumulator cavity. This causes the cylinder rod 116 to retract into the cylinder at a constant speed rate regardless of weight/force on the bench and cylinder rod. Because the pressure in the hydraulic cylinder 102 is initially greater than inside the piston flow control cavity 516 and air 103 in accumulator 106, hydraulic fluid flows through the lower port 507 and upwards through the check valve 147. The hydraulic fluid flows into exhaust retainer 532 from port 507 and laterally outwards therefrom through the lateral openings 534 of the exhaust retainer, around the ball 147*c*, and then upwards in the valve through the flow control orifice 543 and into the flow control cavity 516 of piston 514. At this point, the lowermost terminal end segment 539 of plunger 510 remains positioned in the flow control orifice 543, thereby defining a first flow area formed by the open annular space between the plunger and orifice.

It bears noting that the constant speed rate of descent of the bench pad 50 under compression is achieved by the upwards/downward axial reciprocating motion of the flow control piston 514, which in some embodiments may cycle on a nearly continuous basis as and until the bench moves from the upper position to lower escape position. When the piston is pressurized initially by the hydraulic fluid as described immediately above, the hydraulic fluid pressure acts on the bottom face (end 523) of the piston head 525 causing the piston 514 to move upwards against and compressing flow control spring 512 because the pressure on the face of the piston is greater than the initial pressure inside the piston flow control cavity 516 (see FIG. 49C). This temporarily partially or fully closes the port 508 to the accumulator chamber 104 since the lateral flow orifices 517 and annular slot 518 of the piston 514 become horizontally misaligned with the lateral flow orifices 520 of sleeve 515, thereby partially or fully blocking flow from the piston flow control cavity 516 to the port 508 (see, e.g. FIG. 49C). Hydraulic fluid flow from hydraulic cylinder 102 into the pressure compensating valve 502 is thus restricted and minimized, thereby reducing the bench descent rate. As further seen in FIG. 49C, the diametrically larger flow intermediate segment 540 of the plunger 510 is now positioned in the flow control orifice 543 of the piston 514, creating a second flow a rear between the orifice and plunger which is less than the first flow area created when the terminal end segment 539 was positioned in the orifice. This further acts to instantaneously reduce hydraulic fluid flow and slow the bench descent rate.

Figure 49C:
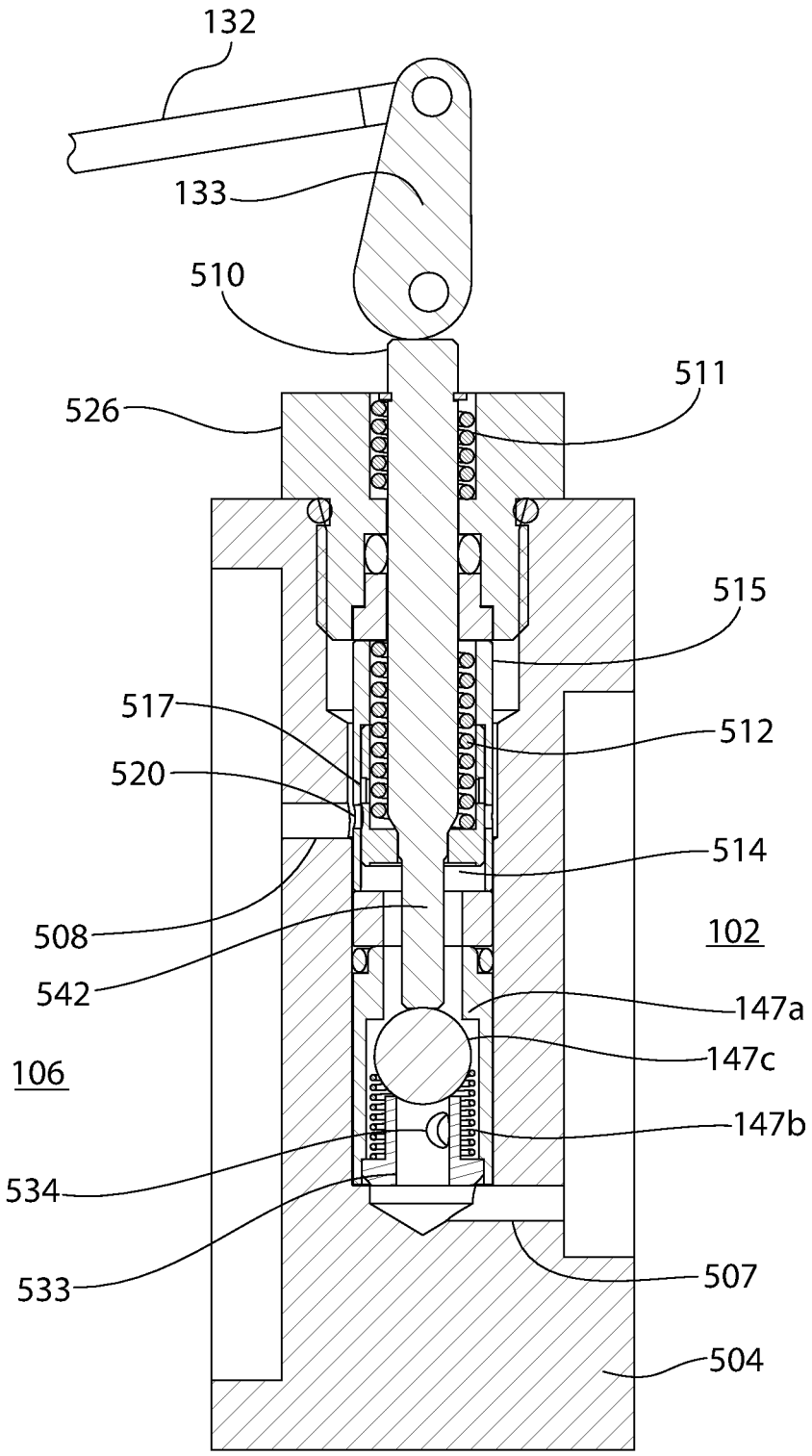
Figure 49D:
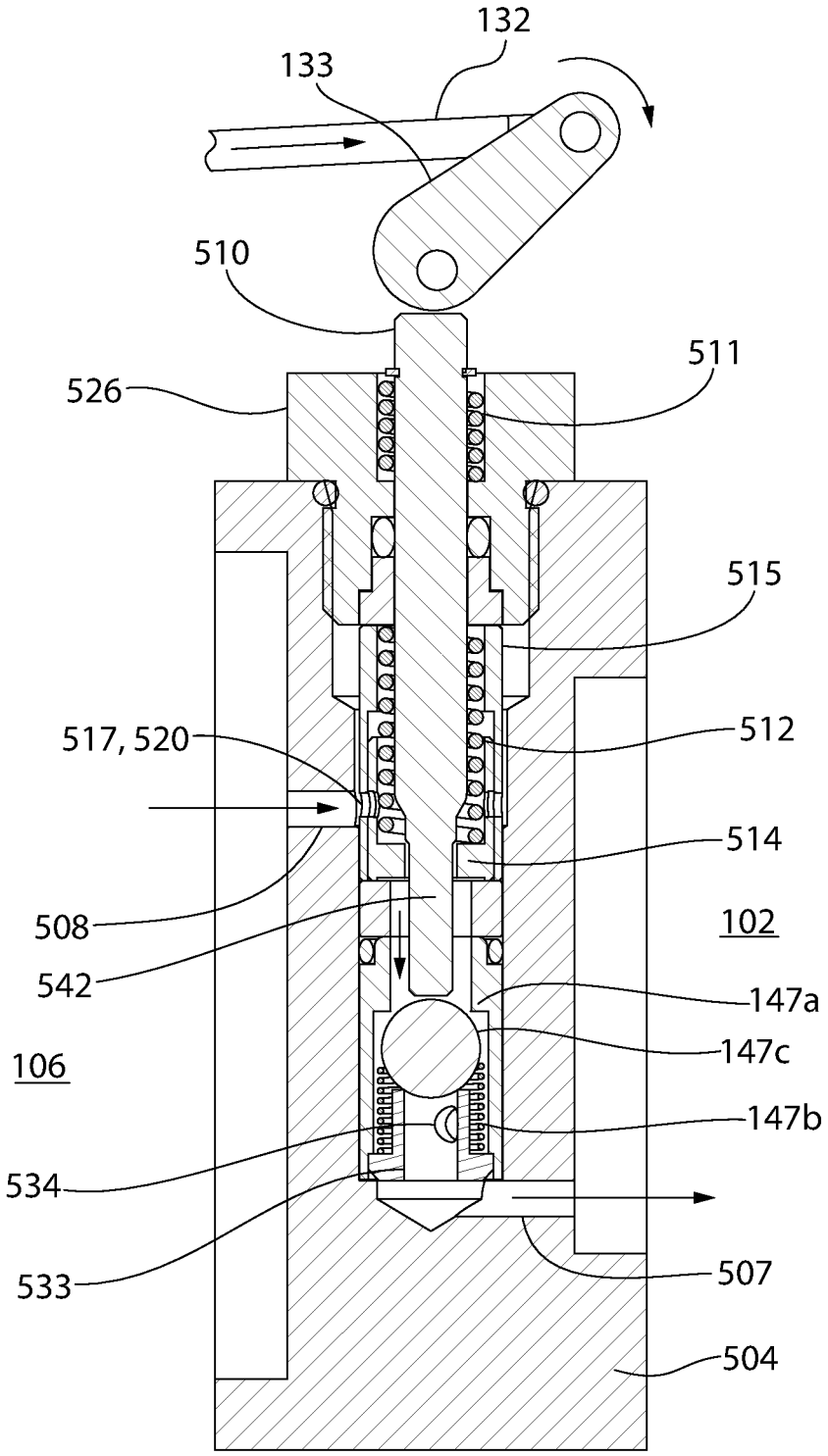
Figure 50:
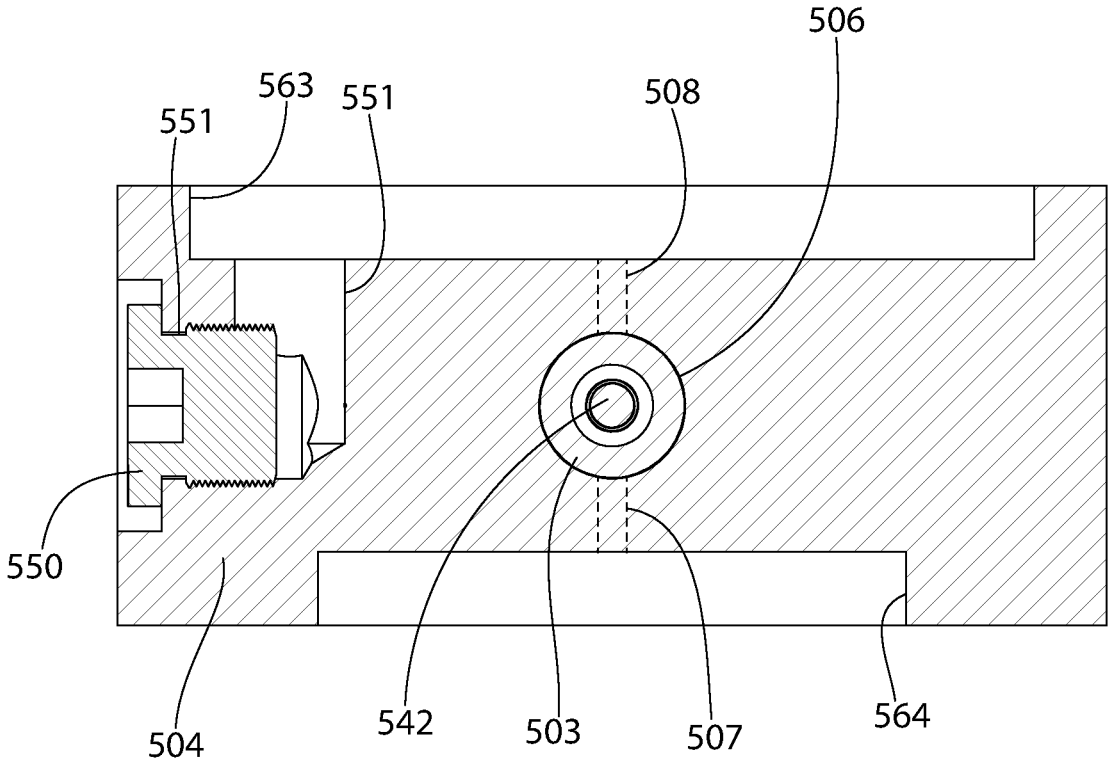
FIG. 50 is a top cross sectional view of the flow control valve assembly taken from FIG. 44.
Figure 51A:
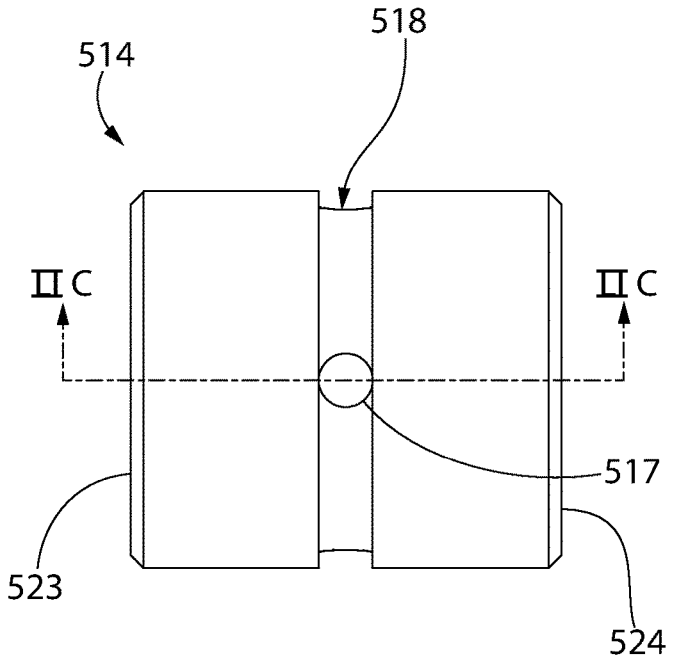
FIG. 51A is a side view of the piston of the flow control valve assembly.
Figure 51B:
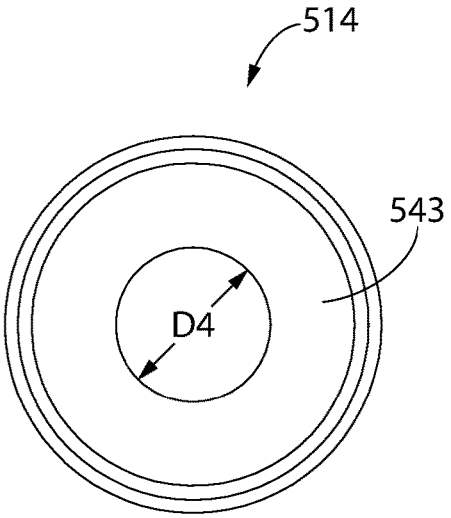
FIG. 51B is an end view thereof.
Figure 51C:
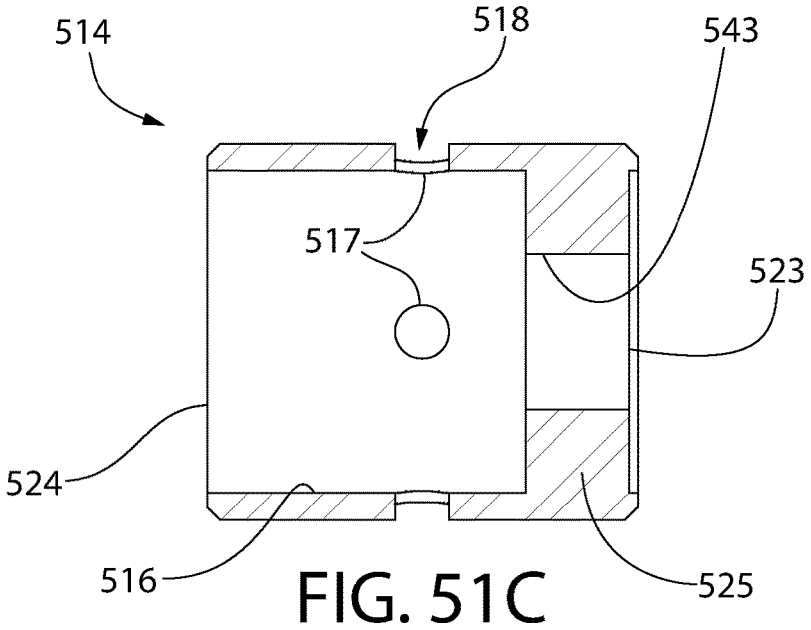
FIG. 51C is a side cross sectional view thereof.
Figure 52A:
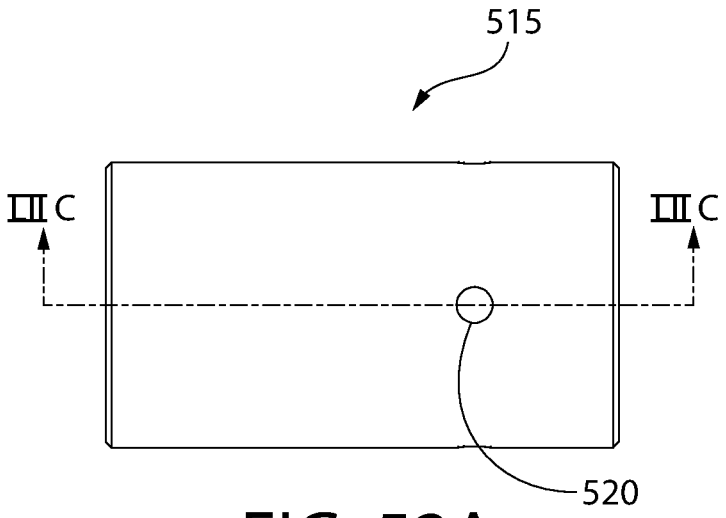
FIG. 52A is a side view of the piston sleeve of the flow control valve assembly.
Figure 52B:
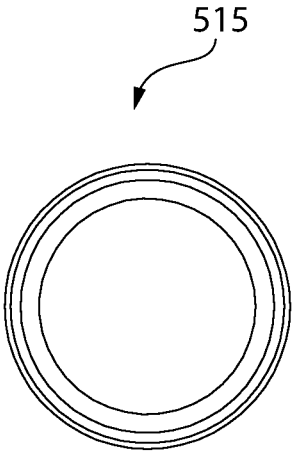
FIG. 52B is an end view thereof.
Figure 52C:
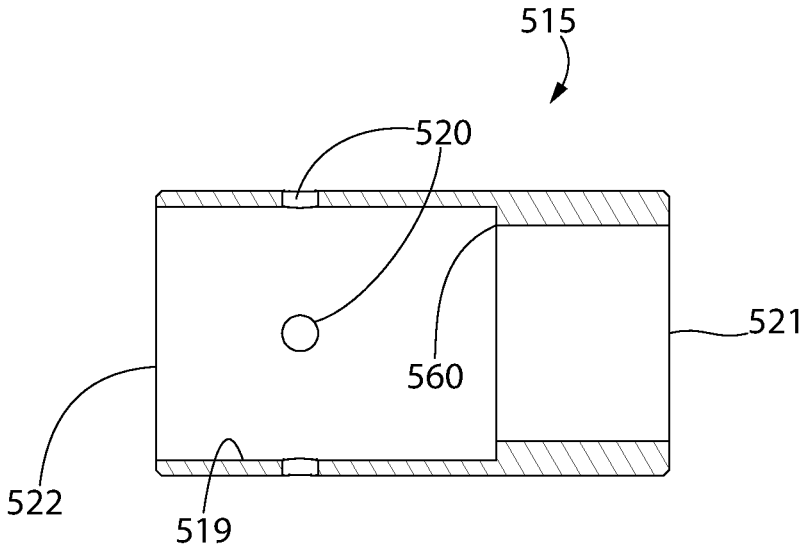
FIG. 52C is a side cross sectional view thereof.
Figure 53A:
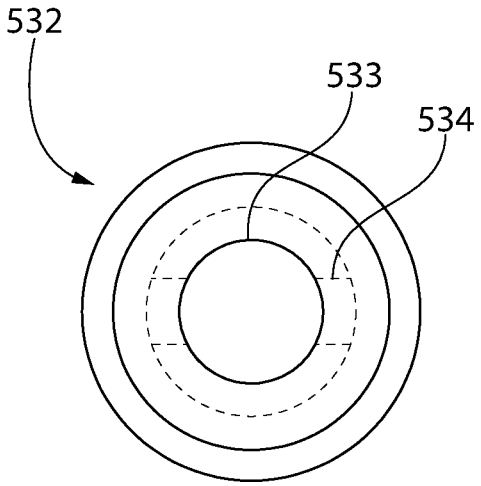
FIG. 53A is an end view of the exhaust retainer of the flow control valve assembly.
Figure 53B:
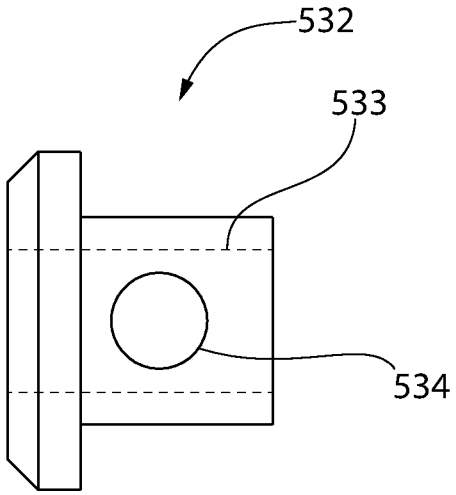
FIG. 53B is a side view thereof.

It bears noting that the maximum upward travel of the piston 514 within outer sleeve 515 is limited by the vertical gap shown in FIG. 48A between the top end 524 of the piston and internal annular shoulder 560 of the sleeve (see also FIGS. 51 and 52) which is formed when the piston is in its lower proximal position relative to check valve 147. In FIG. 49C, this gap is eliminated when the piston 514 is in its upper distal position relative to the check valve.

As the pressure in the piston internal flow control cavity 516 becomes equalized and balanced with the hydraulic pressure on the hydraulic cylinder side of the piston head 525, the biasing action of the flow control spring 512 now is enable to actively press the flow control piston 514 back down to its lower proximal position in a downward movement which again opens the accumulator port 508 as the lateral flow orifices 517, 520 of the piston and outer sleeve 515 become horizontally aligned again. This allows greater hydraulic fluid flow from the hydraulic cylinder 102 into the accumulator chamber 104. This causes the cylinder rod 116 compression/retraction rate and bench descent rate to increase slightly temporarily until the pressure in the piston internal flow control cavity 516 decreases enough to move the flow control piston upward again as describe above when the piston once again partially or fully closes the accumulator port 508 to hydraulic fluid flow.

This foregoing reciprocating piston motion and feedback loop is achieved by the unique design of the pressure compensating valve 502 that provides a constant hydraulic cylinder compression/retraction rate regardless of how much pressure/force is applied to the cylinder rod by the bench and user's weight. Advantageously, this minimizes the possibility of injury to the user caused by rapid dropping and stopping of the bench. It bears noting that the foregoing cyclical motion of the reciprocating piston occurs relatively rapidly and repeats sequentially during the time that the bench pad 50 is in the process of descending until the lower escape position is reached.

Figure 39:
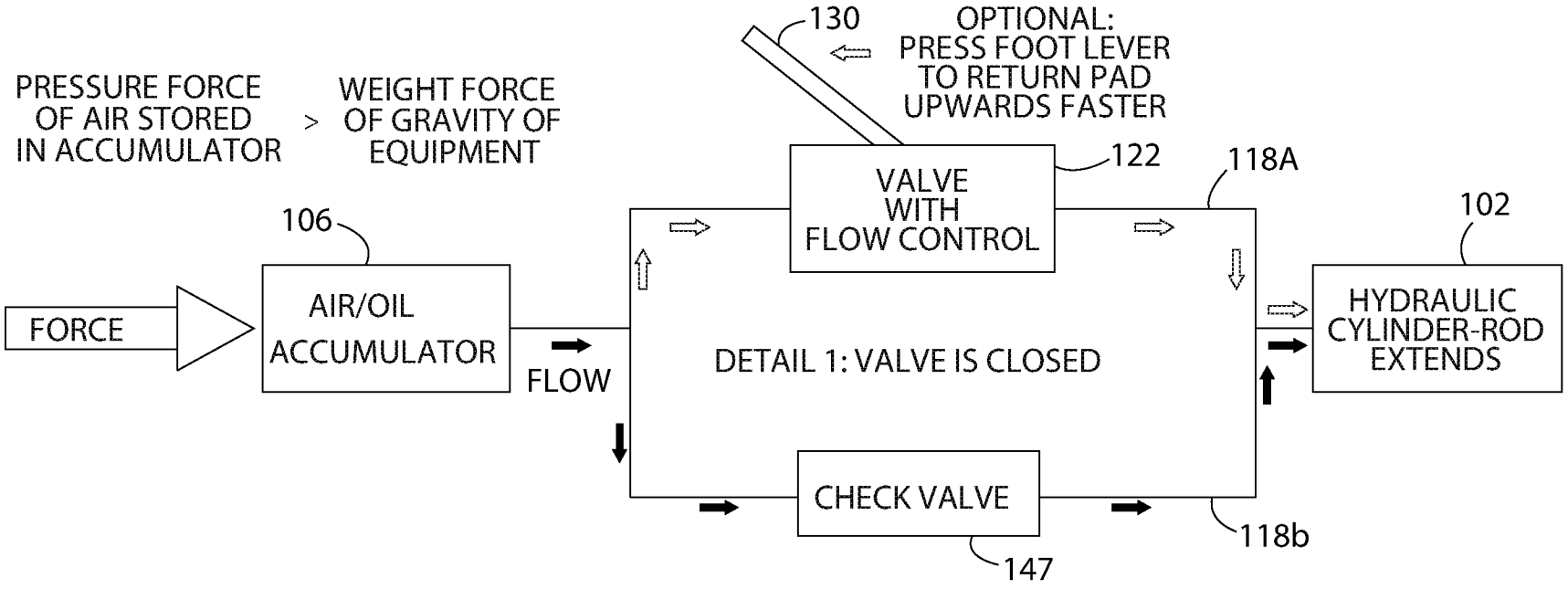
FIG. 39 is a schematic flow diagram of the hydraulic control system in a state when the automatic back pad return mechanism is activated and the back pad is in the process of ascending toward an uppermost exercise position in which hydraulic fluid flows from the accumulator to the hydraulic cylinder via a check valve and/or an open plunger valve.

After the bench pad 50 reaches it lowermost decline escape position, the user may then exit the bench and release the foot pedal 130 to activate the bench auto return feature. The flow diagram of FIG. 39 is applicable to this stage in the benches' operation which initiates the bench auto-return feature. The pressure compensating flow control valve assembly 500 now returns to the position shown in FIG. 49D. When the cylinder rod 116 becomes unloaded (user removed from bench), and is in partial or full compression/retraction into the cylinder 102, and plunger 510 is returned upward via urging by return spring 511 back to its normally extended position, the pressurized hydraulic fluid in and from the accumulator 106 is forced back through check valve 147 causing the cylinder rod to extend and lock in the fully extended position. The bench pad 50 return Because the pressure of the hydraulic fluid in the accumulator is greater than on the hydraulic cylinder side of the pressure compensating valve 502, the fluid from the accumulator is able to displace downward and unseat the ball 147*c* of the check valve 147 permitting flow through the valve to the hydraulic cylinder as shown despite the fact that the plunger 510 is upward and not forcing the ball from its seat. Once the pressure balances between the hydraulic cylinder and accumulator side of the pressure compensating valve 502, the ball will again return upward via the spring and seat, thereby closing the flow path through the valve as seen in FIG. 48A at the beginning of the process.

Although the flow control valve assembly 500 is shown for convenience of description without limitation in a vertical oriented herein, it will be appreciated that the valve assembly may be used in any other suitable angular orientation because the foregoing valve components do not rely on gravity for operation of the valve as described above. The piston 514, plunger 510, and ball check valve 147 are spring biased which allows multiple possible orientations of the valve assembly while still retaining its full functionality. For example, the hydraulic cylinder assembly 100 shown in the weight lifting bench 20 of FIGS. 1-16 herein is disposed obliquely to the vertical and horizontal. Accordingly, the flow control valve assembly 500 is expressly not limited in its applicability to any particular orientation.

Adjustable Flow Control Valve

In an example of a manual type speed control mechanism to regulate the rate of descent of the bench pad 50 shown in FIGS. 32-37, a manually adjustable flow control plunger valve 150 assembly may be provided instead of or in addition to the speed stop 140 described above for fail safe redundancy. The pressure compensating valve 146 is omitted in this design. The adjustable flow control plunger valve 150 may be similar to plunger valve 122, but also includes a rotary stop cam 197 configured to permit external adjustment of the amount of hydraulic fluid flow between the hydraulic cylinder 102 to the accumulator 106. This allows the user to manually adjust the maximum flow rate of hydraulic fluid that passes through the valve to in turn control the rate at which the bench drops when the foot lever 130 is actuated. In one embodiment, the rotary stop cam 197 may be a rotary type knob having a working end inside the valve which interfaces with the plug assembly 152, as further described below.

Referring still to FIGS. 32-37, a hydraulic cylinder assembly 100 comprising adjustable flow control plunger valve 150 is shown having an accumulator 106 which is not coaxially aligned with the hydraulic cylinder 102 like that shown in FIG. 22. Instead, the accumulator 106 is mounted alongside the hydraulic cylinder such as on the top (shown), bottom, or either lateral side such that the axial centerline CL2 of accumulator 106 is parallel to but spaced radially apart from axial centerline CL1 of the hydraulic cylinder 102 in a "piggy-back" type mounting arrangement. In other possible embodiments, the accumulator 106 may be disposed at a 90 degree or oblique angle to the hydraulic cylinder. In yet other possible embodiments, the accumulator 106 may be mounted separately from the hydraulic cylinder 102 in any position and on any appropriate part of the frame 21, and further fluidly connected to the hydraulic cylinder by a flow conduit such as tubing or piping. The mounting position and arrangement of the accumulator with respect to the hydraulic cylinder is not limiting of the invention.

Referring to FIGS. 32-37, the adjustable flow control plunger valve 150 may be mounted on the front or foot end of the hydraulic cylinder 102 as shown. Valve 150 has an axially elongated body 150*a* comprising a cylindrical front end 300 and a diametrically enlarged rear end 301. Rear end 301 is inserted into the open front end 302 of hydraulic cylinder 102 and interfaces with the piston head 114. A pair of annular seals 303 such as O-rings seals the interface between the valve body and cylinder 102 to prevent outleakage of hydraulic fluid. A snap ring 304 fitted to an annular groove 305 on the interior of the hydraulic cylinder 102 proximate to rear front end 302 to removably lock the rear end 301 of the valve body 150*a* to the cylinder.

In the present embodiment, the valve 150 has a spring-biased cylindrical plug assembly 152 comprising elongated shaft 152*a* disposed in an axial bore 159 extending completely through valve body 150*a* from front to rear end. A portion of bore 110 fluidly coupled to the hydraulic cylinder 102 forms a flow conduit between the accumulator 106 and cylinder. Shaft 152*a* is concentrically aligned with the bore 110 of the hydraulic cylinder 102. The shaft includes a diametrically narrow front end 152*b* and opposing threaded rear end 152*c* for threadable coupling to threaded bore 309 in the front end of plunger 155. Front end 152*b* is axially and removably insertable into flow orifice 156 formed through cylindrical valve seat member 309 of the valve seat assembly. An annular seal 307 such as an O-ring disposed around orifice 156 and between a cylindrical end cap 311 and valve seat member 309 is engaged with the terminal front end 152*b* of plug assembly shaft 152*a* when the flow control plunger valve 150 is in a fully closed position.

Compression spring 308 biases plug assembly 152 rearward towards the hydraulic cylinder 102 and closed position of flow control valve 150. External snap ring 306 fitted to the plug assembly shaft 152 engages the rear end of spring 308 and an opposite front end of the spring engages an annular seat formed in axial bore 159. An annular seal 313 between the axial bore 159 and shaft 152 at the front end of spring 308 prevents leakage of air and hydraulic fluid along the shaft outwards from the valve 150. Seal 313 may comprise two or more seals of the same or different type.

In one embodiment, the check valve 147 may be disposed in the valve seat assembly. The check valve which may be a ball type check valve in one embodiment that resides in a flow conduit 314 which extends completely through the valve seat member 309 and end cap 311. Flow conduit 314 fluidly communicates with the flow conduit portion of axial bore 159 (i.e. active portion between annular seal 313 and hydraulic cylinder 102) to form a flow path from the hydraulic cylinder through the check valve 147, and in turn to the accumulator 106 via flow conduit 153. Check valve 147 includes valve seat 147*a*, ball 147*c*, and spring 147*b*. The ball and spring may be movable disposed in an outer sleeve 147*d* in one embodiment.

The end cap 311 of the valve seat assembly traps and holds the valve seat member 309 and check valve 147 in the rear open end of axial bore 159 in the valve 150. A snap ring 312 fitted to the valve body 150*a* adjacent bore 159 locks the valve seat assembly into the valve 150. An annular seal 310 may be provided to seal the valve seat member 309 to valve body 150*a* inside bore 159, thereby ensuring flow exchange between the accumulator 106 and hydraulic cylinder 102 is either through the axial bore 159 or check valve flow conduit 314.

Referring to FIGS. 32-37, flow control valve 150 fluidly communicates with the accumulator 106 via a flow conduit 153 extending from the internal flow conduit portion of axial bore 159 in the valve 150 housing the plug assembly 152 to the accumulator chamber 104. Part of flow conduit 153 is therefore transversely oriented to the cylinder 102. The check valve 147 as shown is physically and fluidly disposed between the bore 110 of the hydraulic cylinder 102 and flow conduit 153 leading to the accumulator 106.

An actuator 154 is mounted on the front foot end of the adjustable flow control plunger valve 150 which includes an elongated and axially slidable cylindrical stem or plunger 155 partially disposed inside the valve. Plunger 155 is connected to the plug assembly 152 at one end internal to the valve 150 and to mechanical linkage 132 at the opposite end which protrudes outwards beyond the valve body. In this embodiment, the mechanical linkage 132 is shown in the form of an extension spring having one end loop connected to a through aperture in plunger 155 and an opposite end loop that connects to the lever arm 131 of the foot lever 130. Linear movement of plunger 155 in opposing axial directions via the foot lever in turn linearly moves the plug assembly 152 in the same manner to open or close the plunger valve 150.

With particular reference to FIGS. 34-37, the plunger 155 of plunger valve 150 is mounted inside an axial passageway 157 formed inside and through the rotary stop cam 197 for sliding movement. Rotary stop cam 152 includes an enlarged circular operator head 190 disposed outside the valve body 150*a* and an elongated cylindrical stem 191 inserted through a complementary configured end portion of axial bore 159 formed in the front foot end of the valve body 150*a* opposite the hydraulic cylinder 102. The stem 191 has a first diameter sized for insertion into bore 159 and operator 190 has a second diameter larger than the stem 191 and bore 159 such that the operator is not insertable into the bore and remains outside the valve body.

The rotary stop cam 197 cooperates with the operating stem 155 to limit the amount that the plunger valve 150 can be opened when the foot lever 130 is fully actuated (i.e. depressed downwards towards the floor). To achieve this, the stem 191 of plunger 155 includes a partial helical cam groove 192 extending partially around the circumference of the stem which receives a lateral cam follower pin 158 therein. Cam groove is obliquely oriented with respect to centerline axis CL1 of the hydraulic cylinder 102. Pin 158 is transversely mounted to axis CL1 in the valve body 150*a*. The pin 158 partially protrudes into axial bore 159 in the valve body that receives stem 191. The stem 191 advances or retracts axially by a small distance each time the actuator head 190 is rotated (depending which direction the head is turned) via cooperation between the cam groove 192 and cam follower pin 158.

The free end of the rotary stop cam stem 191 opposite operator head 190 defines a vertical annular stop surface 194 which faces towards hydraulic cylinder 102. Surface 194 interacts with a mating vertical annular abutment surface 195 defined by a diametrically enlarged washer 193 abuttingly engaging the rear end of the plunger 155 in axial bore 159 opposite the end of the plunger with through hole coupled to mechanical linkage 132. Washer 193 forms an operable part of plunger 155 being fixedly secured thereto and trapped between the rear end of the plunger and step 315 in shaft 152*a* between diametrically smaller front end 152*c* and main portion of the shaft. When the plunger valve 150 is in a closed position, an axial gap 196 is formed between the stop and abutment surfaces 194, 195. The gap closes when valve 150 is opened causing stop surface 194 to abuttingly engage abutment surface 195. It bears noting that the washer 193 engaged with the rear end of plunger 155 further functions to prevent the mechanical linkage 132 connected to the opposite end of the plunger from completely pulling the plunger out of the valve body via the mutual engagement between the stop and abutment surfaces 194, 195. An annular seal 316 seals the rotary stop cam stem 191 to the axial bore 159 of the valve body 150*a* to prevent fluid or air leakage therebetween.

The axial position of the stop surface 194 is adjustable by the user via rotating actuator head 190 which activates the cam and follower features described above. The position of stop surface 194 limits the amount that the plunger 155 and plug assembly 152 connected thereto can move axially via mutual engagement between the stop and abutment surfaces 194, 195 when gap 196 is closed. This in turn limits the degree to which the working end of plug assembly 152 is inserted or removed from the flow orifice 156 at the hydraulic cylinder, thereby in effect limiting the amount that the plunger valve 150 is opened or closed which controls the flow rate of hydraulic fluid through the valve and importantly the drop rate of the bench pad 50. The greater amount that the rotary stop cam stem 191 is inserted into the valve body 150*a*, the lower the flow rate of hydraulic fluid through the flow orifice 156, and vice-versa.

The safety feature of a controlled bench pad 50 drop rate may be achieved in one possible approach by design of the circumferential extent or length of the helix of the helical cam groove 192 based on the foregoing discussion. The cam stem 191 can only be inserted or withdrawn from the valve body 150*a* by an amount commensurate with the extent or length of the groove 192 in which the cam follower pin 158 travels. A maximum safe amount that the valve 150 may be opened which controls drop rate of back pad 50 is controlled by preselecting a circumferential extent/length of the cam groove 192 at the factory such that the pad will drop slow enough for a heavy user to avoid too rapid a descent and sudden stop when the bench fully lowers in the escape position, yet still function to allow the bench pad to drop if a light user is lifting weights on the bench. Other means for controlling the maximum degree to which the valve 150 may be opened to cause the back pad 50 to drop at a safe rate may be used.

Operation of the adjustable flow control plunger valve 150 will now be briefly described. In use, the adjustable flow control plunger valve 150 is normally spring biased into the closed position which cuts off flow of hydraulic fluid from the cylinder 102 to the accumulator 106 (see, e.g. FIGS. 34 and 35). The plug assembly 152 is shown with the narrow front end 152*b* of plug assembly shaft 152*a* inserted into the flow orifice 156 between the hydraulic cylinder 102 bore and portion of the flow conduit 153 internal to the valve.

Valve 150 operates in a similar manner to plunger valve 122 described above and shown in the flow diagrams of FIGS. 38A-B. The plug assembly 152 in the present embodiment however is concentrically aligned with the hydraulic cylinder bore 110 instead of disposed at a 90 degree angle. In sum, pressing the foot lever 130 downwards pulls the mechanical linkage 132 (an extension spring in this embodiment) forward towards the front of the bench, thereby axially withdrawing the plug assembly 152 from the internal flow orifice 156. The plug assembly 152 is configured such that the rate of hydraulic fluid flowing through the valve 150 may be regulated by the degree to which the valve is opened via the foot lever.

The maximum amount that the valve 150 is able to open when actuated can be adjusted by the user in advance via the rotary stop cam 197 which acts as a speed limit stop to restrict the axial motion of the plunger 155, as described above. In short, rotating the rotary stop cam 197 in opposing directions moves the annular stop surface 194 of the stop cam closer or farther away from abutment surface 195 of the plunger assembly, thereby adjusting the width of the control gap 196 therebetween. When the foot lever 130 is fully depressed to implement an escape action, the gap 196 is eliminated as the plunger 155 moves axially towards the front of the bench bringing surfaces 194, 195 into contact. This restricts the amount that the plug assembly shaft 152*a* is withdrawn from the flow orifice 156 in the valve seat assembly to limit the flow rate of hydraulic fluid from the cylinder 102 to the accumulator 106. The greater the valve 150 opens, the faster the back pad 24 will drop and vice-versa thereby controlling the rate of descent of the pad. The adjustable flow control plunger valve 150 is moveable between a fully open position allowing full flow, a closed position stopping flow, or a throttled position therebetween by action of the foot lever 130. Preferably, the rotary stop cam 197 is designed via the provided length of the cam groove 192 thereon as described above to limit the maximum width of the control gap 196 which will always provide a safe controlled drop rate of the back pad 24 regardless of any adjustments made by the user. This is considered an important safety feature not heretofore provided by known weight lifting bench mechanisms.

It bears noting that foot lever 130 and mechanism linkage 132 although in the form of a spring in this non-limiting embodiment operate in the same manner and interact with the plunger 155 to open/close the plunger valve 150 as in the pressure compensating valve assembly 145 described herein.

Bench Pad Auto-Return Feature

According to one aspect of the invention, an auto-return system is provided which automatically returns the back pad 24 to its uppermost incline/exercise position from a lower exercise position or after a full decline escape scenario. FIG. 39 is a schematic flow diagram showing the hydraulic fluid flow path and circuit during the back pad auto-return system mode of operation. The accumulator 106 described herein provides one means for returning the back pad upwards, as explained below.

As already described herein and shown in FIGS. 38A-B, the descending operation is first initiated by the user pressing the foot lever 130 downwards which lowers the back pad 24 to the lower incline or decline position. When the user now gets off the bench equipment with the back pad 24 in its lower position, the user releases the spring-biased foot lever 130 which automatically returns to the upward unactuated position that in turn moves the plunger valve 122 (or alternatively adjustable plunger valve 150 if provided instead) back to its closed position via the mechanical linkage 132. Referring to the hydraulic flow diagram of FIG. 39, at this point in the process the force from the pressurized air stored in the accumulator 106 now is greater than the gravity force from the weight of the equipment without the user pressing against the back pad 24. This is accomplished by initially pressuring the air in the accumulator 106 to a pressure which exceeds the bare weight of the bench pad structure alone without a user seated thereon. The pressurized air forces the hydraulic fluid 101 in the accumulator 106 to bypass the plunger valve 122 (now closed), and flow back to the hydraulic cylinder 102 through a check valve 147. This extends the cylinder rod 116 from its prior retracted position when the back pad 24 is in the lower exercise or escape position. As the rod extends, it exerts a force on the bottom end of back pad rear strut 42 causing the strut operably coupled by the back pad 24 to move back upwards with the pad. The rear strut 42 pivots about pivot axis P1, causing the angle between the strut relative to the ground and frame 22 to increase, thus raising the back pad 24 to the upper exercise position.

In addition to relying on the reverse flow path formed by the check valve 147 to return the back pad 24 upwards, the user may optionally also press downwards on the foot lever 130 to open the plunger valve 122 and speed up the bench return. This will create a dual reverse flow path for the hydraulic oil 101 from the accumulator 106 back into the hydraulic cylinder 102 as shown in FIG. 39. This alternative flow path back in a reverse direction through plunger valve 122 to the hydraulic cylinder 102 is represented by open flow arrows and the normal automatic flow path through the check valve 147 to the cylinder is represented by the closed (solid) flow arrows.

The automatic bench return feature can be accomplished using either the stored air pressure in the accumulator 106 described above to pressurize the hydraulic cylinder 102 (which is high enough to overcome the weight of the unloaded bench pad without a user thereon), or in an alternative embodiment an extension spring mechanism, or a combination of both.

Second Operating Lever and Accumulator Option

Figure 40:
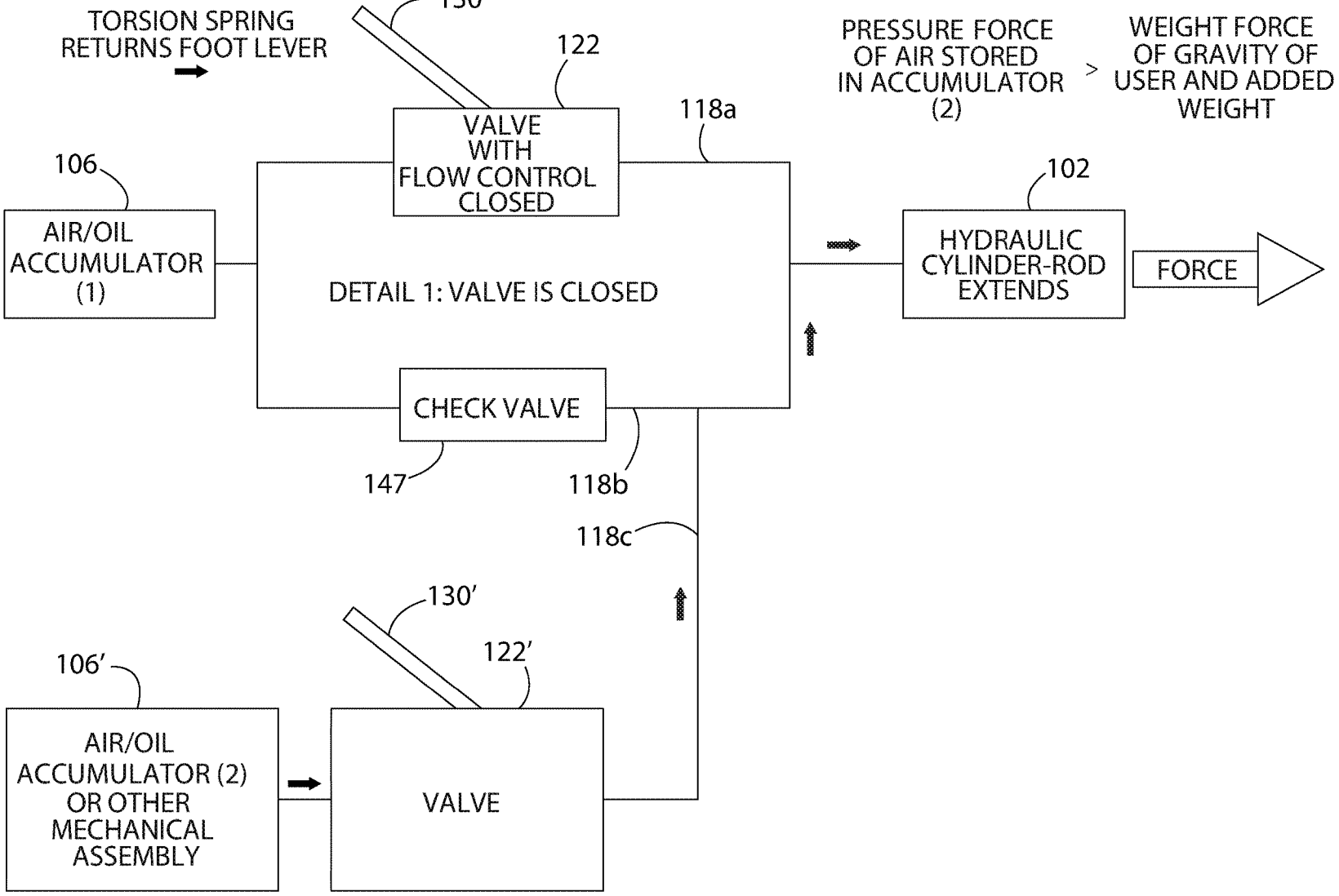
FIG. 40 is a schematic flow diagram of a modified hydraulic control system having a second accumulator and lever operated plunger valve which allows a user to adjust the upper exercise position of back pad independently of the first plunger valve and accumulator.
Figures 41, 42:
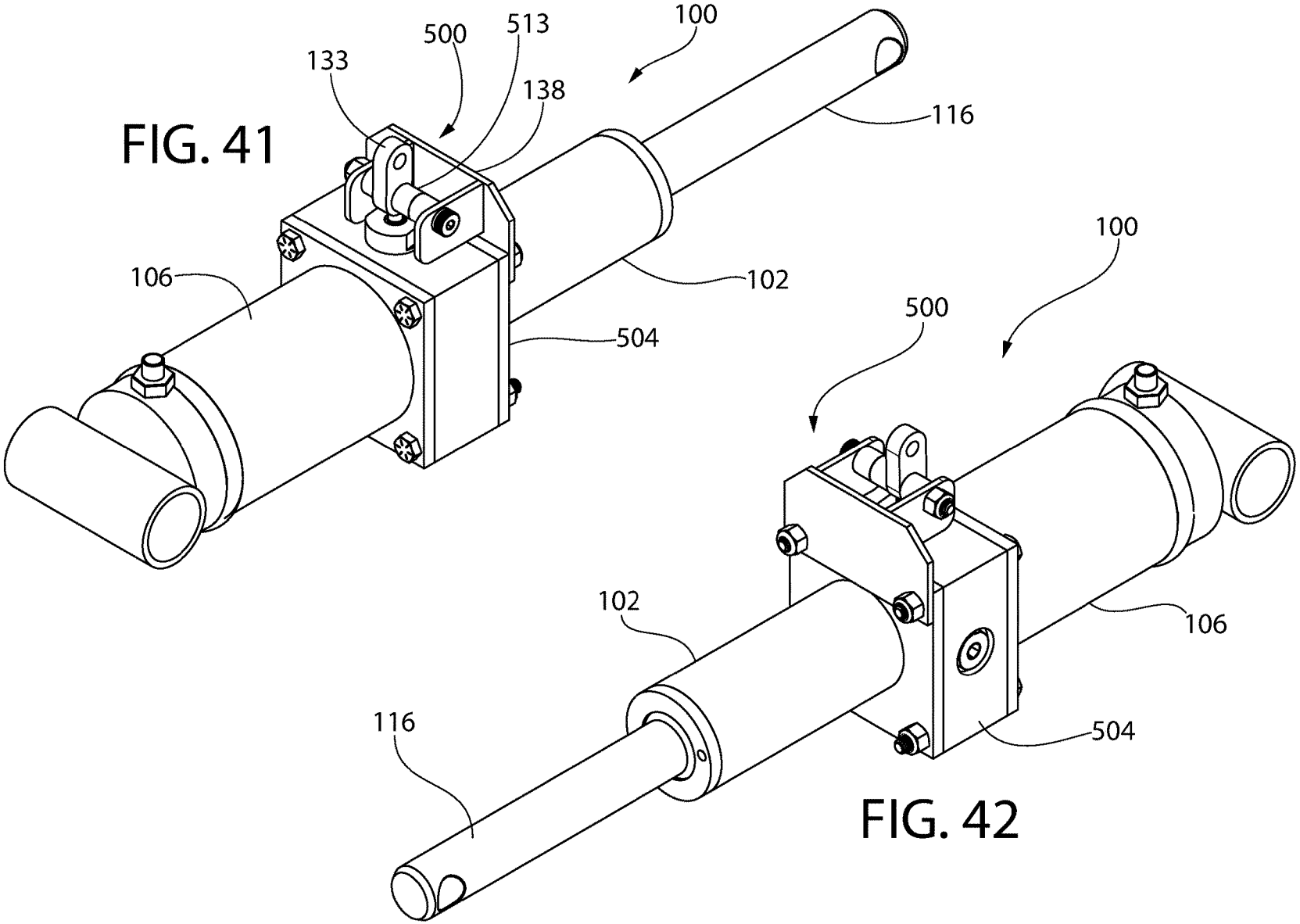
FIG. 41 is a front top perspective view of an alternative hydraulic cylinder assembly according to another embodiment including a hydraulic cylinder, accumulator, and flow control valve assembly.
FIG. 42 is a rear top perspective view thereof.
Figure 43:
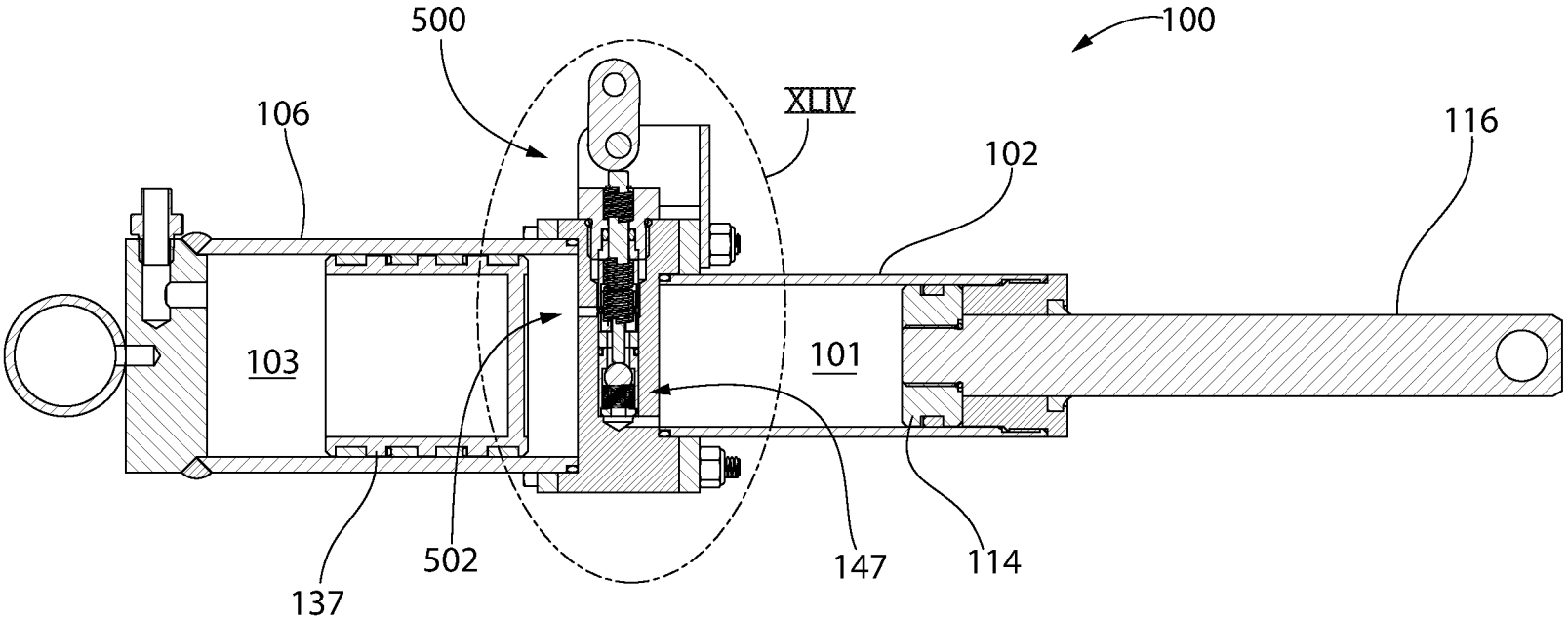
FIG. 43 is a side cross sectional view thereof.

In another embodiment shown in FIG. 40, the user can initiate the auto return of the back pad 24 by using an additional second foot or hand operating lever, plunger valve, and accumulator or another mechanical component (e.g. spring-loaded strut or piston, etc.). While the user remains on the bench pad 50, a second foot lever 130' in one embodiment can be depressed to provide a force generated from the compressed air in a second accumulator 106', or another mechanical means, to raise the bench pad 50 back upright towards its starting upper exercise position. If the angle of the bench is increased beyond that is which desired, this option provides the user ability to decrease the angle back towards the starting position. The force generated by the second accumulator, or other mechanical means, must be such that the force is greater than the weight force of gravity from the body of the user and the bench pad equipment to raise the bench pad upwards with the user seated thereon.

FIG. 40 illustrates a flow diagram of one possible configuration of a flow conduit circuit 118*c* incorporating a second hydraulic cylinder assembly including a second accumulator 106' and second plunger valve 122' with a second operating lever 130' which are fluidly connected via a suitable flow conduit (e.g. tubing and/or piping) arranged as shown. This embodiment allows the user to raise the back pad 24 while remaining pressed back against the back pad applying a pressure force to the pad. If the user while remaining reclined finds that the back pad was lowered too far, the second hydraulic cylinder assembly allows the user to raise the back pad back up to find the perfect exercise position intended.

Operating lever 130' may be a foot lever configured similarly to foot lever 130, or alternatively a hand-operated lever. Second operating lever 130' functions with the second hydraulic cylinder assembly in the same manner as the first hydraulic cylinder assembly and foot pedal 130. Flow conduit circuit 118*c* is tied into flow conduit circuit 118*b* downstream of check valve 147, but upstream of hydraulic cylinder 102 in the original hydraulic circuit. The upper flow circuits 118*a* and 118*b* with check valve 147 as shown incorporate the back pad 24 automatic return feature described herein which is initiated automatically by releasing the foot pedal 130. The lower flow circuit 118*c* is not controlled by a check valve, and therefore does not include the auto return feature requiring this flow circuit to be opened/closed by operation of the second plunger valve 122'. In this embodiment, the pressure of compressed air in the second accumulator 106' is preferably pre-pressurized to a pressure sufficient to raise the back pad against the weight force of the user, the back pad equipment, and in some embodiments also the barbell. In such a case when the second operating lever 130' would be depressed (i.e. actuated), the added weight of the barbell would cause the hydraulic fluid 101 to flow in a reverse direction through flow conduit 118*c* into the second accumulator 106', thereby automatically dropping the back pad 24 to its lower escape position as a safety precaution.

In operation, with the user seated on the seat pad 23 and reclined against the back pad, the second operating lever 130' alone is depressed and actuated which opens second plunger valve 122'. Compressed air flows from second accumulator 106' through second valve 122' and flow conduit circuit 118*c* into flow conduit 118*b* to the hydraulic cylinder 102. This extends the cylinder rod 116 thereby raising the position of the back pad 24 to the desired angle. When the position sought is reached, the operating lever 130' is released which returns automatically to its original position which shuts off flow of air from the second accumulator 106'. It may be noted that the second accumulator is pressurized to a higher pressure than the original accumulator 106 which has insufficient pressure to raise the back pad 24 against the weight force of the user and bench pad equipment and barbell. The back pad 24 may be declined to a lower exercise position or the lowermost decline escape position at any time by activating the first hydraulic cylinder assembly and original foot pedal 130 in the manner already described herein.

Power Rack and Bench Combination

FIGS. 17-20 depict a power rack 70 usable with the angularly adjustable bench 20 for performing a weight lifting exercise routine. Power rack 70 includes a longitudinal axis A-A which is alignable with longitudinal axis LA of bench 20, a base frame 72 configured for resting on a surface such as floor F, and an upper frame 75. Base frame 72 may include including a pair of laterally spaced apart longitudinal members 71 to provide room for positioning the bench 20 therebetween. A cross support 73 may be provided which extends between longitudinal members 71 as shown for lateral stability.

A pair of longitudinally spaced apart upright stanchions 74 extend upwards from each longitudinal member 71 of the base frame 72. The upper portions of the stanchions are interconnected by the upper frame 75 which provides stability for the stanchions. The upper frame 75 may comprise a plurality of elongated bracing members 78 which extend between the stanchions as illustrated in one non-limiting embodiment. The base frame longitudinal members 71, upper frame 75, and stanchions 74 may be formed by metallic tubular structural members of suitable cross sectional shape and material, such as without limitation steel, aluminum, titanium, or combinations thereof.

Figure 19:
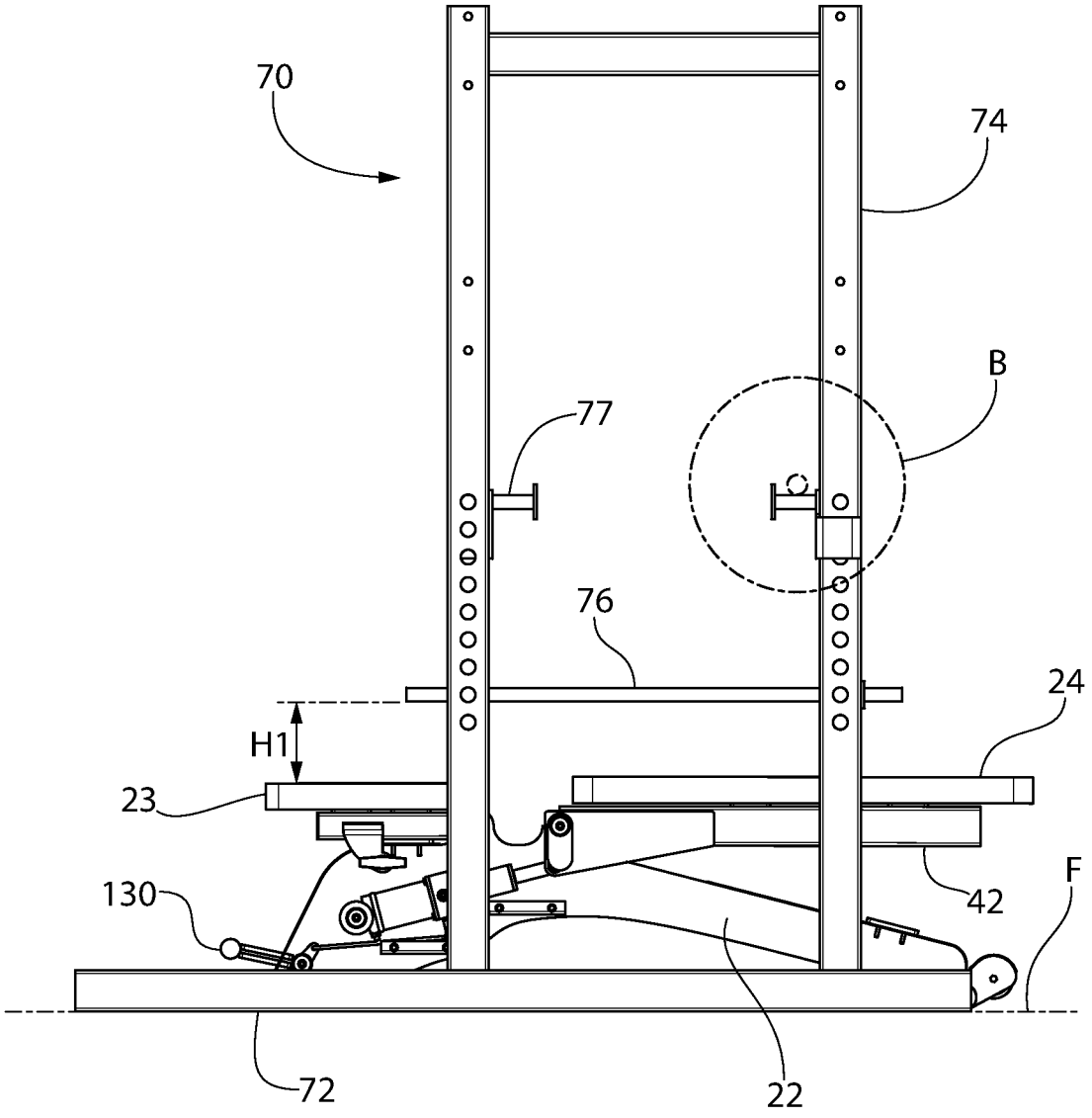
FIG. 19 is a left side view thereof with the bench of FIG. 1 positioned therein and in a horizontal position representative of an exercise position.

Power rack 70 further includes a plurality of weight rests 77 configured and constructed to support a barbell B as shown in FIG. 19. At least one pair of weight rests 77 may be provided, and in some embodiments each stanchion 74 may have a weight rest 77 as shown.

In some embodiments, power rack 70 may further include safety bars or racks 76. A safety rack 76 is provided between each pair of stanchions 74 on each side of the power rack 70. The safety racks 76 are preferably positioned to receive the barbell B when the user experiences fatigue and cannot return it safely to the weight rests 77. The safety racks 76 in combination with the adjustable bench 20 described herein provide a safety system which safely removes the barbell from a user's chest and allows egress from the bench.

Safety Rack Height Relative to Bench Position

Figure 20:
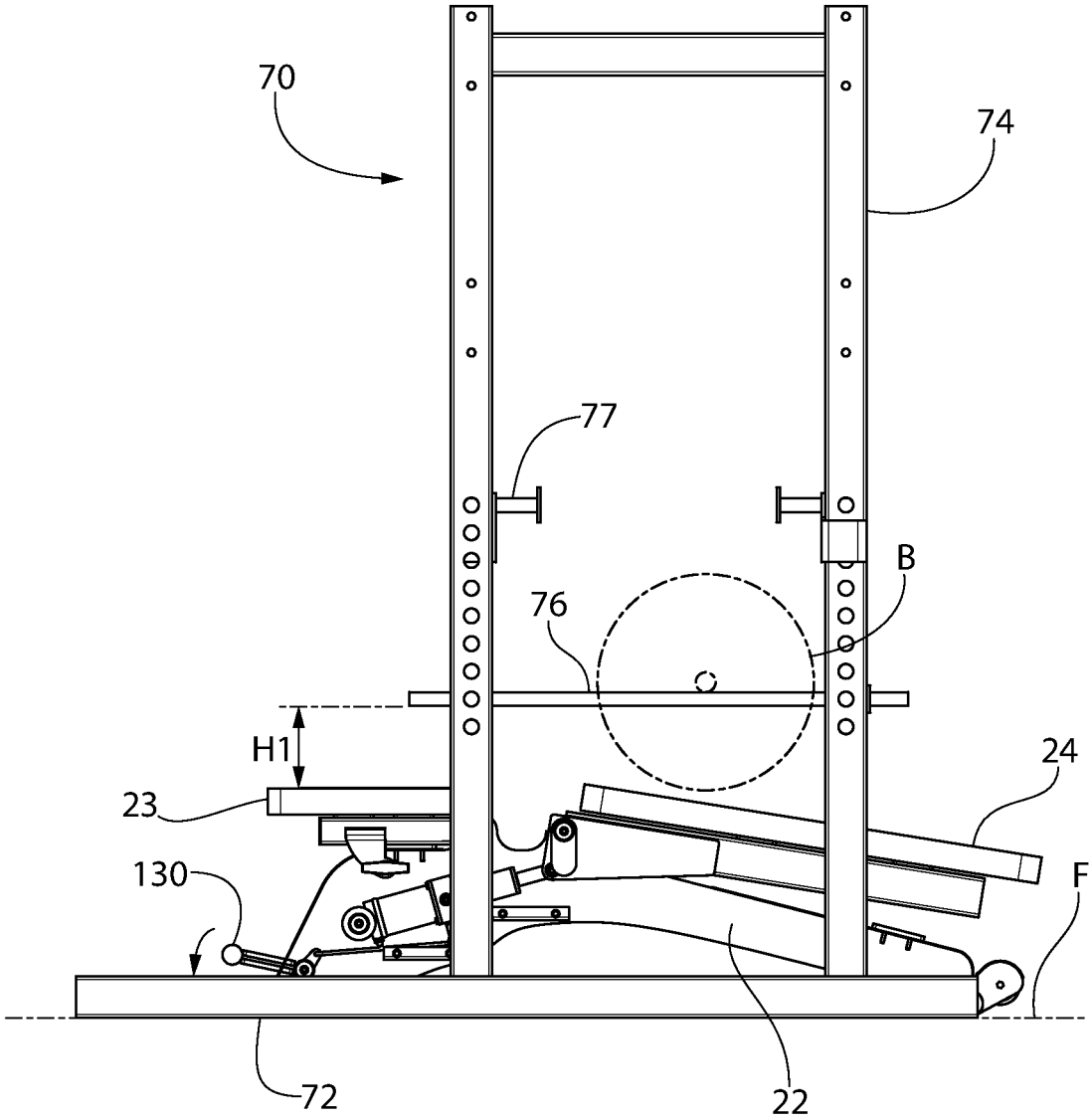
FIG. 20 is a left side view thereof with the bench of FIG. 1 positioned therein and in the lowermost decline position representative of an escape position.

It is desirable that when the back pad 24 is in the lowest decline escape position, the safety racks 76 are positioned and sufficiently elevated such that the top of the safety racks are located above the user's chest or torso region. In all instances, when the user presses the foot lever 130 and the bench pad lowers to its lower escape position shown for example in FIG. 16, the main rod or bar of the barbell B which a user grasps must rest on the safety racks 76 at a height such that the barbell and its weight are completely removed from the user's torso region (barbell shown in dashed lines). To achieve this accordingly, in the lower escape position of the back pad 24, the top surface of the safety rack 76 on which the barbells rests is positioned at a critical height H1 above the highest front part of the back pad 23 when the back pad is in the lowermost decline position as shown in FIG. 20. For contrast and reference, FIG. 19 shows the back pad 24 in a horizontal position. The critical height H1 is sufficient to vertically separate the top surface of the safety racks 28 and barbell B during an escaped scenario from the user's torso region in a manner that completely and safely removes the weight from the user to prevent injury. Preferably, the height H1 is further selected to also provide adequate clearance for the user to readily have an easy path of egress from beneath the barbell B and off of the bench.

Although in some embodiments, the height of the safety racks 28 may be adjustable, as well as the working or exercise height of the back pad 24, it remains important that when the back pad is in the lowest escape position, the safety racks 76 are positioned such that the top surface of the safety racks are still located the critical height H1 and above the users torso as shown in FIG. 20. For such instances in which the safety racks are adjustable, a safety stop is preferably positioned on the rack uprights (vertical stanchions 74) to prevent the safety racks 76 from being lowered to a position that is less than the critical height H1. In one embodiment, the safety stop may be configured as an angle bracket or clip which is welded to each of the stanchions 76 to engage the safety racks 76 and maintain the critical height H1.

Accordingly, when the back pad 24 is positioned in its lowest adjustment and escape position shown for example in FIG. 16 (represented by angle A5) and full actuation of the foot lever 130 has been implemented for an escape maneuver, the critical height H1 is still maintained. As a means of egress from beneath the barbell B when the foot lever 130 is fully depressed and the back pad 24 drops to its lowest escape position, the barbell essentially becomes an integral part of the escape system. The barbell rests on the safety racks 76 and provides a stable hold for the user to grip and slide themselves out from under the weights. The user may push the barbell against the upright stanchions 76 for this purpose. The force then applied by the user against the horizontal safety racks 76 and the stanchions 74 allows the user to push or pull themselves rearward towards the rear end 27 of the bench, and safely up and off the equipment to escape from underneath the barbell.

It bears further noting that the bench 20 disclosed herein which may include the back pad descent speed control and auto-return mechanisms may be provided independently of any weight lifting frame with weight rests. Accordingly, the invention is expressly not necessarily limited to the presence of the weight lifting frame in order to possess full functionality and the various features associated with the bench pad assembly described herein.

Second Inventive Concept—Weight Lifting Bench

A hydraulic cylinder assembly is disclosed for operating a weight lifting bench and other equipment. The hydraulic cylinder assembly comprises a hydraulic cylinder containing a hydraulic fluid, an accumulator containing a pressurized compressible fluid, and a flow control valve assembly interposed in a flow path therebetween. The flow control valve includes an axially reciprocating piston defining a flow control orifice and an axially movable plunger received in the orifice. Movement of the plunger operates to engage and open a ball check valve which in turn opens the flow path allowing hydraulic fluid to flow from the hydraulic cylinder to the accumulator. The working end may be stepped and positionable between first and second axial positions relative to the orifice to define first and second flow areas via movement of the plunger. Reciprocating movement of the piston opens and closes the flow path.

FIGS. 57-64 depict a non-limiting embodiment of an exercise bench in the form of weight lifting bench 1020 according to the present disclosure. Structurally, bench 1020 generally includes a hollow tubular frame 21 configured for placement on a floor and an elongated user bench pad 1050 pivotably coupled to the frame. Pad 1050 supports a user and defines a longitudinal axis LA and corresponding axial direction. A lateral or transverse direction is defined transverse to the longitudinal axis for reference.

Frame 1021 may include a substantially horizontal base 1022 which in one embodiment may be comprised of a bench portion or sub-frame 1037 and a weight rack portion or sub-frame 1038. The bench sub-frame comprises a pair of laterally spaced apart axially extending longitudinal members 1023 to which the bench pad 1050 is pivotably coupled for upward and downward movement. The weight rack sub-frame 1038 comprises an elongated cross member 1024 to which proximal ends 1023*a* of the longitudinal members 1023 are attached in one embodiment forming a one-piece frame after assembly and/or construction. This defines a head end of the bench.

In other possible embodiments, a two-piece frame may be provided in which the bench pad 1050 assembly and supporting bench sub-frame 1037 including longitudinal members 1023 are a separate component from and unattached to the cross member 1024 and weight rack sub-frame 1038. In such an embodiment, shown for example in FIGS. 65A-C, 66, and 67, the proximal ends 1023*a* of the longitudinal members 1023 may be positioned proximate but unconnected to cross member 1024 in use during the exercise routine. This forms a separable free standing "utility" bench which is useable on its own or with multiple different weight rack configurations for performing different types of weight lifting exercise routines. In the portable bench embodiment, the proximal ends 1023*a* of the longitudinal members 1023 may be attached to a second cross member 1024' that may be positioned against or proximate to cross member 1024 of the frame 1022. A pair of wheels 1185 may be fitted to cross member 1024' to enhance the mobility of the free standing bench assembly.

Referring back to FIGS. 57-64 now, the longitudinal and cross members 1023, 1024 respectively are configured for positioning or resting on the horizontal floor. Cross member 1024 defines the head end of the frame 1021 and bench 1050, and the distal free ends 1023*b* of the longitudinal members 1023 define a foot end of the bench. Cross member 1024 may be arranged perpendicular to the longitudinal members 1023 in one embodiment. A cavity 1025 is formed between the longitudinal members 1023 for mounting the hydraulic system components further describe herein.

It will be appreciated that numerous variations of the frame configuration may be provided. Accordingly, the invention is expressly not limited by the configuration.

The weight rack sub-frame 1038 of frame 1021 further includes a pair of laterally spaced apart vertical posts or stanchions 1026 configured for supporting a barbell via appropriately configured weight rests 1027. Stanchions 1026 have a lower end 1026*a* to engage the floor which are attached to the cross member 1024 and a free upper end 1026*b*. The weight rests 1027 may be attached to the upper end 1026*b* of each stanchion as shown or at any other suitable location along the stanchion. Rests 1027 may have any suitable shape but include primarily a horizontal section for placement of the round or other shaped bar of the barbell (the weights being attached to each end of the bar in typical fashion). In the non-limiting illustrated embodiment, the weight rests 1027 may have a generally truncated U-shape with a horizontal section and two opposing upright or vertical sections one of which may be shorter than the other to allow for easy ready removal of the barbell by the user during the weight lifting routine. In other possible embodiments, the weight rests 1027 may be cup shaped or have another shape. Numerous variations are possible and do not limit the invention.

The position of the weight rests 1027 on the stanchions 1026 may be adjustable in some embodiments such as via a telescoping and pinned arrangement. Weight rests 1027 may each be formed on the top or another part of slidable inner tubes 1036 which are insertable inside and through open upper ends 1026*b* of stanchions 1026 for adjusting the height of the rests. The rests 1027 may be locked in the desired position via a plurality of height adjustment holes 1039 formed through the inner tubes 1036 and stanchions 1026 through which cylindrical lock pins 1039*a* (e.g. straight or L-shape) are insertable (see, e.g. FIGS. 57 and 58). Such pinned arrangements are known in the art without further elaboration.

Figure 68:
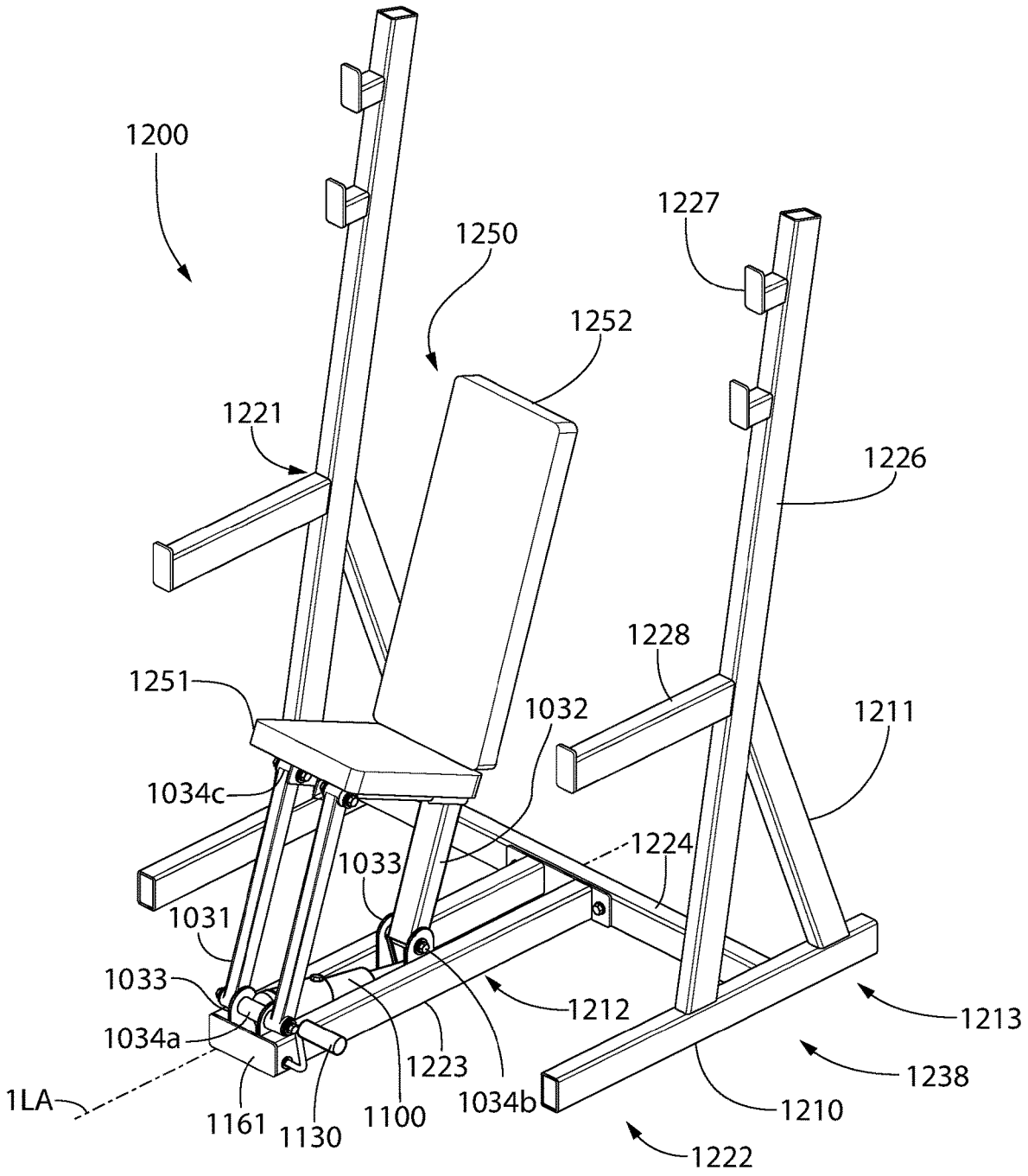
FIG. 68 is a front perspective view of an embodiment of an inclined weight lifting bench with automatic bench return and bench descent control mechanisms according to the present disclosure including a weight rack and attached bench pad assembly.
Figure 69:
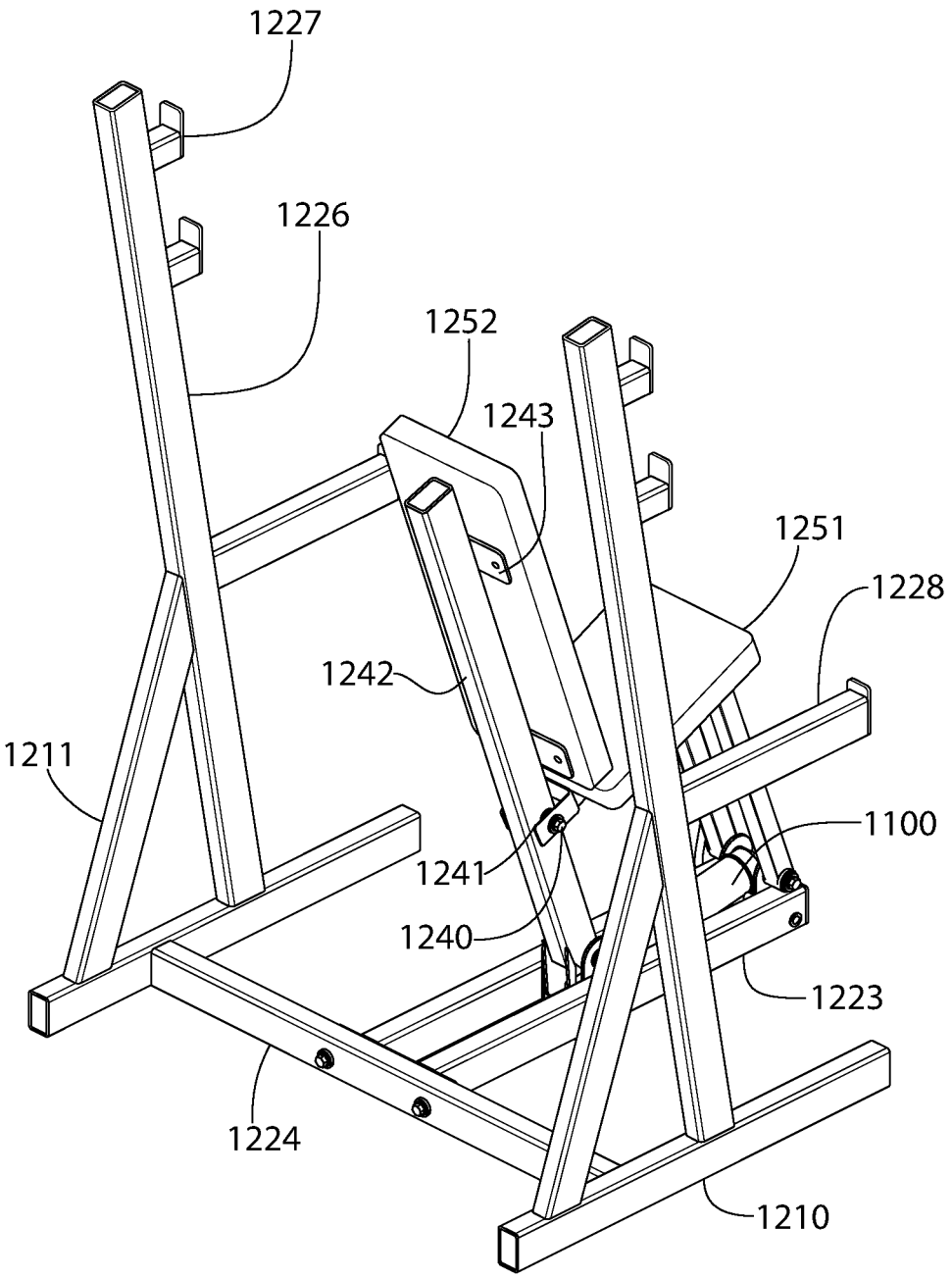
FIG. 69 is a rear perspective view thereof.
Figure 70:
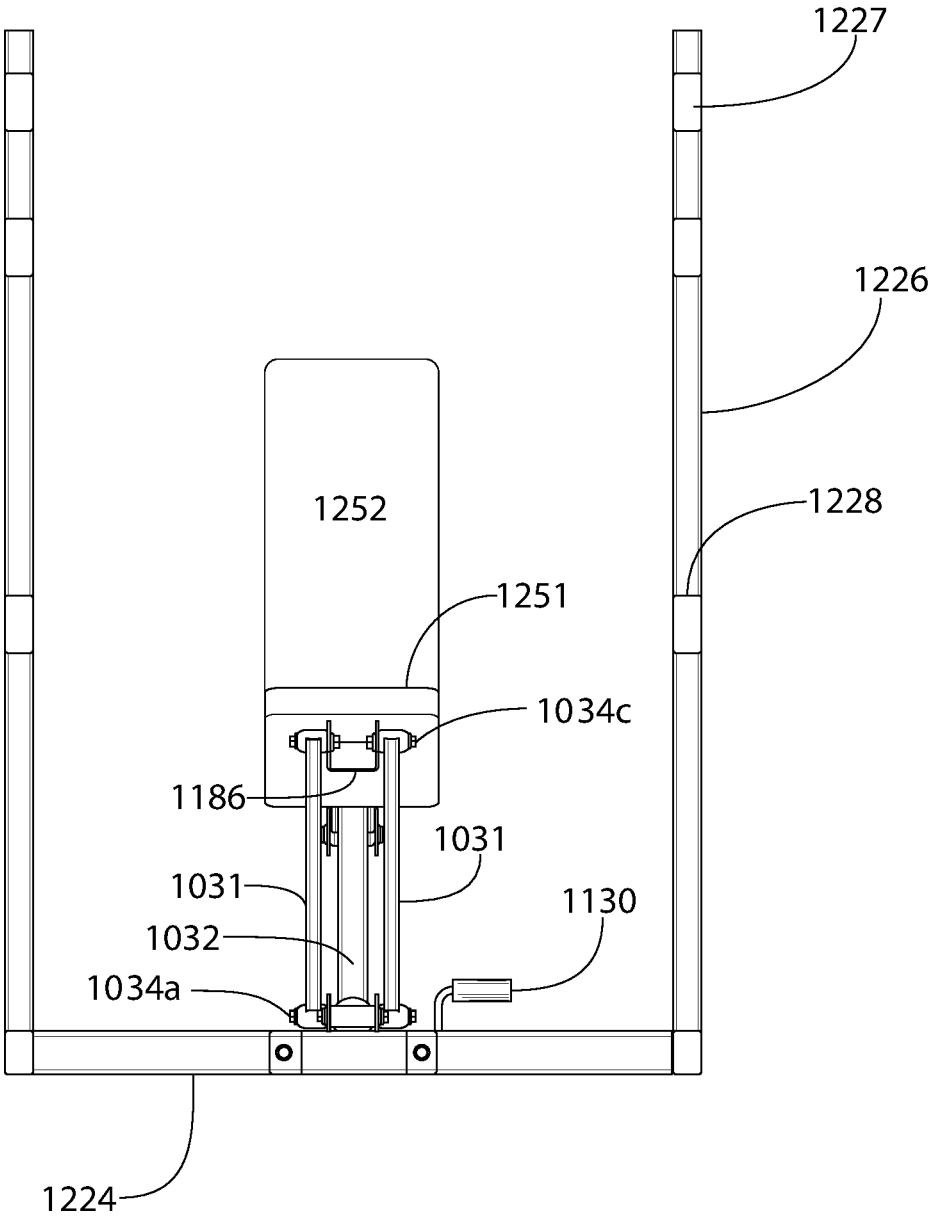
FIG. 70 is a front view thereof.
Figure 71:
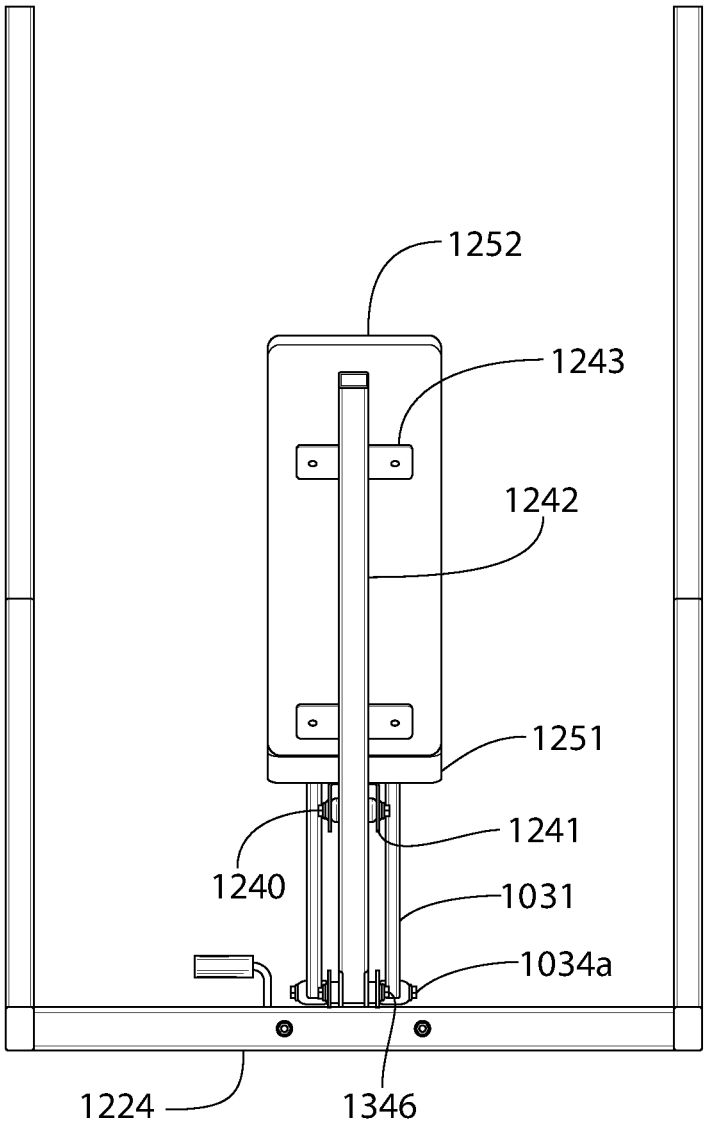
FIG. 71 is a rear view thereof.

Frame 1021 (e.g. weight rack sub-frame 1038) further includes a safety rack 1028 comprising a substantially horizontal member attached at one proximal end 1028*a* to stanchion 1026 and an opposite distal end 1028*b*. In some embodiments, distal end 1028*b* may be a cantilevered free end unattached to another part of the frame 21 (see, e.g. FIG. 68 and safety rack 1228). In the present illustrated embodiment discussed, however, a vertical member 1029 is shown which is connected at an upper end 1029*a* to distal end 1028*b* of the rack and has a lower end 1029*b* contacting the floor. A tie member 1030 such as a strap or a tube may be provided which ties the lower end 1029*b* into the stanchion 1026 for added stability in some configurations.

The frame 1021 and its members described herein may have any suitable transverse cross-sectional tubular shape such as rectangular shapes (e.g. square with equal sides or rectangle with unequal adjacent sides), other polygonal shapes, non-polygonal shapes (e.g. circular), and combinations thereof. Although tubular structural members are preferred in certain embodiments for the main loading carrying elements of frame 1021 to reduce transport weight, some or all of the members of the frame may be solid structural members in some embodiments depending on their expected service conditions and load. Plate members may also be used for certain portions of frame 1021. Frame 1021 may be made of any suitable material, preferably metal including for example without limitation aluminum, steel, titanium, etc. The structural members may be interconnected via any suitable means used in the art such as without limitation welded connections, bolted connections, adhesives, mechanical interference fits, frictional fits, combinations thereof, or other. The frame cross-sectional shape, choice of metallic material, and connection methods are thus not limiting of the invention.

To pivotably couple the bench pad 1050 to the longitudinal members 1023 of frame 1021, the bench 1020 may further include a pivotable linkage mechanism comprising a front (foot-end) strut 1031 and a rear (head-end) strut 1032. In the illustrated embodiment, a pair of laterally spaced apart front struts is provided. A pair of rear struts 1032 may alternatively be provided in other embodiments. The struts 1031, 1032 are pivotably coupled at their respective upper and lower ends to the support pad 1050 and longitudinal members 1023 of the frame 1021 (see, e.g. FIGS. 57-67). Cross bolts 1034*a*, 1034*b* may be used to couple the lower ends of the struts 1031, 1032 respectively to the longitudinal members 1023. The cross bolts are inserted through laterally open round holes in the frame and form fixed pivot joints or points. In one embodiment, a pair of upward extending mounting tabs 1033 may be attached to each the longitudinal members 1023 to facilitate bolting the lower ends of struts 1031 and 1032 to the longitudinal members.

The upper ends of the front and rear struts 1031, 1032 are similarly pivotably coupled to a pair of longitudinally extending and laterally spaced apart pad support members 1035 to which the support pad 1050 is attached. The struts 1031, 1032 may also be bolted to the pad support members 1035 via cross bolts 1034*c*, 1034*d* respectively in some embodiments to form the pivotable coupling system. The cross bolts 1034*c*, 1034*d* are inserted through laterally open round holes in the pad support members and form fixed pivot joints or points. Support members 1035 are oriented substantially horizontal and arranged parallel to the longitudinal axis LA and longitudinal members 1023. In one embodiment, the pad support members 1035 may be made of elongated structural angles; however, other types and shapes of structural members (e.g. tubular, C-channels, etc.) may be used. The support members 1035 may be made of the same metallic materials as the frame 1021 discussed above.

Although the front (foot-end) struts 1031 may comprise two struts in the illustrated embodiments, other embodiments may employ a single strut. Similarly, although the rear (head-end) strut 1032 comprises a single strut in the illustrated embodiment, other embodiments may employ a pair of struts. Accordingly, the invention is not limited to use of either single or double struts for each of the front or rear struts 1031, 1032 so long as the functionality described herein is provided for the pivotable linkage mechanism. It further bears noting that in certain embodiments, pins, rods, shafts, bolts, or other similar elements useable to make a pivotable coupling may be used instead of any pivot elements specifically identified by type herein which represents only some non-limiting examples of pivot joint.

Using the foregoing pivotable coupling system, the bench pad 1050 is vertically movable in position with respect to the frame 1021 including the longitudinal members 1023 and safety rack 1028. This provides the rescue feature of the bench 1020. Support pad 1050 is movable from an upper exercise position (see, e.g. FIG. 61A) in which the user lifts the barbell B during an exercise routine, to a lower escape position (see, e.g. FIG. 61B) via a pivoting toggle-like action created between the pad and frame provided by the front and rear struts 1031, 1032. The struts 1031, 1032 may be approximately equal in length and substantially parallel to each other in some embodiments. In other embodiments the struts may be of different lengths but preferably are arranged and connected to the longitudinal members 1023 and pad support members 1035 to maintain the support pad 1050 in a level horizontal position in both the upper exercise and lower escape positions. In moving between the upper and lower positions, the struts 1031, 1032 may be obliquely angled in relation to the pad support members 1035 and longitudinal members 1023, and have lengths selected to maintain the bench pad 1050 in a substantially horizontal orientation during its vertical motion.

Hydraulic Control System

A support mechanism operably coupled between the sets of struts 1031, 1032 both maintains the position of the bench support pad 1050 in the upper and lower positions and controls the movement of the pad therebetween. In addition, the support mechanism controls the bench descent rate as further described herein. The support mechanism may be hydraulic, pneumatic, electrical, or mechanical in nature. In one embodiment, a hydraulic control system described herein provides the support mechanism for the bench pad. According to one aspect of the invention, the hydraulic control system is additionally configured to provide an auto-return mechanism for automatically returning the bench pad 1050 to the upper position from the lower position after a user escape sequence is initiated.

FIGS. 78-88 depict one embodiment of a hydraulic control system and arrangement in greater detail. The system may include a hybrid hydraulic-pneumatic operator which includes a hydraulic cylinder assembly 1100 generally comprising a single-acting hydraulic cylinder 1102 and an accumulator 1106 in fluid communication with the cylinder. In single-acting cylinder designs, the cylinder piston rod extends under hydraulic pressure and retracts under an externally applied force (e.g. gravity weight of equipment, user, etc.) acting against the rod.

The hydraulic cylinder 1102 has an axial centerline 1CL1 and accumulator 1106 has an axial centerline 1CL2. In the illustrated embodiment, the axial centerlines are coaxially aligned forming an end-to-end mounting relationship between the hydraulic cylinder and accumulator. The hydraulic cylinder 1102 comprises an elongated tubular body or barrel 1108 forming an internal bore 1110 which holds hydraulic fluid 1101 and an axially movable piston 1112 comprising a piston head 1114 and cylinder rod 1116 having one end rigidly coupled thereto inside the bore. Piston head 1114 is sealed at its peripheral edges to the bore 1110 by a suitable annular seal 1114*a* to keep oil from leaking past the head into the part of the cylinder bore behind the head (space on the left side of the head in FIG. 85). A transversely oriented aperture 1120 is formed in an opposite end of the rod 1116 which pivotably couples the rod to a downwardly extending pivot extension 1032*a* disposed on the lower end of strut 1032 below cross bolt 1034*b*. Extension 1032*a* may have a bifurcated clevis shape in one embodiment having two sides spaced laterally apart which receives cylinder rod 1116 therebetween. A cross pin 1121 completes coupling the pivot extension 1032*a* to strut 1032 and defines a pivot axis. Pin 1121 is located on strut 1032 below cross bolt 1034*b* and offset from the axial centerline of the rear strut 1032 to provide leverage so that the cylinder rod 1116 acts to pivot the extension 1032*a* about bolt 1034*b* for raising/lowering bench pad 1050 and holding the pad in stationary position via the hydraulic system.

The accumulator 1106 in one embodiment comprises an elongated body forming an internal chamber 1104 for holding hydraulic fluid 1101 and a compressible gas. The internal chamber 1104 of the accumulator 1106 is fluidly connected to the cylinder bore 1110 by one or more flow conduits 1118 configured to provide bidirectional exchange and flow of hydraulic fluid between the accumulator 1106 and cylinder 1102. In one non-limiting embodiment, the accumulator 1106 may physically be directly coupled to the cylinder 1102 to form a compact cylinder assembly 1100. A unique flow control valve assembly 1145 may be provided which internally incorporates the flow conduits 1118 and is configured to control the flow and exchange of hydraulic fluid between the accumulator 1106 and hydraulic cylinder 1102 as shown in FIGS. 76-85. Advantageously, this eliminates the need for external tubing to form the flow conduits which may be exposed to damage during shipping or use of the bench.

In one embodiment, the valve assembly 1145 may be designed directly as part of the hydraulic cylinder assembly. The valve assembly 1145 may be interspersed directly between the accumulator 1106 and hydraulic cylinder 1102 to provide a compact hydraulic assembly. In this arrangement, one proximal end of hydraulic cylinder barrel 1108 is coupled to one side of the valve assembly body and one proximal end of the accumulator 1106 is coupled to the other side of the valve assembly body. The accumulator and barrel may be welded to the valve assembly 1145 to provide a leak-proof seal in one embodiment; however, other mounting methods may be used such as without limitation bolting or other. The flow conduits 1118 extend through the valve assembly 1145 which fluidly connects the cylinder bore 1110 to the accumulator chamber 1104 as describe below.

Referring to FIGS. 84-88, valve assembly 1145 includes a spring-biased plunger valve 1122, check valve 1147, and optionally a pressure compensating valve 1146. The pressure compensating valve 146 provides an automatic means for controlling the rate of descent of the bench pad 1050 when an escape scenario is initiated by a user. One flow conduit circuit 1118*a* fluidly connects the plunger valve 1122 and pressure compensating valve 1146. Flow conduit circuit 1118*a* fluidly communicates with and extends through the body of valve assembly 1145 in order from: the hydraulic cylinder bore 1110 to the plunger valve 1122, to the pressure compensating valve 1146, and finally to the accumulator chamber 1104. This provides a first fluid or flow path for exchange of hydraulic fluid between the hydraulic cylinder 1102 and accumulator 106. Plunger valve 1122 and pressure compensating valve 1146 may be removably disposed in suitably configured bores 1148 formed in the body of the valve assembly 1145 to facilitate installation and replacement if needed. In one embodiment, the bores 1148 may open downwards through the body of the valve assembly 1145 for insertion of the valves 1122, 1146 into their respective bores.

Check valve 1147 is disposed in a separate flow conduit circuit 1118*b* that extends through the body of the valve assembly 1145 and which is fluidly isolated from flow conduit circuit 1118*a*. Circuit 1118*b* extends from in order hydraulic cylinder bore 1110 through the check valve 1147 and to the accumulator chamber 1104. The check valve 1147 is arranged to permit one-way flow from the accumulator 1106 into to the hydraulic cylinder 1102. Flow in the reverse direction is blocked by the check valve. In one embodiment, check valve 1147 may be a ball check type comprising a spring 1147*b* and biased ball 1147*c* which is seated against a valve seat 1147*a*. Valve seat 1147*a* may be formed by or include an O-ring in some embodiments.

Plunger valve 122 comprises a spring-biased movable stem or plunger assembly including elongated plunger 1124 and compression spring 1123 which is manually operated to open and close the valve. Other suitable type springs may be used. The plunger 1124 is disposed 90 degrees to the axial centerline hydraulic cylinder 1102 in this embodiment. The plunger 1124 functions to shut off the flow of hydraulic fluid between the accumulator 1106 and hydraulic cylinder 1102 by moving the plunger 1124 to a closed or blocking position, thereby obstructing flow conduit circuit 1118*a*. Conversely, withdrawing the plunger 1124 from the flow conduit circuit 1118*a* to an open position permits the exchange of hydraulic fluid between the accumulator 1106 and hydraulic cylinder 1102. The valve 1122 and plunger assembly is operated via an operating lever assembly which in one non-limiting preferred embodiment is configured as a foot lever 1130. Alternatively, a hand-operated lever may be provided. Foot lever 1130 is pivotably mounted to longitudinal members 1023 of the frame 1021 and comprises a generally S-shaped lever in the form of a cylindrical rod comprising a horizontal mounting section 1130*a* which extends through openings in the longitudinal members, a horizontal operating section 1130*b* offset but parallel to section 1130*a* which is configured for operation by the foot or hand of a user to rotate the foot lever, and an intermediate section 1130*c* extending orthogonally therebetween. An enlarged pedal as shown may be provided with operating section 130*b* in some embodiment for easier operation by the user.

Mounting section 1130*a* defines a pivot axis for the foot lever 1130 and includes an elongated cantilevered lever arm 1131 fixedly connected to and protruding outwards from lever section 1130*a* in a perpendicular radial direction. A mechanical linkage 1132 which may be a solid shaft, spring, cable, or other type linkage connects lever arm 1131 of the foot lever to a toggle cam 1133 pivotably mounted proximate to plunger valve 1122. In the present embodiment, mechanical linkage 1132 is shown as a rod. Toggle cam 1133 has a generally flattened plate-like body in the illustrated embodiment defining a cam surface 1133*a* at a working end which acts on a cam follower 1134 coupled to plunger 1124. An opposite operating end of the cam is pivotably connected to mechanical linkage 1132, and two opposing lateral sides extends between the working and operating ends. In one embodiment as shown, the cam follower 1134 may be defined by a distal cylindrical end portion of the plunger 1124 which projects outward and below the valve 1122 body. Retracting or projecting the cam follower 1134 from valve 1122 therefore selectively closes or opens the valve 1122, respectively.

The cylindrical cam follower 1134 protrudes downwards from and below the body of valve assembly 1145 to engage the toggle cam 1133. The cam follower 1134 formed as an integral part of the valve plunger 1124 (or separate part coupled thereto) operates such that pivoting the foot lever 1130 in opposite rotational directions open or closes the plunger valve 1122 since arcuately curved cam surface 1133*a* is asymmetrically offset from pivot 1135 which mounts the toggle cam 1133 to the body of the valve assembly 1145 (see, e.g. FIGS. 84-85). The pivot hole formed in toggle cam 1133 which receives pivot 1135 is asymmetrically located between the lateral sides of the toggle cam body as shown so that the distance from the pivot to either of the lateral sides is unequal. In one embodiment, pivot 1135 may be formed by a transverse pin which is supported by a support bracket such as inverted U-shaped clevis 1138 attached to the bottom of the valve assembly 1145 body. Other style mounting brackets and arrangements may be used for the pivotable connection.

Figure 85:
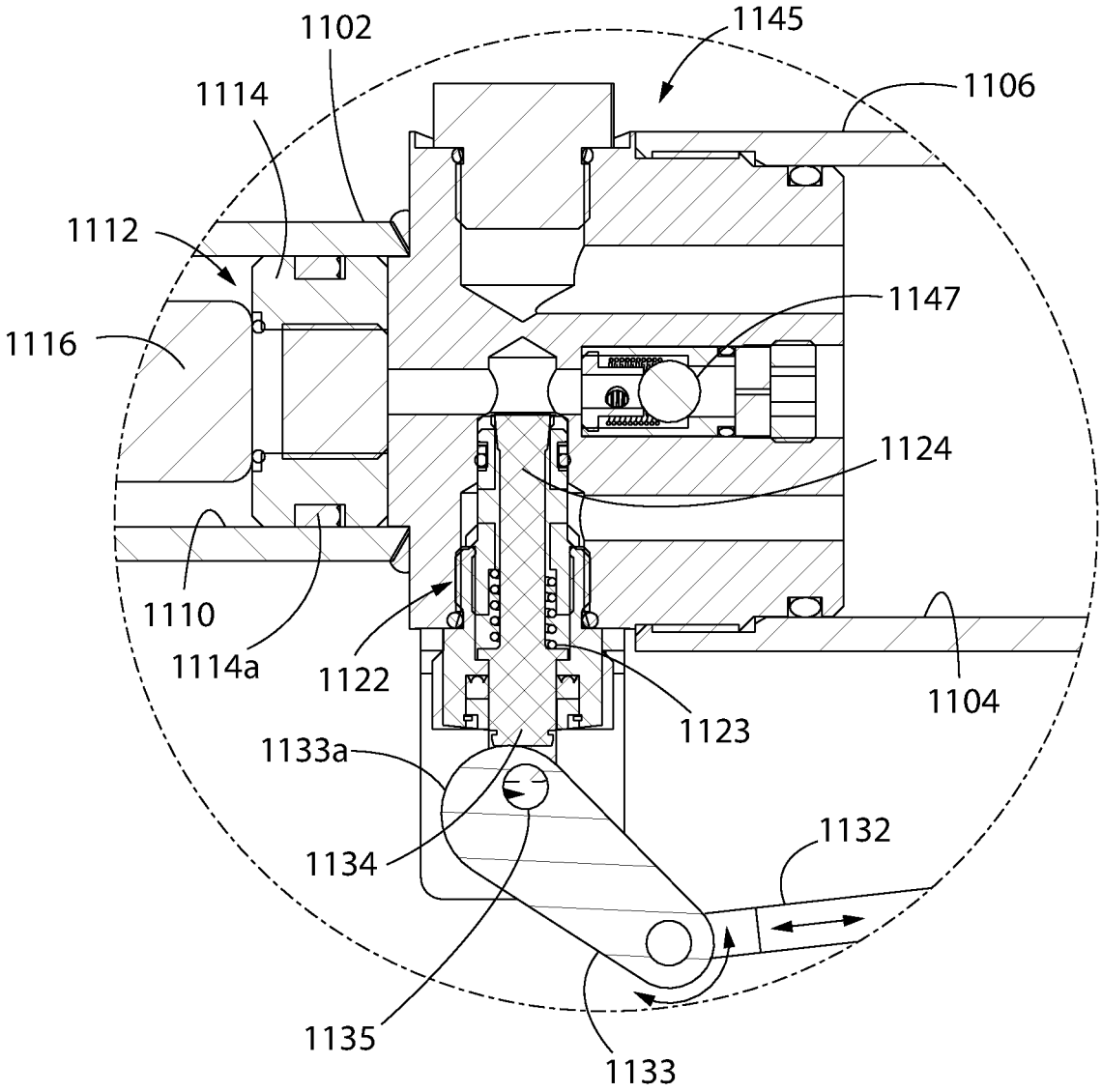
FIG. 85 is a detailed view taken from FIG. 84.
Figure 86:
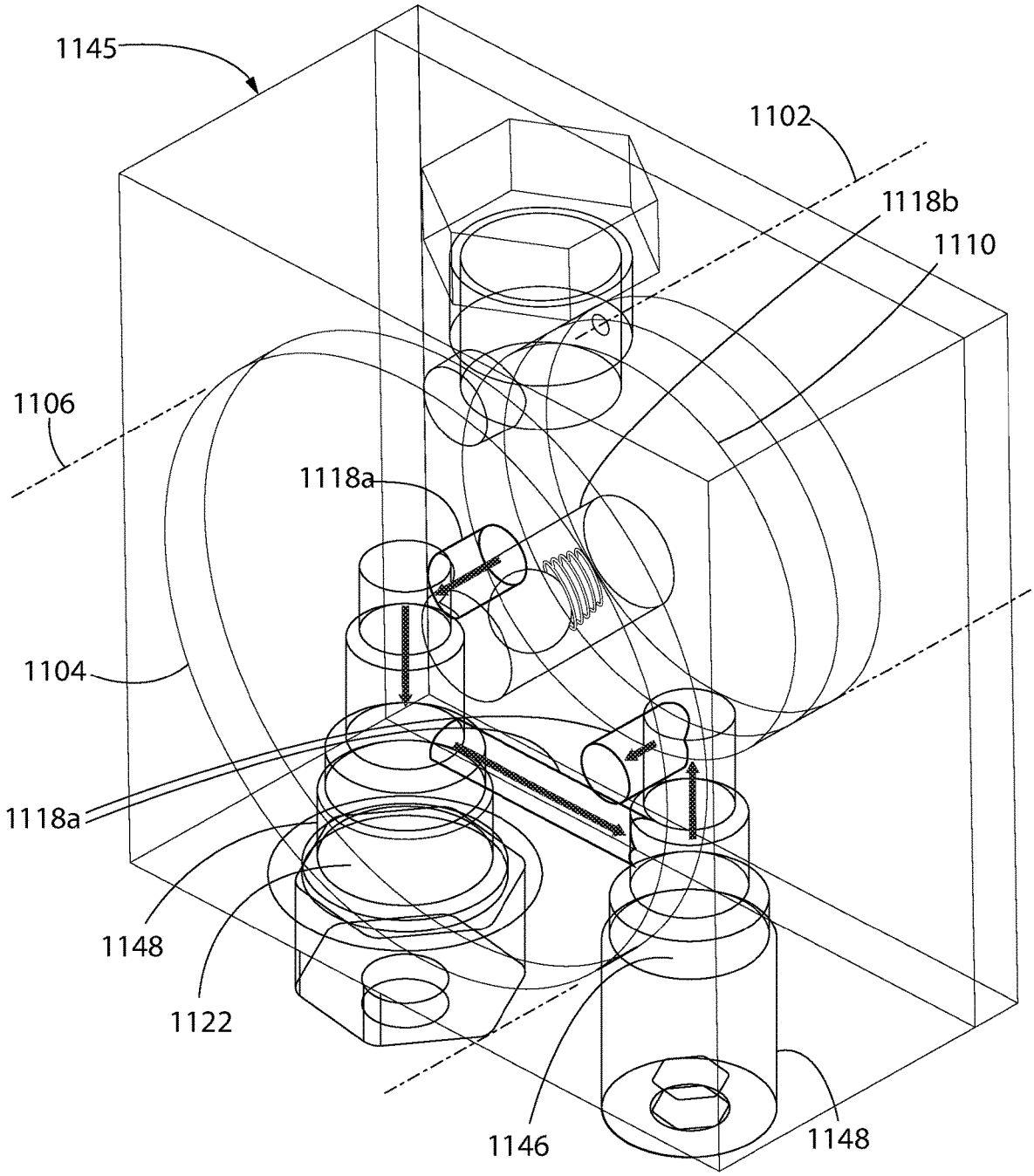
FIG. 86 is a perspective view of the flow control valve assembly of the cylinder system of FIGS. 78 and 79 showing the valve internals.
Figure 87:
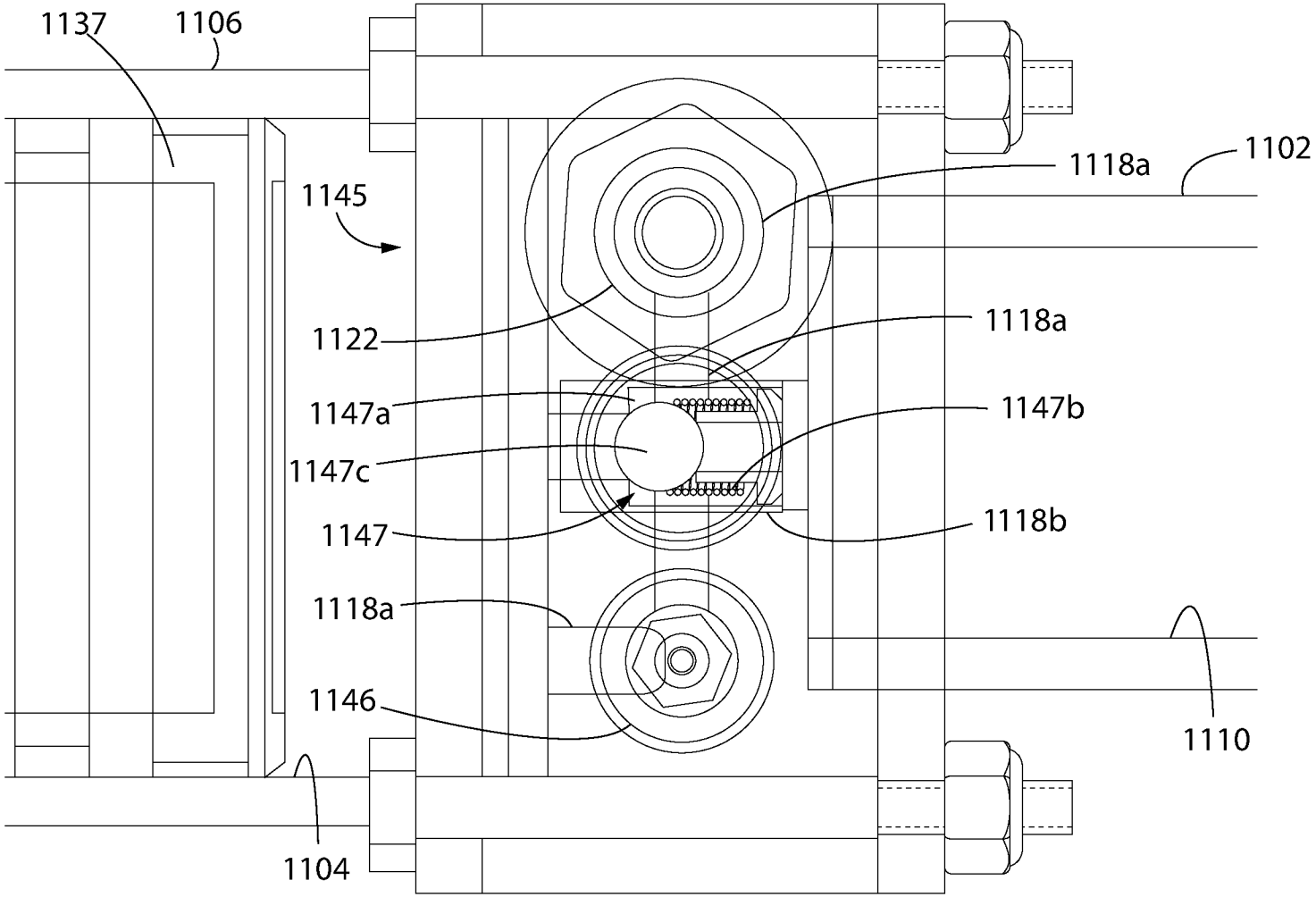
FIG. 87 is a top view thereof.
Figure 88:
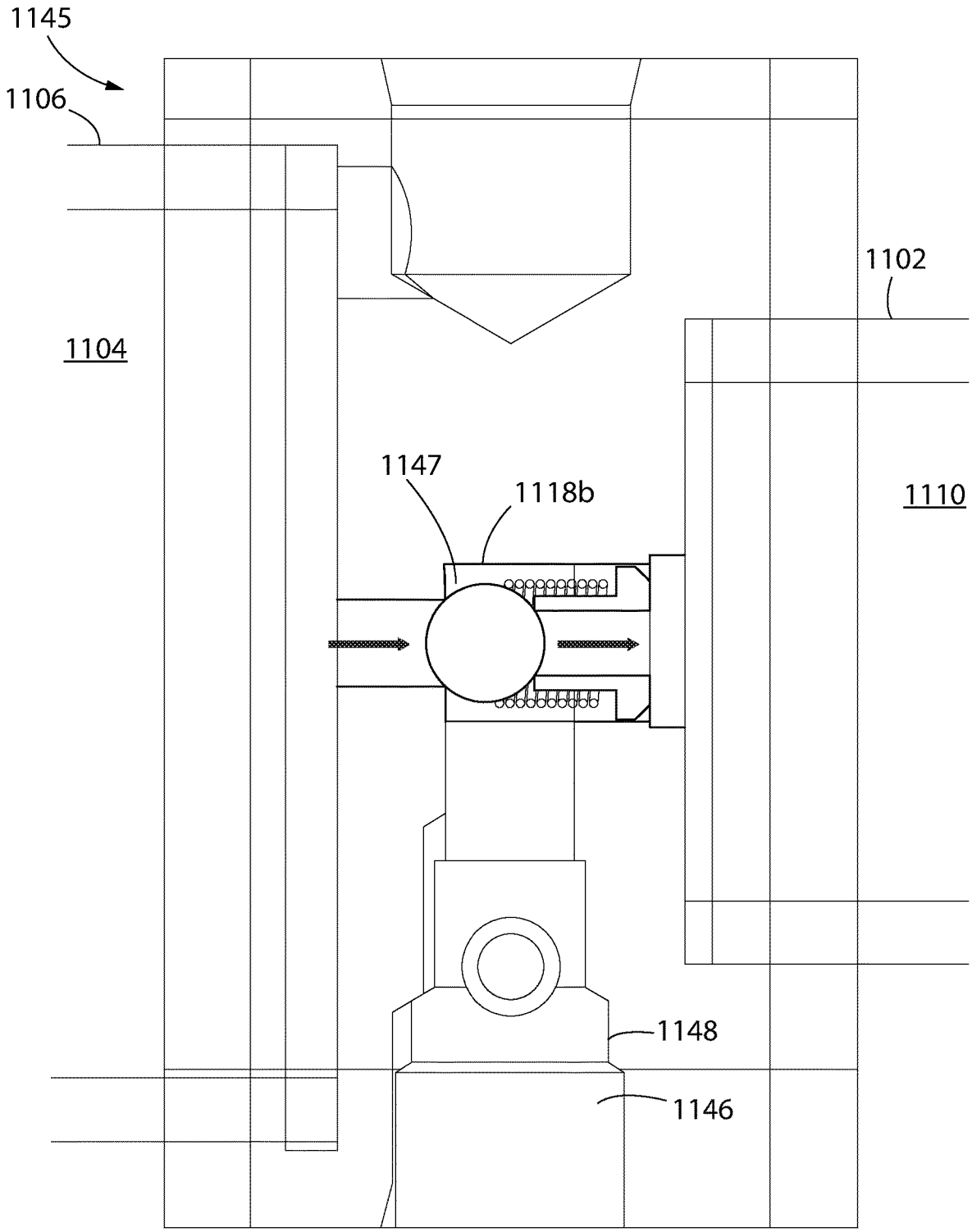
FIG. 88 is a side view thereof showing the valve internals.
Figure 89:
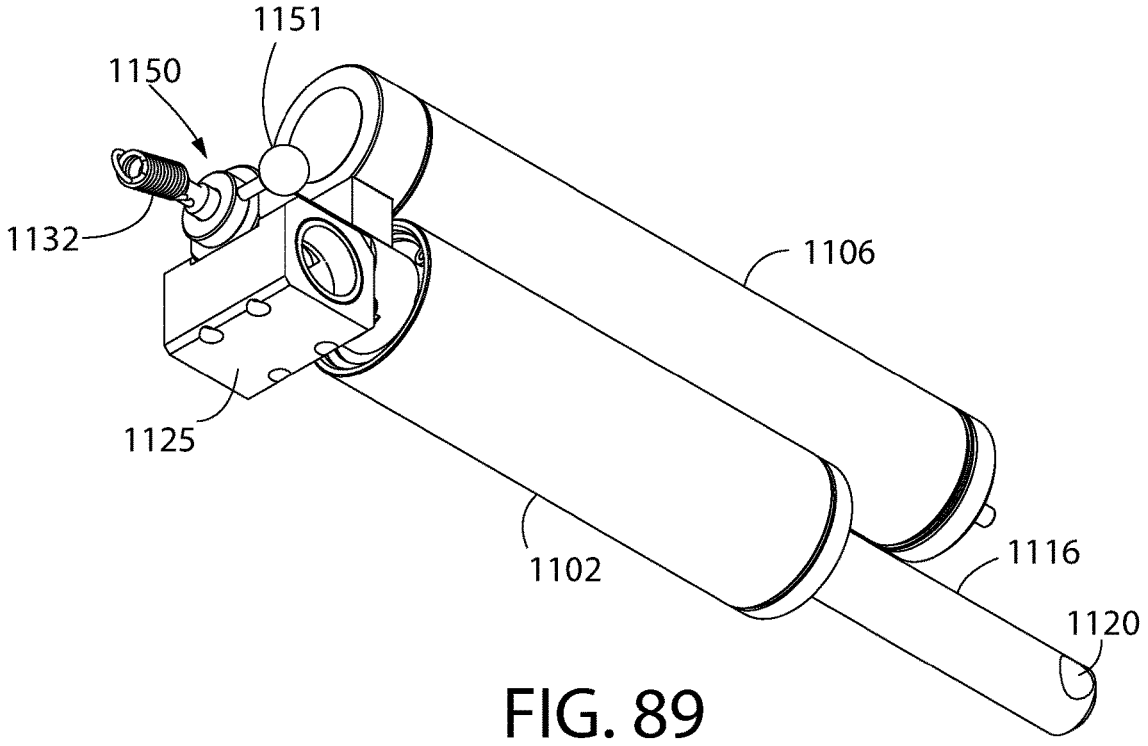
FIGS. 89 and 90 show front and rear perspective views respectively of another embodiment of a hybrid hydraulic cylinder system for operating any of the weight lifting benches and/or pad assemblies disclosed herein that comprises an integrated hydraulic cylinder, accumulator, and operating valve assembly in which the accumulator is arranged parallel to the cylinder.
Figure 90:
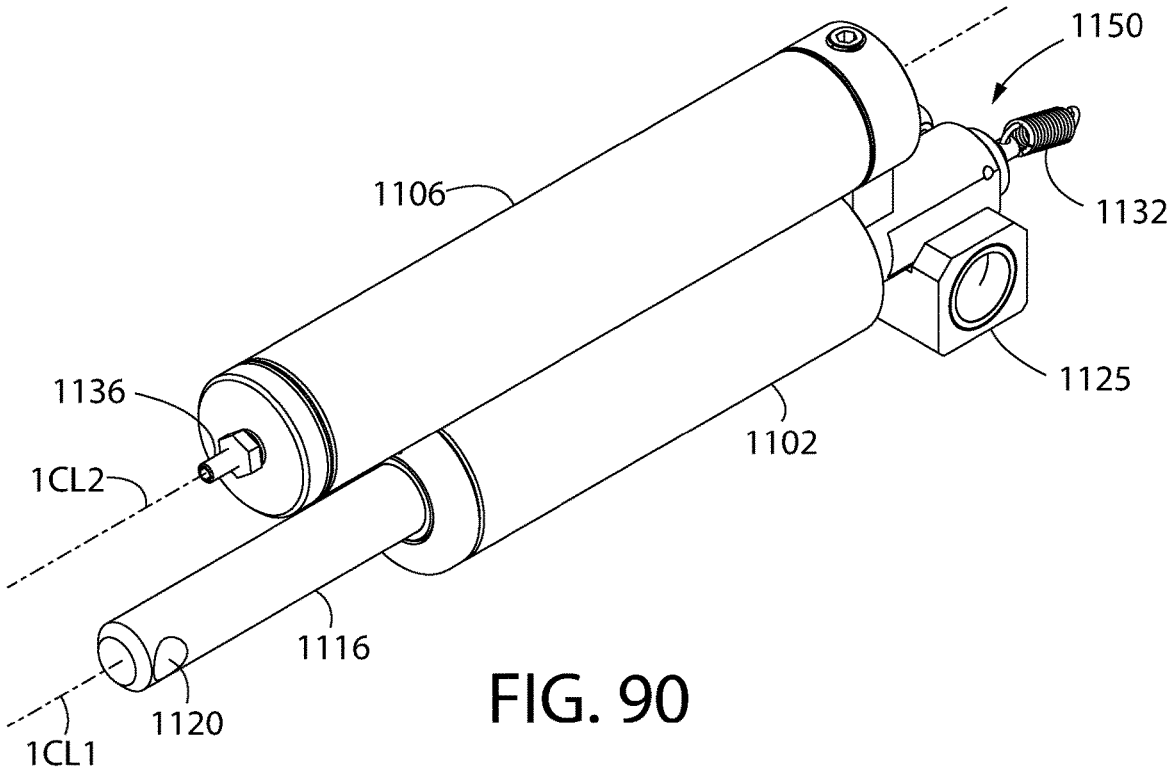
Figure 91:
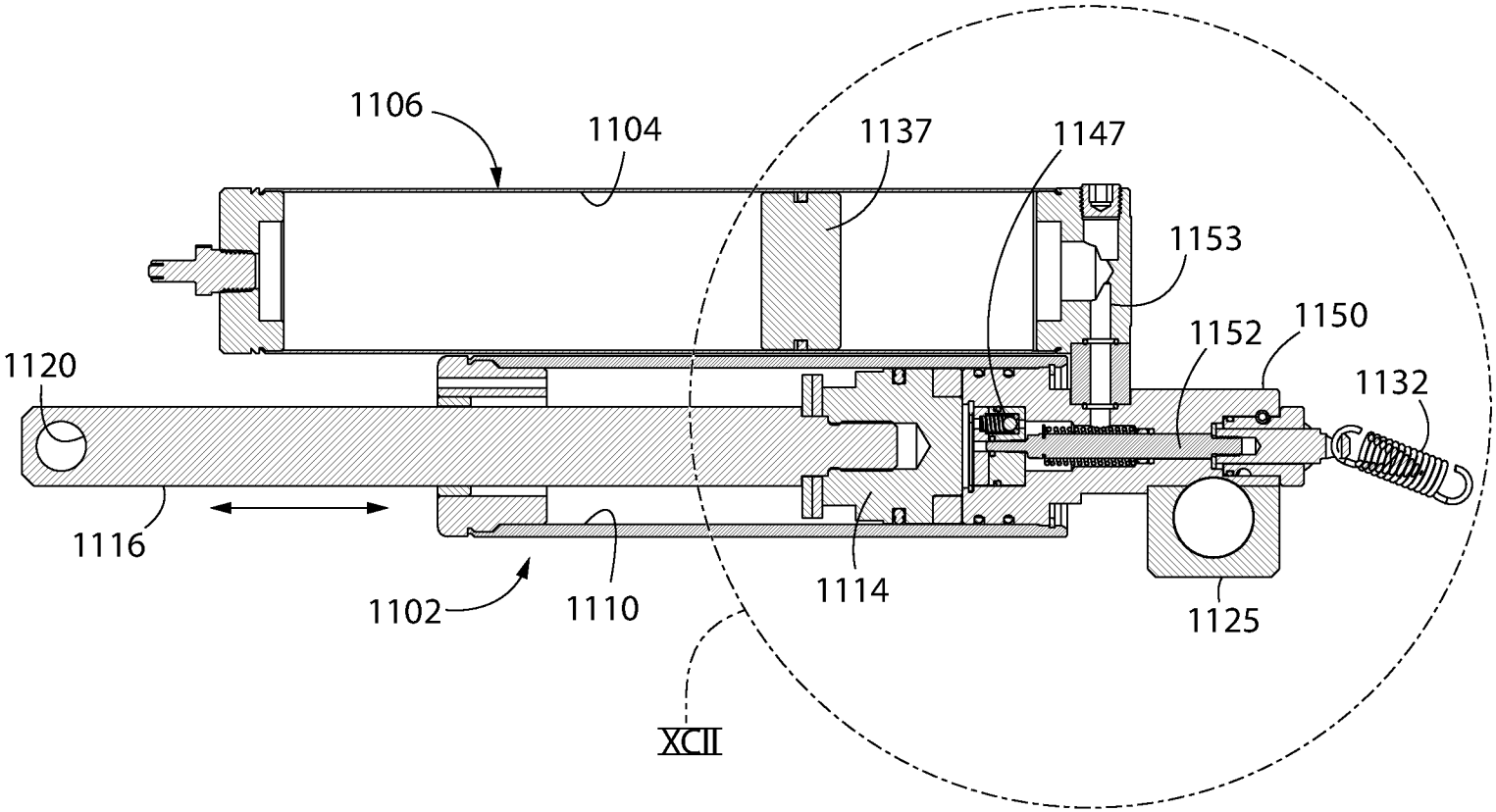
FIG. 91 is a side cross-sectional view thereof.
Figure 92:
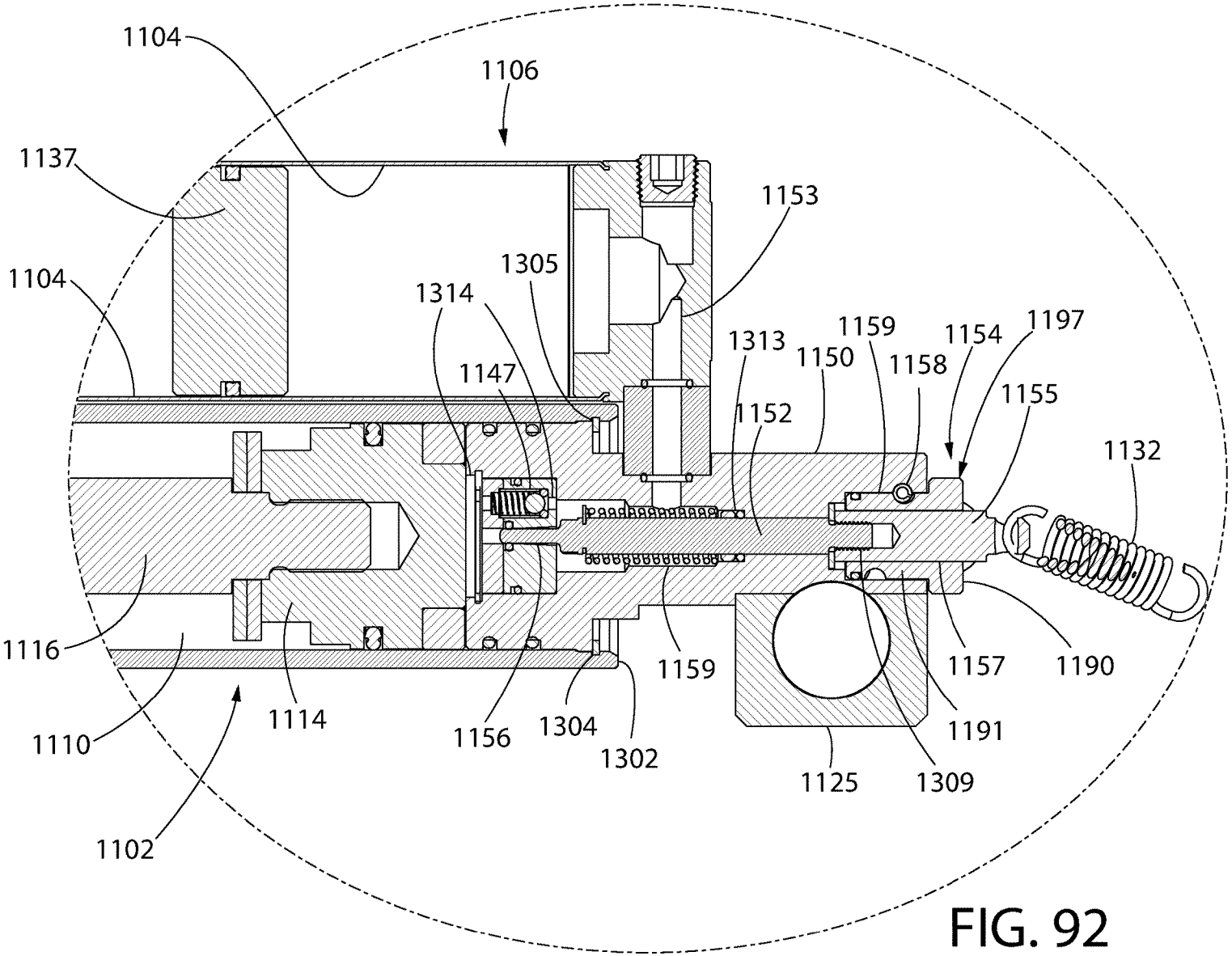
FIG. 92 is an enlarged detail taken from FIG. 91.

FIG. 85 shows the toggle cam 1133 in a first inactive position with spring-biased cam follower 1134 contacting an outer lateral region of cam surface 1133*a* closest to pivot 1135. The cam follower 1134 is biased downward by plunger spring 1123 to maintain contact with the cam surface 1133*a* on the toggle cam and bias valve 1122 into a closed position. Rotating the toggle cam 1133 in a clockwise direction (in FIG. 85) via foot lever 1130 and mechanical linkage 1132 brings the central portion of cam surface 1133*a* into engagement with the bottom end of the cam follower 1134. This pushes the cam follower 1134 and plunger 1124 upward into the plunger valve 1122 against the biasing force of the plunger spring 1123. The plunger 1124 is actuated and raised to move plunger valve 1122 into a closed position.

Referring to FIG. 78-84, the hydraulic cylinder assembly 1100 may utilize a suitable incompressible hydraulic oil used in such cylinders as the working fluid. In one implementation, the accumulator 1106 may be a hydro-pneumatic gas-over-oil type in one embodiment incorporating a compressible gas with the hydraulic fluid oil. The gas may be compressed air or other suitable compressible inert gas (e.g. nitrogen, etc.) which is pre-charged (i.e. pre-pressurized) to an appropriate initial pre-charge pressure. The oil 1101 occupies the hydraulic cylinder bore 1110 and air 1103 at least partially fills the accumulator chamber 1104 (depending on whether the cylinder rod 1116 is retracted or extended). An air-oil interface is formed between the air and oil within the chamber by an axially slidable piston 1137 which shifts position in response to movement of the cylinder rod 1116 and connected piston head 1114 in hydraulic cylinder 1102. Piston 1137 is sealed at its peripheral edges to the chamber 1104 by suitable annular seals to keep air oil from leaking past the piston into the oil. The air 1103 may be filled into the chamber 1104 at a pre-charge pressure via an air fill or charging valve 1136 fluidly connected to the accumulator 1106. Valve 1136 may be a Schraeder type valve in one embodiment; however, other type valves may be used.

It should be noted that an air/oil accumulator is preferable over other designs due to lower manufacturing costs and added longevity of life. The rubber bladder used in other air or gas-over-oil type accumulators may be problematic for this design and application. Particularly when the hydraulic cylinder used in a substantially horizontal position as illustrated herein, the rubber bladder can rub and wear over time against the interior of the accumulator chamber, thereby ultimately leading to failure and leakage. However, rubber bladder type accumulators may viably be used nonetheless. Still in other embodiments contemplated, weight-loaded piston or spring type accumulators may be used. Accordingly, the choice of accumulator type does not limited the invention.

In operating principle, compressed air 1103 at a pressure higher than atmospheric stores useable potential energy which is converted to kinetic energy to displace piston head 1114 and automatically return the bench pad 1050 to an upright position, as further described herein. The compressed air exerts pressure against a distal side of the piston 1137 (farthest from valve 1122) in accumulator 106 that separates the air and hydraulic fluid. Piston 1137 in turn exerts force against the hydraulic oil 1101 on the proximal side of piston 1137 (closest to valve assembly 1145). The oil acts in a rigid manner (due to the incompressible nature of the hydraulic oil) against the proximal side of the piston head 1114 in the cylinder bore 1110 when the bore and accumulator chamber 1104 are fluidly connected. This pressure force is used to extend the cylinder rod 1116 for forming the support pad auto-return feature of the present invention.

The hydraulic cylinder 1102 with cylinder rod 1116 is the support mechanism between the sets of struts 1031, 1032 that maintains the upright position of the bench pad 1050. When the cylinder rod 1116 is fully extended, the bench pad 1050 is in its highest position relative to the floor or ground At this point, the hydraulic fluid fills the cylinder bore 1110 in the hydraulic cylinder 1102 pushing and extending the rod outwards from the cylinder. The transfer of hydraulic fluid between the cylinder bore 1110 and the air/oil accumulator chamber 1104 controls the cylinder rod and hence bench pad 1050 position. When the cylinder rod 1116 is fully retracted inwards into the cylinder 1102, the bench pad 1050 is in the lowest position relative to the floor or ground. At this point, the hydraulic fluid fills the accumulator 106 and the rod is completely retracted. To adjust the vertical position of the bench pad 1050, the user may press the foot lever 1130. The foot lever controls the position of flow control valve 1122 (e.g. open or closed) which allows or prevents the exchange and flow of hydraulic fluid between the hydraulic cylinder 1102 and accumulator 1106.

Figure 95A:
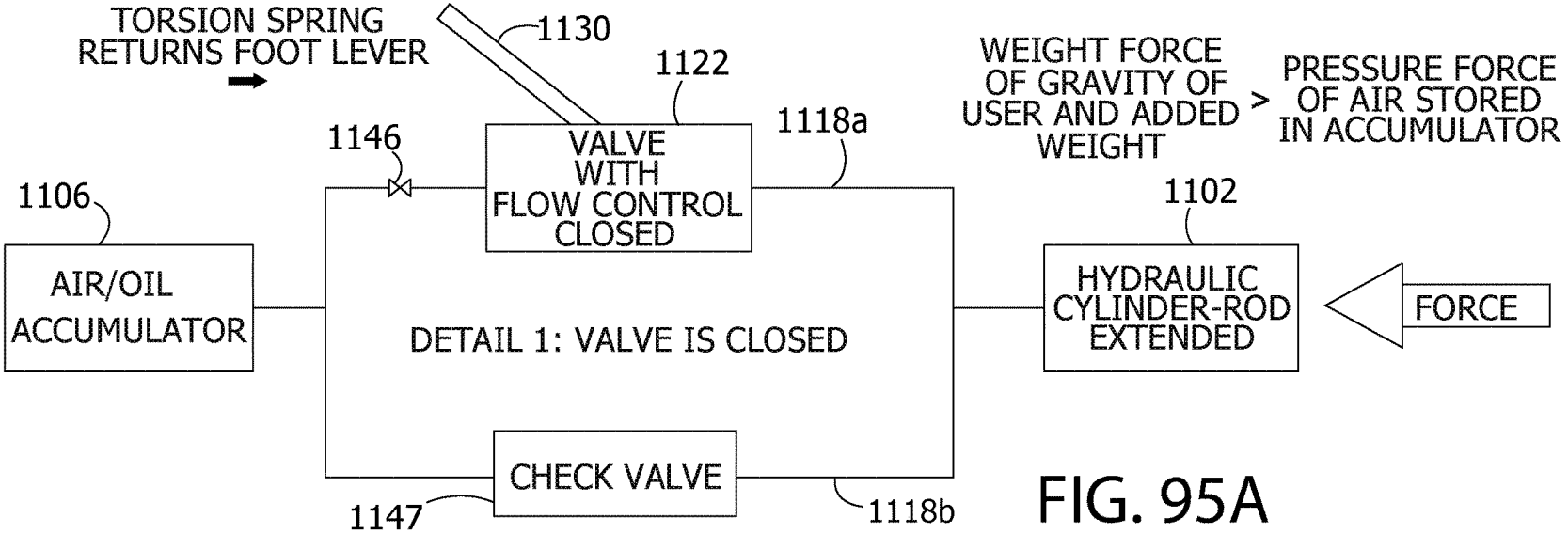
FIG. 95A is a schematic flow diagram of the hydraulic control system in a state when the bench pad is in the extended normal upper exercise position in which the exchange of hydraulic fluid between the hydraulic cylinder and accumulator is stopped by a closed lever actuated plunger valve.

Operation of the hydraulic control system will now be described. FIG. 95A corresponds to bench pad 1050 in an upper exercise position (see, e.g. FIG. 61A or 65A for the portable bench). Plunger valve 1122 is closed in which foot lever 11130 is in an upward position and the toggle cam 133 is in a corresponding upward position to close the valve. While the bench pad 1050 is in an upper exercise position with a weight lifter seated thereon, the gravity force from the weight of the user and the added weights of the barbell act as force against the hydraulic cylinder 1102 in a direction towards retracting the rod 1116 therein. With the foot lever 1130 in the upward unactuated position shown in the hydraulic flow diagram of FIG. 95A, however, the plunger valve 1122 remains closed and does not permit hydraulic fluid to flow or exchange between the cylinder 102 and accumulator 1106, thereby preventing the bench pad from dropping. Accordingly, the hydraulic cylinder 1102 is not in fluid communication with the accumulator 1106 at this time. In this position, the weight training equipment is ready and operational for exercise. Due to the fact that hydraulic fluid is non-compressible, the hydraulic cylinder set-up provides the same rock solid feel as a rigidly welded piece of equipment. It should be noted that the bench pad 1050 may be in its highest adjustment position or somewhat lower but still upward to suit the size of the user and preferences.

Figure 95B:
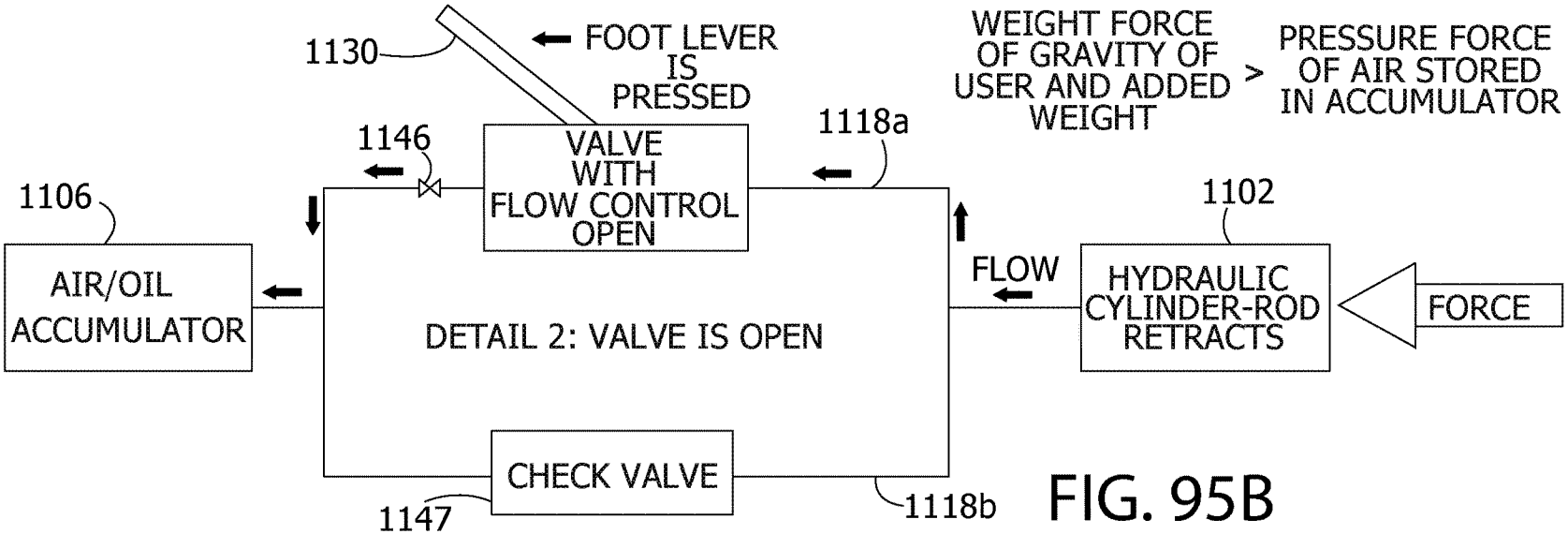
FIG. 95B is a schematic flow diagram of the hydraulic control system in a state when the bench pad is in the process of descending to the collapsed lower escape position in which hydraulic fluid flows from the hydraulic cylinder into the accumulator via an open plunger valve.

When the foot lever 1130 is pressed downward and rotated towards the floor or ground to a downward actuated position, the plunger valve 1122 opens as shown in flow diagram of FIG. 95B to implement the escape scenario. The downward motion of the foot lever 1130 pulls the mechanical linkage 1132 towards the front foot-end of the bench to open the valve 1122. The toggle cam 1133 coupled to the valve rotates laterally and upward causing the valve plunger 1124 to be urged downwards by spring 1123 to open the valve 1122. The gravity force of weight from the user and added weight of the barbell on the equipment forces the cylinder rod 1116 to retract inwards into hydraulic cylinder 1102 and the hydraulic fluid 1101 to now flow from the cylinder 1102 to the accumulator 1106. As the rod 1116 retracts into the cylinder 1102, the downward gravity force on the struts 1031, 1032 cause them to pivot at the fixed pivot points (i.e. cross bolts 1034*a*, 1034*b*), and the angles of the struts change relative to the ground and base 1022 causing the bench pad 1050 to lower. If the user intends to simply partially lower the bench pad 1050 for an exercise routine, releasing the foot lever 1130 at any point during the descending bench motion will close the plunger valve 1122 and hold the bench pad in the respective position. If the user tires during the lifting routine and becomes trapped beneath the barbell, the escape scenario may be implemented such that the user holds down the foot lever until the bench pad 50 drops to its lowest escape position (see, e.g. FIG. 61B or 65C for the portable bench). The barbell will come to rest on the safety rack 1028, thereby creating a vertical gap between the bar of the barbell and user's chest allowing the user to escape. The barbell rests on the safety racks and provides a stable hold for the user to grip and slide themselves out from under the weights. The force against the horizontal safety racks and upright support racks allows the user to pull themselves forward, and up and off the equipment.

Figure 78:
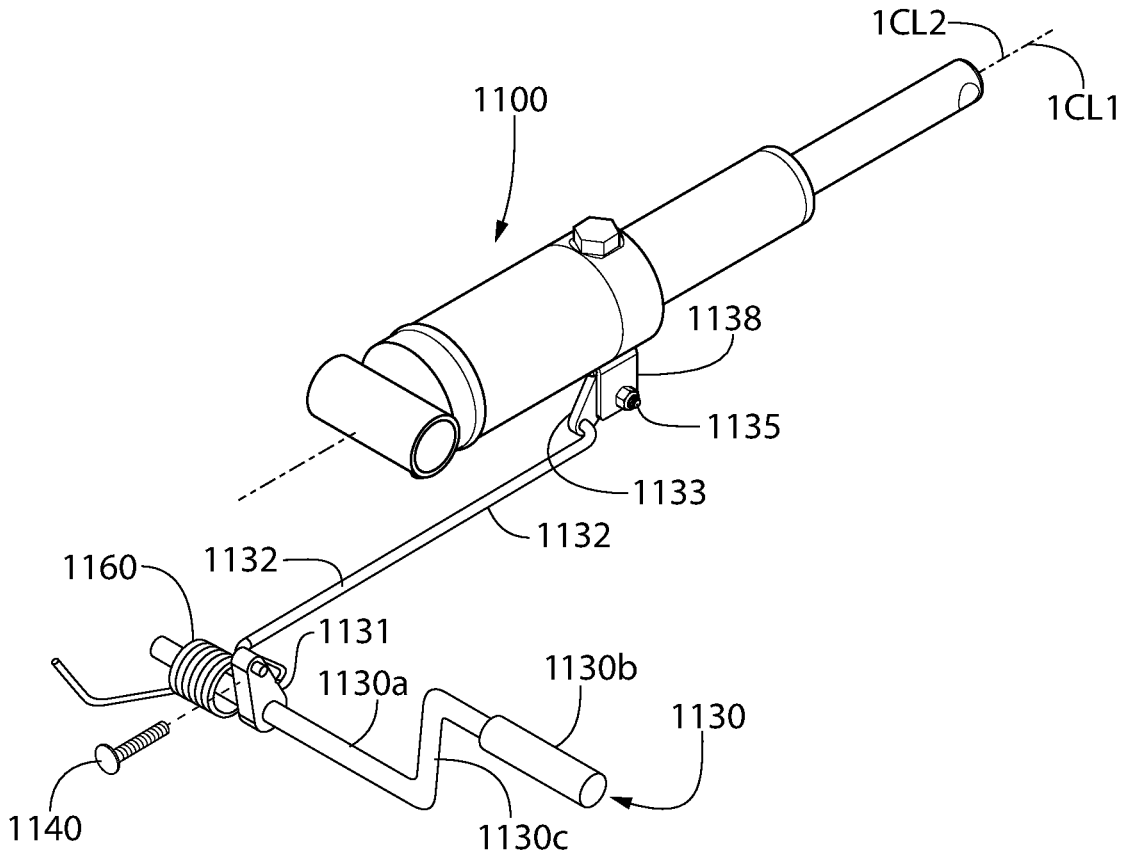
FIGS. 78 and 79 show front and rear perspective views respectively of one embodiment of a hybrid hydraulic cylinder system for operating any of the weight lifting benches and/or pad assemblies disclosed herein that comprises an integrated hydraulic cylinder, accumulator, and operating valve assembly in axial alignment.
Figure 79:
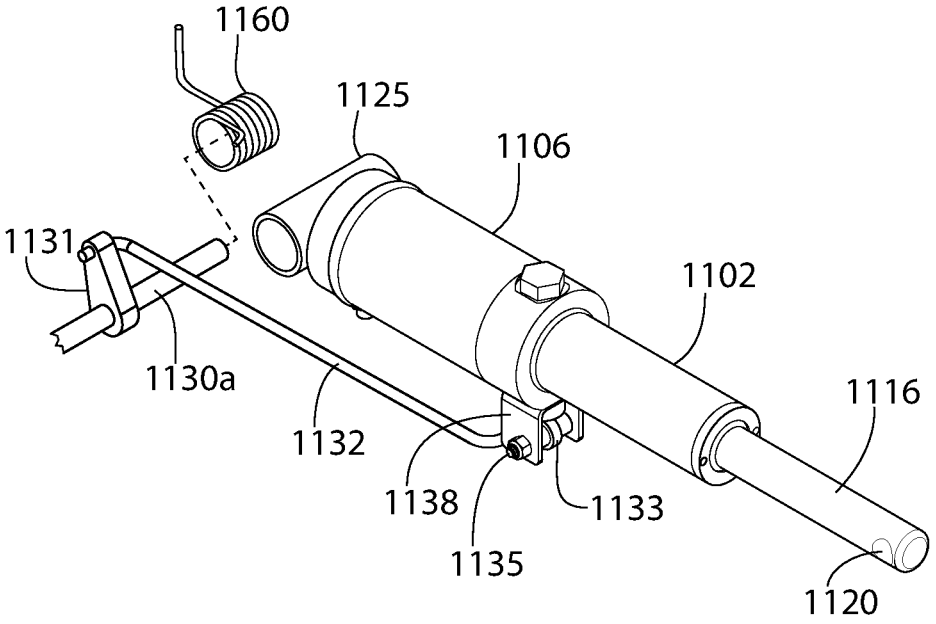
Figure 80:
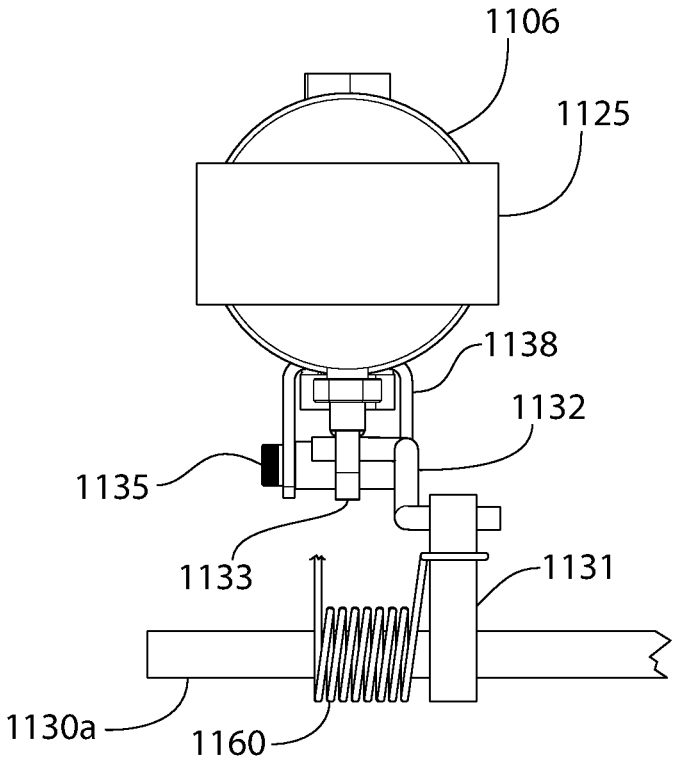
FIG. 80 is a front view thereof.
Figure 81:
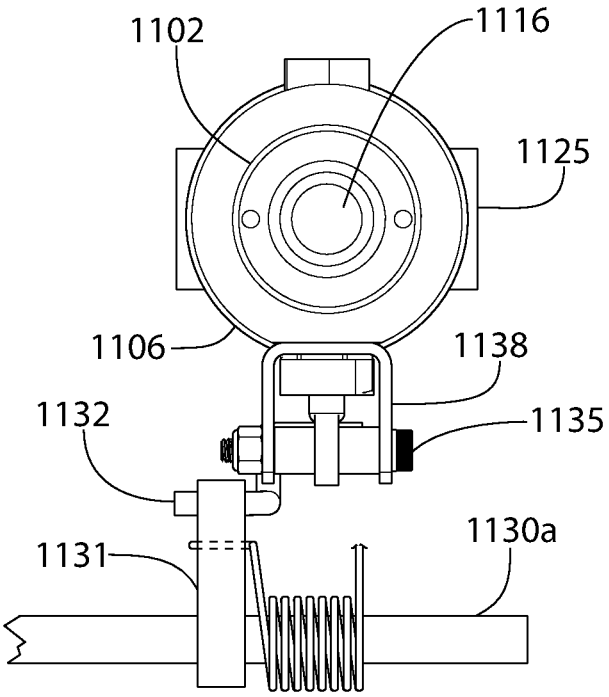
FIG. 81 is a rear view thereof.
Figure 82:
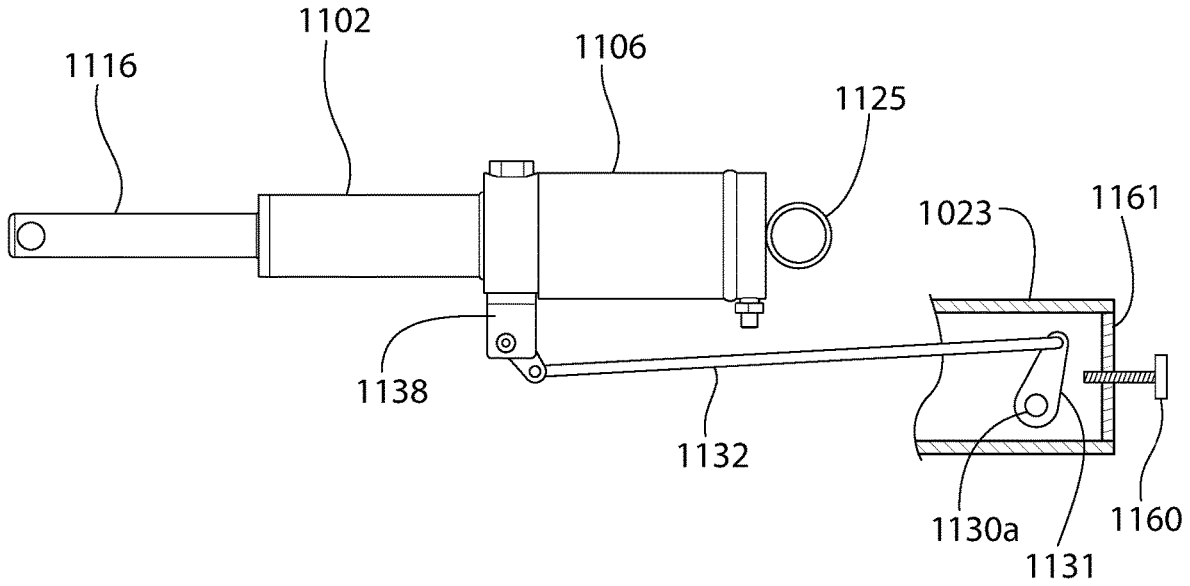
FIG. 82 is a side view thereof.
Figure 83:
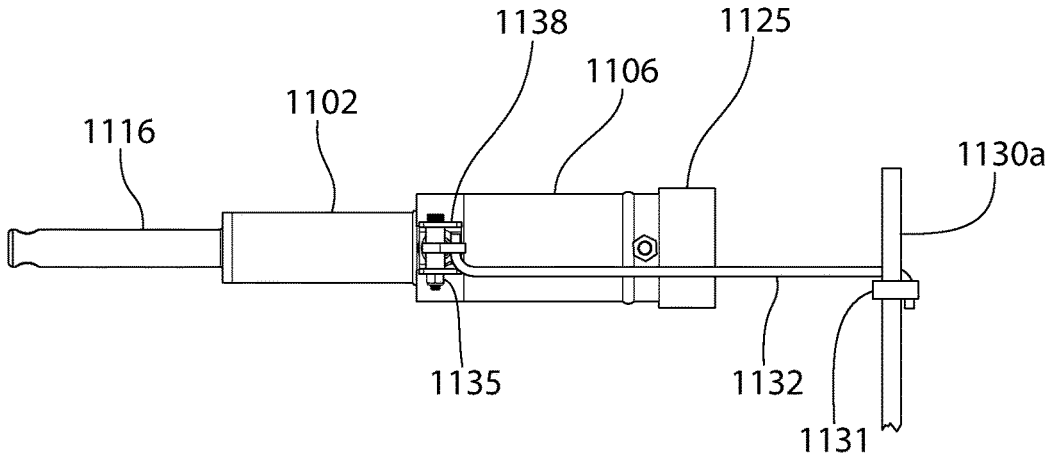
FIG. 83 is a bottom view thereof.
Figure 93:
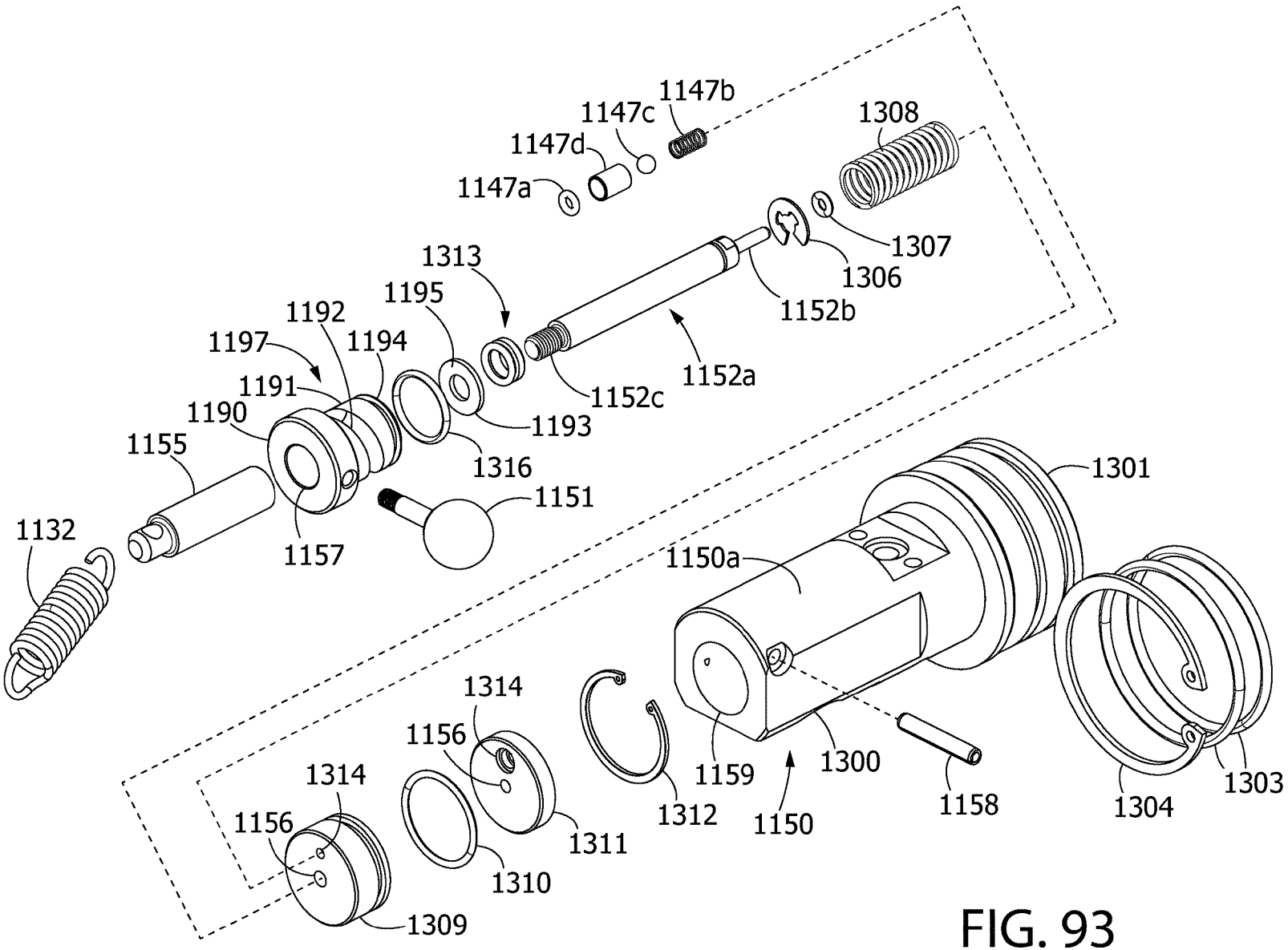
FIG. 93 is an exploded view of the hydraulic cylinder system of FIGS. 89 and 90.
Figure 94:
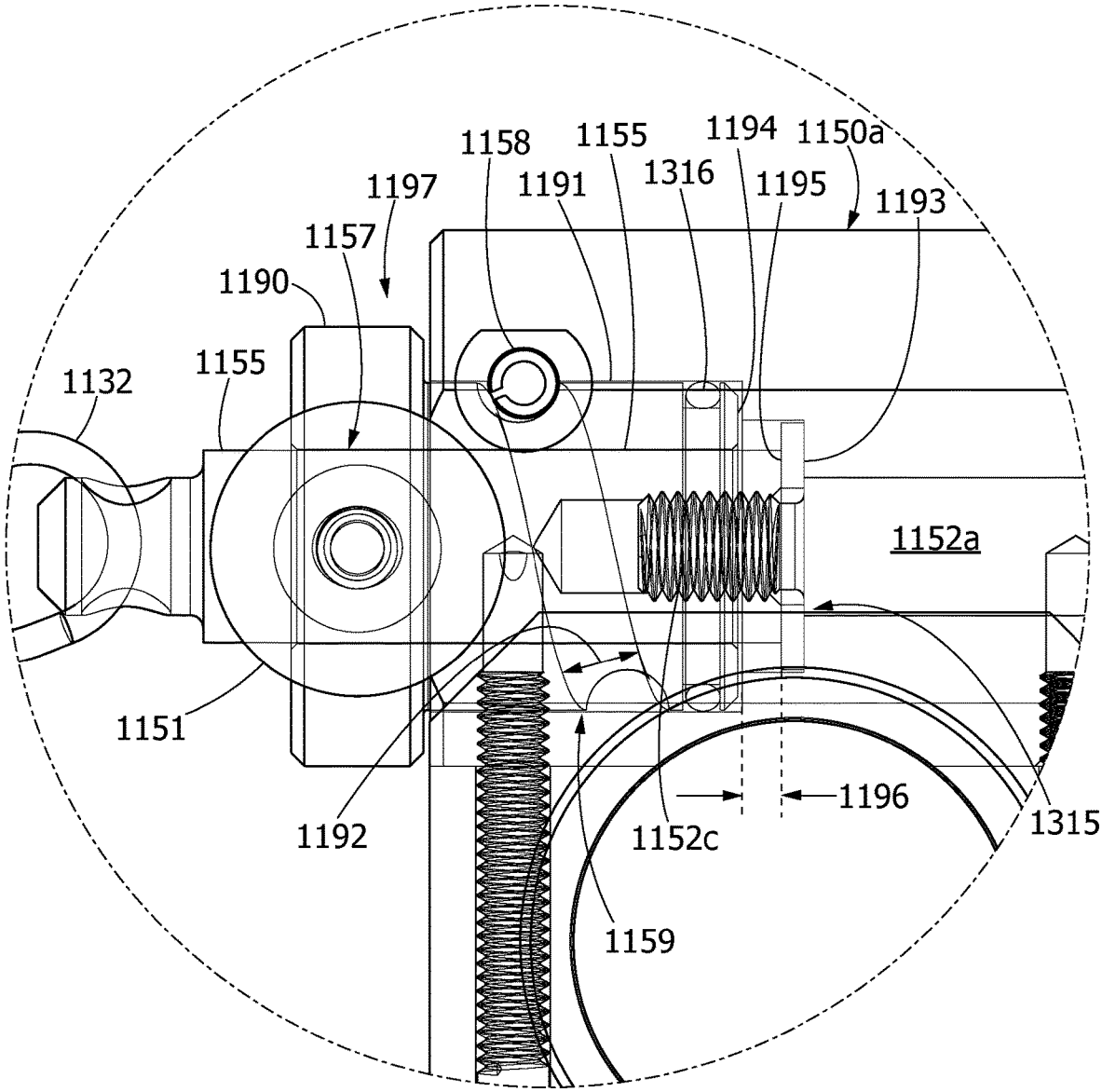
FIG. 94 is an enlarged side cross-sectional view of the plunger portion of the hydraulic cylinder system of FIGS. 89 and 90.
Figure 98:
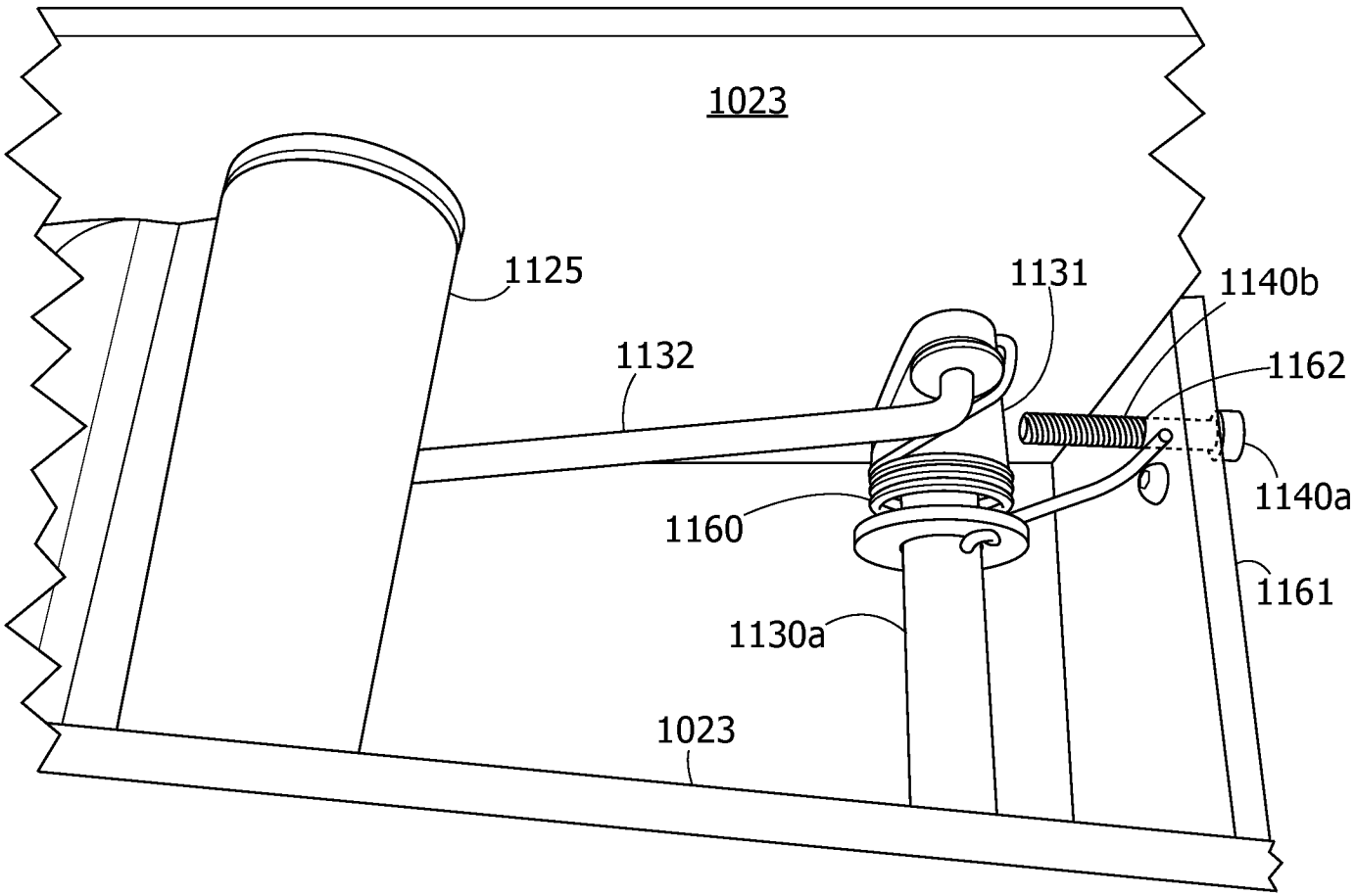
FIG. 98 is a top perspective view showing a portion of an operating lever assembly for the automatic bench return mechanism including an automatic operating lever return mechanism and adjustable bench pad speed control stop.

When the foot lever 1130 is then released by the user, the lever automatically rotates back into the upward unactuated position under the biasing action of return spring 1160 thereby moving the mechanical linkage 1132 in an opposite direction back towards the rear head end of the bench. FIGS. 78, 82, and 93 show the return spring arrangement. In one embodiment, the return spring 1160 may be torsion spring arranged around the mounting section 1130*a* of the foot lever rod as best shown in FIG. 98. One leg of the spring engages transverse member 161 and the opposing leg engages the lever arm 1131 of the foot lever 1130 assembly. This biases the lever arm 1131 towards the head end (rack end) of the bench (counterclockwise in FIG. 98), which in turn biases the foot lever 1130 into the upwards unactuated position associated with full closure of the plunger valve 1122. Without the return spring 1160, the user would have to not only press the foot lever to open the valve, but then manually pull it back to close the valve. The automatic return of the foot lever is not only easier for the user to operate, but it is less problematic for the equipment to function as designed. In other possible arrangements, the torsion return spring 1160 may alternatively be mounted around the pivot pin 1135 supported by the support bracket or clevis 1138 attached to the hydraulic cylinder assembly 1100 such as the valve assembly 1145. One leg of the spring may engage the toggle cam 1133 and the opposing leg engages the clevis 1138 or other part of the hydraulic cylinder assembly 100. The foot pedal 1130 biasing action remains the same in this embodiment as described above, but the spring is mounted on the other end of the mechanical linkage 1132 closest to the hydraulic cylinder instead of the foot pedal. It will be appreciated that other types of springs including helical compression springs, extension springs, etc. may alternatively be used to bias the foot lever into its upward unactuated position.

In order for the plunger valve 1122 to stay open, the user must maintain pressure on the foot lever 1130. If pressure is removed from the foot lever, the valve will close and the bench pad 1050 will remain in a fixed position. This feature allows for adjustable positioning of the bench pad without ever having to get off the equipment. When the weight lifter experiences maximum fatigue, he/she has the option to press the foot lever and lower the bench pad 1050 to the escape position closer to the ground until the weight (i.e. barbell) is removed safely by the support racks 1028.

By operation of the foot lever 1130, the plunger valve 1122 configured to function as an on, off, or throttling valve, is operable to create full flow when in a fully opened position, no flow in a fully closed position, and partial flow in a throttled position therebetween. The rate of descent at which the bench pad 1050 drops during an escape scenario initiated by a user is determined by the amount that the valve 1122 is open and gravity force generally of the weights of both the user and barbell held by user. In various embodiments, the rate of decent may be controlled automatically or manually by the user to suit both user preferences, and more importantly to achieve a safe controlled drop of the bench pad 1050.

Bench Descent Speed Control Safety Mechanism

Prior weight lifting benches known having mechanisms for lowering the bench upon activation of a release mechanism did not provide a means for controlling the drop rate of the bench in an exercise escape scenario, thereby overlooking this important safety issue. The bench descent speed or rate control safety system according to the present disclosure however prevents the bench pad 1050 from slamming down when the foot lever 1130 is depressed to initiate an escape scenario which may otherwise jolt the user creating a potential for injury. An automatic means for controlling the rate of descent for bench pad 1050 to achieve a safe motion is provided in one embodiment by the pressure compensating valve 1146 (which in the present embodiment is part of the valve assembly 1145 described above). Valve 1146 is preferably designed and set to maintain a preset pressure differential across the valve and hence flow rate through the valve regardless of pressure variations in the inlet hydraulic fluid stream that may be caused by users of different physical weights or handling barbell loads which may vary. Accordingly, the rate at which the bench pad 1050 will drop when foot lever 1130 is depressed downwards will always remain constant thereby reflecting a factory preset pressure differential regardless of whether a heavy or light user is seated on and using the bench, which affects the upstream pressure acting against the valve from the hydraulic cylinder 1102 side of the valve. The preset pressure which coincides with the maximum predetermined speed or descent rate for bench pad 1050 may preferably be set at the factory as a safeguard and is not adjustable by the user; however, the user may be provided with some ability to adjust the descent rate up to the maximum descent speed. The predetermined maximum descent rate of the bench is therefore independent of the weight load applied to the bench pad. Pressure compensating valves have a cartridge acted on by a spring that regulates the degree that the valve is open. The valve preset pressure differential/flow rate is preferably selected to provide flow of hydraulic fluid through the valve which provides a reasonable rate of descent for the bench pad 1050 thereby avoiding a rapid uncontrolled drop jarring the user. Pressure compensating valves are available from numerous commercial sources such as Parker Hannifin Corporation and others.

One possible type of manual speed control mechanism that may be used in lieu of a pressure compensating valve comprises an adjustable speed control stop 1140 that limits the distance the foot lever 1130 can travel, thus limiting the amount the plunger valve 122 can open. Speed control stop 1140 is shown for example in FIGS. 78, 82, and 93. A valve assembly 1145 for bench having a speed control stop may comprise only the plunger valve 1122 and check valve 1147, and eliminates the pressure compensating valve 1146 shown schematically in FIGS. 95A-B. However, in other embodiments contemplated, both a speed control stop 1140 and pressure compensating valve 1146 may be provided to achieve redundancy and a backup for limiting the descent rate to a safe speed. In such an alternative arrangement, the pressure compensating valve may be factory preset to establish a maximum safe rate of descent for the bench pad 1050. The speed control 1140 stop may provide a user adjustment to adjust the descent rate at which the bench pad 1050 drops up to a point that is less than the factory preset maximum limit of pressure compensating valve 146.

By limiting the amount the plunger valve 1122 can open using the speed control stop 1140, the bench pad 1050 in essence can always be set to drop at a slow and safe controlled rate without reliance on a pressure compensating valve which can be omitted in some embodiments. The adjustable descent speed control stop 1140 gives users the ability to adjust the lowering speed of the bench pad 1050 depending on their size and weight lifting ability. Light weight users can adjust the stop to allow less resistance of the lowering of the bench. Heaver lifters can add more resistance with the stop, adding more resistance and thus slowing down the speed of the bench lowering. The maximum range of motion of the speed control stop 140 is preferably preset at the factory to a value which will always provide a controlled slow bench descent rate regardless of the physical weight of the user and amount of weights being handled during the exercise routine. If in less preferred but satisfactory implementations the user is provided with complete control over the adjustment of bench pad descent rate with only a speed control stop 1140, reasonably responsible weight lifters will adjust the rate of descent properly when setting up the bench equipment before exercising and the need ever arises to use the foot lever and activate an escape scenario during an exercise routine.

In practice, heavy users that lift heavy weights create a larger gravity force than light users that lift light weights. The difference in the force of weight from gravity changes the rate at which the bench is lowered. The adjustable speed control stop 1140 provides one mechanical means that allows the user to manually adjust the amount of hydraulic fluid that passes through the plunger valve 1122 and control the rate at which the bench is lowered. This feature gives all users, regardless of size and strength, the ability to control the equipment at a comfortable rate.

Referring to FIGS. 78, 82, and 93, speed control stop 1140 may comprise an enlarged knob 1140*a* of any suitable configuration having a threaded stem 1140*b* protruding outwards from the knob towards the head end of the bench and lever arm 1131 of the foot lever 1130. The stem threadably engages a threaded hole 1162 formed in a foot end transverse member 1161 of the frame 1021 that extends between the longitudinal members 1023. In one embodiment, transverse member 1161 may have a substantially flat plate-like form and be attached to or proximate the distal free ends 1023*b* of the longitudinal members 1023 at the foot end of the bench. The free end of the stem 1140*b* is positioned to engage the lever arm 1131 mounted on the mounting section 1130*a* of the foot lever rod between the longitudinal members 1023. By rotating the speed control stop 1140 in opposing directions, the stem 1140*b* advances towards or retracts from the lever arm 1131. When the foot lever is activated and depressed downwards by a user, the free end of stem 140*b* engages the lever arm 1131 to arrest rotation of the foot lever 1130, thereby limiting in turn the amount that plunger valve 1122 may be opened and drop rate of bench pad 1050. In operation, the closer the stem 1140*b* of speed control stop 1140 is spaced apart from foot pedal lever arm 1131 before the foot lever is activated, the sooner the stem will engage the lever arm resulting in a slower bench pad rate of descent. The farther the stem 1140*b* of speed control stop 1140 is spaced apart from foot pedal lever arm 1131 before the foot lever is activated, the later the stem will engage the lever arm resulting in a faster bench pad rate of descent.

Hybrid Hydraulic Cylinder Valve Assembly

FIGS. 113-126 depict the hydraulic cylinder assembly 1100 of FIGS. 78-85 described in detail above with an alternative embodiment of a unique hybrid and pressure compensating flow control valve assembly 1500 having a compact design. Functionally, the compact valve assembly 1500 operates under the same principles as but replaces pressure compensating flow control valve assembly 1145 shown in FIGS. 84-88, with important differences in the valve internals. In the compact valve assembly 500 design, the pressure compensating valve 1502 interacts directly with and is engageable with the ball check valve 1147 to control the position of the check valve. Advantageously, the separate plunger valve 1122 is eliminated allowing for a more compact and mechanically simpler hydraulic cylinder design that achieves the same functionality with fewer parts due to the unique arrangement of valve elements.

Referring to FIGS. 113-126, pressure compensating flow control valve assembly 1500 includes a valve body which defines a flow manifold block 1504 comprising a vertically elongated axial central bore 1506 for housing the pressure compensating valve 1502 and check valve 1147 components. Axial bore 1506 defines a vertical centerline 1CL3 of the valve assembly. A plurality of internal fluid conduits defined by hydraulic cylinder and accumulator ports 1507, 1508 is formed by additional bores in the manifold block 1504. Flow ports 1507 and 1508 may be oriented perpendicular to axial central bore 1506 and centerline 1CL3 in one embodiment as illustrated; however, other orientations are possible. Flow port 1508 creates a flow path between accumulator 1106 and axial central bore 1506. Flow port 1507 creates a flow path between hydraulic cylinder 1102 and the axial bore 1506. Collectively, the axial central bore 1506 and flow ports 1507, 1508 establish a fluid flow path between hydraulic cylinder 1102 and accumulator 1106 which is controlled by the pressure compensating valve 1502 and check valve 1147, as further described herein.

In one implementation, manifold block 1504 further includes a first side recess 1563 which receives an end of the cylindrical tube of the accumulator 106 and an opposing second side recess 1564 which receives an end of the cylindrical tube of the hydraulic cylinder 1102. The accumulator and hydraulic cylinder tubes may be inserted into the recess and sealed to the manifold block 1504 to prevent leakage of hydraulic fluid by any suitable means. Forms of providing a leak-proof seal include without limitation bolted radial flanges and gaskets/seals, circumferential seal welds, shrink fitting, etc. The hydraulic cylinder 1102 and accumulator 1106 are cantilevered from the manifold block 1504 in opposing directions in which the hydraulic cylinder and accumulator are coaxially aligned as illustrated. Other arrangements are possible.

Check valve 1147 includes essentially the same cylindrical check body 1503 that defines annular valve seat 1147*a*, ball 1147*c*, and spring 1147*b* already described herein with respect to control valve assembly 1145 shown in FIGS. 84-88. The valve seat 1147*a* is defined by an internal annular shoulder formed inside the central passage 1529 of the check body 1503 which defines a flow orifice 1562 therethrough which is alternatingly closed by the check ball 1147*c* to prevent flow in one operating position, and opens in another operating position to permit flow through the check valve. In one embodiment, the check valve 1147 may be disposed proximate to the lower of the manifold block 1504 and in direct flow communication with flow port 1507 which may similarly be disposed near the lower end of the valve body. Check valve 1147 is oriented in a vertical position with the seat 1147*a* being at the top and the ball and spring immediately below. Spring 1147*b* biases the ball 1147*c* upwards against the seat to close off the central flow passage 1503 of and flow through the check body 1503.

Figure 116:
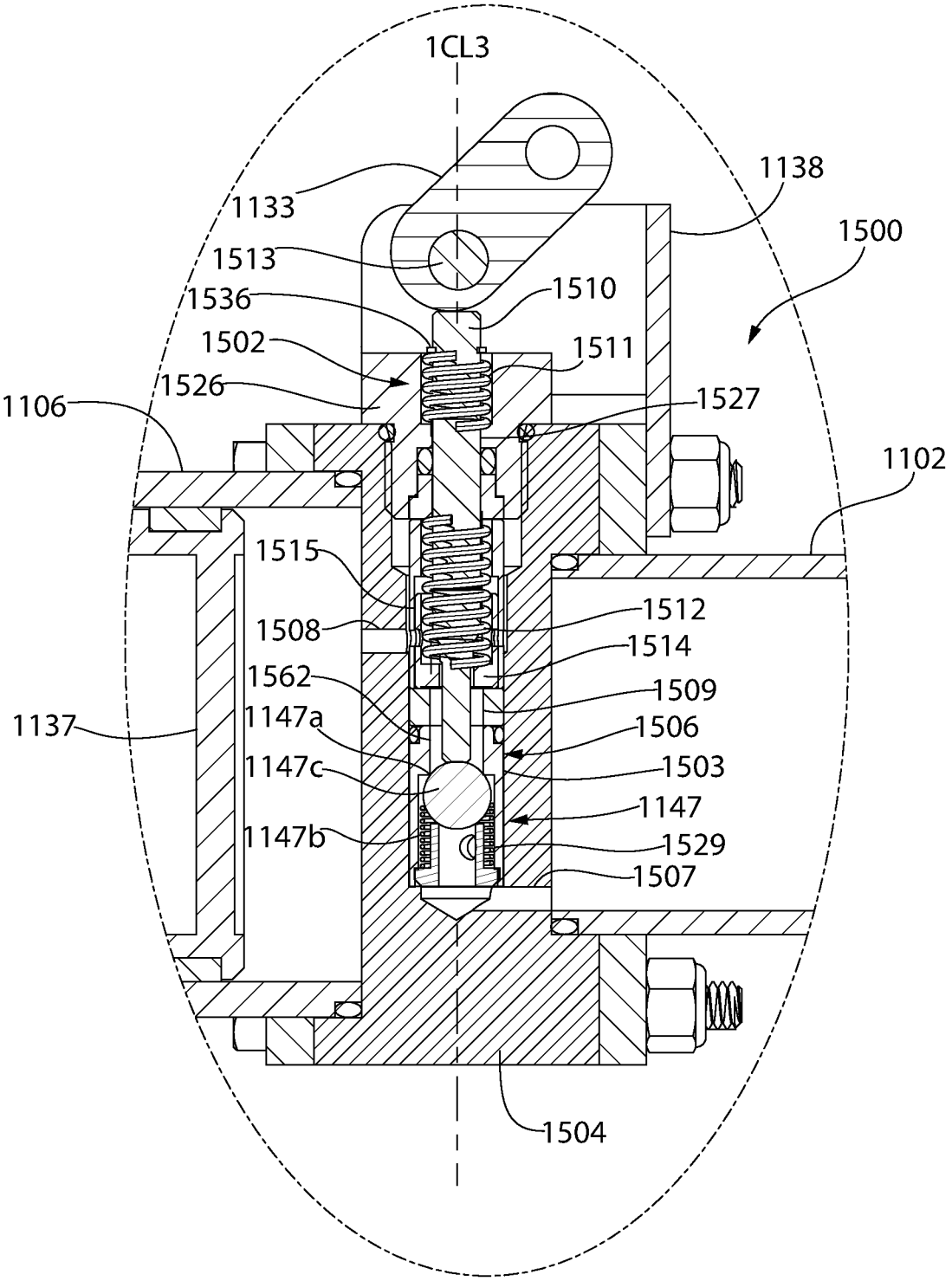
Figure 117:
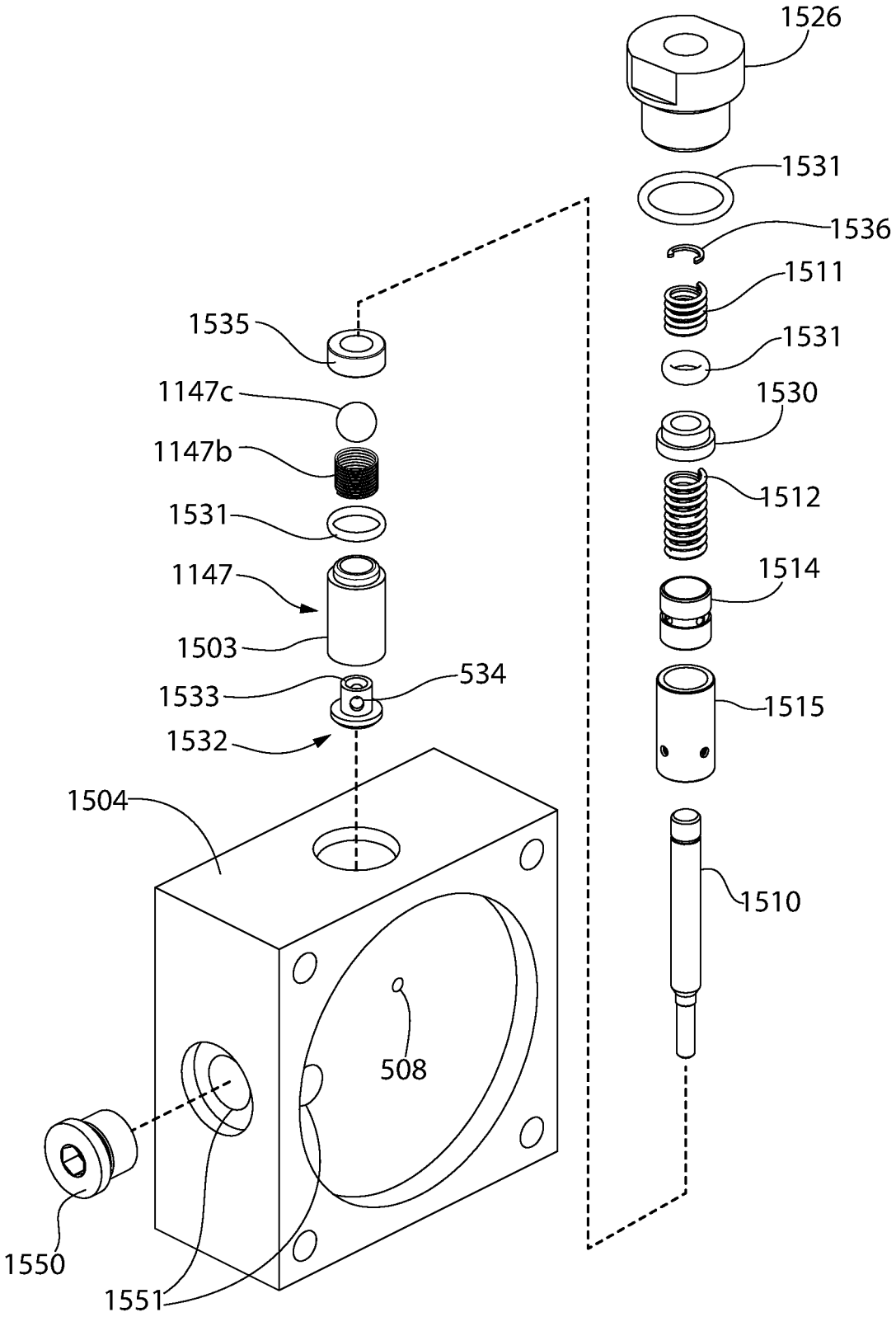
Figure 118:
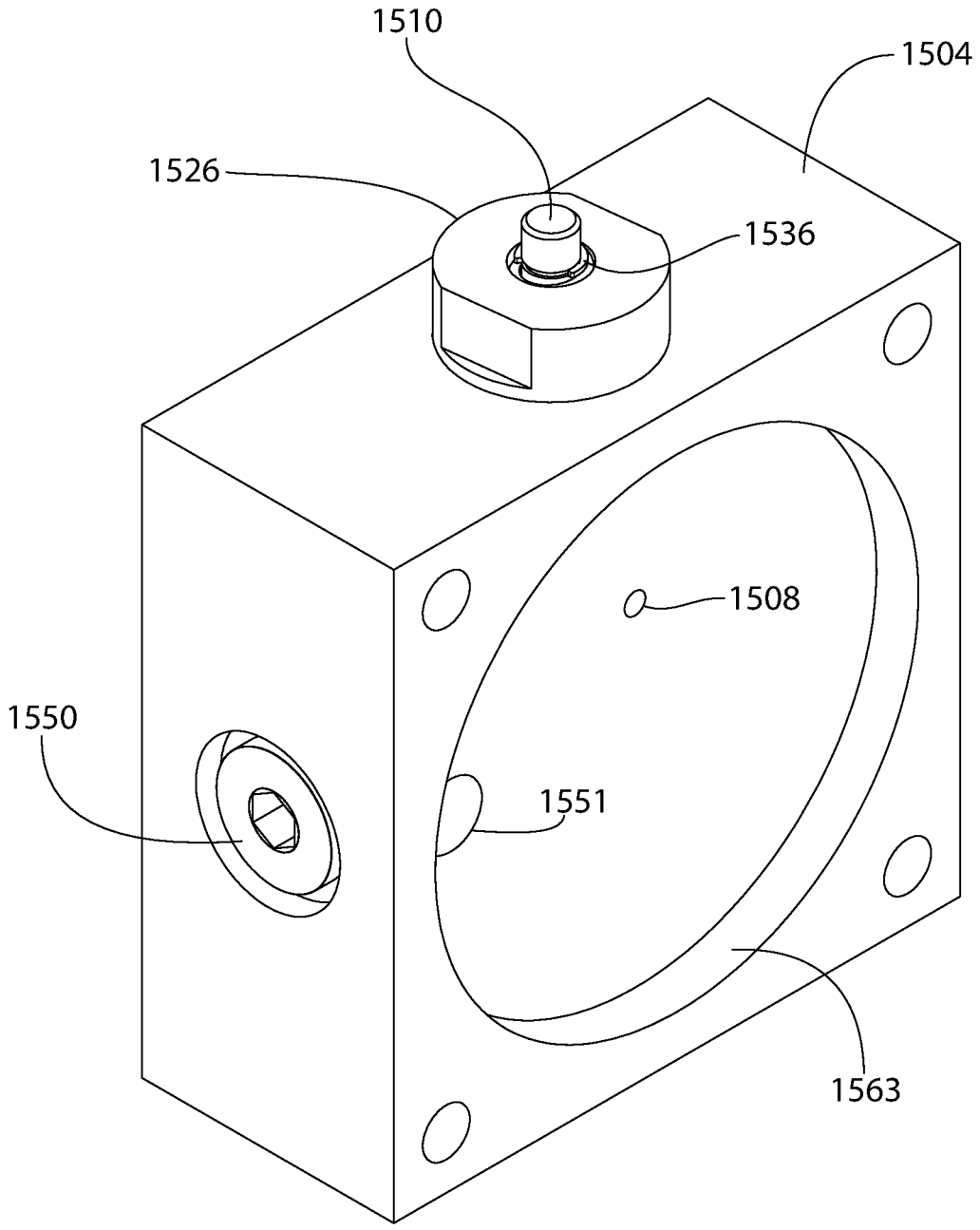
Figure 119:
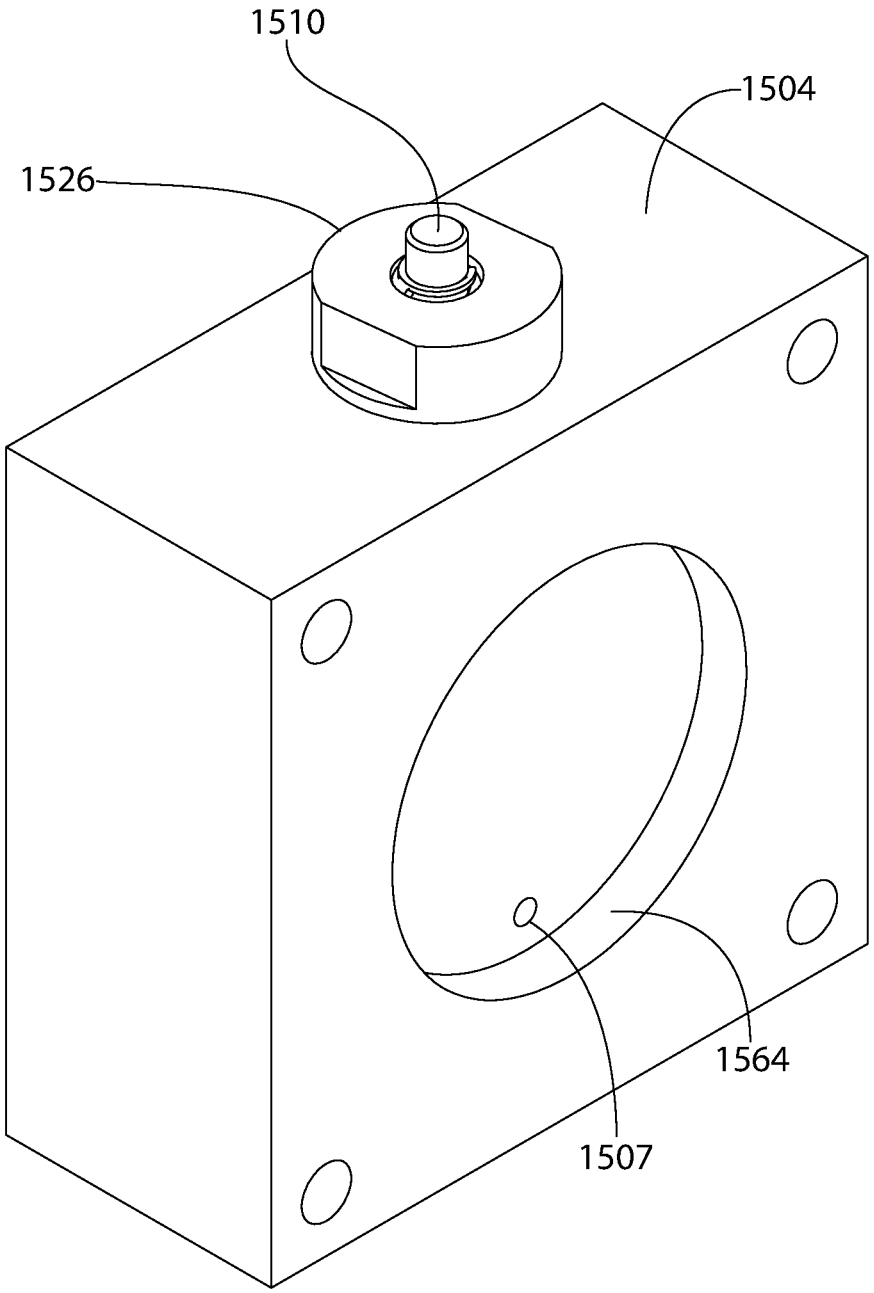

A generally cylindrical exhaust retainer 1532 (see, e.g. FIG. 125) is positioned in the bottom of the axial central bore 1506 of the manifold block 1504. Retainer 1532 has an axial through passage 1533 and plurality of lateral flow openings 1534 which communicate with the through passage 1533. The exhaust retainer 1532 nests inside the check body 1503 as best shown in FIGS. 116 and 121. The retainer 1532 may have a diametrically enlarged head at the bottom end that may include chamfered sides to conform to the shape of the central axial passage 1503 closed bottom end.

The pressure compensating valve 1502 includes elongated cylindrical plunger 1510 movable disposed in manifold block 1504 for axial upward and downward movement between extended and retracted positions relative to the manifold block 1504. Plunger 1510 is biased in an upwards outward direction towards the extended position by return spring 1511 toward toggle cam 1133 pivotably mounted via pivot 1513 to the manifold block 1504 above the plunger. In this embodiment, the toggle cam 1133 defines a valve operator whose position is changed by mechanism linkage 1132 as previously described herein. The bottom end of spring 1511 engages a socket disposed in the top of cap housing 1526 and top end of the spring may be retained by a retainer clip 1536 which engages an annular groove 1537 in the plunger 1510 (see, e.g. FIG. 126). The top end of the plunger 1510 is acted on by the toggle cam 1133 (i.e. cam surface 1133*a*) and bottom end of the plunger acts on and engages check ball 1147*c* as illustrated. Plunger 1510 is alternatingly movable between (1) a lower unblocking position (see, e.g. FIG. 121B) to unseat the check ball 1147*c* from its seat 1147*c* to permit flow through the check valve, and (2) an upper blocking position (see, e.g. FIG. 121A) in which the ball 1147*c* is seated to prevent or block flow through the check valve. Accordingly, plunger 1510 is coaxially aligned with check valve 1147 (and ball 1147*c*) in one embodiment.

In one embodiment with reference to FIG. 126, plunger 1510 includes an upper operating end 1538 having a diameter 1D1 and a diametrically narrowed and stepped lower working end 1542 of various diameters. The working end includes a terminal end segment 1539 distal-most to the operating end and having a diameter 1D2, and an intermediate segment 1540 spaced apart from the working end tip 1561 of the plunger and adjoining the end segment 1539.

The terminal end segment 1539 defines tip 1561. The intermediate segment 1540 has a diameter 1D3 which is larger than 1D2. Both 1D2 and 1D3 are smaller than 1D1. A frustoconical-shaped shoulder 1541 forms a transition between the operating end 1538 and working end 1542 of plunger 1510.

The working end 1542 of plunger 1510 interfaces with and is alternatingly projectable and retractable in a flow control orifice 1543 defined by the head 1525 of piston 1514 (further described below and shown in FIG. 123) to control the flow of the hydraulic fluid through pressure compensating flow control valve assembly 1500 between hydraulic cylinder 1102 and accumulator 1106. The plunger 1510 thereby provides a variable flow control orifice 1543 in which the flow rate of hydraulic fluid depends on the position of the plunger in the orifice. Orifice 1543 has a diameter 1D4 slightly larger than both diameters 1D2 and 1D3 to allow the working end 1542 of plunger 1510 to be received through the orifice. In one illustrative example, without limitation, orifice diameter 1D4 may be 0.180 inches, and the plunger working end diameters 1D2 and 1D3 may be 0.150 inches and 0.175 inches. In each instance, the flow area through flow control orifice 1543 is defined by the diameter 1D4 minus diameters 1D2 or 1D3, as further described herein.

Pressure compensating valve 1502 further includes flow control spring 1512, a flow modulation device such as flow control piston 1514, and flow control outer sleeve 1515. The piston 1514 is axially movable in a reciprocating quickly cycling fashion to alternatingly open and close the flow path between the hydraulic cylinder 1102 and accumulator 106 when the flow control valve is in the open position with check ball 1147 unseated. As best shown in FIGS. 123 and 124, flow control piston 1514 and sleeve 1515 may each generally have a cylindrical tubular shape. Piston 1514 has cylindrical sidewalls which define an internal flow control cavity 1516 extending from and through bottom end 1523 to top end 1524 of the piston. The diameter of the flow control cavity 1516 is smaller at bottom end 1523 than the top end 1524 and defines the flow control orifice 1543 formed by a hole through piston head 1525 at the bottom end, as illustrated. Similarly, flow control sleeve 1515 has an open interior defining central passage 1519 extending from bottom end 1522 to top end 1521. The diameter of the central passage 1519 is smaller at bottom end 1522 than the top end 1521 forming an internal annular shoulder 1560 of the sleeve. When the valve is assembled, the piston 1514 nests inside sleeve 1515 (i.e. passage 1519) and is slideably movable therein with respect to the sleeve.

Flow control spring 1512 is positioned inside axial central bore 1506 of the pressure compensating flow control valve assembly 1500 and acts on the piston 1514. This biases the piston downwards inside the sleeve 1515 in a direction towards the bottom of the valve axial central bore 1506 (see, e.g. FIG. 121A). Spring 1512 extends through both the piston and sleeve. The spring 1512 is retained in the manifold block 1504 by cap housing 1526 removably mounted to the top end of the body in axial central bore 1506. Cap housing 1526 may include an upwardly/downwardly open central bore 1527 through which the plunger 1510 extends and is movable upwards/downwards therethrough. Return spring 1511 is seated in the bore 1527 around the upper portion of the plunger 1510.

Plunger 1510, piston 1514, and ball check valve 1147 are coaxially aligned and mounted in axial central bore 1506 as for example in FIG. 116. Hydraulic fluid flows axially through these components and within the central passage parallel to the valve assembly centerline 1CL3 and both enters and leaves the central passage in a transverse direction to the centerline, as further described herein.

In one embodiment, flow control piston 1514 includes circumferentially spaced apart lateral flow orifices 1517 extending completely through the sidewalls of the piston from central passage 1516. Similarly, flow control sleeve 1515 includes circumferentially spaced apart lateral flow orifices 1520 extending completely through the sidewalls of the piston from central passage 1519. The outer surface of the piston sidewalls may include an annular slot 1518 recessed into the sidewalls which is in fluid communication with the lateral flow orifices 1517. Slot 1518 extends only partially through the piston sidewalls.

The pressure compensating flow control valve assembly 1500 further includes other valve appurtenances such as multiple seals 1531 such as O-rings, an O-ring retainer 1530 inserted into the cap housing 1526 as shown, and check O-ring retainer 1535. A bleed port 1551 extending through the manifold block 1504 and fluidly coupling the accumulator 1106 to the ambient environment is provided for initially bleeding air from the hydraulic cylinder assembly. In one embodiment, the bleed port may be L-shaped; however, other shapes and orientations of a bleed portion may be used. A plug 1550 which may be threaded into the manifold block 1504 is provided which seals the bleed port 1551 off during normal operation of the hydraulic cylinder assembly.

Operation of the hybrid pressure compensating flow control valve assembly 1500 will now be briefly described. The bench auto-return and controlled descent features previously described herein function in the same general manner as before; the primary difference being in the hydraulic and air fluids flow control and path provided by the hybrid valve assembly. Accordingly, the flow schematic diagrams of FIGS. 95-96 remain applicable except plunger valve 1122 shown therein is replaced by the present pressure compensating flow control valve assembly 1500.

FIGS. 121A-D show sequential cross sectional images of the pressure compensating flow control valve assembly 1500 during operation. FIG. 121A shows the valve assembly 1500 in its initial position prior to a user seated on the bench initiating an escape scenario via activation of the foot pedal 1130. The hydraulic control system is in the state shown in FIG. 95A. Bench pad 1050 is in the fully extended normal upper exercise position in which the exchange of hydraulic fluid 101 between the hydraulic cylinder 1102 and accumulator 1106 is stopped by a closed pressure compensating valve 1502 and check valve 1147. In this static state, plunger 1510 is in the normally "valve closed" extended position and the cylinder rod 116 is fully extended and locked (bench in the full upright position). The flow control piston 1514 is in it lower proximal position with piston head 1525 abuttingly engaging the top of the check O-ring retainer 1535. The lateral flow orifice 1517 and annular groove/slot 1518 of the flow control piston 1514 are horizontally aligned with the lateral flow orifices 1520 of flow control sleeve 1515. It bears noting that the annular slot 1518 eliminates the need for the lateral flow orifices 1517 and 1520 of the piston and sleeve respectively to be concentrically aligned to enable flow therethrough. Similarly, an annular gap is formed by clearance between the sleeve 1515 and inside of the central axial cavity 1506 of the flow manifold block 1504 eliminating the need for the sleeve's lateral flow orifices 1520 to be concentrically aligned with the accumulator port 1508.

At this point in the bench descent operating process, the working end 1542 of the plunger 1510 is positioned in flow control orifice 1543 of the piston 1514. The working end tip 1561 of the plunger is positioned proximate to (i.e. contacting or slightly spaced apart from) the check ball 1147*c*. Check valve 1147 is closed and its ball is fully biased upwards and seated on valve seat 1147*a* via spring 1147*b*, thereby blocking the flow path of and preventing hydraulic fluid from flowing from the hydraulic cylinder 102 to the accumulator 1106 through valve 1502. The hydraulic fluid 1101 is pressurized by the weight of the user, added equipment weight of the bench pad assembly, and any free weights being held by the user at the time.

When the user then initiates an escape scenario as already described herein by pressing down on the foot pedal 1130, the bench pad 1050 and user will begin to descend at a regulated controlled rate as a result of the pressure compensating flow control valve assembly 1500. The flow diagram of FIG. 95B is applicable to this stage in the benches' operation. The plunger 1510 is pushed downwards via rotation of the toggle cam 1133 to the "valve open" retracted position shown in FIG. 121B (noting that the operated end of the plunger need not be even flush with the outer surface of the manifold block 1504 or recessed therein in the retracted position). The bottom tip of the plunger 1510 if not previously contacting the check valve ball 1147*c* engages and displaces the ball downwards pushing it off of its annular valve seat 1147*a*. This opens flow control orifice 1543 allowing hydraulic fluid flow in the path shown in FIG. 95B from the hydraulic cylinder 1102, through the open check valve, into the pressure compensating valve 1502, and finally then into the accumulator cavity. This causes the cylinder rod 1116 to retract into the cylinder at a constant speed rate regardless of weight/force on the bench and cylinder rod. Because the pressure in the hydraulic cylinder 1102 is initially greater than inside the piston flow control cavity 1516 and air 1103 in accumulator 106, hydraulic fluid flows through the lower port 1507 and upwards through the check valve 1147. The hydraulic fluid flows into exhaust retainer 1532 from port 1507 and laterally outwards therefrom through the lateral openings 1534 of the exhaust retainer, around the ball 1147*c*, and then upwards in the valve through the flow control orifice 1543 and into the flow control cavity 1516 of piston 1514. At this point, the lowermost terminal end segment 1539 of plunger 1510 remains positioned in the flow control orifice 1543, thereby defining a first flow area formed by the open annular space between the plunger and orifice.

It bears noting that the constant speed rate of descent of the bench pad 1050 under compression is achieved by the upwards/downward axial reciprocating motion of the flow control piston 1514, which in some embodiments may cycle on a nearly continuous basis as and until the bench moves from the upper position to lower escape position. When the piston is pressurized initially by the hydraulic fluid as described immediately above, the hydraulic fluid pressure acts on the bottom face (end 1523) of the piston head 1525 causing the piston 1514 to move upwards against and compressing flow control spring 1512 because the pressure on the face of the piston is greater than the initial pressure inside the piston flow control cavity 1516 (see FIG. 121C). This temporarily partially or fully closes the port 1508 to the accumulator chamber 1104 since the lateral flow orifices 1517 and annular slot 1518 of the piston 1514 become horizontally misaligned with the lateral flow orifices 1520 of sleeve 1515, thereby partially or fully blocking flow from the piston flow control cavity 1516 to the port 508 (see, e.g. FIG. 121C). Hydraulic fluid flow from hydraulic cylinder 1102 into the pressure compensating valve 1502 is thus restricted and minimized, thereby reducing the bench descent rate. As further seen in FIG. 121C, the diametrically larger flow intermediate segment 1540 of the plunger 1510 is now positioned in the flow control orifice 1543 of the piston 1514, creating a second flow a rear between the orifice and plunger which is less than the first flow area created when the terminal end segment 1539 was positioned in the orifice. This further acts to instantaneously reduce hydraulic fluid flow and slow the bench descent rate.

It bears noting that the maximum upward travel of the piston 1514 within outer sleeve 1515 is limited by the vertical gap shown in FIG. 121A between the top end 1524 of the piston and internal annular shoulder 1560 of the sleeve (see also FIGS. 123 and 124) which is formed when the piston is in its lower proximal position relative to check valve 147. In FIG. 121C, this gap is eliminated when the piston 1514 is in its upper distal position relative to the check valve.

As the pressure in the piston internal flow control cavity 1516 becomes equalized and balanced with the hydraulic pressure on the hydraulic cylinder side of the piston head 1525, the biasing action of the flow control spring 1512 now is enable to actively press the flow control piston 1514 back down to its lower proximal position in a downward movement which again opens the accumulator port 1508 as the lateral flow orifices 1517, 1520 of the piston and outer sleeve 1515 become horizontally aligned again. This allows greater hydraulic fluid flow from the hydraulic cylinder 1102 into the accumulator chamber 1104. This causes the cylinder rod 1116 compression/retraction rate and bench descent rate to increase slightly temporarily until the pressure in the piston internal flow control cavity 1516 decreases enough to move the flow control piston upward again as describe above when the piston once again partially or fully closes the accumulator port 1508 to hydraulic fluid flow.

This foregoing reciprocating piston motion and feedback loop is achieved by the unique design of the pressure compensating valve 1502 that provides a constant hydraulic cylinder compression/retraction rate regardless of how much pressure/force is applied to the cylinder rod by the bench and user's weight. Advantageously, this minimizes the possibility of injury to the user caused by rapid dropping and stopping of the bench. It bears noting that the foregoing cyclical motion of the reciprocating piston occurs relatively rapidly and repeats sequentially during the time that the bench pad 1050 is in the process of descending until the lower escape position is reached.

Figure 96:
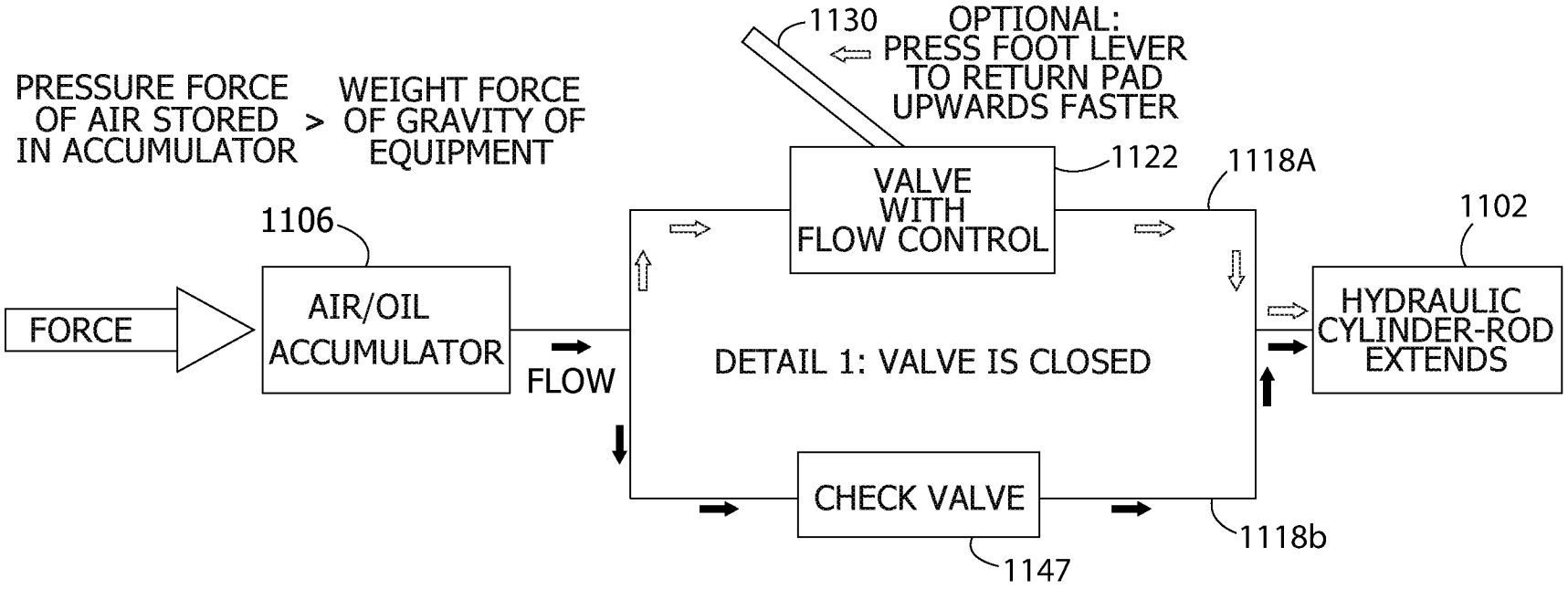
FIG. 96 is a schematic flow diagram of the hydraulic control system in a state when the automatic bench return mechanism is activated and the bench pad is in the process of ascending to the extended upper exercise position in which hydraulic fluid flows from the accumulator to the hydraulic cylinder via a check valve and/or an open plunger valve.

After the bench pad 1050 reaches it lowermost escape position, the user may then exit the bench and release the foot pedal 1130 to activate the bench auto return feature. The flow diagram of FIG. 96 is applicable to this stage in the benches' operation which initiates the bench auto-return feature. The pressure compensating flow control valve assembly 1500 now returns to the position shown in FIG. 121D. When the cylinder rod 1116 becomes unloaded (user removed from bench), and is in partial or full compression/retraction into the cylinder 1102, and plunger 1510 is returned upward via urging by return spring 1511 back to its normally extended position, the pressurized hydraulic fluid in and from the accumulator 1106 is forced back through check valve 1147 causing the cylinder rod to extend and lock in the fully extended position. The bench pad 1050 return Because the pressure of the hydraulic fluid in the accumulator is greater than on the hydraulic cylinder side of the pressure compensating valve 1502, the fluid from the accumulator is able to displace downward and unseat the ball 1147*c* of the check valve 1147 permitting flow through the valve to the hydraulic cylinder as shown despite the fact that the plunger 1510 is upward and not forcing the ball from its seat. Once the pressure balances between the hydraulic cylinder and accumulator side of the pressure compensating valve 1502, the ball will again return upward via the spring and seat, thereby closing the flow path through the valve as seen in FIG. 121A at the beginning of the process.

Although the flow control valve assembly 1500 is shown for convenience of description without limitation in a vertical oriented herein, it will be appreciated that the valve assembly may be used in any other suitable angular orientation because the foregoing valve components do not rely on gravity for operation of the valve as described above. The piston 1514, plunger 1510, and ball check valve 1147 are spring biased which allows multiple possible orientations of the valve assembly while still retaining its full functionality. For example, the hydraulic cylinder assembly 1100 shown in the weight lifting bench 1020 of FIGS. 57-62 herein is disposed obliquely to the vertical and horizontal. Accordingly, the flow control valve assembly 1500 is expressly not limited in its applicability to any particular orientation.

Adjustable Flow Control Valve

In another example of a manual type speed control mechanism to regulate the rate of descent of the bench pad 1050 shown in FIGS. 89-94, a manually adjustable flow control plunger valve 1150 assembly may be provided instead of or in addition to the speed stop 1140 described above for fail safe redundancy. The pressure compensating valve 1146 is omitted in this design. The adjustable flow control plunger valve 1150 may be similar to plunger valve 1122, but also includes a rotary stop cam 1197 configured to permit external adjustment of the amount of hydraulic fluid flow between the hydraulic cylinder 1102 to the accumulator 1106. This allows the user to manually adjust the maximum flow rate of hydraulic fluid that passes through the valve to in turn control the rate at which the bench drops when the foot lever 1130 is activated. In one embodiment, the rotary stop cam 1197 may be a rotary type knob having a working end inside the valve which interfaces with the plug assembly 1152, as further described below.

Figure 84:
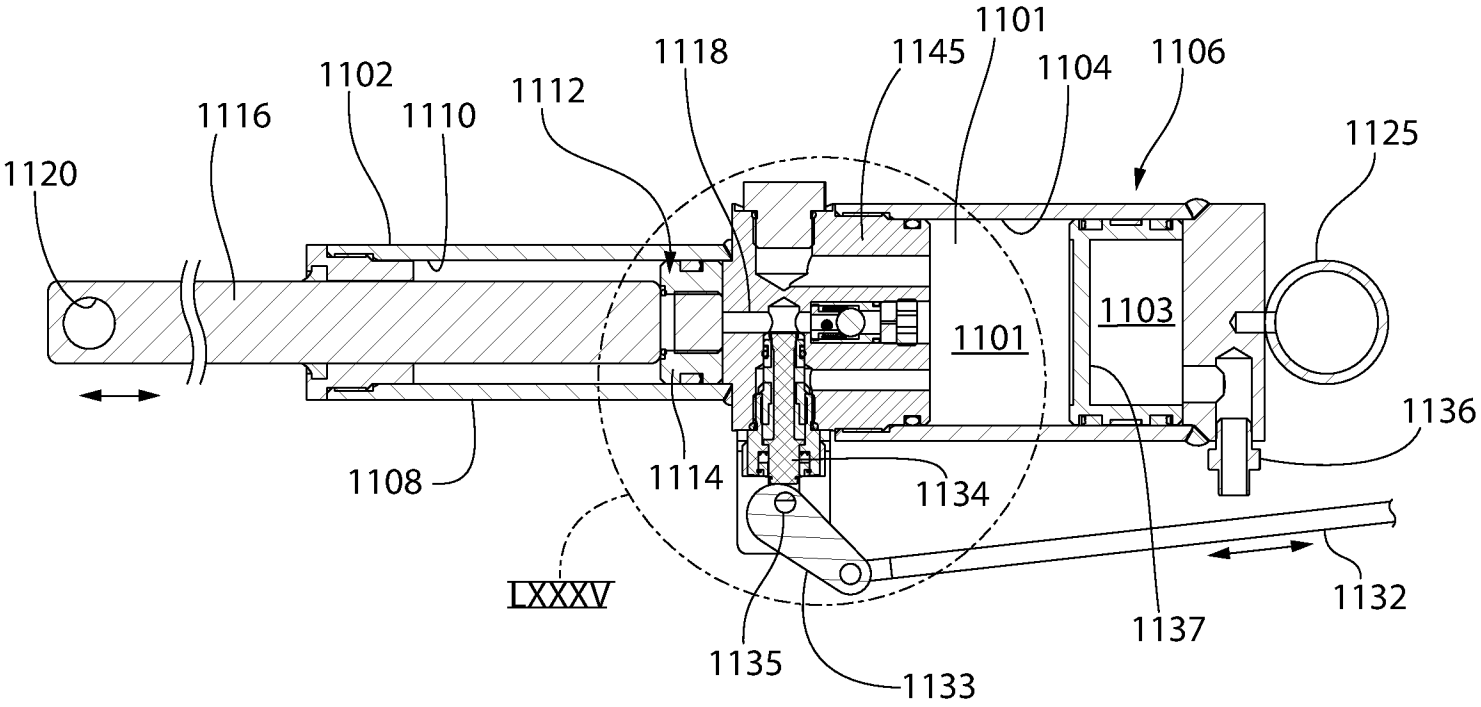
FIG. 84 is a side cross-sectional view thereof.

Referring still to FIGS. 89-94, a hydraulic cylinder assembly 1100 comprising adjustable flow control plunger valve 1150 is shown having an accumulator 1106 which is not coaxially aligned with the hydraulic cylinder 1102 like that shown in FIG. 84. Instead, the accumulator 1106 is mounted alongside the hydraulic cylinder such as on the top (shown), bottom, or either lateral side such that the axial centerline 1CL2 of accumulator 106 is parallel to but spaced radially apart from axial centerline 1CL1 of the hydraulic cylinder 1102 in a "piggy-back" type mounting arrangement. In other possible embodiments, the accumulator 106 may be disposed at a 90 degree or oblique angle to the hydraulic cylinder. In yet other possible embodiments, the accumulator 1106 may be mounted separately from the hydraulic cylinder 1102 in any position and on any appropriate part of the frame 1021, and further fluidly connected to the hydraulic cylinder by a flow conduit such as tubing or piping. The mounting position and arrangement of the accumulator with respect to the hydraulic cylinder is not limiting of the invention.

Referring to FIGS. 91-94, the adjustable flow control plunger valve 1150 may be mounted on the front or foot end of the hydraulic cylinder 1102 as shown. Valve 1150 has an axially elongated body 1150*a* comprising a cylindrical front end 1300 and a diametrically enlarged rear end 1301. Rear end 1301 is inserted into the open front end 1302 of hydraulic cylinder 1102 and interfaces with the piston head 1114. A pair of annular seals 303 such as O-rings seals the interface between the valve body and cylinder 1102 to prevent out-leakage of hydraulic fluid. A snap ring 1304 fitted to an annular groove 1305 on the interior of the hydraulic cylinder 1102 proximate to rear front end 1302 to removably lock the rear end 301 of the valve body 1150*a* to the cylinder.

In the present embodiment, the valve 1150 has a spring-biased cylindrical plug assembly 1152 comprising elongated shaft 1152*a* disposed in an axial bore 1159 extending completely through valve body 1150*a* from front to rear end. A portion of bore 1110 fluidly coupled to the hydraulic cylinder 1102 forms a flow conduit between the accumulator 106 and cylinder. Shaft 1152*a* is concentrically aligned with the bore 1110 of the hydraulic cylinder 1102. The shaft includes a diametrically narrow front end 1152*b* and opposing threaded rear end 1152*c* for threadable coupling to threaded bore 1309 in the front end of plunger 1155. Front end 1152*b* is axially and removably insertable into flow orifice 1156 formed through cylindrical valve seat member 1309 of the valve seat assembly. An annular seal 1307 such as an O-ring disposed around orifice 1156 and between a cylindrical end cap 1311 and valve seat member 1309 is engaged with the terminal front end 1152*b* of plug assembly shaft 1152*a* when the flow control plunger valve 1150 is in a fully closed position.

Compression spring 1308 biases plug assembly 1152 rearward towards the hydraulic cylinder 1102 and closed position of flow control valve 1150. External snap ring 1306 fitted to the plug assembly shaft 1152 engages the rear end of spring 1308 and an opposite front end of the spring engages an annular seat formed in axial bore 1159. An annular seal 1313 between the axial bore 1159 and shaft 1152 at the front end of spring 1308 prevents leakage of air and hydraulic fluid along the shaft outwards from the valve 1150. Seal 1313 may comprise two or more seals of the same or different type.

In one embodiment, the check valve 1147 may be disposed in the valve seat assembly. The check valve which may be a ball type check valve in one embodiment that resides in a flow conduit 1314 which extends completely through the valve seat member 1309 and end cap 1311. Flow conduit 1314 fluidly communicates with the flow conduit portion of axial bore 1159 (i.e. active portion between annular seal 1313 and hydraulic cylinder 1102) to form a flow path from the hydraulic cylinder through the check valve 1147, and in turn to the accumulator 1106 via flow conduit 1153. Check valve 1147 includes valve seat 1147*a*, ball 1147*c*, and spring 1147*b*. The ball and spring may be movable disposed in an outer sleeve 1147*d* in one embodiment.

The end cap 1311 of the valve seat assembly traps and holds the valve seat member 1309 and check valve 1147 in the rear open end of axial bore 1159 in the valve 1150. A snap ring 1312 fitted to the valve body 1150*a* adjacent bore 1159 locks the valve seat assembly into the valve 1150. An annular seal 1310 may be provided to seal the valve seat member 1309 to valve body 1150*a* inside bore 1159, thereby ensuring flow exchange between the accumulator 106 and hydraulic cylinder 1102 is either through the axial bore 1159 or check valve flow conduit 1314.

Referring to FIGS. 89-94, flow control valve 1150 fluidly communicates with the accumulator 1106 via a flow conduit 1153 extending from the internal flow conduit portion of axial bore 1159 in the valve 1150 housing the plug assembly 1152 to the accumulator chamber 1104. Part of flow conduit 1153 is therefore transversely oriented to the cylinder 1102. The check valve 1147 as shown is physically and fluidly disposed between the bore 1110 of the hydraulic cylinder 1102 and flow conduit 1153 leading to the accumulator 1106.

An actuator 1154 is mounted on the front foot end of the adjustable flow control plunger valve 1150 which includes an elongated and axially slidable cylindrical stem or plunger 1155 partially disposed inside the valve. Plunger 1155 is connected to the plug assembly 1152 at one end internal to the valve 1150 and to mechanical linkage 1132 at the opposite end which protrudes outwards beyond the valve body. In this embodiment, the mechanical linkage 1132 is shown in the form of an extension spring having one end loop connected to a through aperture in plunger 1155 and an opposite end loop that connects to the lever arm 1131 of the foot lever 1130. Linear movement of plunger 1155 in opposing axial directions via the foot lever in turn linearly moves the plug assembly 1152 in the same manner to open or close the plunger valve 1150.

With particular reference to FIGS. 91-94, the plunger 1155 of plunger valve 1150 is mounted inside an axial passageway 1157 formed inside and through the rotary stop cam 1197 for sliding movement. Rotary stop cam 1152 includes an enlarged circular operator head 190 disposed outside the valve body 150*a* and an elongated cylindrical stem 1191 inserted through a complementary configured end portion of axial bore 159 formed in the front foot end of the valve body 1150*a* opposite the hydraulic cylinder 1102. The stem 1191 has a first diameter sized for insertion into bore 1159 and operator 1190 has a second diameter larger than the stem 1191 and bore 1159 such that the operator is not insertable into the bore and remains outside the valve body.

The rotary stop cam 1197 cooperates with the operating stem 1155 to limit the amount that the plunger valve 1150 can be opened when the foot lever 1130 is fully actuated (i.e. depressed downwards towards the floor). To achieve this, the stem 1191 of plunger 1155 includes a partial helical cam groove 1192 extending partially around the circumference of the stem which receives a lateral cam follower pin 1158 therein. Cam groove is obliquely oriented with respect to centerline axis CL1 of the hydraulic cylinder 102. Pin 1158 is transversely mounted to axis 1CL1 in the valve body 1150*a*. The pin 1158 partially protrudes into axial bore 1159 in the valve body that receives stem 1191. The stem 1191 advances or retracts axially by a small distance each time the actuator head 1190 is rotated (depending which direction the head is turned) via cooperation between the cam groove 1192 and cam follower pin 1158.

The free end of the rotary stop cam stem 1191 opposite operator head 1190 defines a vertical annular stop surface 194 which faces towards hydraulic cylinder 1102. Surface 1194 interacts with a mating vertical annular abutment surface 1195 defined by a diametrically enlarged washer 1193 abuttingly engaging the rear end of the plunger 1155 in axial bore 1159 opposite the end of the plunger with through hole coupled to mechanical linkage 1132. Washer 1193 forms an operable part of plunger 1155 being fixedly secured thereto and trapped between the rear end of the plunger and step 1315 in shaft 1152*a* between diametrically smaller front end 1152*c* and main portion of the shaft (best shown in FIG. 94). When the plunger valve 1150 is in a closed position, an axial gap 1196 is formed between the stop and abutment surfaces 1194, 1195. The gap closes when valve 1150 is opened causing stop surface 1194 to abuttingly engage abutment surface 1195. It bears noting that the washer 1193 engaged with the rear end of plunger 1155 further functions to prevent the mechanical linkage 1132 connected to the opposite end of the plunger from completely pulling the plunger out of the valve body via the mutual engagement between the stop and abutment surfaces 1194, 1195. An annular seal 1316 seals the rotary stop cam stem 1191 to the axial bore 1159 of the valve body 1150*a* to prevent fluid or air leakage therebetween.

The axial position of the stop surface 1194 is adjustable by the user via rotating actuator head 190 which activates the cam and follower features described above. The position of stop surface 1194 limits the amount that the plunger 1155 and plug assembly 1152 connected thereto can move axially via mutual engagement between the stop and abutment surfaces 1194, 1195 when gap 1196 is closed. This in turn limits the degree to which the working end of plug assembly 1152 is inserted or removed from the flow orifice 1156 at the hydraulic cylinder, thereby in effect limiting the amount that the plunger valve 1150 is opened or closed which controls the flow rate of hydraulic fluid through the valve and importantly the drop rate of the bench pad 50. The greater amount that the rotary stop cam stem 1191 is inserted into the valve body 1150*a*, the lower the flow rate of hydraulic fluid through the flow orifice 1156, and vice-versa.

The safety feature of a controlled bench pad 1050 drop rate may be achieved in one possible approach by design of the circumferential extent or length of the helix of the helical cam groove 1192 based on the foregoing discussion. The cam stem 1191 can only be inserted or withdrawn from the valve body 1150*a* by an amount commensurate with the extent or length of the groove 1192 in which the cam follower pin 1158 travels. A maximum safe amount that the valve 1150 may be opened which controls drop rate of bench pad 1050 is controlled by preselecting a circumferential extent/length of the cam groove 1192 at the factory such that the pad will drop slow enough for a heavy user to avoid too rapid a descent and sudden stop when the bench fully lowers in the escape position, yet still function to allow the bench pad to drop if a light user is lifting weights on the bench. Other means for controlling the maximum degree to which the valve 1150 may be opened to cause the bench pad 50 to drop at a safe rate may be used.

Operation of the adjustable flow control plunger valve 1150 will now be briefly described. In use, the adjustable flow control plunger valve 1150 is normally spring biased into the closed position which cuts off flow of hydraulic fluid from the cylinder 1102 to the accumulator 1106 (see, e.g. FIGS. 91 and 92). The plug assembly 1152 is shown with the narrow front end 1152*b* of plug assembly shaft 1152*a* inserted into the flow orifice 1156 between the hydraulic cylinder 1102 bore and portion of the flow conduit 1153 internal to the valve.

Valve 1150 operates in a similar manner to plunger valve 1122 described above and shown in the flow diagrams of FIGS. 95A-B. The plug assembly 1152 in the present embodiment however is concentrically aligned with the hydraulic cylinder bore 1110 instead of disposed at a 90 degree angle. In sum, pressing the foot lever 1130 downwards pulls the mechanical linkage 1132 (an extension spring in this embodiment) forward towards the front of the bench, thereby axially withdrawing the plug assembly 1152 from the internal flow orifice 1156. The plug assembly 1152 is configured such that the rate of hydraulic fluid flowing through the valve 1150 may be regulated by the degree to which the valve is opened via the foot lever.

The maximum amount that the valve 1150 is able to open when actuated can be adjusted by the user in advance via the rotary stop cam 1197 which acts as a speed limit stop to restrict the axial motion of the plunger 1155, as described above. In short, rotating the rotary stop cam 1197 in opposing directions moves the annular stop surface 1194 of the stop cam closer or farther away from abutment surface 1195 of the plunger assembly, thereby adjusting the width of the control gap 1196 therebetween. When the foot lever 1130 is fully depressed to implement an escape action, the gap 1196 is eliminated as the plunger 1155 moves axially towards the front of the bench bringing surfaces 1194, 1195 into contact. This restricts the amount that the plug assembly shaft 1152*a* is withdrawn from the flow orifice 1156 in the valve seat assembly to limit the flow rate of hydraulic fluid from the cylinder 1102 to the accumulator 1106. The greater the valve 1150 opens, the faster the bench pad 1050 will drop and vice-versa thereby controlling the rate of descent of the pad. The adjustable flow control plunger valve 1150 is moveable between a fully open position allowing full flow, a closed position stopping flow, or a throttled position therebetween by action of the foot lever 1130. Preferably, the rotary stop cam 1197 is designed via the provided length of the cam groove 1192 thereon as described above to limit the maximum width of the control gap 1196 which will always provide a safe controlled drop rate of the bench pad 1050 regardless of any adjustments made by the user. This is considered an important safety feature not heretofore provided by known weight lifting bench mechanisms.

It bears noting that foot lever 1130 and mechanism linkage 1132 although in the form of a spring in this non-limiting embodiment operate in the same manner and interact with the plunger 1155 to open/close the plunger valve 1150 as in the pressure compensating valve assembly 1145 described herein.

Bench Pad Auto-Return Feature

According to one aspect of the invention, an auto-return system is provided which automatically returns the bench pad 1050 to its upper exercise position after an escape scenario. The accumulator 1106 described herein provides one means for returning the bench pad upwards, as explained below.

As already described herein and shown in FIGS. 95A-B, the escape scenario is first initiated by the user pressing the foot lever 1130 downwards which lowers the bench pad 1050 to the lower escape position to allow the user to escape from under the barbell. When the user now gets off the bench equipment with the bench pad 1050 in its lower escape position, the user releases the foot lever 1130 which returns to the upward unactuated position that in turn moves the plunger valve 1122 (or alternatively adjustable plunger valve 1150 if provided instead) back to its closed position via the mechanical linkage 1132. Referring to the hydraulic flow diagram of FIG. 95, at this point in the process the force from the pressurized air stored in the accumulator 1106 now is greater than the gravity force from the weight of the equipment without the user seated on the bench pad 10 50. This is accomplished by initially pressuring the air in the accumulator 1106 to a pressure which exceeds the bare weight of the bench pad structure alone without a user seated thereon. The pressurized air forces the hydraulic fluid 1101 in the accumulator 1106 to bypass the plunger valve 1122 (now closed), and flow back to the hydraulic cylinder 1102 through a check valve 1147. This extends the cylinder rod 1116 from its prior retracted position when the bench pad 1050 is in the lower escape position. As the rod extends, it exerts a force on the rear (head-end) strut 1032 causing both strut 1032 and front (foot-end) struts 1031 operably coupled by the bench pad 1050 to move back upwards. The struts 1031, 1032 pivot about their fixed pivot point locations, causing the angle between the struts relative to the ground and frame base 1022 to increase, thus raising the bench pad 1050 to the upper exercise position.

In addition to relying on the reverse flow path formed by the check valve 1147 to return the bench pad 1050 upwards, the user may optionally also press downwards on the foot lever 1130 to open the plunger valve 1122 and speed up the bench return. This will create a dual reverse flow path for the hydraulic oil 1101 from the accumulator 106 back into the hydraulic cylinder 1102 as shown in FIG. 96. This alternative flow path back in a reverse direction through plunger valve 1122 to the hydraulic cylinder 1102 is represented by open flow arrows and the normal automatic flow path through the check valve 1147 to the cylinder is represented by the closed (solid) flow arrows.

Figure 99:
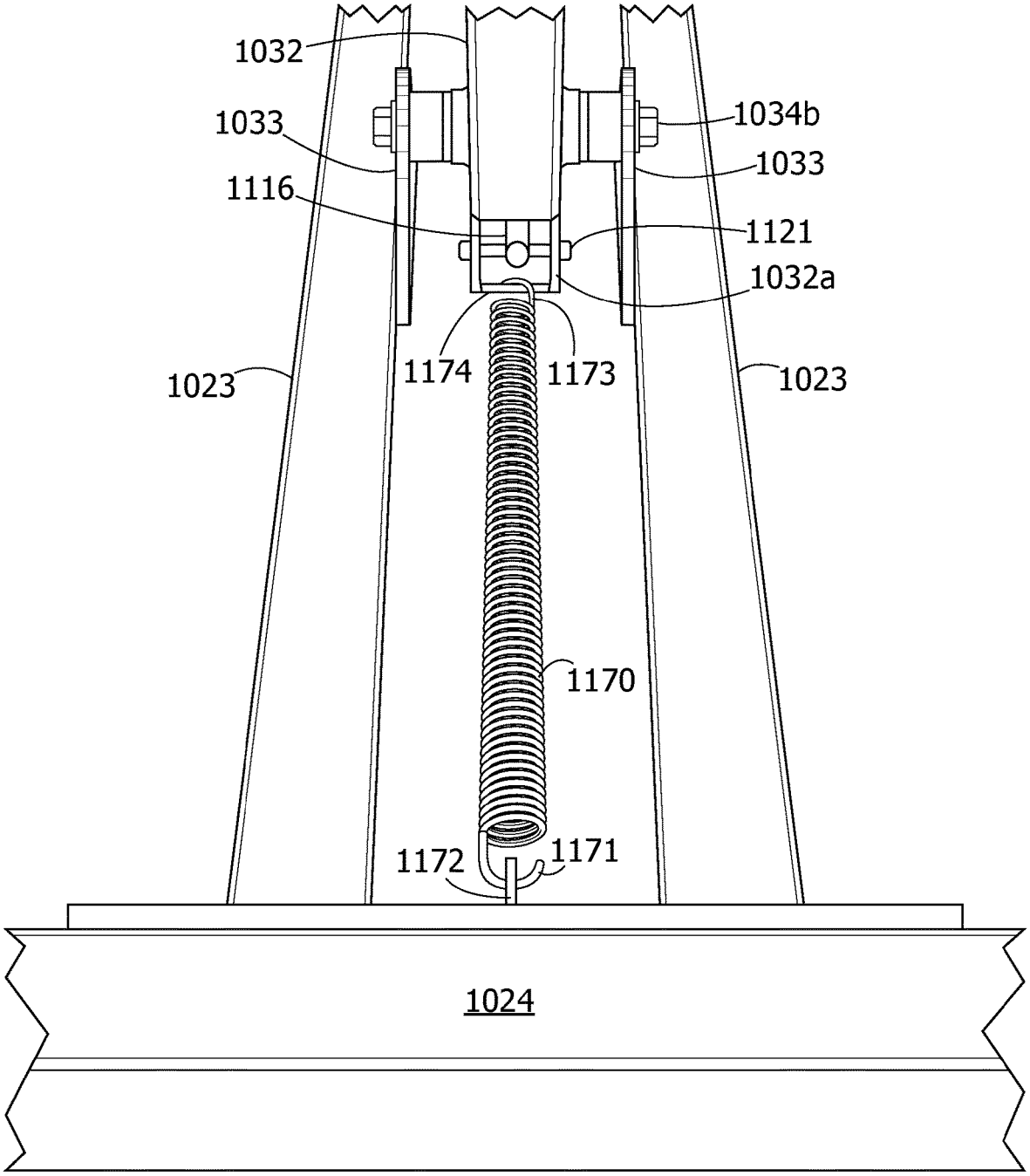
FIG. 99 is a top perspective view showing an alternative bench pad automatic return mechanism comprising a spring usable in lieu of or in addition to an accumulator.

The automatic bench return feature can be accomplished using either the stored air pressure in the accumulator 1106 described above to pressurize the hydraulic cylinder 1102 (which is high enough to overcome the weight of the unloaded bench pad without a user thereon), or in an alternative embodiment an extension spring mechanism, or a combination of both. FIG. 99 shows an extension spring 1170 having a first hooked end 1171 engaged with a tab 1172 extending from cross member 1024 of the frame 1021 and an opposite hooked end 1173 engaged with a cross pin 1174 mounted to pivot extension 1032*a* on the lower end of rear strut 1032. Cross pin 1174 extends laterally between spaced apart sides 1175 of pivot extension 1032*a* and is disposed below cross bolt 1034*b* to impart a pivoting action about the cross bolt via the extension spring. End 1171 of spring 1170 engages an opening formed in tab 1172. In operation, when the escape scenario described herein is initiated, the extension spring 1170 exerts an axial pulling force on the bottom of rear strut 1032, thereby causing the strut and bench pad 1050 to pivot and automatically return back upwards into the starting exercise position when the user gets off the pad. Spring 1170 is selected with a spring force which is greater than the weight of the bench pad 1050 without a user seated thereon. It will be appreciated that other types of springs such as for example without limitation compression springs, torsion springs, etc. may be used in the alternative to provide the same functionally of the bench auto-return feature.

Second Operating Lever and Accumulator Option

Figure 97:
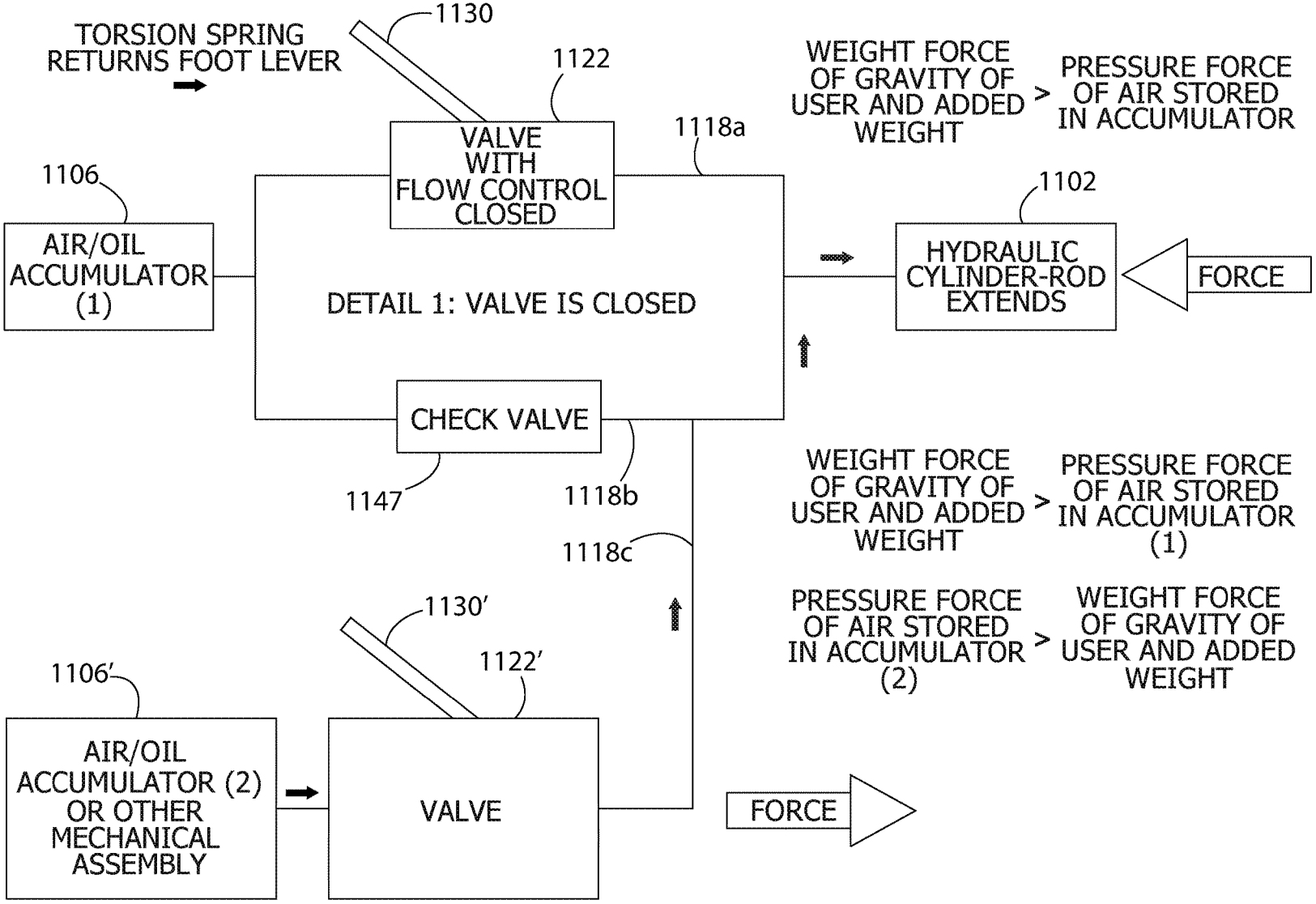
FIG. 97 is a schematic flow diagram of a modified hydraulic control system having a second accumulator and lever operated plunger valve which allows a user to adjust the upper exercise position of bench pad independently of the first plunger valve and accumulator.

In another embodiment shown in FIG. 97, the user can initiate the auto return of the bench pad 1050 or adjust the exercise position of the bench pad by using a second foot or hand operating lever, plunger valve, and accumulator or another mechanical component (e.g. spring-loaded strut or piston, etc.). While the user remains on the bench pad 1050, a second foot lever 1130' in one embodiment can be depressed to provide a force generated from the compressed air in a second accumulator 106', or another mechanical means, to raise the bench pad 1050 back upright towards its starting upper exercise position. If the angle of the bench is increased beyond that is which desired, this option provides the user ability to decrease the angle back towards the starting position. The force generated by the second accumulator, or other mechanical means, must be such that the force is greater than the weight force of gravity from the body of the user and the bench pad equipment to raise the bench pad upwards with the user seated thereon.

FIG. 97 illustrates a flow diagram of one possible configuration of a flow conduit circuit 1118*c* incorporating a second accumulator 1106' and second plunger valve 1122' with operating lever 1130' check valve 1147' which are fluidly connected via a suitable flow conduit (e.g. tubing and/or piping) arranged as shown. Operating lever 1130' may be a foot lever configured similarly to foot lever 1130 or hand-operated lever. Flow conduit circuit 1118*c* is tied into flow conduit circuit 1118*b* downstream of check valve 1147, but upstream of hydraulic cylinder 1102 in the original hydraulic circuit.

In operation, with the user seated on the seat pad 1050, the operating lever 1130' is depressed and actuated which opens second plunger valve 1122'. Compressed air flows from second accumulator 1106' through second valve 1122' and flow conduit circuit 1118*c* into flow conduit 1118*b* to the hydraulic cylinder 1102. This extends the cylinder rod 1116 thereby raising the position of the bench pad 1050 as desired. When the position sought is reached, the operating lever 1130' is released which returns automatically to its original position which shuts off flow of air from the second accumulator 1106'. It may be noted that the second accumulator is pressurized to a higher pressure than the original accumulator 1106 which has insufficient pressure to raise the bench pad 1050 against the weight force of the user and bench pad equipment. The pressure force of air stored in the second accumulator 1106' however is greater than the weight force of gravity of the user and added bench pad equipment to raise the bench pad when the user is seated and the operating lever 1130' is actuated to open the second plunger valve 1122'.

In one implementation, it may be preferable that the user does not hold the barbell B while adjusting the lifting or exercise position of the bench pad 1050 via the second accumulator and plunger valve flow circuit for safety reasons. Accordingly, the pressure of compressed air in the second accumulator 1106' is preferably pre-pressurized to a pressure insufficient to raise the bench pad against the weight force of the user, the bench pad equipment, and the barbell. In such a case when the second operating lever 1130' would be depressed (i.e. actuated), the added weight of the barbell would cause the hydraulic fluid 1101 to flow in a reverse direction through flow conduit 1118*c* into the second accumulator 1106', thereby automatically dropping the bench pad 1050 to its lower escape position as a safety precaution. In other embodiments, however, it is possible to pre-pressurize the second accumulator 1106' to a pressure sufficient to also overcome the added weight of the barbell allowing a user to adjust the bench pad position while holding the weight. Either setup of the second accumulator 1106' is possible.

Safety Rack Height Relative to Bench Position

It is desirable that when the bench pad 1050 is in the lowest escape position, the safety racks are positioned and sufficiently elevated such that the top of the safety racks are located above the user's chest or torso region. In all instances, when the user presses the foot lever 1130 and the bench pad lowers to its lower escape position shown for example in FIG. 61B, the main rod or bar of the barbell B which a user grasps must rest on the safety racks 1028 at a height such that the barbell and its weight are completely removed from the user's torso region (barbell shown in dashed lines). To achieve this accordingly, in the lower escape position of the bench pad 1050, the top surface of the safety rack 1028 on which the barbells rests is positioned at a critical height 1H1 above the top surface of the bench pad 1050. The critical height 1H1 is sufficient to vertically separate the top surface of the safety racks 1028 and barbell 1B during an escaped scenario from the user's torso region in a manner that completely and safely removes the weight from the user to prevent injury. Preferably, the height 1H1 is further selected to also provide adequate clearance for the user to readily have an easy path of egress from beneath the barbell 1B and off of the bench.

Figure 72:
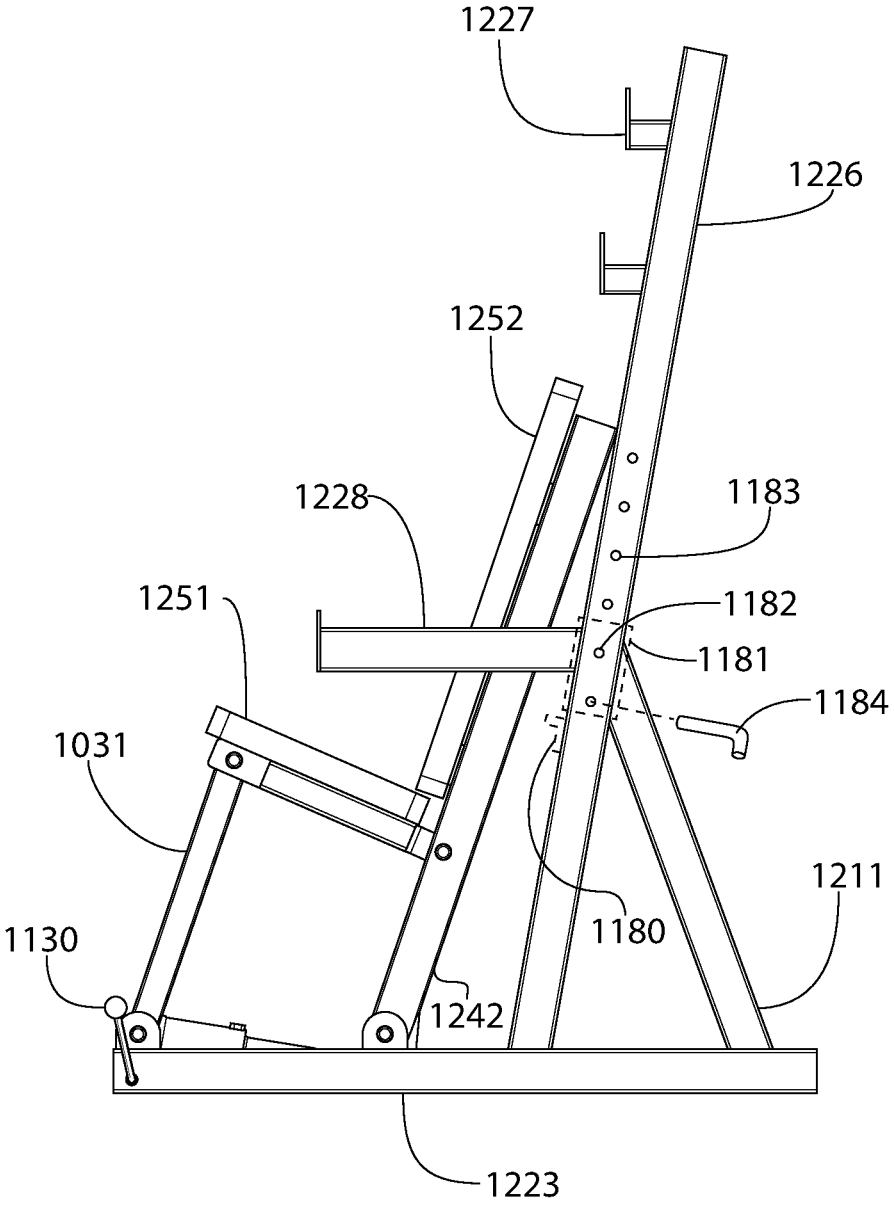
FIG. 72 is a right side view thereof.
Figure 73:
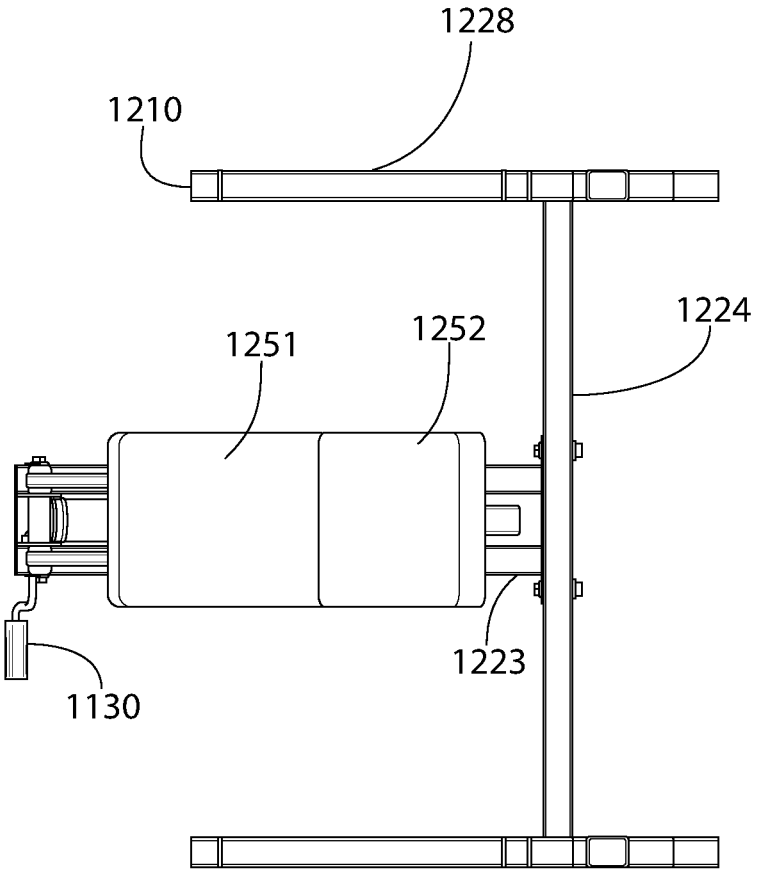
FIG. 73 is a top view thereof.
Figure 74:
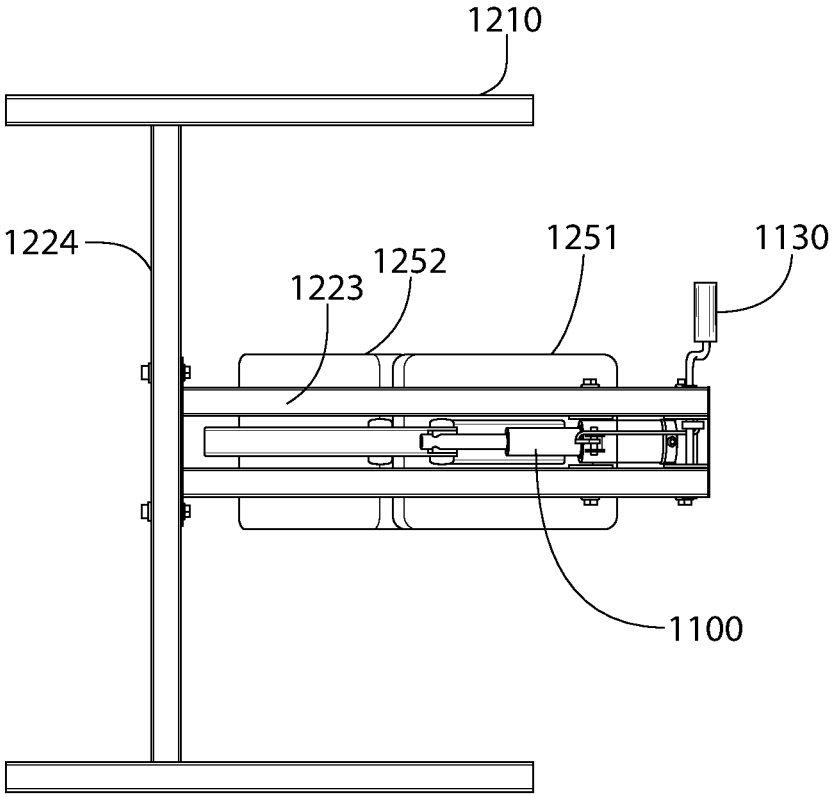
FIG. 74 is a bottom view thereof.

Although in some embodiments, the height of the safety racks 1028 may be adjustable, as well as the working or exercise height of the bench pad 1050, it remains important that when the bench pad 1050 is in the lowest escape position, the safety racks are positioned such that the top surface of the safety racks are still located the critical height 1H1 and above the users torso. For such instances in which the safety racks are adjustable shown for example in FIG. 72 by dashed lines, a safety stop 1180 is preferably positioned on the rack uprights (vertical stanchions 1026) to prevent the safety racks 1028 from being lowered to a position that is less than the critical height 1H1. Vertically adjustable safety racks 1028 may be provided in one embodiment by providing an open tubular collar 1181 on the proximal end of safety racks 1028 which are configured for sliding up/down on the stanchions 1026. One or more holes 1182 are provided in the collar 1181 which can be moved into various vertical positions concentrically aligned with mating holes 1183 formed in stanchion. An L-shaped or other pin 1184 may be removably inserted through the holes 1182, 1183 to lock the safety racks into one of a plurality of possible vertical positions. The safety stop 1180 is fixedly mounted on the stanchions 1026 to engage the collar 1181 or bottom surface of the safety racks 1028. In one embodiment, the safety stop 1180 may be configured as an angle bracket or clip which is welded to each of the stanchions 1026 to maintain the critical height 1H1.

Preferably, the lowermost position of the safety rack 1028 whether fixedly attached to the vertical stanchions 1026 or adjustable in height as described above is selected to maintain the critical height 1H1 regardless of whether a flat bench pad 1050 is used (see, e.g. FIG. 57) or bench pad with an angularly adjustable back rest or pad is provided (see, e.g. incline bench 200 shown in FIGS. 68-75). Accordingly, when the back pad 1252 is positioned in its lowest adjustment and escape position shown for example in FIG. 75 (represented by angle 1A3) and full actuation of the foot lever 1130 has been implemented for an escape maneuver, the critical height 1H1 is still maintained.

As a means of egress from beneath the barbell B when the foot lever 1130 is fully depressed and the bench pad 1050 drops to its lowest escape position (see, e.g. FIG. 61B), the barbell becomes an integral part of the escape system. The barbell rests on the safety racks 1028 and provides a stable hold for the user to grip and slide themselves out from under the weights. The user may push the barbell against the upright stanchions 1026 to the proximal end 1028*a* of the safety rack horizontal members. The force then applied by the user against the horizontal safety racks 1028 and the stanchions 1026 racks allows the user to push or pull themselves forward towards the distal foot end of the bench, and safely up and off the equipment to escape from underneath the barbell.

Incline Bench

FIGS. 68-75 show an incline bench 1200 according to the present disclosure which incorporates the hydraulic cylinder assembly 1100 described herein. The bench pad 1050 is movable in the same manner previously described between several upper exercise positions and a lowermost escape position via actuation of the foot lever 1130. The incline bench 1200 further may incorporate the same auto-return feature which automatically returns the bench pad 1050 to an uppermost exercise position following an escape scenario simply when the user releases the foot lever 1130. In addition, the incline bench incorporates the features which controls the bench descent rate as further described herein.

Incline bench 1200 has a frame 1221 which is constructed similarly to and includes the same basic structural members described with respect to frame 1021. Accordingly, frame 1221 includes vertical stanchions 1226 connected by a cross member 1224, pair of longitudinal members 1223 connected thereto, weight rests 1227, and safety racks 1228. In one implementation, a pair of vertically spaced weight rests 1227 may be provided to offer a user two possible heights for positioning the barbell during a weight lifting routine. In the present embodiment, the safety racks 1228 may be constructed as cantilevered members to facilitate access to the bench pad 1050. In other embodiments, a vertical member similar to member 1029 (see, e.g. FIG. 57) may also be provided which is connected at an upper end 1029*a* the free end of each safety rack and has a lower end 1029*b* contacting the floor or another part of the frame. The incline bench frame 1221 may further comprise tie members 1210 in the form of tubular elements as shown or alternatively straps to which the stanchions 1226 are attached. An angle brace member 1211 may be provided for additional support which spans between the rear head end of the tie member 1210 and stanchion 1226 obliquely to the tie member. The substantially horizontal base 1222 is comprised of a bench portion 1212 including longitudinal members 1223 and a weight rack portion 1213 including cross member 1224 and tie members 1210. Frame 221 may be constructed of the same type of structural members and materials as frame 1021 describes herein.

In lieu of a solid one-piece bench pad 1050 shown in FIG. 57 for the flat bench which collectively provides both seat and back portions, the bench pad 1250 provided for the incline bench 1200 instead comprises a two-piece assembly including a seat pad 1251 and separate back pad 1252. Back pad 1252 is pivotably connected to the seat pad 1251 via a lateral pivot bolt 1240. In one embodiment, a U-shaped mounting clip 1241 is attached to and extends rearwardly from seat pad 1251 towards the rear head end of the bench. The clip 1241 receives therein between the opposing sides an elongated version of a rear (head end) strut 1242 having an extended length which is greater than rear strut 1032 of the flat bench. Pivot bolt 1240 is inserted through the clip 1241 and rear strut 1242 to form the pivot joint (best shown in FIG. 69). Back pad 1252 is angularly positionable and adjustable in relation to the seat pad 1251.

The pivotable linkage mechanism of the incline bench 1200 which pivotably couples the bench pad 1250 to the longitudinal members 1223 of frame 1221 comprises a rear strut 1242. Rear strut 1242 is pivotably connected at a lower end to longitudinal members 1223 via cross bolt 1034*a* similar to rear strut 1032 of the flat bench (see, e.g. FIGS. 57-65C). Unlike rear strut 1032, however, the rear strut 1242 for the incline bench extends substantially above the bottom of seat pad 1251 for distance which may be greater than the distance between cross bolt 1034*a* and the bottom of the seat pad 1251. The upper end of the rear strut 1242 is fixedly attached to the underside of the back pad 1252 such as via mounting tabs 1243 using fasteners or another suitable fixed type mounting arrangement. Therefore, the angle of the back pad 1252 will always match the angle of the rear strut 1252 with respect to the base 1222 and its horizontal members in the present embodiment. The rear strut 1242 is further pivotably connected to the rear end of the seat pad 1251 via clip 1241 and pivot bolt 1242. It bears noting that the seat pad 1251 in the incline bench embodiment terminates at the rear strut 1242 rather than extending rearward for a distance beyond the strut unlike rear strut 1032 (see, e.g. FIGS. 57-58, 61-62, 64, and 65A-C).

The front (foot end) struts 1031 of the pivotable linkage mechanism may be similar to the flat bench. Accordingly, struts 1031 are pivotably connected to longitudinal members 1223 at their bottom ends via cross bolt 1034*a* and at their top ends via one or two cross bolts 1034*c*. Any suitable type bracket such as without limitation the U-bracket 1186 shown in FIG. 70 may be used to complete the pivotable connection of struts 1031 to the underside of the seat pad 1251. Other mounting bracket arrangements may be used.

The pivotable linkage mechanism of the incline bench 1200 provides the same safety features and motion of the flat bench previously described thereby allowing a user to escape the barbell when fatigued via the foot lever 1130 and safety racks 1228. Bench pad 1250 is therefore also movable between an upper exercise position and a lower escape position in which the barbell and its weight are completely removed from the user.

Advantageously, however, the incline bench pivotable linkage mechanism also allows users to perform weight-lifting exercises with the barbell at different angles without having to get off the bench to make adjustments in the position of the back pad 1252. Accordingly, the same linkage mechanism is usable as part of the normal exercise routine allowing a user to conveniently adjust the position of the back pad 1252 via operation of the foot lever 1130 to train the chest muscles for example at different angles. When muscles are forced to contract at different angles, additional muscle fibers are incorporated into the workout which increases the potential for muscular growth. Large muscle groups such as the chest muscles optimally should be trained at different angels to involve fibers from all parts of the muscle. This type of training builds stronger, fuller muscles. As the user can adjust the angle of the back pad 1252 to vary the parts of the chest muscles which are involved in the weight lifting exercise via the foot lever 1130 while staying on the bench, the workout becomes more efficient allowing blood flow to stay in the chest area and eliminating wasted time adjusting the equipment.

Figure 75:
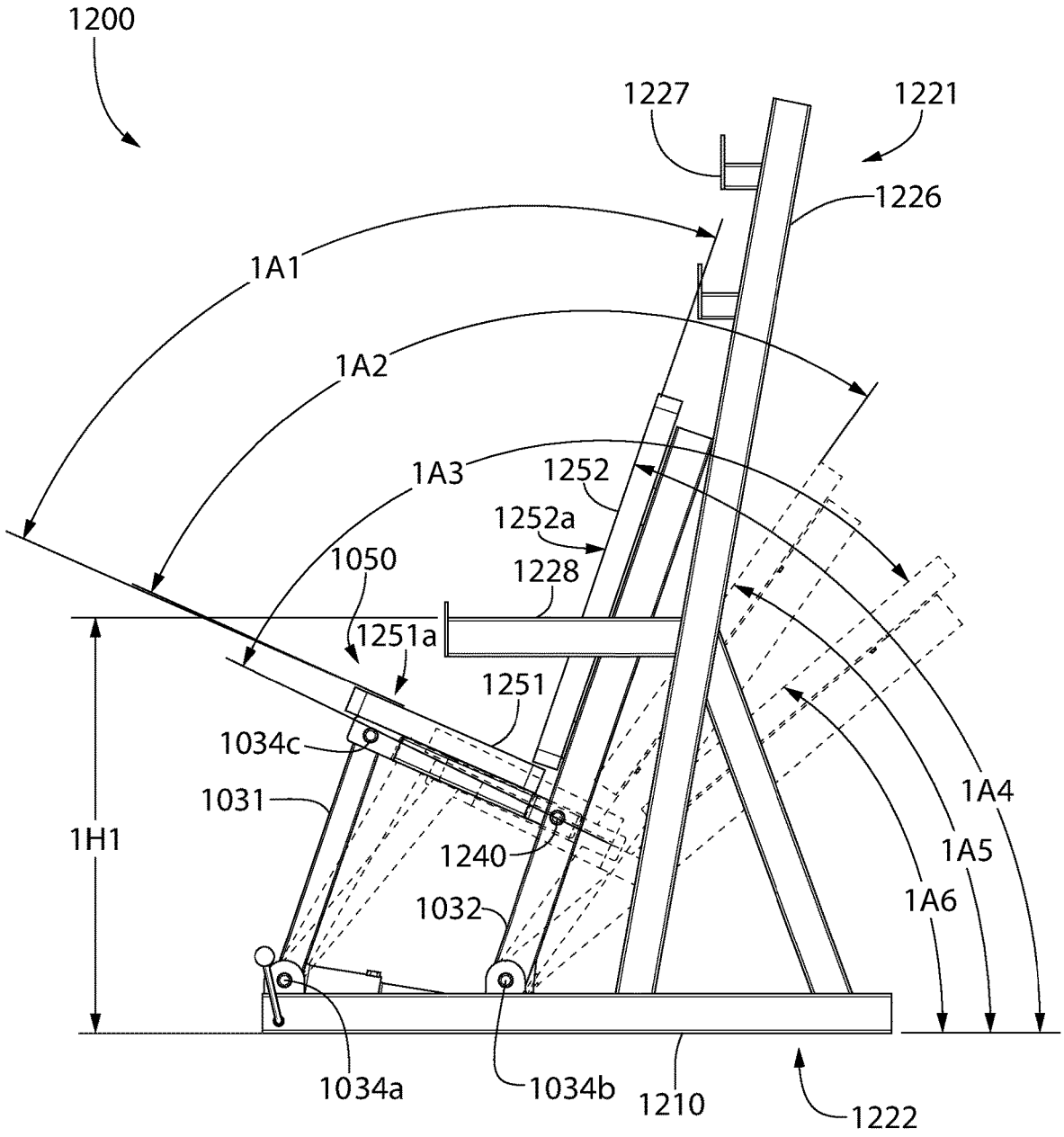
FIG. 75 is a right side view thereof showing ranges of motion of the bench.
Figure 76:
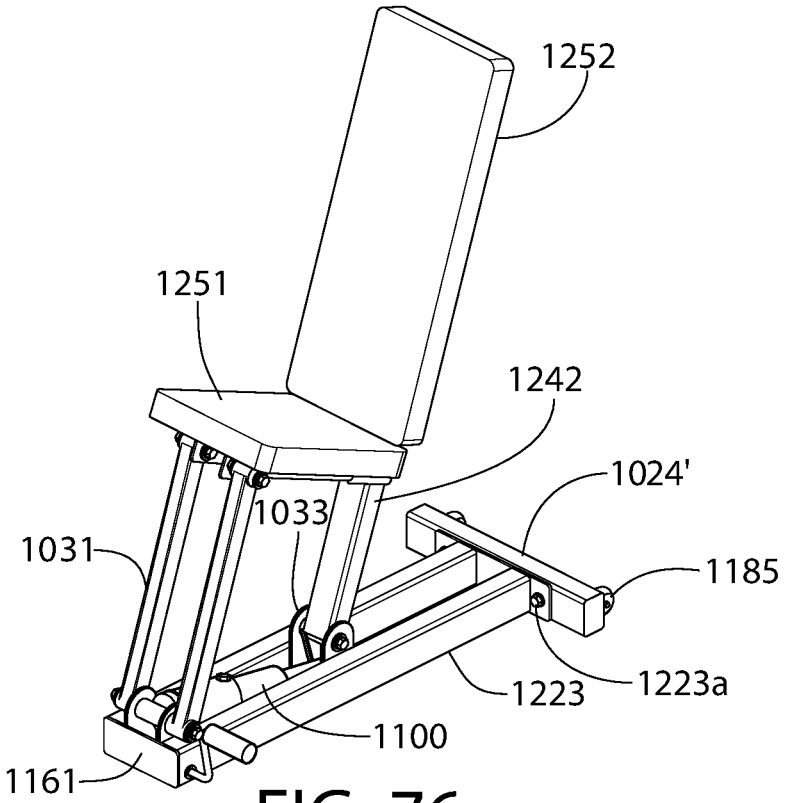
FIGS. 76-77 show front and rear perspective views respectively of an embodiment of a portable incline bench pad assembly without attached weight rack.
Figure 77:
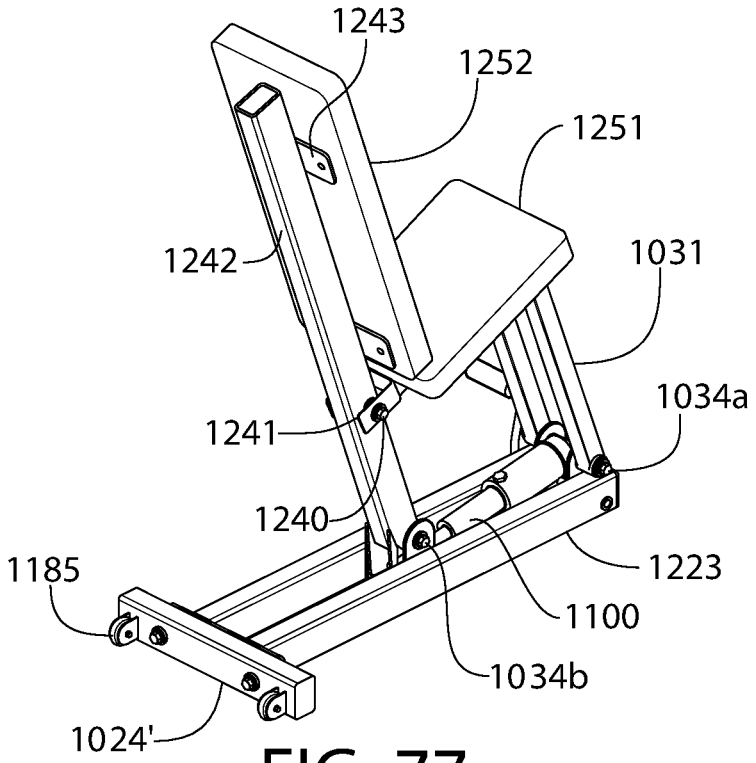

Operation of the incline bench 1200 for varying the position of the bench pad 1250 will now be described. FIG. 75 shows the pivoting and angular action of the bench pad 1250 with respect to the frame 1221 and relative movement between the seat pad 1251 and back pad 1252.

In the back pad's uppermost exercise position, an angle 1A1 between the top surface 1251*a* of the seat pad 1251 and top surface 1252*a* of the back pad 1252 is smallest. In one embodiment, angle 1A1 may be about 90 degrees. The seat pad 1251 is not horizontal and in one embodiment the front end (foot end) of the seat pad remains always higher than the rear end (head end) throughout the entire angular range of motion of the bench pad 1250. Accordingly, the front end (foot end) of the seat pad 1251 closest to foot lever 1130 is higher than the rear end (head end) of the seat pad closest to the stanchions 1226. The lengths of the struts 1031, 1032 are selected to produce the approximate 90 degree angle created between the seat pad 1251 and back pad 252 to securely maintain the weight lifters position during the exercise. The length (distance) of the front struts 1031 between cross bolts 1034*c* and 1034*a* is greater than the length (distance) of the rear strut 1032 between cross bolts 1034*b* and pivot bolt 1240 to achieve this angular relationship. In its uppermost position, the back pad 1252 is disposed at angle 1A4 with respect to the floor/base 1222 of the frame 1221. Angle 1A4 is between 0 and 90 degrees. The initial angles of the struts 1031, 1032 in this uppermost position of the back pad 1252 are such that minimal force is exerted against the hydraulic cylinder 1102 when in the back pad and bench pad 1250 are in their highest position, while allowing the gravity force from the weight of the user and the additional weights (e.g. barbell) to initiate the lowering bench process via actuation of the cylinder by depressing and releasing the foot lever 1130 at different angled positions.

The angle of the seat pad 1251 changes relative to the back pad 1252 as the angle of the back pad changes relative to the ground/base 1222 of the frame 1221 to maintain user comfort and produce different inclined weight lifting positions to exercise different portions of the chest muscle group. For example, the user may depress and release the foot lever 1130 while remaining seated on the bench pad 1250 until the back pad 1252 reaches a second intermediate exercise position represented by angles 1A2 and 1A5 (measured with respect to the same reference points as angles 1A1 and 1A4). Angle 1A2 is greater than 1A1 and angle 1A5 is less than 1A4 as the back pad 1252 is now moved closer to the floor/base 1222 of frame 1221. The user may continue to lower the bench pad gradually in the same manner into a plurality of different intermediate exercise positions to continue to work different parts of the chest muscle group. It bears noting that in some instances the more the user depresses the foot lever 1130 downwards, the faster the bench will lower to successive intermediate exercise positions.

If during the exercise routine the user becomes fatigued and cannot return the weight safely to the weight rests 1227, an escape scenario similar to that already described herein using the hydraulic cylinder assembly 1100 may be implemented. In that case, the user fully depresses and holds the lever 1130 in the downward position until the bench pad 1250 drops to the lowermost escape position represented by angles 1A3 and 1A6 ((measured with respect to the same reference points as angles 1A1 and 1A4). Angle 1A3 is greater than angles 1A1 and 1A2, and angle 1A6 is greater than angles 1A4 and 1A5. In the escape position, the critical height 1H1 described above is similarly maintained which completely removes the weight from the user's torso or chest (and other portion of body which may be nearest to the barbell when resting on any portion of the safety racks 1228).

It may be noted that when the cylinder rod 1116 is fully extended, the bench pad 1250 is in the highest upward position and the angle of the back pad is highest relative to the ground. At this point, the hydraulic fluid 101 fills the bore 1110 in the cylinder 1102 and extends the rod completely. The transfer of hydraulic fluid between the cylinder chamber and the air/oil accumulator controls the cylinder rod. When the cylinder rod is fully retracted by depressing the foot lever 1130, the back pad 1252 is in the lowest position and the angle of the back pad is lowest relative to the ground. At this point, the hydraulic fluid flows from the cylinder 1102 to and fills the accumulator 1106 wherein the rod is completely retracted into the cylinder. To adjust the angle of the bench pad, the user simply presses a foot lever 130. As already described herein, the foot lever 1130 controls a plunger valve 1122 which in turn controls the flow of hydraulic fluid between the hydraulic cylinder 1100 and accumulator 1106 that alternatingly either extends or retracts the cylinder rod 1116 to change position of the bench pad 1250.

The incline bench 1200 thus provides a new method for performing the incline bench press exercise via the user's ability to change the angle of the back pad and work different muscle groups. A user can advantageously change the back angle by depressing and releasing the foot lever when the desired position is reached, never having to get off the bench to change angle with mechanical pins as used heretofore.

In some embodiments, the incline bench 1200 may include the second operating lever 1130' hydraulic system and components described herein (see, e.g. FIG. 97 and related description) to allow the user to adjust the angle of the back pad 1252 while remaining seated on the bench, as discussed above.

In other possible embodiments, a two-piece frame may be provided in which the incline bench pad 1250 assembly and bench sub-frame comprising supporting longitudinal members 1223 are a separate free standing component from and unattached to the cross member 1224 and the weight rack portion or sub-frame 1238 of the bench. In such an embodiment, shown for example in FIGS. 76 and 77, the proximal ends of the longitudinal members 1223 may be positioned proximate but unconnected to cross member 1224 in use during the exercise routine. This forms a separable free standing incline bench which is useable on its own or with multiple different weight rack configurations for performing different types of weight lifting exercise routines. In this portable bench embodiment, the proximal ends 1223*a* of the longitudinal members 1223 may be attached to a second cross member 1024' (similar to the free standing utility bench in FIGS. 65-67) that may be positioned against or proximate to cross member 1224 of the frame 1222. A pair of wheels 1185 may be fitted to cross member 1024' to enhance the mobility of the free standing incline bench assembly.

Adjustable Weight Lifting Bench

FIGS. 100-110 depict an adjustable weight lifting bench 400 that incorporates features and operability of both the flat and incline benches described herein with further user adjustability and control of the bench pad angular position and bench configuration. For various exercise routines, bench 1400 has two operating modes which can be altered by the user to selectively either maintain the back pad 1402 in the same angular orientation when moved from the upper exercise position to the lower escape position of the bench, or alternatively the back pad 1402 changes angular orientation moving between the exercise and escape positions similar to the incline bench 1200. Advantageously, this provides a highly configurable and versatile weight lifting bench.

Bench 1400 may utilize hydraulic cylinder assembly 1100 having either of the valve configurations for a pressure compensating valve assembly 1145 or user adjustable flow control plunger valve 1150, both of which incorporate the safety feature of the speed control mechanism to regulate the rate of descent of the bench pad in a controlled slow manner. Other types of support mechanisms operably coupled between the sets of struts which support and maintain the position of the bench pad 1401 in the upper and lower positions, and controls the movement of the pad therebetween, may instead be provided such as pneumatic, electrical, or mechanical types. The bench pad 1401 is movable in the same manner previously described between several upper exercise positions and a lowermost escape position via actuation of the foot lever 1130. The adjustable bench 1400 further may incorporate the same auto-return feature which automatically returns the bench pad 1401 to an uppermost exercise position following an escape scenario simply when the user releases the foot lever 1130.

Adjustable weight lifting bench 1400 may use any of the bench and/or weight rack sub-frames disclosed herein, or others. In one embodiment, the frame may be configured as a free standing "utility" bench similar to that shown in FIGS. 66 and 67 which is useable on its own or with multiple different weight rack configurations for performing different types of weight lifting exercise routines. These frame components are already described herein and numbered similarly, and hence will not repeated in detail for brevity. In other embodiments, as another example, the weight rack sub-frame 1038 may instead be incorporated into the frame of the adjustable bench 1400 similarly to that shown in FIG. 68 for the incline bench 1200.

Referring to FIGS. 100-110, the adjustable weight lifting bench 1400 includes longitudinal members 1023, cross member 1024', and optionally wheels 1185. Front struts 1031 and rear strut 1104 are supported in position by hydraulic cylinder assembly 1100. Foot lever 1130 is supported by longitudinal members 1023. The bench pad 1401 includes back pad 1402 and seat pad 1403. The angular orientation of the back pad and seat pad are user adjustable. A longitudinally extending support rail 1405 is pivotably mounted to the top ends of both the front and rear struts 1031, 1404 by cross bolts 1034*c* and 1034*d*. Rail 1405 may be generally U-shaped in one embodiment in cross section and includes an elongated axial slot 406 extending from a point proximate a front end 1405*a* to a point proximate the rear end 1405*b*. The bottom ends of the front and rear struts 1031, 1404 are pivotably mounted to longitudinal members 1023 by cross bolts 1034*a* and 1034*b*.

The upper end of the rear strut 1404 is also pivotably coupled to a pair of longitudinally extending and laterally spaced apart support members 1407 to which the back pad 1402 is attached. The back pad support members 1407 may be configured similarly to support members 1035 already described herein formed from a pair of structural angles. The same cross bolt 1034*d* may conveniently be used to couple both the upper end of rear strut 1404 and lower ends of support members 1407 to the rail 1405. Support members 1407 may be positioned on the outside of opposing lateral sides of rail 1405 while the upper end of rear strut 1404 with top mounting aperture 1409 may be positioned inside of the lateral sides (see, e.g. FIG. 101).

Figure 100:
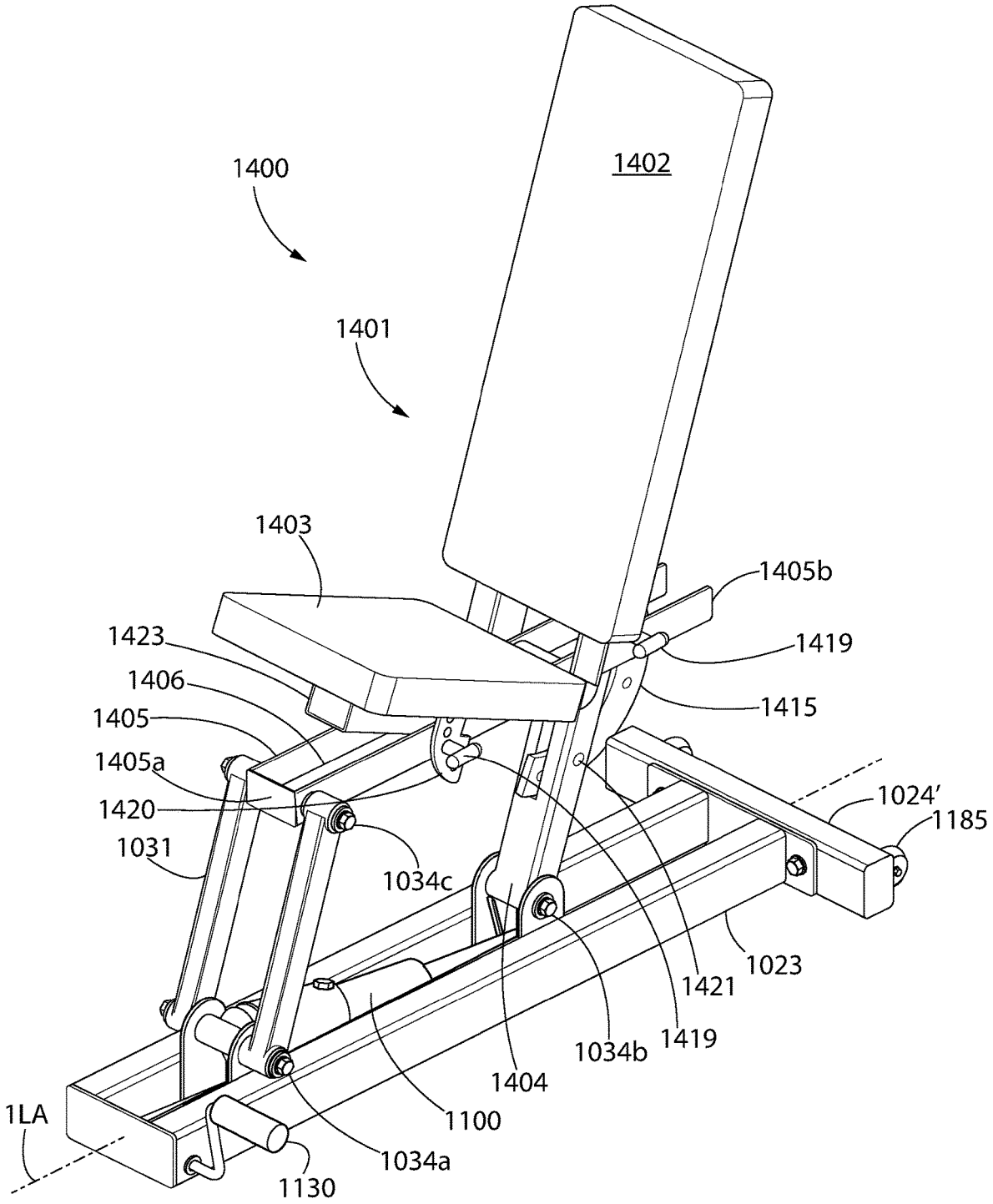
FIGS. 100 and 101 show front and rear perspective views respectively of an embodiment of an adjustable weight lifting bench that incorporates features of the flat bench of FIGS. 57-67 and incline bench of FIGS. 68-77 with further adjustability and control of the bench pad position and configuration.
Figure 101:
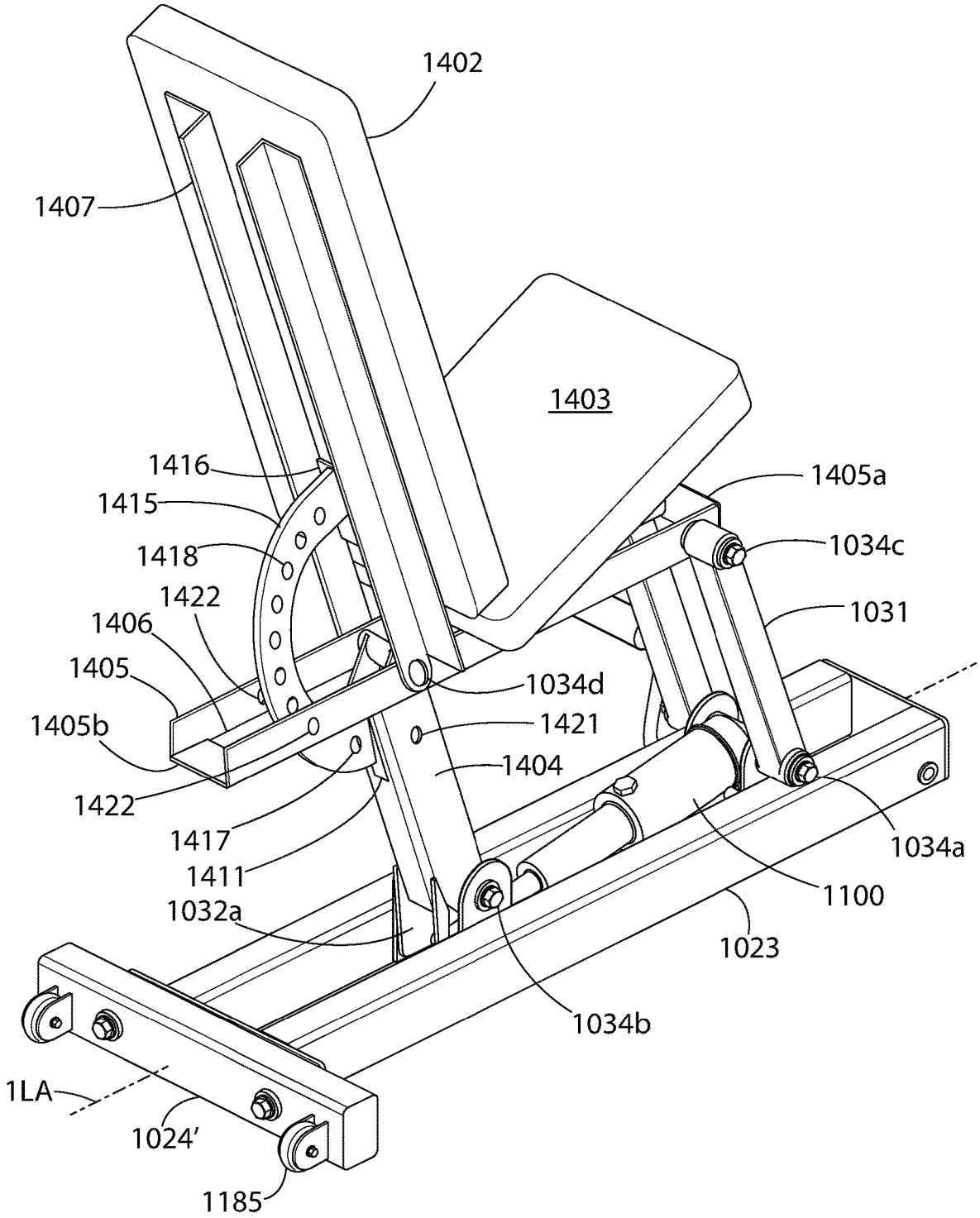
Figure 102:
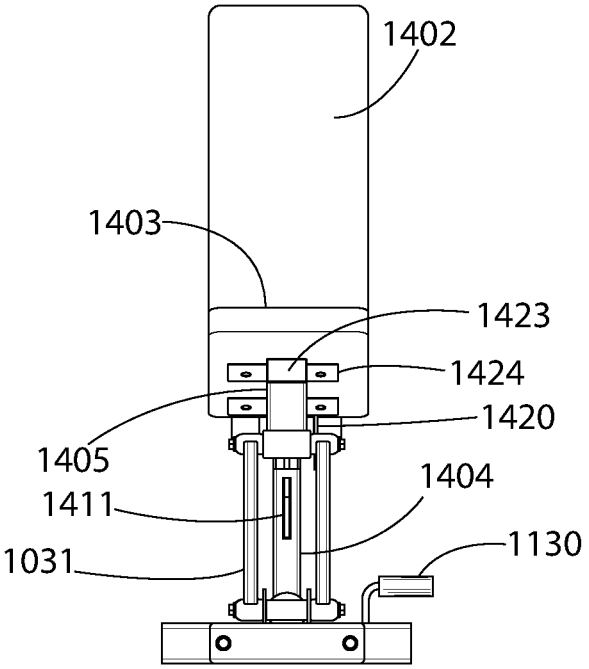
FIG. 102 is a front perspective view thereof.
Figure 107:
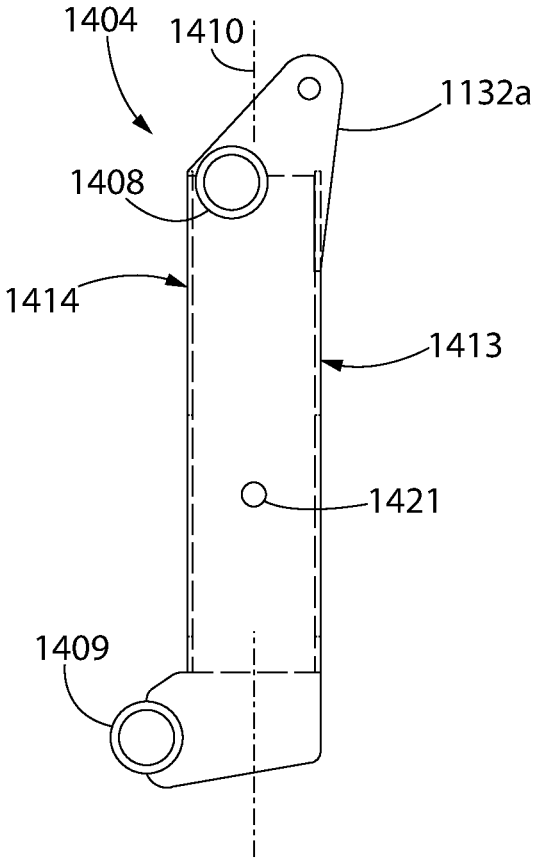
FIG. 107 is a side view of the rear strut of the bench of FIGS. 100 and 101.
Figure 108:
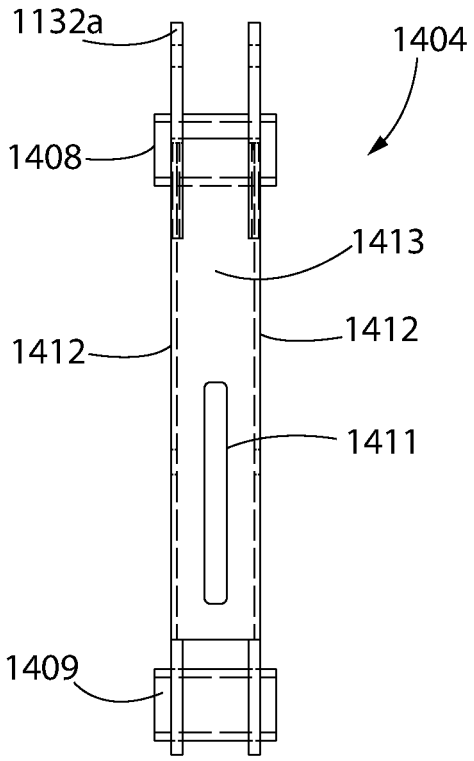
FIG. 108 is a rear view thereof.

Rear strut 1404 is shown in detail in FIGS. 107 and 108, and further shown in FIGS. 100 and 101. Strut 1404 has an elongated body and may be generally L-shaped in the example embodiment having two opposing lateral sidewalls 1412, a closed rear wall 1413, and a closed front wall 1414. The strut may have a generally rectangular tubular shape in transverse cross section. A vertically elongated slot 1411 is formed in front and rear walls 1414, 1413 which slideably receives the back pad support bracket 1415 therethrough in some motions of the bench pad 1401. In some embodiments, the front or rear walls 1414, 1413 may be open thereby negating the need for a slot therein.

The top mounting aperture 1409 which receives cross bolt 1034*d* is transversely offset from the axial centerline 1401 of elongated rear strut 1410 by a distance greater than the bottom mounting aperture 1408 which receives cross bolt 1034*b*. This provides the geometric configuration allowing the dual operating modes of the back pad 1402, as further described herein. In one embodiment, the top and bottom mounting apertures 1409, 1408 may be formed by transversely oriented tubular sleeves; the sleeve defining the top aperture being disposed between the lateral sides of rail 1405 and the sleeve defining the bottom aperture being disposed between the mounting tabs 1033 on the base longitudinal members 1023. Pivot extension 1032*a* is disposed on the lower end of rear strut 1404 below mounting aperture 1408 similarly to the arrangement shown in FIG. 62.

Figure 103:
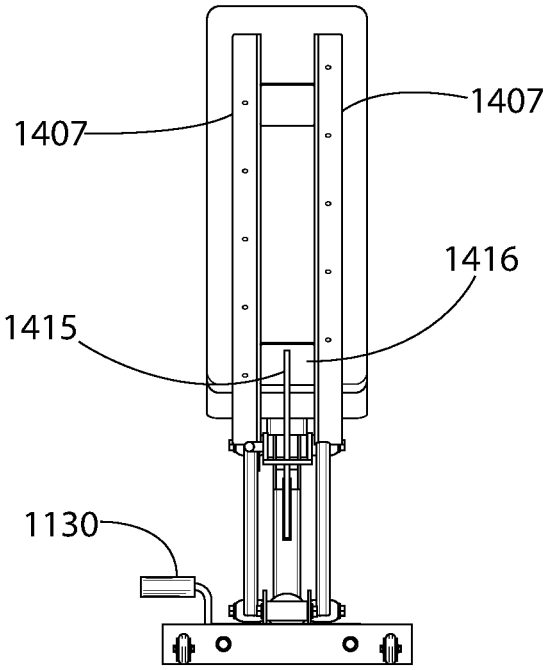
FIG. 103 is a rear perspective view thereof.
Figure 106A:
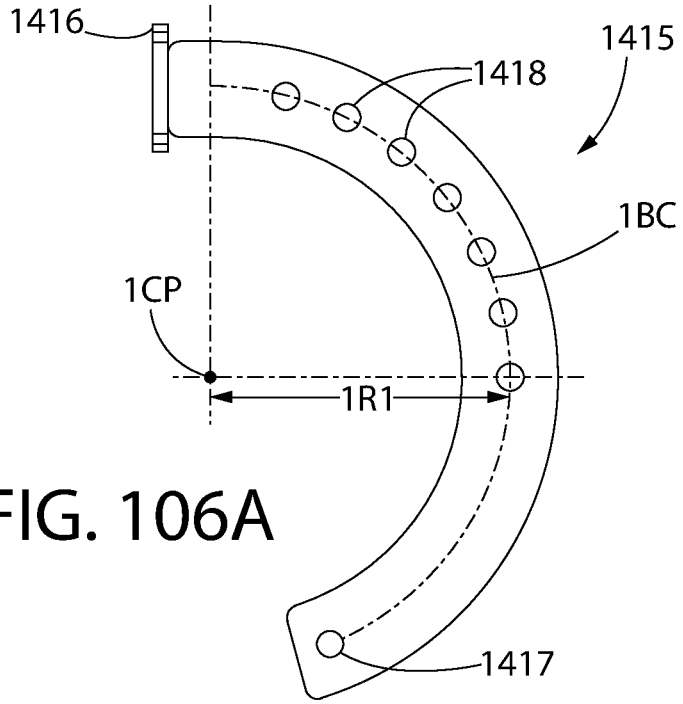
FIG. 106A is a side view of the back pad support bracket of the bench of FIGS. 100 and 101.

To control and guide the motion of back pad 1402, the back pad support bracket 1415 is attached at its top end to the rear of the back pad (see FIGS. 101, 103, and 106A). An enlarged flat mounting plate 1416 may be attached to the top end to facilitate coupling bracket 1415 to the back pad via fasteners inserted through fastener holes in the pad. Other types of coupling may of course be provided. Support bracket 1415 has an arcuately shaped body forming an arc. Bracket 1415 may be formed a flat metal plate in one embodiment.

Figure 104:
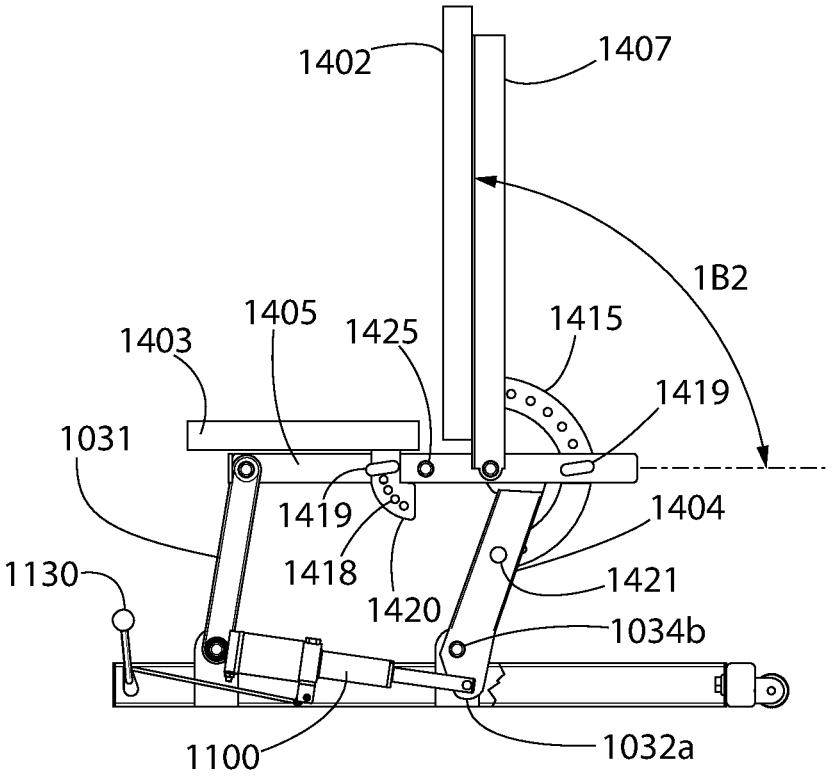
FIG. 104 is a side perspective view showing the bench in a first position.
Figure 105:
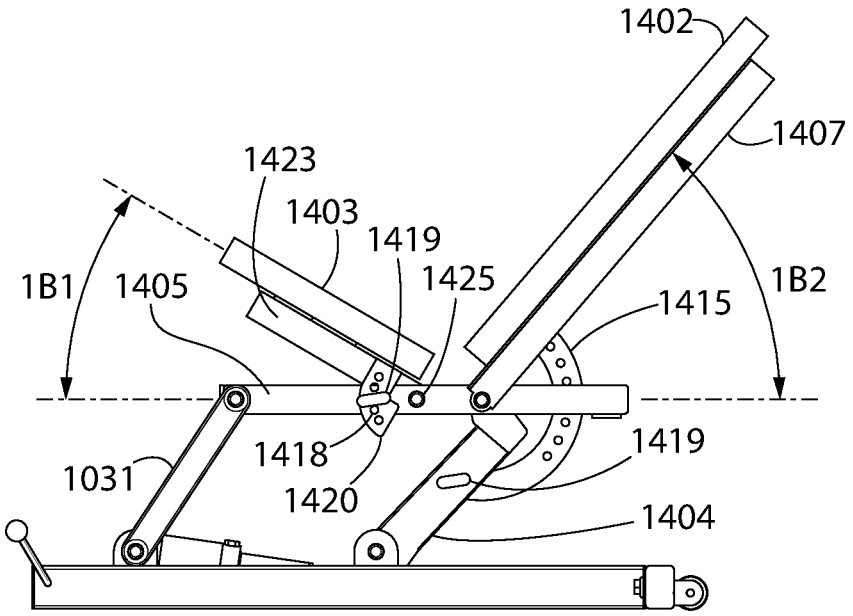
FIG. 105 is a side perspective view thereof showing the bench in a second position.

The bottom end of support bracket 1415 defines a first pin locking hole 1417 for receiving lock pin 1419 (see, e.g. FIG. 104). Lock pin 1419 may alternatively be inserted through one of a series of second pin locking holes 1418 disposed in the upper portion of mounting bracket 1415 (see, e.g. FIG. 105) to change the operating mode of the bench 1400. Holes 1418 may start near the midpoint of the bracket and are arranged in an arc terminating proximate to the top end of the bracket as shown. Pin locking holes 1418 are spaced radially apart along the bracket, and preferably may be equidistantly spaced from each other and between the curved sides of the bracket (best shown in FIG. 106). Locking holes 1418 and locking hole 1417 are arranged along a bolt circle 1BC having a critical radius 1R1. The center point 1Cp of the bolt circle 1BC that defines a critical radius 1R1 coincides with the location and axis of the upper rear cross bolt 1034*d* used to couple the rear strut 1404 (and back pad support members 1407) to the horizontal support rail 1405. This ensures that during the entire angular range of motion of the back pad 1402, one of the pin locking holes 1418 will always concentrically align with pin holes 1422 formed in the spaced apart lateral sides of bench support rail 1405 to lock the bracket 1415 to the rail via lock pin 1419. Furthermore, this also ensures that the single pin locking hole 1417, also arranged on the same bolt circle 1BC at radius 1R1, can be concentrically aligned with pin holes 1421 formed in the lateral sides of rear strut 404 to alternatively lock the bracket 1415 to the rear strut via lock pin 1419. When the back pad bracket 1415 is mounted to the bench, it bears noting that in order to accomplish the foregoing concentric hole alignment relationships, the pin holes 1421 and 1422 in the rear strut 1404 and support rail 1405 respectively must also fall along the same bolt circle 1BC at critical radius 1R1 from the top rear cross bolt 1034*d*.

In some embodiments, the single pin locking hole 1417 at the bottom end of mounting bracket 1415 may be spaced farther apart from the lower-most locking hole 1418 by an arcuate distance greater than the arcuate distance between holes 1418. In other embodiments, the series of locking holes 1418 may continuous from the top end of bracket 1415 to the bottom end thereby including locking hole 1417 along bolt circle 1BC which in this case would correspond to lower-most hole in the series. In one non-limiting embodiment, a single sole pin locking hole 1417 and series of seven pin locking holes 1418 may be provided as an example; however, more or a lesser number of holes may be furnished. The pin locking holes 1418 permit user selection of the angle of back pad 1402, as further described herein.

Figure 106B:
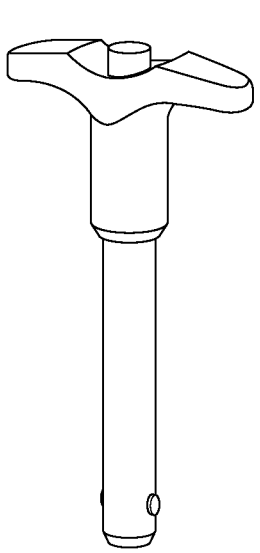
FIG. 106B is a perspective view of the lock pin of the bench of FIGS. 100 and 101.

The lock pin 1419 may be a T-shaped pin in one embodiment with an elongated shaft and an operating handle arranged transversely to the shaft (see, e.g. FIG. 106B). Lock pin 1419 may also be a self-locking ball lock type pin as depicted including a central plunger mechanism protruding through the operating handle which operably retracts or projects locking balls disposed in the shaft. Such pins are well known in the art. Other configurations of lock pins 1419 may be provided including without limitation L-shaped pins like pin 1039*a* (see, e.g. FIG. 57) or others. Accordingly, the invention is not limited by the type of lock pin used.

Figure 110A:
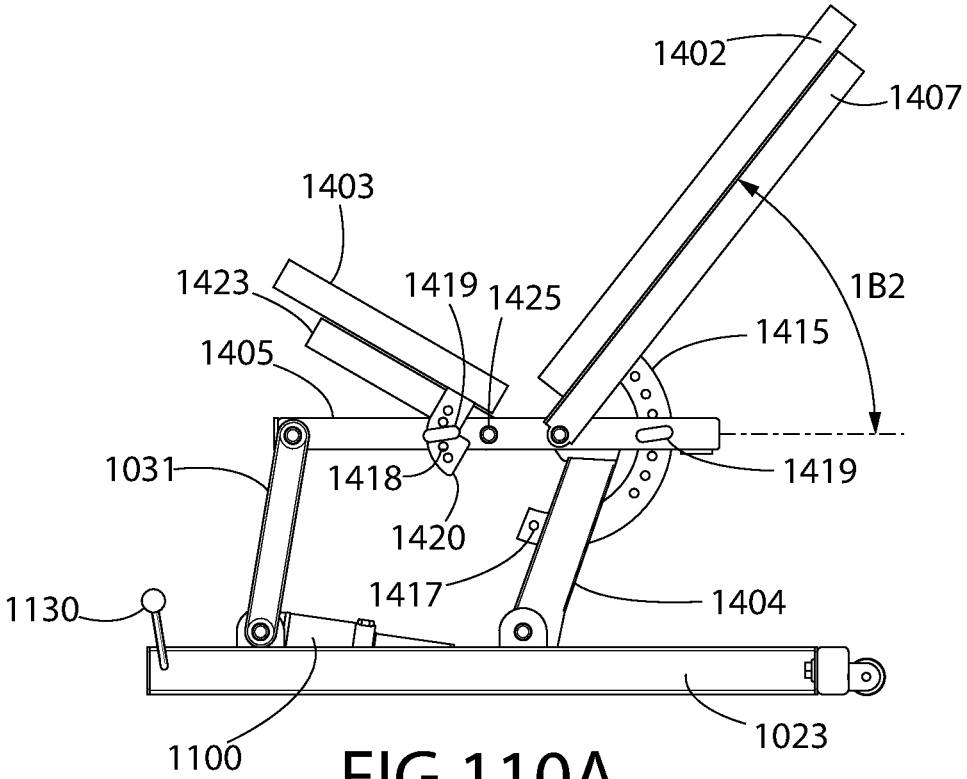
FIG. 110A is a side view of the bench of FIGS. 100 and 101 shown in a third position.
Figure 110B:
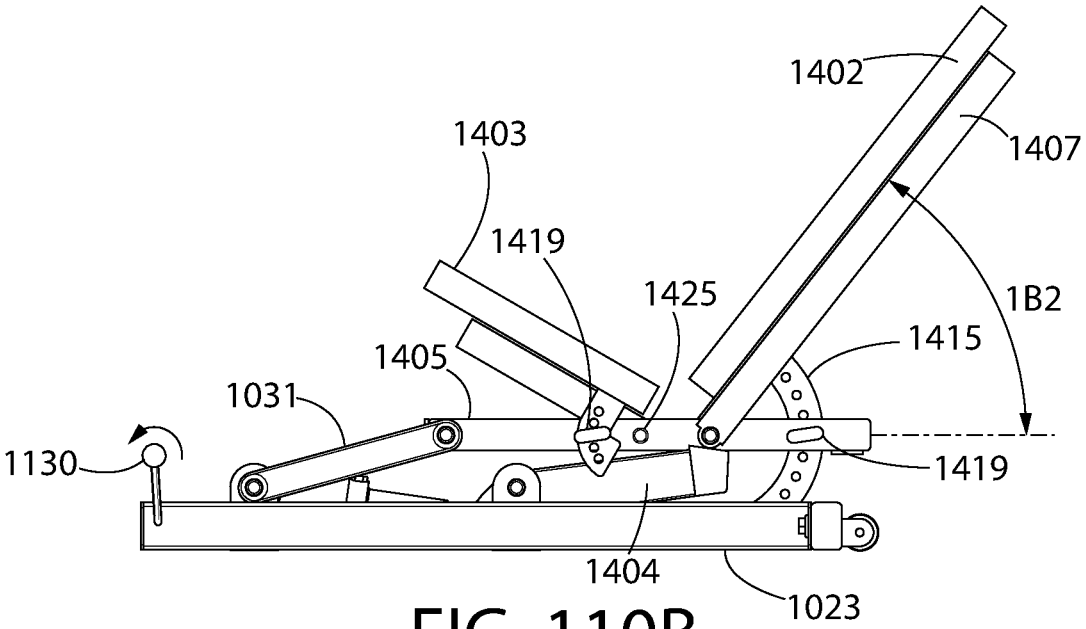
FIG. 110B is a side view of the bench of FIGS. 100 and 101 shown in a fourth position.

Referring to FIGS. 100, 102, and 104-105, the angular orientation of the seat pad 1403 is also adjustable by the user via an arcuately curved support bracket 1420. Bracket 1420 is attached at its top end to the underside of seat pad 1403 such as by a flat mounting plate 1424 through which threaded fasteners may be installed. The seat pad support bracket 1420 runs on the outside of horizontal support rail 1405. The seat pad 1403 is attached to an elongated tubular seat support member 1423 pivotably attached to support rail 1405 by a cross bolt 1425. Support member moves inside of and into or out of support rail 1405 depending on the angle of the seat pad. Bracket 1420 may be shaped generally similar to back pad mounting bracket 1415, but a much shorter version of the same. Seat pad mounting bracket 1420 also includes a series of radially spaced apart locking holes 1418 arranged in an arcuate pattern which receive a second lock pin 419. The user selects an angle 1B1 of the seat pad 1403 in relation to support rail 1405, and then inserts s shorter version of lock pin 1419 through one of the series of locking holes 1418 in bracket 1420 and a concentrically aligned hole in the lateral side of support rail 1405 (obscured by lock pin 1419 in the figures), thereby locking the seat pad in position. As shown in FIGS. 110A and 110B, the seat pad 1403 remains at the angle 1B1 selected between the upper exercise position and lower escape position of the bench pad 1401 including positions therebetween.

Figure 109A:
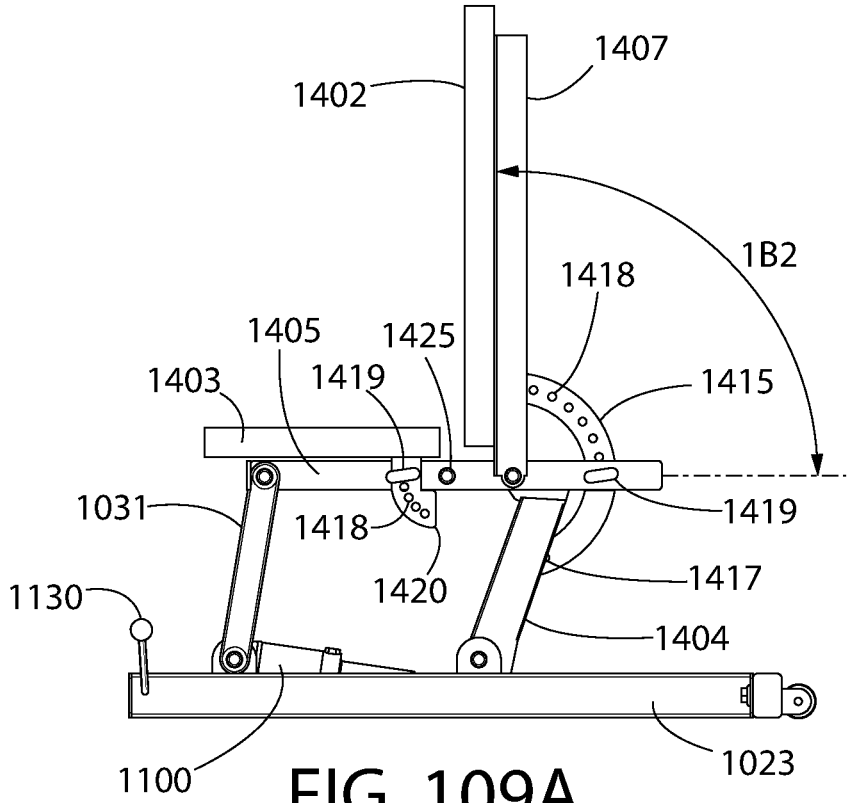
FIG. 109A is a side view of the bench of FIGS. 100 and 101 shown in a first position.
Figure 109B:
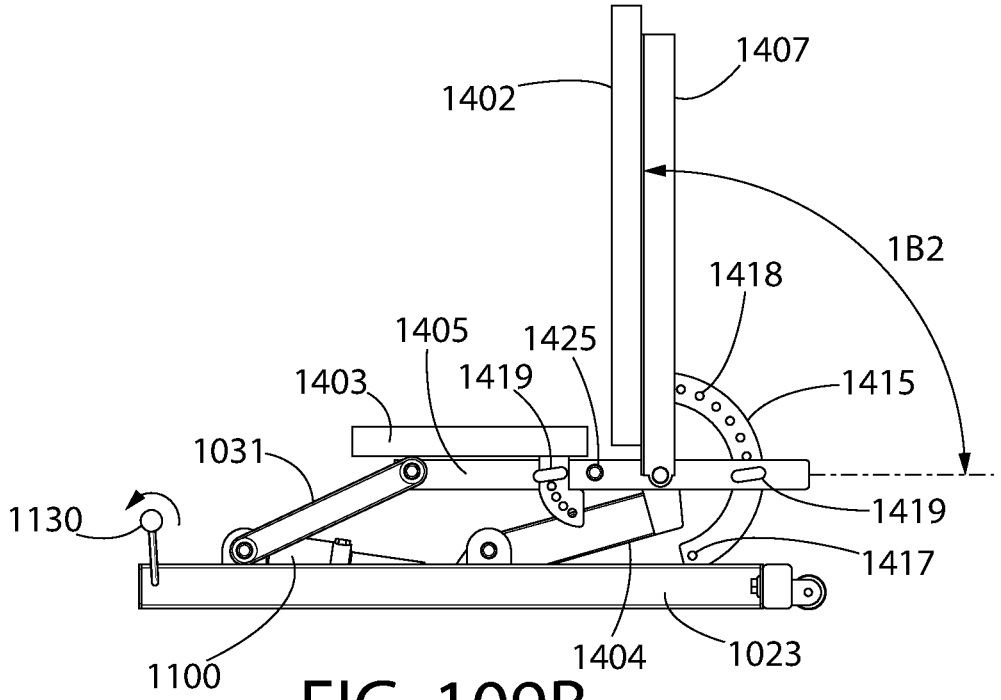
FIG. 109B is a side view of the bench of FIGS. 100 and 101 shown in a second position.
Figure 111A:
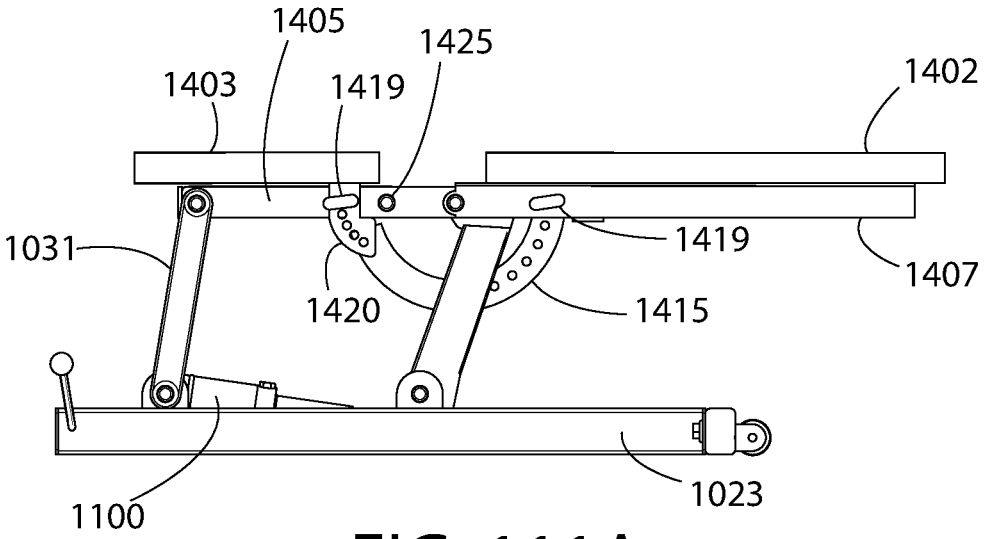
FIG. 111A is a side view of the bench of FIGS. 100 and 101 shown in a fifth position.
Figure 111B:
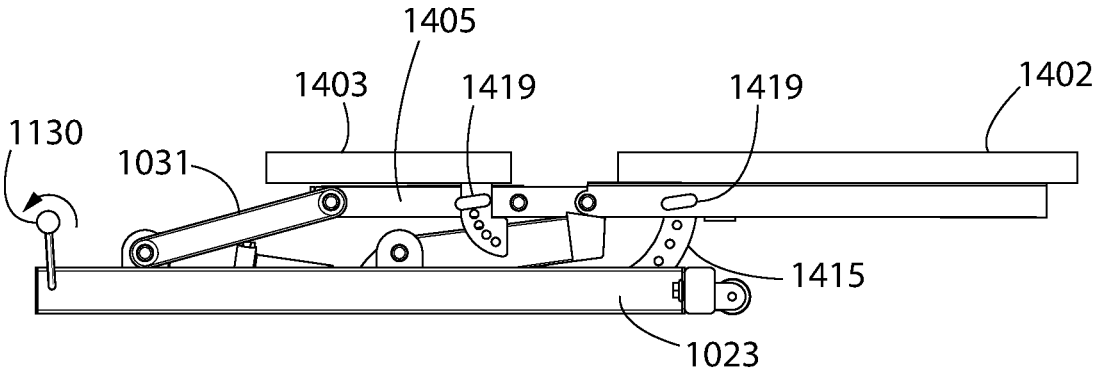
Figure 112A:
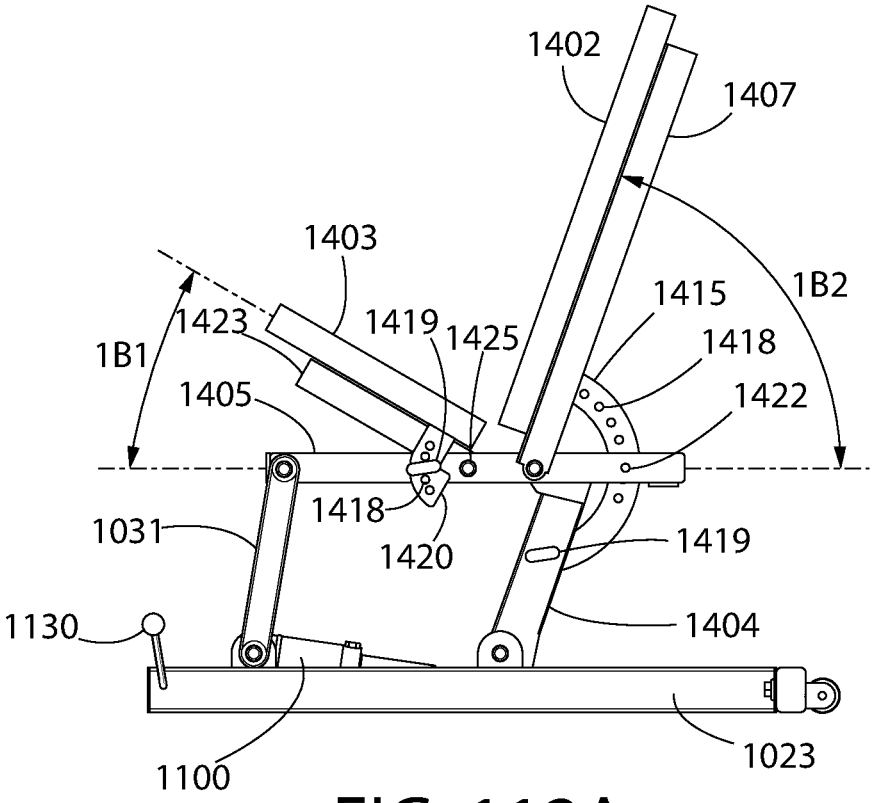
Figure 112B:
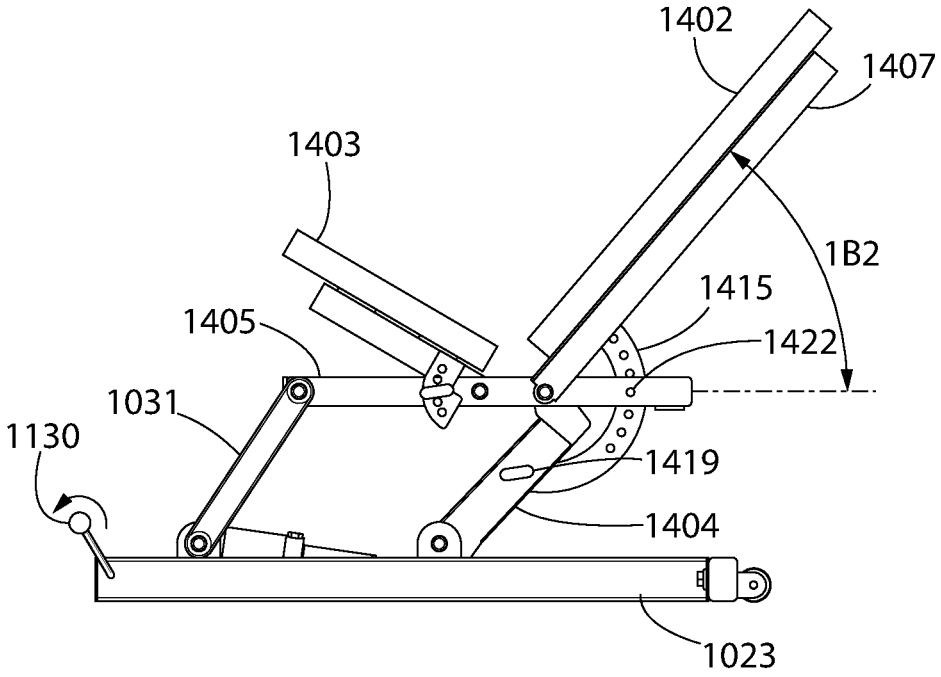
Figure 112C:
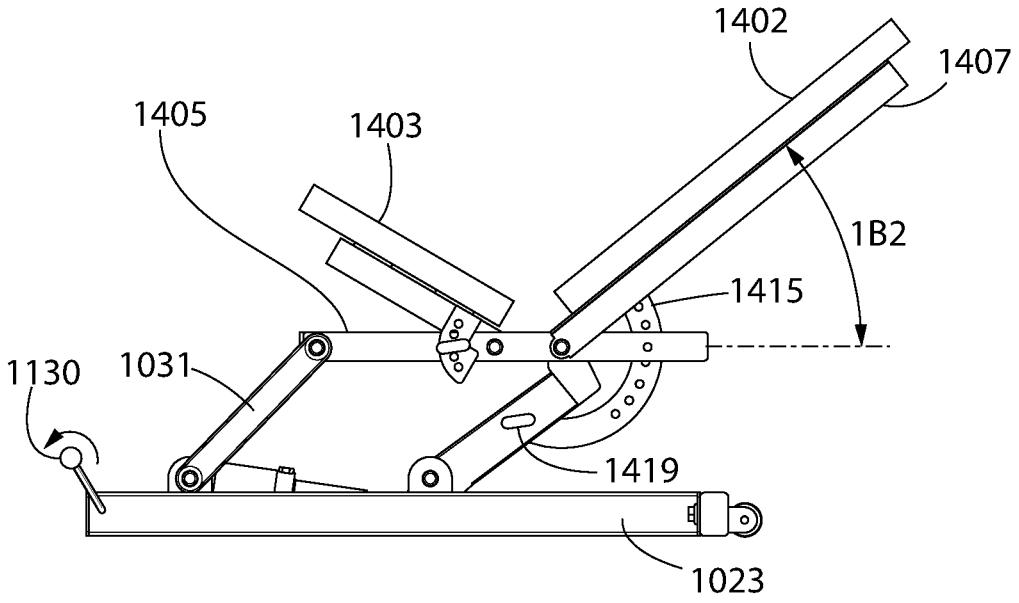
Figure 112D:
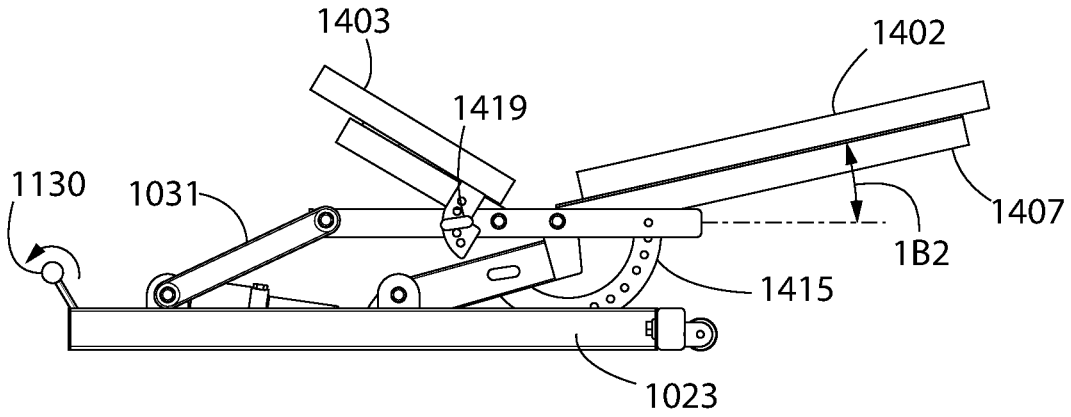
Figures 113, 114:
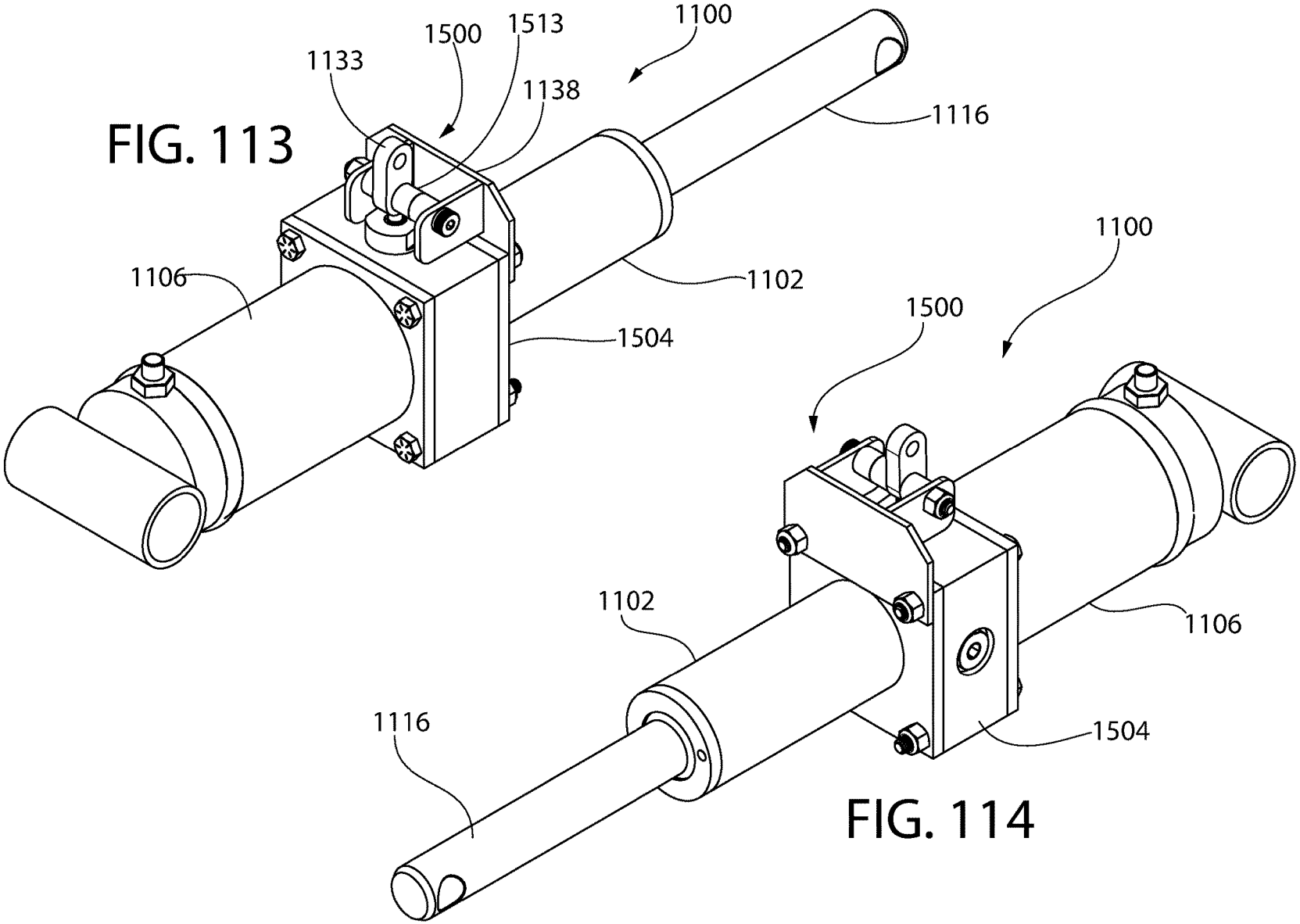
Figure 115:
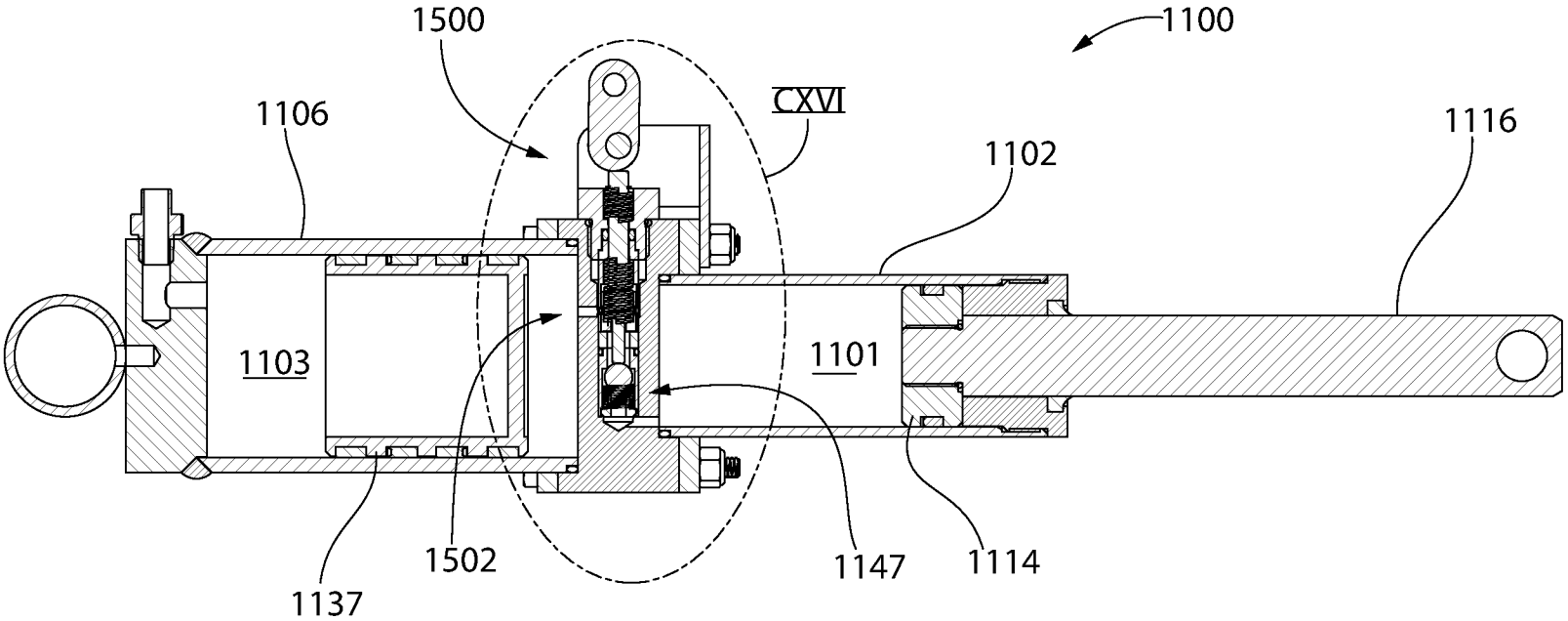

The adjustable weight lifting bench 1400 has two modes of operation as noted above. In the first operating mode, the back pad 1402 is automatically maintained in the same angular orientation when the bench moves from the upper exercise position to the lower escape position of the bench via activation of foot lever 1130. This accomplished by inserting the lock pin 1419 for the back pad 1402 in a first location through the support rail 405 which always remains parallel to the floor or ground regardless of the operating mode selected. This first pin location is shown for example in FIGS. 100, 104, and 109A-111B. The user first manually selects the desired angle 1B2 of the back pad 1402 in relation to the support rail 1405 corresponding to the desired weight lifting routine prior to exercise. Lock pin 1419 is inserted through each of one of the series of locking holes 1418 in the back pad support bracket 1415 which has been concentrically aligned with the pair of laterally spaced apart pin holes 1422 in the opposing lateral sides of the horizontal support rail 1405 to lock the bracket 1415 in position on the support rail 1405. The angle of the back pad 1402 has a full range of motion from 90 degrees vertical to 0 degrees horizontal for a variety of exercises. When the back pad angle 1B2 is increased beyond 90 degrees, the slots 1411 in the rear strut 1404 allows the back pad support bracket 1415 to pass through the strut without interference. FIGS. 109A-B shows a military press position in which angle 1B2 is 90 degrees. FIGS. 111A-B shows a flat press position in which the back pad angle 1B2 is 0 degrees. And FIGS. 110A-110B shows one of several intermediate angular positions afforded by the series of locking holes 1418 in which the back pad angle 1B2 is between 90 and 0 degrees (e.g. 50 degrees, etc.). Regardless of the bench pad configuration selected by the user, it bears noting that the back pad angle 1B2 remains constant during the entire descent motion of the bench pad 1401 in the first operating mode. The seat pad angle 1B1 selected by the user also remains constant during descent.

In the second operating mode, the back pad 1402 has dynamically adjustable incline positions and automatically changes angular orientation when the bench moves the upper exercise and lower escape positions similar to the incline bench 1200. This accomplished by inserting the lock pin 1419 for the back pad 1402 in a second location through the rear strut 404 instead of the support rail 1405. This second pin location is shown for example in FIGS. 105 and 112A-D. Lock pin 1419 is inserted through the pair of laterally spaced apart pin holes 1421 in the opposing lateral sides of the rear strut 1404 and the single pin locking hole 1417 to lock the pin 1419 to the rear strut (see also FIG. 107). The position of the back pad support bracket 1415 to the rear strut remains constant during descent of the bench. This allows the user to automatically adjust the angle of the back pad 1402 during the exercise via operation of foot lever 1130 of the hydraulic cylinder system disclosed herein. The bench has a range of inclined positions from near 90 degrees vertical to near 0 degrees horizontal. When the foot lever 1130 is pressed forward and downward, the angle 1B2 of the back pad 1402 changes and the bench lowers to the floor/ground. FIGS. 112A to 112D shows various positions from a high incline press to a lower incline press position respectively. Although the back pad angle 1B2 changes during descent of the bench, the seat pad angle 1B1 selected by the user remains constant starting in FIG. 112A and ending in FIG. 112D.

It bears further noting that any of the bench pads and bench pad sub-frame disclosed herein which may include the bench descent control and auto-return mechanisms may be provided independently of any weight lifting frame with weight rests. Accordingly, the invention is expressly not necessarily limited to the presence of the weight lifting frame in order to possess full functionality and the various features associated with the bench pad assembly described herein.

Third Inventive Concept—Rotary Exercise System

A rotary exercise system in one embodiment includes a chassis configured for mounting to stationary support members, a rotational support shaft rotatably coupled to chassis, and handle bar assembly coupled to the support shaft and manually rotatable therewith by a user. A variable resistance mechanism applies a user-adjustable rotational resistance force on the support shaft, which changes the force required to be applied by the user to rotate the handle bar assembly during an exercise routine. In some embodiments, the resistance mechanism may be a frictional resistance mechanism, such as a drum or disc brake assembly. A user-operated control actuator allows the user to readily change resistance settings to increase or decrease the rotational resistance imparted to the support shaft by the resistance mechanism. In some implementations, the chassis may be detachably mounted on vertical supports of a power rack and adjustable in height for performing different exercise routines.

Referring initially to FIGS. 127-132, a rotary exercise system generally comprises a rotary apparatus in the form of handle bar assembly 2020 rotatably mounted to a chassis 2021 configured for detachable mounting to and between at least two vertical uprights or supports 2022 of a stationary support frame or structure. In one non-limiting embodiment, the support structure may be a free-standing power rack 2024 as shown comprising fours vertically elongated support members 2022 and a plurality of horizontal cross members 2023 spanning between the support members to form a rigid space frame. The bottom ends of the support members 2022 are configured for engaging a generally flat floor support surface 2025 of any suitable type and construction. Support members 2022 and cross members 2023 are metal structural elements (e.g. steel, aluminum, and/or titanium) which may be solid or have an open tubular construction for weight reduction. Cross members 2023 may be permanently attached to the vertical support members 2022 or removable attached thereto such as via fasteners as shown.

In one non-limiting embodiment, the chassis 2021 may comprise a first (e.g. right) and second (e.g. left) mounting rack assembly 2026. The mounting rack assemblies 2026 may be specifically configured for detachable securement to the vertical supports 2022 of the power rack 2024 or alternatively the vertical supports of another type support structure. In one embodiment, each mounting assembly 26 comprises a mounting bracket 2027 complementary configured and dimensioned to the transverse cross-sectional shape and size of the vertical supports 2022. Brackets 2027 may be three-sided collar in one embodiment comprising an open rear, opposing front wall, and two adjoining sidewalls extending perpendicularly rearward from the front wall. Brackets 2027 further define a cavity 2028 therein for receiving and securing the vertical support 2022. Each bracket 2027 may be attached to a vertical support 2022 by horizontally inserting the support into cavity 2028 of the bracket. When the vertical supports 2022 are inserted into the cavities 2028, the brackets 2027 are vertically slideable along the vertical supports of the rack 2024 to a user-selectable desired mounting position or height of the handle bar assembly 2020. Each bracket includes one or more mounting holes 2029 which are concentrically alignable with corresponding mounting holes 30 formed the vertical supports 2022 of the power rack 2024. Removable fasteners 2031 such as without limitation bolts or pins are provided for insertion through each pairs of aligned holes 2029, 2030 for securing and fixing the bracket in position on the power rack. Pins if used for fasteners 31 may be any type or configuration compatible for use with the holes of the power rack vertical supports 2022.

It bears noting that the three-sided mounting bracket 2027 allows the chassis 2021 to be mounted to the power rack 2024 without partially disassembling the rack. In other possible embodiments, however, the centrally open brackets 2027 may be have a completely enclosed tubular cross-sectional shape thereby forming an annular collar with four opposing perpendicular walls (see, e.g. FIG. 133) that completely encircles the power rack vertical support 2022 when inserted through the cavity 2028 of the bracket. This latter design is mounted by vertically sliding the bracket onto the top end of the rack vertical support 2022 and sliding the bracket downward to the desired mounting position. Of course, other configurations of mounting brackets 2027 may be used in other embodiments beyond the foregoing non-limiting examples so long as the chassis may be fixedly attached to the rack vertical supports 2022. In yet other possible implementations, the mounting brackets 2027 may be non-removably and permanently attached to other types of dedicated support structures with vertical supports such as via welding.

It will be appreciated that the rotary exercise system is not limited in its applicability to free standing power racks alone, which represented only one of many possible mounting options. In other possible embodiments, the chassis 2021 of the exercise system may be attached to a wall mounted power rack 2240 as shown in FIG. 136. This rack comprises two vertical support members 2022 configured to rest on a support surface. These support members 2022 are each anchored near both the top and bottom ends to a wall structure by horizontal supports 2023. The horizontal supports 2023 are configured for mounting to the wall structure, and may include end flanges 20230 with holes to receive fasteners as depicted or other appurtenances to facilitate anchoring to the wall structure. In yet other possible embodiments, entirely wall mounted vertical members 2022 may be provided as shown in FIG. 137 which do not extend to the floor. Such a construction comprises a box frame with shortened height comprising four vertical support members 2022 and horizontal supports 2023 extending therebetween as shown. The rear vertical members 2022 are attached to a wall structure and the front two verticals are used for mounting the rotary exercise system. This mounting rack is dedicated solely to the rotary exercise machine and may be a self supporting unit including the mounting rack and rotary handle bar unit and all appurtenances described further herein. Accordingly, it will be clear to those in the art that numerous mounting variations of the rotary exercise system are possible and does not limit the invention.

The present rotary exercise system is further not limited to mounting on vertical supports of "power racks" or portions thereof. Instead, the system only requires two rigid and stationary members of any orientation for mounting and is thus not limited in its applicability by the construction of the structure that supports stationary members. For example, although the figures depict horizontal mounting of the exercise system on a pair of vertical supports (i.e. handle bars extending horizontally), it will be appreciated that the exercise system may be used in a vertical orientation with the handle bars extending vertically instead. In this case, the main support members 2022 may instead be oriented horizontally for securing the chassis 2021 thereto. Such an orientation would allow other types of exercise motions to be performed by the user (e.g. pulling on the handle bars with one arm and pushing the handle bars with the other arm).

The structure of the handle bar assembly 2020 will now be described. Referring to FIGS. 127-133, the rotary handle bar assembly 2020 includes a central or main rotational support shaft 2041 and plurality of handle bars 2040 coupled to the support shaft and rotatable therewith. Support shaft 2041 defines an axis or rotation 2RA of the handle bar assembly. In one embodiment, support shaft 2041 and handle bars 2040 may each have an elongated cylindrical shape which may have a textured or knurled surface to facilitate gripping by the user. In other embodiments, handle bars 2040 may have different shapes or be other entirely different type elements such as without limitation ball grips, rock climbing handles or grips, towels, pegs, ropes, etc.

Handle bars 40 may be coupled to support shaft 2041 by a support frame comprising a pair of side support structures 2042 laterally spaced apart on the shaft. In one embodiment, each side support structure 2042 may include an X-shaped lateral support member 2043 rigidly attached to the support shaft 2041 such as via welding to be rotatable in unison therewith. Other forms of rigid attachment such as bolting, etc. may be used. Each lateral support member 2043 may comprise four radial arms 2046 in one embodiment which intersect perpendicularly at the support shaft 2041 and extend radially outward therefrom as illustrated. The lateral support members 2043 may be located inboard on the rotational support shaft 2041 such that an outboard end portion 2048 of the main support shaft 2041 extends laterally outwards for a distance beyond each support member 2043 for rotational mounting to each side mounting rack assembly 2026, as further described herein.

The lateral support members 2043 may be constructed by casting or forging as a monolithic unitary structure with each radial arm 2046 being an integral part thereof. In other embodiments, lateral support members 2043 may be constructed from two or more structural elements welded together. In the non-limiting illustrated embodiment, the arms 46 may have a rectilinear cross-sectional shape such as rectangular or square (i.e. rectangle with even sides). Other shapes however may be used. The arms 2046 may comprise hollow solid structure or tubular structures for weight reduction. Lateral angle braces 2047 may be attached between each adjacent arm 46 as shown to add structural rigidity to the lateral support member 2043. Braces 2047 are obliquely angled to the radial arms 2046.

Although each lateral support member 2043 is depicted as an open frame polygonal structure in the illustrated embodiment to reduce weight, it will be appreciated that other configurations of these support members may be used. For example, in other embodiments lateral support members 2043 may each be configured and formed as round disks fixedly attached to the main support shaft 2041. Each disk may have a solid structure or a partially open structure with cutouts formed in the disk material to reduce weight. The handle bars 2040 are attached at their ends to the disks. In some embodiments, the lateral support members 2043 may each be configured as a spoked wheel having a central hub fixedly attached to the main support shaft 2041, an outer circular and annular wheel to which the handle bars 2040 are attached, and a plurality of spokes extending radially between the hub and wheel in a well-known manner. Accordingly, the lateral support members 2043 are not limited to any particular configuration so long as the handle bars 2040 may be rigidly supported from the main support shaft 2041.

The side support structures 2042, main rotational support shaft 2041, handle bars 40, and mounting rack assemblies 2026 are preferably formed of a suitably strong metal for their given application, such as steel, aluminum, titanium, or other. A combination of metals may be used for different parts and need not all be the same. The components may have a solid structure or comprise hollow tubular elements for weight reduction.

With continuing reference now to FIGS. 127-133, opposing ends 2045 of each handle bar 2040 are attached to one of the radial arms 2046 of each X-shaped lateral support member 2043. In one embodiment, the handle bars 2040 may be attached proximate to the terminal free end of each arm 46 as shown. Handle bars 2040 may be oriented parallel to the main support shaft 2041. When constructed, the handle bars may be arranged to encircle the support shaft 2041 as shown and are positioned to be readily graspable by a user. In operation, a user manually pulling or pushing on one of the handle bars 2040 rotates the main rotational support shaft 2041 vis-à-vis the side support structures 2042. In one embodiment, the handle bars 2030 may be rigidly attached to the lateral support members 2046. In other embodiments, the handle bars 2030 may be rotatably attached to the lateral support members 2043 and may be freely rotatable in relation thereto.

In the illustrated embodiments, four handle bars 2040 are provided based on the shape of the X-shaped lateral support members 2043 each having four arms for mounting the handle bars. In other possible embodiments, other configurations of side support structures 2042 may be provided having more or less number of arms; thereby changing the number of handle bars which may be used. For example, in some alternative embodiments the side support structures may each have six equal spaced arms instead of four thereby allowing six handle bars to be provided. Accordingly, the invention is not limited to any particular number of handle bars although preferably at least four are provided so that the user does not have to reach overly far to grab the next successive handle bar 40 as the handle bar assembly 2020 rotates during the exercise routine.

Referring now to FIGS. 127-133, each mounting bracket 2027 further includes a support bushing 2032. Bushing 2032 have a hollow tubular shape and receive the outboard free end portions of the main rotational support shaft 2041 therein as shown. The bushings 2032 are preferably formed of as suitably strong metal and are rigidly attached to the mounting brackets 2027 by any suitable means, such as welding. The interior circumferential surfaces of the bushings 2032 provide annular bearing surfaces which support both ends of the support shaft 2041, and thus transmit the weight of handle bar assembly 2020 and user (when hanging therefrom) to mounting rack assemblies 2026 and in turn to the power rack vertical support members 2022. The support shaft 2041 of the handle bar assembly 2020 is rotatable inside the bushings 2032, thereby rotatably mounting the support shaft 2041 to the chassis 2021. In one embodiment, the opposing terminal end portions 2048 of the support shaft 2041 protrude outwards beyond the bushings 2032. This allows a removable travel stop 2049 or other retention device to be secured to each end portion 2048 of the shaft for trapping the handle bar assembly 2020 between the side mounting rack assemblies 2026, thereby collectively forming a single unit that can be easily transported and mounted on the power rack vertical support members 2022 by the user. In various embodiments, for example without limitation, the travel stops 49 may comprise an assembly of a bushing or washer 2068 and fastener 2067 threaded into an axial threaded bore 2066 formed in the ends of the shaft 2041 as shown in FIG. 133, an assembly of a washer and cotter pin extending through a through-bore formed transversely through the end portion of the shaft 2041 (not shown), or any other suitable part or assembly of parts operable to prevent the support shaft from pulling through the two spatially separated bushings 2032. It is well within the ambit of those skilled in the art to provide a suitable travel stop and shaft retention device.

The rotary exercise system further comprises at least one a user-adjustable rotational resistance assembly or mechanism 2050 operably coupled to the main rotational support shaft 2041. Resistance mechanism 2050 is operable to apply a variable resistance on the support shaft 2041 having a level of resistance which may be preselected by the user. The greater the resistance applied to the support shaft 2041 by resistance mechanism 2050, the harder it would be for the user to turn the handle bars 2040, and vice-versa. Accordingly, the handle bar assembly 2020 is not free spinning, thereby improving the exercise benefit in addition to allowing rotation of the handle bars 2040 about the support shaft 2041 in a controlled manner. Any suitable type of resistance device or mechanism may be used, including without limitation a frictional resistance mechanism, a magnetic resistance mechanism, a hydraulic fluid resistance mechanism, or a hydraulic or pneumatic cylinder resistance system.

In one embodiment, the frictional based resistance system may comprise a brake system such as a disc or drum brake mechanism. These type mechanisms are used in various types of bikes such as exercise and mountain bicycles, and other applications, and are well known in the art without undue elaboration.

One example of a frictional resistance mechanism 2050 is shown in FIGS. 133-135. In this non-limiting embodiment, the resistance mechanism 2050 may be a commercially-available disc brake unit 2072 generally comprising an assembly of a rotor 2053 fixedly but preferably not permanently attached to the main rotational support shaft 2041 to rotate therewith and brake pad assembly. Rotor 2053 is centered between a pair of disc brake pads 2052*a*, 2052*b* each supported by an adjustable caliper 2051 in a well known manner. The spaced apart brake pads 2052*a*, 2052*b* are laterally and axially movable (parallel to the rotational axis 2RA of support shaft 2041) toward or away from the rotor 2053 to compress the rotor therebetween with varying degrees. This creates frictional resistance that impedes rotation of the main rotational support shaft 2041 by the user when turning the handle bar assembly 2020.

The rotor 2053 may be fixedly attached to the support shaft 2041 by numerous methods; one non-limiting example of which is shown and described herein. The rotor mount may include a bolted flange 2070 permanently mounted on rotational support shaft 2041 such as via welding. A plurality of fasteners 2071 such as bolts or screws pass through holes in the flange 2070 and corresponding holes in the central hub portion of the rotor disc for securing the rotor 2053 to the flange in fixed manner. This arrangement allows the rotor to be readily replaced if necessary. Rotor 2053 may be a relatively thin solid circular metal disc (disk), or alternatively may be a ventilated disc including cutouts such as variously shaped holes and slots (see, e.g. FIG. 133) to dissipate the heat of friction generated by the braking force and reduce weight. Ventilated rotors are commonly used for example in bicycle disc brake systems and other applications, and are well known in the art. Rotor 2053 may be protected by removable covers 2069 mounted to the mounting rack assemblies 2026 (see, e.g. FIGS. 127 and 133).

A fixed or floating type caliper 2051 may be used. In a fixed type caliper, the caliper remains stationary in axial position relative to the rotor 2053. The brake pads are mounted to a pair of pistons on the caliper and each move axially inwards to clamp the rotor from each side.

Conversely, in the floating type caliper 2051 shown and described herein, inner and outer portions of the segmented caliper body move relative to each other and the rotor. This type of caliper is typically less complex and expensive than a fixed type caliper. In the floating brake caliper 2051 disclosed herein, the outer brake pad 2052*b* is mounted on the outboard brake piston portion 2054 of the segmented caliper body and inner brake pad 2052*a* is mounted on the opposite inboard sliding caliper portion 2055 of the body, respectively. Portions 2054 and 2055 are axially movable together and apart with respect to each other and the rotor 2053.

In operation, the piston portion 2054 of the caliper body pushes the outer brake pad 2052*b* inwards when activated by a cam lever 2054 operably coupled thereto until the pad engages the outward facing lateral braking surface of the rotor 2053. The piston portion 2054 thus cannot move any farther toward the rotor, which in turn causes the caliper to then pull the opposing sliding caliper portion 2055 of the caliper body outwards towards the piston portion until inner brake pad 2053 also engages the inward facing lateral braking surface of the rotor. This squeezes the rotor 2053 between the brake pads, thereby creating frictional and rotational resistance to turning the handle bar assembly

2020. The frictional braking force or pressure is applied to both sides of the rotor 2053 in a direction parallel to the axis or rotation 2RA of the support shaft 2041 and rotor 2053. The distance between the brake pads 2052*a*, 2052*b* is therefore primarily controlled by the position of piston portion 2054 of the caliper body, which in turn activates the opposing sliding caliper portion 2055. Suitable floating caliper mechanical disc brake units that may be used in the present invention include MB1 Series units commercially available from Airheart Brake (Tolomatic Inc. of Hamel, Minn.) or other suppliers.

With continuing reference to FIGS. 133-135, the disc brake unit 2072 may be mounted to and supported by one of the mounting rack assemblies 2026. In one embodiment, the brake mount may include a first bracket 2073 specially configured to engage or mounted the brake unit such as caliper body 2063. Bracket 2073 is in turn mounted to a second bracket 2060 attached to the respective mounting rack assembly 2026. The brake unit 2072 may supported in a cantilevered manner as shown for positioning of the caliper 2051 in proper relationship to the rotating rotor 2053 and support shaft 2041. Any materials and configurations of brackets may be used. It bears noting that although the brake unit 2072 is shown mounted above the rotor 2053 in the illustrated embodiment, any mounting position may be used including on the sides or beneath the rotor so long as the brake pads are engageable with the opposing side surfaces of the rotor.

According to one aspect of the invention, the frictional resistance mechanism 2050 is user adjustable to allow the user to preselect and set a desired rotational resistance for the rotary exercise system. The disc brake caliper 2051 may be operated and adjusted by a resistance control system, which may be either a mechanical or hydraulic mechanism; both of which are well known in the art. A mechanical resistance adjustment mechanism is shown herein as one non-limiting example. In one embodiment, a mechanical resistance adjustment mechanism may comprise cam lever 2061 which is pivotably mounted on the caliper body 2063. Lever 2061 is connected to one top end of a control linkage such as metal wire control cable 2062. The other bottom end of the cable is connected to a manual control actuator 2065 which is coupled to and operable to push and pull the control cable 2062, thereby transmitting a force to and pivoting the cam lever 2061 in a known manner which adjusts the braking force or resistance. The control actuator 2065 may be mounted to mounting rack assembly 2026 by a mounting support 2064 of any suitable configuration, such as a metal bracket.

Any suitable type of commercially available control actuator 2065 may be coupled to the control cable 2062, such as a rotary knob, pivotable lever, or other style user interface. A rotary control knob form of an actuator 2065 is shown in the non-limiting illustrated example herein. Control cables and control actuators are commercially available from manufacturer's such as Glendinning Products, LLC of Conway, S.C. and others. Control actuator 2065 has a plurality of user selectable resistance settings which changes the rotational resistance applied to the support shaft 2041 of the handle bar assembly by the frictional resistance mechanism. Adjusting the control actuator to select one of the resistance settings increases or decreases a physical force required to be exerted manually by the user on the handle bars in order to rotate the handle bar assembly 2020. Indicia may be included on the control actuator (e.g. knob or lever) to mark various rotational resistance settings, thereby providing repeatability of desired resistance settings by the user.

To adjust the rotational resistance applied to rotor 2053 and in turn the handle bar assembly 2020 by the disc brake system described above, the user rotates the resistance control knob (actuator 2065) clockwise or counter-clockwise to the desired setting. The actuator 2065 pushes or pulls the control cable 2062 depending on the direction that the knob is rotated. The force transmitted by the cable 2062 activates and pivots the cam lever 2061 on the brake caliper 2051, which either pushes the piston portion 2054 towards further engagement with the rotor 2053 or withdraws the piston portion therefrom thereby concomitantly moving the sliding caliper portion 55 of the caliper towards or away from the rotor, as described above. For example, when the control knob actuator is turned clockwise, the knob mechanism may pull the control cable 2062 and cam lever 2061 downward. An angled surface on the cam lever 2061 pushes the brake piston portion 2054 inwards towards the rotor 2053 as the lever rotates. This correspondingly pulls the sliding caliper portion 2055 of caliper 2051 outwards towards the rotor, thereby pressing the both brake pads 2052*a*, 2052*b* against the rotor to increase friction, thus increasing rotational resistance in the system. Conversely, when the control knob actuator is turned counter-clockwise, the knob mechanism may push the control cable 2062 and cam lever 2061 upward instead. When the cam lever 2061 pivots in this opposite direction, the angle on the cam lever allows the brake piston portion 2054 to move outward and separate the brake pads 2052*a*, 2052*b* from the rotor 2053 to decrease friction, thus decreasing rotational resistance in the system. The control actuator 2065 therefore effectively changes the rotational resistance on the rotational support shaft 2041 in a manner preselected by the user before the exercise routine begins.

In some embodiments, at least a single variable resistance mechanism such as the disc or drum brakes or other type resistance device described herein may be provided to apply rotational resistance to the rotational support shaft 2041 of the handle bar assembly 2020. In other embodiments as shown herein, a variable resistance mechanism may be coupled to each end of the support shaft 2041 to impart a balanced resistance force to each side of the handle bar assembly 2020.

A method of operation and use of the rotatable handle bar assembly 2020 when the device is used as a pull-up bar will now be briefly explained. If the power rack 2024 or 2240 of FIG. 127 or 136 are used, respectively, the user may first select a desired mounting height/position of the handle bar assembly 2020 on the vertical support members 2022. Assuming the user wishes to perform pull-ups freely hanging from the handle bars 40 in this non-limiting example, the user positions the chassis 2021 (i.e. mounting rack assemblies 2026 along the vertical support members 2022 at a height preferably so that the user will be freely suspended from the handle bars 2040 when the lower-most handle bar is in a bottom vertical position as the handle bar assembly rotates. The user concentrically aligns the mounting holes 2029 in each mounting rack assembly 2026 with corresponding mounting holes 2030 in the vertical support members 2022, and then inserts a suitable fastener 2031 therethrough. A lockable type fastener may be used to prevent inadvertent pullout of the fastener from the mounting holes. The rotary exercise system is now readied for use.

As the user jumps, grasps, and hangs from one of the handle bars 2040 which is not directly underneath the rotational support shaft 2041 (e.g. between the 12 and 6 o'clock positions), the user's bodyweight creates a downward force from gravity transmitted to the side support structures 2042 to which the handle bars are attached. This in turn creates a torsional force acting on the rotational support shaft 2041 which rotates with the rotor 2053 mounted thereto about the axis of rotation 2RA. The torsion force acting around the axis of rotation 2RA causes the rotational support shaft 2041 to rotate, thus rotating the handle bar assembly 20 and all of the handle bar members fixed to it. As the rotor 2053 rotates, friction is created between the rotor and the brake pads 2052*a*, 2052*b*, and the rotational resistance continues along with the rotation until the user is no longer in a moment or torsion generating position (e.g. hanging directly underneath the axis of rotation). As the user climbs from one handle bar to the next higher one not directly beneath the support shaft 2041, the torsional force will again be created and the fitness apparatus will continue to rotate as the user successively climbs from one handle bar to the next.

In engineering terms, the foregoing torsional force or torque (T) created by the user on the support shaft 2041 (i.e. axis of rotation 2RA) is the product of the weight of the user (force 2F) and the distance (2r) between the support shaft and the user (i.e. linear distance between the handle bar 2040 and support shaft which is the moment arm). In this case, the moment arm (distance r) is represented by half the length of the radial arms 2046 of the side support structures 2042. Torque is expressed in units of foot-pounds or Newton-meters.

It bears noting that the angular speed that the handle bar assembly 2020 will rotate is determined by the difference between the weight of the user and the frictional resistance preselected and set by the user for the frictional resistance mechanism 2050. This allows the user to select the "climbing" speed from fast to slow. If the torsional force created by the user does not exceed the frictional resistance force selected by the user, the handle bar assembly 2020 will not rotate at all. Accordingly, the frictional resistance setting used will vary with the weight of the user. Notably, the user may use the lowest-most handle bar 2040 at the 6 o'clock bottom position for performing standing pull-ups. The torque neutral position will not cause the handle bar assembly 2020 to rotate because there is no moment arm created by the force or weight of the user when hanging from this bottom handle bar.

It will be appreciated that the user may alternatively mount the handle bar assembly 2040 at other positions on the vertical support members 2022 (e.g. shoulder height, waist height, or below) to perform various types of exercises with the arms and legs. When mounted proximate to the exercise floor support surface 2025, the user may lie on his/her back and rotate the device with the legs. Positions above this low mounting position may be used to perform various exercises with muscle groups other than the legs. Notably, the handle bar assembly 2020 can advantageously be rotated in opposite directions with the same resistance force applied by the variable resistance mechanism 2050. This expands the versatility of the rotary exercise system.

An example of a commercially available drum brake unit 2090 that may be used as the frictional resistance mechanism will now be described with reference to FIG. 138. Such units, well known in the art without undue elaboration, generally comprise a flanged hub (not shown on far side) which is fixedly mounted on the rotational support shaft 2041 of the handle bar assembly 2020 and rotates therewith. An annular brake drum 2092 is mounted to the flange hub such as via fasteners (e.g. bolting or screws) using mating holes in the hub and drum to rotate the brake drum with the support shaft 2041. The brake assembly 2093 is positioned inside the drum and includes arcuately shaped brake shoe and pads 2095 coupled to a piston assembly, which moves the brake pads radially outwards to engage the interior surfaces of the arcuately shaped sidewall of the brake drum 2092 thereby creating friction. This creates rotational resistance on the rotations support shaft 2041 of the handle bar assembly. A control or cam lever 2094 is internally coupled to the piston and brake pad assembly which moves the brake pads to increase or decrease frictional resistance between the drum and pad. The control actuator 2065 and control cable 2062 attached to the cam lever 2094 as already described herein may be used to allow the user to increase or decrease the rotational resistance. Such commercially available drum brake units suitable for this application FIGS. 139 and 140 are schematic diagrams showing one example of a non-contact magnetic resistance mechanism 2100 that may alternatively be used in lieu of the friction resistance system are common in spinning bikes and well known in the art. Instead of frictional resistance which generates heat and wear, magnetic rotational resistance is non-contact and generated from electro magnetic currents that vary in strength based on the proximity of magnets to the rotor. An adjustment mechanism allows the user to vary the distance between the magnets and the rotor to vary the drag placed on the rotor or rotational resistance. Referring to the foregoing referenced figures, the chassis 2021 is similar to the embodiments already described herein except for omission of the specific brackets used to mount the disc brake unit. Rotor 2053 is rotationally fixed to the support shaft 2041 in the same manner and centered between a pair of magnets 2104 which may be fixedly mounted on one end of a pivotally movable U-shaped clevis section of a lever arm 2101. The lever arm may be roughly L-shaped and mounted below the rotor 2053 in one embodiment. Other mounting positions may be used. One magnet 2104 is mounted on each branch of the clevis in opposing relationship. The lever arm 2101 may be pivotably mounted by a pivot 2103 to a mounting bracket attached to the mounting rack assembly 2026. In one embodiment, the mounting support 2064 used for the control actuator 2065 may be configured and also used for the mounting bracket of the pivot 2103; however, a separate bracket may also be used and mounted to the mounting rack assembly 2026. The pivot 2103 may comprises a pin or fastener (illustrated) which extends through the body of the lever arm 2101. In one, the pivot 2103 may be located approximately midway between the opposing ends of the lever arm 2101 as shown. Other locations for the pivot however may be used.

The adjustment mechanism for the magnetic actuator 2100 may comprise the same control cable 2062 and actuator 2065 previously described herein. The control wire 2062 may be attached to the other end of the lever arm 2101 opposite the clevis section with the magnets 2104. Raising and lowering the control cable 2062 via rotating the knob-shaped actuator 2065 causes the opposite clevis end of the lever arm 2101 with magnets to pivotably move about pivot 2103 either towards or away from the rotor, thereby concomitantly increasing or decreasing the rotational resistance force induced by the magnets on the rotor and handle bar assembly 2020 respectively. Such magnetic resistance mechanisms are commercially available.

Hydraulic fluid resistance systems that may alternatively be used generally comprise a contained hydraulic fluid in an confined space in conjunction with a rotating impeller therein that provides smooth, steady resistance during rotation of the rotational support shaft 2041.

A hydraulic or pneumatic cylinder containing a compressible fluid mounted in conjunction with the rotor may also alternatively be used to create rotational resistance. The cylinder may be rotatably mounted at one end to the mounting rack assembly 2026 and the cylinder rod projecting from the other end may be mounted to the rotor 2041 and is movable therewith. As the support shaft 2041 and rotor 2053 fixedly mounted thereto rotates around the rotational axis 2RA, the cylinder rod extends and retracts in a reciprocating motion in conjunction with rotation of the rotor to which it is mounted. Whether the cylinder is extending or retracting, the linear force imparted to the cylinder rod by the compressible fluid within the cylinder is translated into rotational resistance imparted to the rotor 2053.

Although handle bars 2040 depicted herein have a single fixed location on each radial arm 2046 of the lateral support members 2043, in other embodiments the mounting position of the handle bars on the handle bar assembly may be adjustable. As shown in FIG. 133 represented by the dashed circles depicting alternate handle bar mounting positions, each radial arm 2046 may have multiple user-selectable handle bar mounting hole 2220 locations 2220 in which the handle bars 2040 may be mounted. Using through holes 2220 in the radial arms 2046, the handle bars 2040 may be tapped on each end with an axial threaded bore and bolted to the radial arms at a desired location thereby allowing users to adjust the position of the handle bars. By adjusting the position of the handle bars 2040 inward or outward on the radial arms 2046, the radius of rotation and the torsional force change accordingly.

For example, when mounted in holes 2220 located closer to the axis of rotation 2RA, the distance between handle bars becomes closer and users have less of a reach to grasp the next bar. This makes climbing the rotating system less of an effort and accommodates weaker and/or smaller users. When mounted in holes located farther from the axis of rotation, the distance between hand grips becomes larger and users have a greater reach to grasp the next grip. This makes climbing the rotating system more of an effort and accommodates stronger and/or larger users.

It will be appreciated that the handle bar assembly 2020 may be mounted at varying heights along the vertical support members 2022 in the manner describe herein. This allows different types of exercise routines to be performed and can work numerous different muscle groups. For example, the handle bar assembly may be mounted near the floor and the user may rotate the handle bars with their legs while lying on the back. In another example, the handle bar assembly may be mounted to be reachable at standing height allowing the handle bars to be grasped and rotated while the user is standing on the floor. In yet another example, the handle bar assembly may be mounted above the user's head at a height which requires the user to jump to grab the handle bars. In this case, the user will be completely elevated off the floor while successively gripping one handle bar after another as the handle bar assembly rotates. Accordingly, the invention is limited by the height at which the handle bar assembly is used.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A hydraulic cylinder assembly comprising:

a hydraulic cylinder containing a hydraulic fluid;

an accumulator in fluid communication with the hydraulic cylinder, the accumulator containing a pressurized compressible fluid; and a flow control valve assembly interposed in a flow path between the hydraulic cylinder and the accumulator, the flow control valve configured and operable to control flow of the hydraulic fluid exchanged between the hydraulic cylinder and accumulator;

the flow control valve including an axially reciprocating piston defining a flow control orifice and an axially movable plunger having an operating end and an opposing working end, the working end being received in the flow control orifice and positionable between a first axial position and a second axial position relative to the flow control orifice;

an operating lever pivotably coupled to the flow control valve, the operating lever movable to control movement of the working end of plunger between the first and second axial positions;

wherein the working end of the plunger defines a first flow area when the plunger is in the first axial position and a second flow area smaller than the first flow area when the plunger is in the second axial position.

2. The assembly of claim 1, further comprising a toggle cam coupled to the operating lever and defining a cam surface which acts on a cam follower defined by the plunger, the toggle cam pivotably movable via the operating lever to move the working end of the plunger between the first and second axial positions.

3. The assembly of claim 2, wherein the toggle cam has an elongated body defining a first end pivotably coupled to the flow control valve and a second end pivotably coupled to the operating lever.

4. The assembly of claim 3, wherein the toggle cam translates linear movement of the operating lever to rotary motion of the toggle cam.

5. The assembly of claim 3, wherein a pivot point defined by the first end of the toggle cam is located eccentrically from a centerline of the toggle cam adjacent to the cam surface.

6. The assembly of claim 2, wherein the cam follower is defined by the operating end of the plunger and protrudes downwards from a body of the flow control valve.

7. The assembly of claim 2, wherein the cam follower is biased by a spring to maintain engagement with the cam surface.

8. The assembly of claim 1, further comprising a check valve disposed in flow conduit circuit through the flow control valve separate from the flow path between the hydraulic cylinder and the accumulator.

9. The assembly of claim 8, wherein the check valve is configured to permit one-way flow from the accumulator to the hydraulic cylinder.

10. The assembly of claim 1, wherein the accumulator comprises an axially slideable second piston.

11. The assembly of claim 10, wherein the second piston defines an air to oil interface between oil in the hydraulic cylinder and air in the accumulator.

12. The assembly of claim 11, wherein the second piston shifts axial position within the accumulator in response to movement of the piston in the hydraulic cylinder.

13. The assembly of claim 12, wherein oil is exchanged between the hydraulic cylinder and accumulator upon movement of the piston in the hydraulic cylinder.

14. The assembly of claim 11, wherein the air in the accumulator has a precharged pressure.

* * * * *